US010492544B2

(12) United States Patent
McKeen et al.

(10) Patent No.: US 10,492,544 B2
(45) Date of Patent: Dec. 3, 2019

(54) GARMENT FRAME, SUPPORT STRUCTURE, CASING, AND HOUSING

(71) Applicant: EVELYN & BOBBIE, LLC, Portland, OR (US)

(72) Inventors: Bree R. McKeen, Portland, OR (US); Stephanie Muhlenfeld, Portland, OR (US); Olivia Blough-Swingen, Portland, OR (US)

(73) Assignee: EVELYN & BOBBIE, INC., Portland, OR (US)

( * ) Notice: Subject to any disclaimer, the term of this patent is extended or adjusted under 35 U.S.C. 154(b) by 0 days.

(21) Appl. No.: 15/608,973

(22) Filed: May 30, 2017

(65) Prior Publication Data

US 2017/0340024 A1 Nov. 30, 2017

Related U.S. Application Data

(60) Provisional application No. 62/342,795, filed on May 27, 2016, provisional application No. 62/385,075,
(Continued)

(51) Int. Cl.
*A41C 3/06* (2006.01)
*A41C 3/02* (2006.01)
*A41C 3/14* (2006.01)

(52) U.S. Cl.
CPC ..... *A41C 3/06* (2013.01); *A41C 3/02* (2013.01); *A41C 3/142* (2013.01)

(58) Field of Classification Search
CPC ..... A41C 3/0057; A41C 3/10; A41C 3/007; A41C 3/0021; A41C 3/0014; A41C 3/128; A41C 3/122; A41D 27/24
(Continued)

(56) References Cited

U.S. PATENT DOCUMENTS 2,553,036 A 5/1951 Christensen
2,786,205 A 3/1957 Payne
(Continued)

FOREIGN PATENT DOCUMENTS

CN 202077593 U 12/2011
CN 102406248 A 4/2012

OTHER PUBLICATIONS

International Search Report and Written Opinion dated Aug. 29, 2017, from the International Searching Authority, for International Patent Application No. PCT/US2017/034866 (filed May 26, 2017), 12 pages.

(Continued)

*Primary Examiner* — Gloria M Hale
(74) *Attorney, Agent, or Firm* — Hoge, Fenton, Jones & Appel, Inc.; Amy J. Embert

(57) ABSTRACT

A garment, such as a bra, may include a frame, support structure, casing and/or housing. The frame may be adapted to fit underneath a wearer's breasts and partially wrap around her torso. The support structure be coupled to the frame and may include a volumetric cup positioned thereon, which may be a cantilever projection from the frame adapted so that a portion of a wearer's breasts may be inserted therein. The frame and/or support structure may be encased in a casing. Casing may increase the size of volumetric cup to cover a larger portion of the wearer's breast. Casing may also provide padding or other mechanisms to increase the comfort of wearing the frame, support structure, and/or casing for the wearer. The casings (one for each side of the wearer) may be housed in a housing that wraps around the wearer's torso thereby enabling the wearer to wear the garment.

20 Claims, 92 Drawing Sheets

Related U.S. Application Data filed on Sep. 8, 2016, provisional application No. 62/460,036, filed on Feb. 16, 2017, provisional application No. 62/506,516, filed on May 15, 2017, provisional application No. 62/507,183, filed on May 16, 2017, provisional application No. 62/510,527, filed on May 24, 2017, provisional application No. 62/510,720, filed on May 24, 2017.

(58) Field of Classification Search
USPC ..... 450/52–56, 51, 41, 43–49
See application file for complete search history.

(56) References Cited

U.S. PATENT DOCUMENTS 2,793,369 A 5/1957 Panighini
2,954,031 A 9/1960 Froehlich
2,992,646 A 7/1961 Weinberg
2,994,325 A 8/1961 Geissmann
3,021,845 A 2/1962 Smith
3,196,460 A 7/1965 Marian
3,351,954 A 11/1967 Chalfin et al.
3,446,213 A * 5/1969 Goldman ..... A41C 3/10 450/39
3,491,762 A 1/1970 Simonsen
3,504,104 A * 3/1970 Takashi ..... H01B 7/0018 174/120 R
3,698,399 A 10/1972 Hand
4,470,419 A 9/1984 DiTullio
4,617,934 A * 10/1986 Hittel ..... A41C 3/0007 450/1
6,165,045 A 12/2000 Miller et al.
6,379,327 B2 4/2002 Lundy
6,425,800 B1 7/2002 Huang
6,431,946 B1 8/2002 Fildan et al.
6,439,959 B1 * 8/2002 Magrone ..... A41C 3/0014 450/41
6,447,365 B1 * 9/2002 Powell ..... A41C 3/122 450/41
6,688,942 B2 * 2/2004 Holliday ..... A41C 3/0057 450/1
6,761,614 B2 7/2004 Pinna
7,234,994 B2 * 6/2007 Fildan ..... A41C 3/128 450/41
7,309,276 B2 12/2007 Legaspi et al.
7,335,086 B1 * 2/2008 Karon ..... A41C 3/065 450/1
7,377,833 B1 5/2008 Wanzenboeck et al.
7,407,428 B2 8/2008 Fildan et al.
7,425,170 B1 9/2008 Herbert et al.
7,549,302 B2 6/2009 Duckham et al.
D606,285 S 12/2009 Schindler
D616,627 S 6/2010 Schindler
D622,477 S 8/2010 Schindler
7,833,082 B2 11/2010 Bugada
8,047,891 B1 11/2011 Albritton
8,123,589 B2 2/2012 Chapman et al.
8,187,054 B2 5/2012 Redenius
D666,384 S 9/2012 Schindler
8,747,184 B2 6/2014 Liu
8,864,549 B2 * 10/2014 McKeen ..... A41C 3/0021 450/51
9,237,772 B2 * 1/2016 McKeen ..... A41C 3/0021
9,392,822 B2 * 7/2016 McKeen ..... A41C 3/0021
2002/0022432 A1 2/2002 Magrone et al.
2003/0092355 A1 5/2003 Rabinowicz et al.
2003/0232571 A1 12/2003 Weinerth
2005/0079794 A1 4/2005 Giese
2008/0090491 A1 * 4/2008 Liu ..... A41C 3/0014 450/39
2009/0247047 A1 10/2009 Avalos-Dessner et al.
2010/0120329 A1 5/2010 MacDonald
2010/0210179 A1 8/2010 Redenius
2011/0244757 A1 10/2011 Mays
2012/0184181 A1 7/2012 Liu
2014/0087624 A1 3/2014 Yuasa et al.
2014/0213145 A1 * 7/2014 McKeen ..... A41C 3/0021 450/59
2015/0044940 A1 2/2015 McKeen
2015/0118936 A1 4/2015 Schlueter

OTHER PUBLICATIONS

First Examination Report dated Aug. 17, 2018, from the European Patent Office, for European Patent App. No. 14743241.3, 4 pages.
Babej, "Does Silent Assembly's New Bra Technology Spell The End of The Underwire?", Forbes (Aug. 15, 2013), http://www.forbes.com/sites/marcbabej/2013/08/15/does-silent-assemblys-new-bra-technology-spell-the-end-of-the-underwire/, 4 pgs.
Bellis, "The History of the Brassiere", About.com, http://inventors.about.com/od/bstartinventions/a/brassiere.htm; downloaded Jun. 30, 2014, 1 pg.
"Customer Service: Patent Information", Jockey bra, http://www.jockey.com/customerservice/patentsinformation, downloaded Jun. 30, 2014, 2 pg.
Evelyn & Bobbie, LLC; International Application No. PCT/US2014/013240 filed Jan. 27, 2014 International Search Report and Written Opinion dated May 21, 2014, 12 pgs.
JoViPak, http://www.bellisse.com/index.php?option=com_content&view=category&layout=blog&id=58&Itemid=27; downloaded Jun. 30, 2014; 2 pgs.
Kenosha, "New JOCKEY® bra, with Patented Volumetric Fit System, Gives Women a Near-Custom Fit", Jockey bra (May 30, 2013), http://smnr.akamediainc.com/jockey-reinvents-the-bra/, 2 pgs.
Pop, Lenuta, "Here comes the bra technology Microsoft", ICGEEKS (Dec. 4, 2013), http://icgeeks.org/here-comes-the-bra-technology-microsoft/, 3 pgs.
Riordan, "Patents; In bra technology, an incremental improvement can translate into comfort", The New York Time (Oct. 28, 2002), http://www.nytimes.com/2002/10/28/business/patents-in-bra-technology-an-incremental-improvement-can-translate-into-comfort.html, 2 pgs.
The Emergency Bra website: http://ebbra.com/; downloaded Jun. 30, 2014; 1 pages.
Thirdlove website: https://thirdlove.com., accessed Jun. 30, 2014; 2 pgs.
Ultimo website, http://www.ultimo.co.uk/michelle-mone; downloaded Jun. 30, 2014; 2 pgs.
Examination Report No. 1 for standard patent application dated Apr. 13, 2017, from Australian Government, for Australian Patent Application No. 2014209122, 3 pgs.
Written Opinion dated Jun. 9, 2016, from Intellectual Property Office of Singapore, for Singapore Patent Application No. 11201505798V (filed Jan. 27, 2014), 7 pgs.
Office Action dated Apr. 19, 2017, from the State Intellectual Property Office of China, for Chinese Patent Application No. 201480010903.6, 22 pgs.
Office Action dated May 30, 2016, from the State Intellectual Property Office of China, for Chinese Patent Application No. 201480010903.6, 11 pgs.
Search Report completed Apr. 29, 2016, from Intellectual Property Office of Singapore, for Singapore Patent Application No. 11201505798V (filed Jan. 27, 2014), 3 pgs.
Supplementary European Search Report dated Aug. 16, 2016, from European Patent Office, for European Patent Application No. 14743241.3, 7 pgs.
Written Opinion dated May 4, 2017, from Intellectual Property Office of Singapore, for Singapore Application No. 11201505798V (filed Jan. 27, 2014), 6 pages.
First Examination Report dated Jan. 18, 2017, from New Zealand Intellectual Property Office, for New Zealand Application No. 710721, 9 pages.

* cited by examiner

200

500

500

800

900

2600

2800

2900

2900

2900

3100

3200

3200

3300

3400

GARMENT FRAME, SUPPORT STRUCTURE, CASING, AND HOUSING

RELATED APPLICATIONS

This application is a NON-PROVISIONAL application of U.S. Provisional Patent Application No. 62/342,795 filed on May 27, 2016 entitled "SYSTEMS, DEVICES, AND METHODS FOR GARMENT SIZING AND PRODUCTION"; a NON-PROVISIONAL application of U.S. Provisional Patent Application No. 62/385,075 filed on Sep. 8, 2016 entitled "BRASSIERE SUPPORT STRUCTURE WITH CURVED OPENING"; a NON-PROVISIONAL U.S. Provisional Patent Application No. 62/460,036 filed Feb. 16, 2017 entitled "GARMENT FRAME AND CASING"; a NON-PROVISIONAL application of U.S. Provisional Patent Application No. 62/506,516 filed on May 15, 2017 entitled "GARMENT CLOSURE MECHANISM"; a NON-PROVISIONAL application of U.S. Provisional Patent Application No. 62/507,183 filed on May 16, 2017 entitled "SYSTEMS, DEVICES, AND METHODS FOR DETERMINING A BRA SIZE FOR A WEARER"; a NON-PROVISIONAL application of U.S. Provisional Patent Application No. 62/510,527 filed on May 24, 2017 entitled "BRA COMPONENTS, CASEMENT, AND HOUSING"; and a NON-PROVISIONAL application of U.S. Provisional Patent Application No. 62/510,720 filed on May 24, 2017 entitled "BRA COMPONENTS, CASEMENT, AND HOUSING", all of which are incorporated herein by reference in their respective entireties.

FIELD OF INVENTION

The present invention relates to the field of apparel and, more specifically to systems, devices, and methods for garment sizing and production. The garment may be a bra, or a similar garment, configured to reposition a portion of a volume of a wearer's breast or breasts and support a portion of a weight of the wearer's respective breast when worn by the wearer by, for example, redirecting the weight to the wearer's torso by, for example, providing a cantilever projection upon which the breast weight may be positioned.

BACKGROUND

Brassieres have been used for lifting and shaping the breasts for approximately 100 years. Brassieres (and other related garments, such as underwire swimwear tops) are typically manufactured using two U-shaped metal components or "under wires," which serve to create a rounded housing for each breast. The underwire also serves to create a uniform shape in accordance with a fashionable silhouette. The underwire is conventionally a flat U-shape, and does not conform to the curved dimensions of the wearer's rib cage. Thus, the underwire brassiere in its traditional form frequently creates areas of poking and rubbing at the ends of the wire (between breasts and in underarm areas), as well as pinching at the lowermost point of the underwire (at the bottom of the breast, directly under the nipple) where the underwire pushes into the ribs. The larger the breasts, the more significant these pressure points tend to be. Seams and fabric casements, which serve to hold the underwire in place, can further exacerbate the pinching and rubbing of the wire against the skin and ribs.

The underwire casement of traditional brassieres typically attaches to three straps. The primary back strap attaches laterally around the rib cage, in most cases fastening in the rear near the spine. The two shoulder straps attach to the underwire casement in the front and to the lateral strap in the rear. The two shoulder straps run over the belly of the trapezius muscles and support the weight of the breasts against these muscles of the neck and shoulders (primarily the trapezius and levator scapulae muscles). In this way, the force of the lifted breast effectively hangs from the neck and shoulders.

In typical brassiere construction, and especially in larger breasted wearers, all three straps typically create discomfort for the wearer. To support the load of the breast tissue, conventional shoulder straps push down on the trapezius muscles, which in turn forces the head forward and the spine out of proper postural alignment. This misalignment frequently results in tension in the head, neck and shoulders that is directly linked to wearing a conventional bra. This pressure on the trapezius muscles is made visible in the surface indentations frequently left behind in the shoulders of brassiere wearers. Further, these indentations frequently become permanent after years of continued brassiere wear. The effects can also be seen in the slouched or hunched spinal posture of large-breasted, brassiere-wearing women.

In addition, if the primary back strap is fitted tightly enough to the torso such to relieve some of the pressure from the shoulder straps, then the pressure of the underwire casement against the body (and the rubbing and pinching related to the casement) in turn increases. In the case of brassiere garments where the shoulder straps have been removed entirely (i.e. "strapless" brassieres), the garment typically slides down the torso over time, moving out of its intended placement and flattening the profile of the breasts, with aesthetically displeasing results. The result is that wearers are forced to frequently tug the garment back into place, undermining the intention of the wearer for the state of their undergarment to remain private. (Imagine, by way of example, a bride with a strapless dress and strapless brassiere, which begins to fall down during her wedding ceremony. To remain modest and avoid embarrassment, she has no choice but to tug her undergarment back into place, thus revealing the state of her undergarment slippage to any who are observing her.)

In addition, underwire-alternative brassieres that possess rigid regions or thick seams directly beneath the breast fail to provide a comfortable alternative because of resulting pressure on the top of the abdominal cavity when the wearer sits or otherwise bends at the waist.

In summary, the traditional construction of the bra brings with it a set of specific design features that are inherently linked to chafing, rubbing, poking, and pinching of the skin; tension and pain in the muscles of the wearer; and pressure or compression of the upper abdominal cavity.

SUMMARY

The present invention is directed to, among other things, a garment such as a bra, sports bra, compression bra, bralette, corset, bustier, camisole, swimsuit, sports top, shirt, and dress and components thereof. The garment may include a frame, support structure, casing and/or housing. The frame may be adapted to fit underneath a wearer's breasts and partially wrap around her torso. In most cases, the frame does not include a volumetric, or breast, cup. The support structure be coupled to the frame and may include a volumetric, or breast, cup positioned thereon. The volumetric cup may be a cantilever projection from the frame adapted so that a portion of a wearer's breasts may be inserted therein. In most cases, the volumetric cup will not completely cover the wearer's breast. The frame and/or support structure may be encased or enclosed in a casing. Casing may server to increase the size of volumetric cup to cover a larger portion of the wearer's breast. Casing may also provide padding or other mechanisms to increase the comfort of wearing the frame and/or casing for the wearer. The casings (one for each side of the wearer) may be housed in a housing that wraps around the wearer's torso thereby enabling the wearer to wear the garment.

The frame, may include an under-bust band shaped so as to approximate a curvature in a horizontal plane of a wearer's torso proximate to an inframammary fold of the wearer. In some embodiments, a portion of the under bust band is adapted for positioning under a wearer's breast proximate to the wearer's inframammary fold. The shape of the under-bust band may be self supporting.

In some embodiments, the under bust band may include an intermammary-cleft portion, an under-bust portion, and a wrap-around portion. The intermammary-cleft portion may be adapted to be proximate to an intermammary cleft of a wearer when worn by the wearer. A first side of the under-bust portion may be connected to the intermammary-cleft portion and adapted to be proximate to an under-bust region of the wearer when worn by the wearer. The wrap-around portion may be connected to a second side of the under-bust portion and adapted to be proximate to a lateral side of the wearer's torso. On some occasions, the wrap-around portion may have an outer edge adapted to be proximate to a side vertical midline of the wearer when worn by the wearer, the side vertical midline extending through a center of the wearer's torso as viewed from the side and bisecting an anterior and a posterior of the wearer.

In some embodiments, the under-bust band may include a wrap-around portion, the wrap-around portion may be adapted to correspond to a position on a wearer at or near a vertical midline separating an anterior portion of the wearer from a posterior portion of the wearer.

In another embodiment, the under-bust band may include a wrap-around portion, the wrap-around portion may be adapted to correspond to a position on a wearer beyond a vertical midline separating an anterior portion of the wearer from a posterior portion of the wearer.

In further embodiment, the under-bust band may include a wrap-around portion, the wrap-around portion may be curved so as to approximate a curvature of a wearer's torso along a horizontal plane extending approximately from a sagittal plane center midline of a wearer to a frontal plane reference line of the wearer.

In yet another embodiment, the under-bust band may include a wrap-around portion, the wrap-around portion may be curved so as to approximate a curvature of a wearer's torso along a horizontal plane extending approximately from a sagittal plane center midline of the wearer through a frontal plane reference line of the wearer and around a posterior portion of the wearer when the frame is worn.

In some instances, the under-bust band may include an under-bust portion, an upper edge of the under-bust portion may be curved so as to accept a portion of a wearer's breast inserted therein when worn by the wearer.

In one embodiment, the under-bust band may include an under-bust portion, an upper edge of the under-bust portion may be curved so as to approximate a curvature of a wearer's inframammary fold.

In some instances, the frame may be adapted for inclusion in a casing and/or housing. At times, the frame may be adapted for inclusion in a casing and the casing is adapted for inclusion in a housing.

In yet another embodiment, the under-bust band may include an under-bust portion adapted to be proximate to an under-bust region of a wearer when worn by the wearer and a cantilever projection, the cantilever projection extending outward from a portion of an upper edge of the under-bust portion. The cantilever projection may be part of a volumetric cup included within a support structure. A width of the cantilever projection is larger on a first side of the cantilever projection than a width of the cantilever projection on a second side of the cantilever projection.

In a still further embodiment, the under-bust band may include a cantilever projection that extends outward from a portion of an upper edge of the band. In some instances, an upper edge of the band and may be curved so as to approximate a wearer's inframammary fold. At times, the cantilever projection may be shaped, sized, and positioned so as to accept a portion of a wearer's breast when worn.

The present invention may also include a system comprising a frame and a casing. The frame may include an under-bust band shaped so as to approximate a curvature of a wearer's torso proximate to an inframammary fold of the wearer and adapted for positioning under a wearer's breast at the inframammary fold and the casing may encase the frame. At times, the casing may include a volumetric cup shaped, sized, and positioned so as to accept a portion of a wearer's breast when worn.

In some embodiments, the frame of the system may further include a cantilever projection, the cantilever projection extending from a portion of an upper edge of the band, the cantilever projection may be shaped, sized, and positioned so as to accept a portion of a wearer's breast when worn.

BRIEF DESCRIPTION OF THE FIGURES

The present application is illustrated by way of example, and not limitation, in the figures of the accompanying drawings, in which:

FIGS. 12A-120 provide illustrations of wearer who is not wearing clothes;

FIGS. 17A-170 provide illustrations of wearer wearing an exemplary frame in accordance with embodiments of the present invention;

FIGS. 33A and 33B provide illustrations of a front plan view and a side view, respectively, of an exemplary system 3300 in accordance with embodiments of the present invention.

Figure 1A:
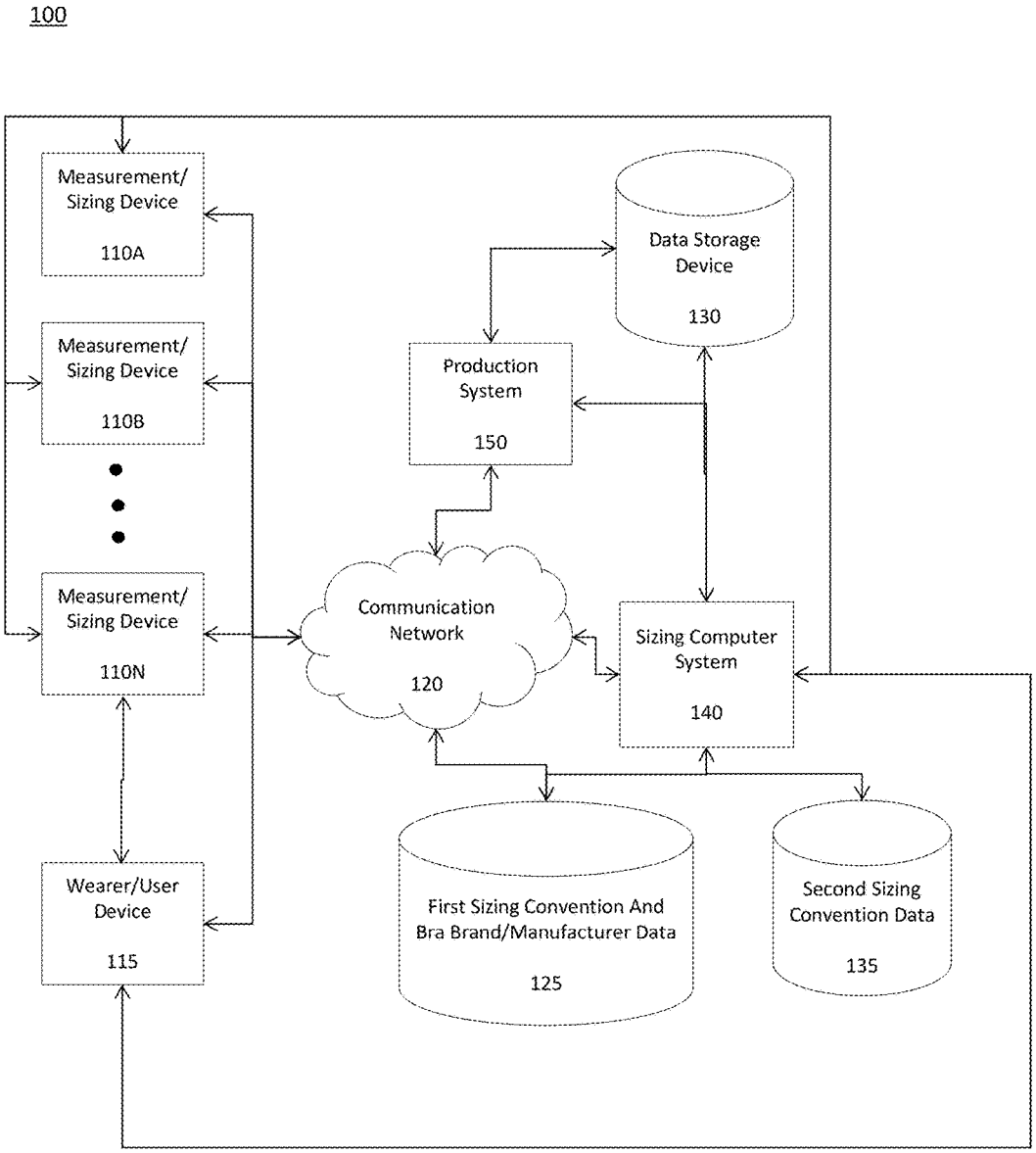
FIG. 1A is a block diagram of an exemplary system, in accordance with embodiments of the present invention.

Throughout the drawings, the same reference numerals and characters, unless otherwise stated, are used to denote like features, elements, support structures, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

Written Description

Disclosed herein are various embodiments of a frame, support structure, casing, and housing designed as, and/or for inclusion in and/or with, a garment, such as a bra, sports bra, compression bra, corset, bustier, camisole, swimsuit, sports top, shirt, and dress. Also, disclosed herein are methods and processes for determining a size (e.g., according to a second sizing convention and/or a personalized size) of a garment, or bra, that is appropriate for a wearer, determining dimensions or other aspects of features for the frame, support structure, casing and/or housing for the production or manufacture of same, and systems and components for executing these processes.

The frames and support structures disclosed herein may provide structural support for the garments and may be sufficiently rigid so as to shape breast tissue inserted therein into a desired silhouette and maintain that shape/silhouette while being worn by the wearer. The frames and support structures disclosed herein may also be sufficiently rigid to support the weight of breast tissue received therein and redirect that weight to the wearer's torso or, more particularly, to a portion of the wearer's torso at, near, or surrounding her inframammary folds (i.e., around the circumference of her torso (e.g., her side or back)). As used herein, the terms breast and breast tissue refer to a wearer's natural breasts, breast implants, and/or prosthetic breasts.

The frames and support structures disclosed herein may, in some instances, be encased (e.g., partially, or wholly, surrounded) by a casing, a housing, and/or a portion thereof. In other instances, the frames and/or support structures disclosed herein may be inserted into, and/or positioned on, a casing and/or housing and/or a portion thereof. The casings may be adapted for inclusion in housings, garments, bras, sports bras, compression bras, corsets, bustiers, camisoles, swimsuits, sports tops, shirts, and dresses, and may, in some instances, form a portion of a breast cup, or breast covering, for these garments.

In some instances, the frames, support structures, casings, and/or housings disclosed herein work together to provide breast weight support and/or bear the load of the wearer's breast weight and redistribute it around, for example, 180°-360° of the wearer's torso (at, or near, a horizontal reference line connecting the bottoms of the wearer's inframammary folds) typically without the use of shoulder straps. However, none of the frames, support structures, casings and/or housings preclude the use of one or more shoulder straps. In this way, the frames, support structures, casings, and/or housings disclosed herein support the breast weight from portions of the wearer's torso located at her sides (i.e., the sides of her torso underneath her arms) and underneath the wearer's breasts. In various embodiments, the frames, support structures, casings, and housings and/or features thereof disclosed herein may be interchangeable with one another.

In most embodiments, the frames, support structures, casings, and/or housings disclosed herein and, in particular, a lower edge thereof, will be arc shaped in a manner that approximates a shape of a circumference of the wearer's torso at, or near, a horizontal reference line connecting the bottoms of the wearer's inframammary folds and, in some instances, above and/or below that horizontal reference line. The frames, support structures, casings, and/or housings will maintain this arc shape even in the absence of outside force so that, for example, breast weight, or load, may be transferred to the wearer's torso by way of a self-supporting cantilever projection, or shelf, that is supported by a portion of the arc-shaped the frames, support structures, casings, and/or housings that wrap around a portion of the wearer's circumference.

The frames, support structures, casings, and housings disclosed herein may be made using any appropriate process including, but not limited to, stamping, press molding, thermal molding, injection molding, 3D printing, spray fabric, sewing, and the like. In some instances, frames, support structures, casings, and housings disclosed herein may be made via thermal molding using aluminum, steel, and/or synthetic molds. In some embodiments, the frames, support structures, casings, and housings may be co-manufactured (i.e., all made from the same material and/or at the same time) as may be possible using a 3D printing process. In other embodiments, one or more of the frames, support structures, casings, and housings may be separately manufactured and then assembled using any appropriate manner of assembly including, but not limited to, mechanical bonding, thermal bonding, chemical bonding, sewing, and the like. Also, the term "support" as used herein may refer to a weight or mass bearing capability or an ability to support (i.e., hold up) a load, typically in the form of breast weight. In many instances, this support is facilitated by way of a cantilever projection from, for example, a frame and/or a portion of a casing and/or housing corresponding to the frame.

Turning now to the figures, FIG. 1 is a block diagram depicting an exemplary garment sizing and production system 100 that may be used to produce or manufacture a frame, support structure, casing, and/or housing as described herein. System 100 may also be used to determine a wearer's frame, support structure, casing, and/or housing size and/or a size of a garment incorporating a frame, support structure, casing and/or housing that would be appropriate for the wearer.

System 100 includes a plurality of measurement/sizing devices 110A-110N. Measurement/sizing devices 110A-110N may be used to take and/or determine one or more measurements of an individual (also referred to herein as a "wearer") and/or capture information that is used to determine a dimension of the individual and/or a size for a garment worn by the individual. Exemplary measurement devices include a camera, a camera capable of capturing three-dimensional (3D) images, a manual tape measure, a scale, a ruler, and a processor adapted to determine a measurement based on, for example, an image, or some combination thereof.

In some instances, two or more measurement/sizing devices 110A-110N may be arranged in an array to capture image(s) and/or measurements of an individual from a plurality of viewpoints and/or angles. For example, an array of four measurement/sizing devices 110A-110Ns may be arranged at the four corners of a planar square configuration to capture images of the top left, bottom left, top right, and bottom right sides of an individual's torso. The planar square configuration may be oriented perpendicularly to the wearer.

Measurements taken by measurement/sizing devices 110A-110N may be stand-alone and/or relational measurements. Stand-alone measurements are measurements of a body dimension that are not related to another body landmark or dimension. Exemplary stand-alone measurements are height, weight, and chest/torso circumference. Stand-alone measurements may also determine a radius of curvature, a mass, and/or a volume of, for example, a torso, a breast, and/or a pair of breasts. Relational measurements are measurements of body dimensions made in relation to one another. Exemplary relational measurements include a distance between two breasts (i.e., inter-breast distance), a distance between two nipples, a distance between a clavicle and an axilla (armpit), and a distance between an axilla and a nipple.

In some instances, the measurements taken by one or more measurement/sizing devices 110A-110Ns may be used to determine a shape, or contour, of a body part or exterior surface of the individual. For example, one or more three-dimensional image(s) captured by one or more measurement/sizing devices 110A-110N(s) may be analyzed to determine a curvature of an exterior surface of a torso to determine relationships between the front, side, and back of the body so that a shape (not just a circumference) of the individual may be determined. In another example, one or more three-dimensional image(s) captured by one or more measurement/sizing devices 110A-110N(s) may be analyzed to determine a breast shape and/or a placement position on a torso of an individual.

In some cases, an individual (e.g., a wearer) may enter measurement data (e.g., height, weight, traditional bra size, etc.) directly into system 100 via wearer/user device 115. Additionally, or alternatively, another individual (e.g., a person measuring the individual or sales person), who may be referred to herein as a "user" may enter one or more measurements into wearer/user device 115. Exemplary measurements taken via a physical, or manual, measurement/sizing device(s) 110A-110N include a chest circumference or relational dimensions between two or more body reference points. Exemplary tools for taking manual measurements include, but are not limited to, measuring tapes, scales, and volumetric measuring devices, such as a series of differently sized cones or other curved bra-cup-like objects that may be placed over breast tissue to measure the volume and/or shape of the breast tissue. In some cases, the individual (or someone on the individual's behalf) may enter data regarding, for example, breast shape, size, and placement on the torso via wearer/user device 115. In some embodiments, the individual may enter this information via answers to a series of questions provided to the individual via wearer/user device 115.

In some embodiments, measurement/sizing devices 110A-110N may be able to capture coloration and/or other pigmentation information regarding the individual. For example, one or more measurement/sizing devices 110A-110N may be accompanied with a set of standard pigmentation or coloration samples that may be used to determine a coloration or pigmentation of the individual via, for example, a correlation process. Additionally, or alternatively, an image of the wearer may be analyzed by, for example, a measurement/sizing device 110A-110N, wearer/user device 115, and/or sizing computer system 140 to determine skin tone of the wearer and/or a color or pattern that may match the wearer and/or a preference of the wearer.

In some instances, measurement/sizing devices 110A-110N and wearer/user device 115 may be resident in the same location, such as a shop or retail establishment, while in other instances one or more measurement/sizing devices 110A-110N and/or wearer/user device 115 may be resident in different locations as may be the case where wearer/user device 115 is a software application (i.e., an app) running on, for example, the individual's smart phone or computer. In some cases, one or more measurement/sizing devices 110A-110N may also be owned/operated by the individual as may be the case when the individual measures herself via, e.g., a scale or captures images via a camera (2D and/or 3D).

Measurement/sizing data and other information about an individual may be communicated to a wearer/user device 115 and/or a sizing system 140 via a communication network 120. Communication network 120 may be a wired and/or wireless communication network and, in some instances, may be coupled to the Internet and/or cloud-computing storage devices. Sizing system 140 may be a computer system configured to receive measurement and/or sizing data from measurement/sizing devices 110A-110N and/or wearer/user device 115 and execute one or more processes 200-1100 described herein.

Data storage device 130 may be one or more individual data storage devices and/or an array of data storage devices. Data storage device 130 may store measurement and sizing data for a plurality of individuals/wearers as well as sizing information. In some embodiments, this stored data may be associated with a wearer account associated with the wearer and/or user. Data storage device 130 may also store one or more sets of instructions for execution by one or more components of system 100 (e.g., measurement/sizing devices 110A-110N, wearer user device 115, sizing computer system 140, and/or a production system 150).

Production system 150 may be any system enabled to produce a physical garment, or a component thereof (e.g., a frame, support structure, casing and/or housing), including, but not limited to, a 3D printer, compression molding equipment, a sewing machine, injection molding equipment, stamping equipment, and so on. In most cases, production system 150 will be an automated, or semi-automated, system and may include one or more components. For example, when a component of production system 150 is a 3D printer, production system 150 may include the 3D printer and a computer or processor capable of providing instructions to the 3D printer regarding what to print and how to print it. The computer/processor of this production system 150 may also be capable of converting information (e.g., dimensions, sizes, material thicknesses, garment sizes, etc.) into a set of instructions usable by the 3D printer to print/make a frame, support structure, casing and/or housing and/or a component thereof.

In another embodiment, production system 150 may be an injection molding system that may, or may not, include a system for designing and/or manufacturing one or more injection molds or dies. For embodiments where production system 150 also includes a system for designing and/or manufacturing one or more injection molds or dies, production system 150 may also include mold/die manufacturing equipment and materials as well as a computer or processor capable of providing instructions to the mold/die manufacturing equipment regarding how to manufacture the mold/die. Likewise, when production system 150 is stamp or pressing equipment, the production system 150 may include a system for designing and/or manufacturing stamps or compression equipment as well as a computer or processor capable of providing instructions to the stamp/compression system to manufacture the stamps and/or compression equipment.

In some instances, sizing system 140 may provide instructions to production system 150 regarding how to produce one or more components of a garment including a frame, support structure, casing and/or housing as will be discussed in greater detail below with regard to, for example, FIGS. 12A-34H. In some instances, data, measurements, or other information needed to provide (by wearer/user device 115 and/or sizing computer system 140) and/or execute (by production system 150) these instructions may be provided by data storage device 130 and/or second sizing convention database 135 responsively to, for example, a request from, for example, wearer/user device 115, sizing computer system 140, and/or production system 150.

System 100 may also include a first sizing convention and bra brand/manufacturer database 125 and a second sizing convention database 135 both of which are communicatively coupled to communication network 120, sizing computer system 140, and/or wearer/user device 115 (via, e.g., communication network 120). First sizing convention and bra brand/manufacturer database 125 may store data regarding industry-standard bra sizing convention(s) based on, in most instances, torso circumference and bra cup size (e.g., 34C or 40DD) and parameters (e.g., measurements values or ranges of measurement values) associated therewith. In some instances, first sizing convention and bra brand/manufacturer database 125 may also include information regarding parameters (e.g., measurements values or ranges of measurement values) used for small, medium, large, and extra large bras as may be appropriate for sports bras, camisoles, and the like.

First sizing convention and bra brand/manufacturer database 125 may also store information regarding parameters for bras and other garments including, but not limited to, sports bras, compression bras, bralettes, corsets, bustiers, camisoles, swimsuits, sports tops, shirts, and dresses that are used by various bra brands and/or manufacturers for the design and production of the respective garment. Exemplary parameters that may be associated with the various bra brands and/or manufacturers include, but are not limited to, bra dimensions, placement of hooks or fasteners, degree of elasticity of materials used, underwire dimensions, commonly used fabrics, and weight. These parameters may be used by sizing computer system 140 and/or wearer/user device 115 to, for example, determine dimensions of a bra a wearer is wearing beyond those provided by the "size" of the bra according to the first sizing convention (e.g., a 34C or 40DD).

Second sizing convention database 135 may store information regarding a second sizing convention for bras and other garments including, but not limited to, sports bras, compression bras, bralettes, corsets, bustiers, camisoles, swimsuits, sports tops, shirts, and dresses. The second sizing convention database 135 may store information regarding, for example, a set of second sizing convention sizes and how these second sizing convention sizes match/correlate to various parameters associated with, for example, objective and subjective measurements/determinations of a plurality of wearers, evaluations of anatomical measurements of the plurality of wearers and information regarding how bras made/sized according to the first sizing convention fit. Additionally, or alternatively, second sizing convention database 135 stores information regarding how to match/correlate information about a wearer (e.g., measurements, bra size according to the first sizing convention, preferences, indications, etc.) with a wearer's size according to the second sizing convention by storing a set of parameters for each size within the second sizing convention along with instructions (that may be executed by sizing computer system 140 and/or wearer/user device 115) regarding how to match information received in the form of, for example, measurements, subjective judgements regarding how bras sized according to the first sizing convention fit the wearer and whether or not they are comfortable to the wearer to a second sizing convention size.

In some embodiments, wearer/user device 115 may act as a terminal facilitating communication (e.g., providing prompts or questions and/or receiving indications and/or answers) between a wearer and/or user and the sizing computer system 140. Additionally, or alternatively, wearer/user device 115 may execute instructions for one or more of the processes described herein without the direct assistance of sizing computer system 140. This may be facilitated by, for example, a downloading of instructions and/or data (provided by, for example, first sizing convention and bra brand/manufacturer database 125 and/or second sizing convention database 135) by a software application running on the wearer/user device 115 and/or communication between wearer/user device 115 and sizing computer system 140. In some instances, some, or all, of the downloading of information and/or instructions between wearer/user device 115 and sizing computer system 140 may be performed as a background process. In this way, some of the processes described herein may be executed partially or fully by the wearer/user device 115. Additionally, or alternatively, wearer/user device 115 may communicate with sizing computer system 140 to provide data (e.g., wearer sizing or preference data) thereto and/or receive information (e.g., updated instructions, new bra or garment option to provide, etc.) therefrom.

Figure 1B:
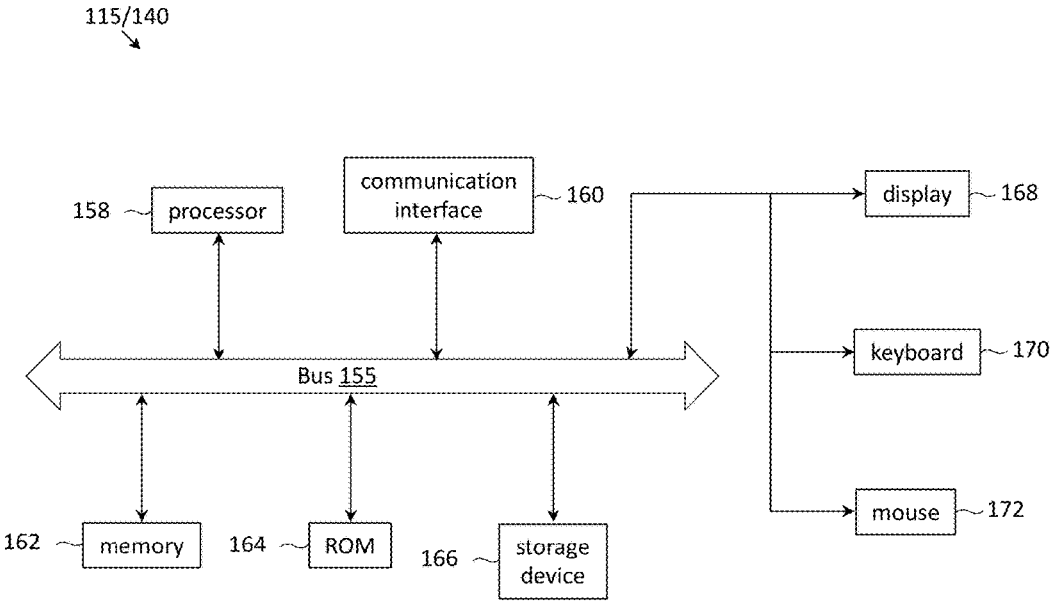
FIG. 1B is a block diagram of an exemplary wearer/user device and/or sizing computer system in accordance with embodiments of the present invention.

FIG. 1B depicts components of an exemplary wearer/user device 115 and/or sizing computer system 140 in which computer readable instructions instantiating the methods of the present invention may be stored and executed. As is apparent from the discussion herein, aspects of the present invention involve the use of various computer systems and computer readable storage media having computer-readable instructions stored thereon. FIG. 1B provides an example of a system that may be representative of any of the computing systems (e.g., wearer/user device 115 and/or sizing system 140) discussed herein. Examples of wearer/user device 115 and/or sizing system 140 may include a smartphone, a desktop, a laptop, a mainframe computer, an embedded system, etc. Note, not all of the various computer systems have all of the features of wearer/user device 115 and/or sizing system 140. For example, certain ones of the computer systems discussed above may not include a display inasmuch as the display function may be provided by a client computer communicatively coupled to the computer system or a display function may be unnecessary. Such details are not critical to the present invention.

Wearer/user device 115 and/or sizing system 140 includes a bus 155 or other communication mechanism for communicating information, and a processor 158 coupled with the bus 155 for processing information. Wearer/user device 115 and/or sizing system 140 also includes a main memory 162, such as a random access memory (RAM) or other dynamic storage device, coupled to the bus 155 for storing information and instructions to be executed by processor 158. Main memory 162 also may be used for storing temporary variables or other intermediate information during execution of instructions to be executed by processor 158. Wearer/user device 115 and/or sizing system 140 further includes a read only memory (ROM) 164 or other static storage device coupled to the bus 155 for storing static information and instructions for the processor 158. A storage device 166, for example a hard disk, flash memory-based storage medium, or other storage medium from which processor 158 can read, is provided and coupled to the bus 155 for storing information and instructions (e.g., operating systems, applications programs and the like).

Wearer/user device 115 and/or sizing system 140 may be coupled via the bus 155 to a display 168, such as a flat panel display, for displaying information to a computer user/wearer. An input device 170, such as a keyboard including alphanumeric and other keys, may be coupled to the bus 155 for communicating information and command selections to the processor 158. Another type of user input device is cursor control device 172, such as a mouse, a track pad, or similar input device for communicating direction information and command selections to processor 158 and for controlling cursor movement on the display 168. Other user interface devices, such as microphones, speakers, etc. are not shown in detail but may be involved with the receipt of user input and/or presentation of output.

The processes referred to herein may be implemented, partially or wholly, by processor 158 executing appropriate sequences of computer-readable instructions contained in main memory 162. Such instructions may be read into main memory 162 from another computer-readable medium, such as storage device 166, and execution of the sequences of instructions contained in the main memory 162 causes the processor 158 to perform the associated actions. In alternative embodiments, hard-wired circuitry or firmware-controlled processing units may be used in place of, or in combination with, processor 158 and its associated computer software instructions to implement the invention. The computer-readable instructions may be rendered in any computer language.

In general, all of the above process descriptions are meant to encompass any series of logical steps performed in a sequence to accomplish a given purpose, which is the hallmark of any computer-executable application. Unless specifically stated otherwise, it should be appreciated that throughout the description of the present invention, use of terms such as "processing", "computing", "calculating", "determining", "displaying", "receiving", "transmitting" or the like, refer to the action and processes of an appropriately programmed computer system, such as wearer/user device 115 and/or sizing system 140 or similar electronic computing device, that manipulates and transforms data represented as physical (electronic) quantities within its registers and memories into other data similarly represented as physical quantities within its memories or registers or other such information storage, transmission or display devices.

Wearer/user device 115 and/or sizing system 140 also includes a communication interface 160 coupled to the bus 155. Communication interface 160 may provide a two-way data communication channel with a computer network, which provides connectivity to, and among, the various computer systems discussed above. For example, communication interface 160 may be a local area network (LAN) card to provide a data communication connection to a compatible LAN, which itself is communicatively coupled to the Internet through one or more Internet service provider networks. The precise details of such communication paths are not critical to the present invention. What is important is that wearer/user device 115 and/or sizing system 140 can send and receive messages and data through the communication interface 160 and in that way, communicate with hosts accessible via the Internet. It is noted that the components of wearer/user device 115 and/or sizing system 140 may be located in a single device or located in a plurality of physically and/or geographically distributed devices.

Figure 2A:
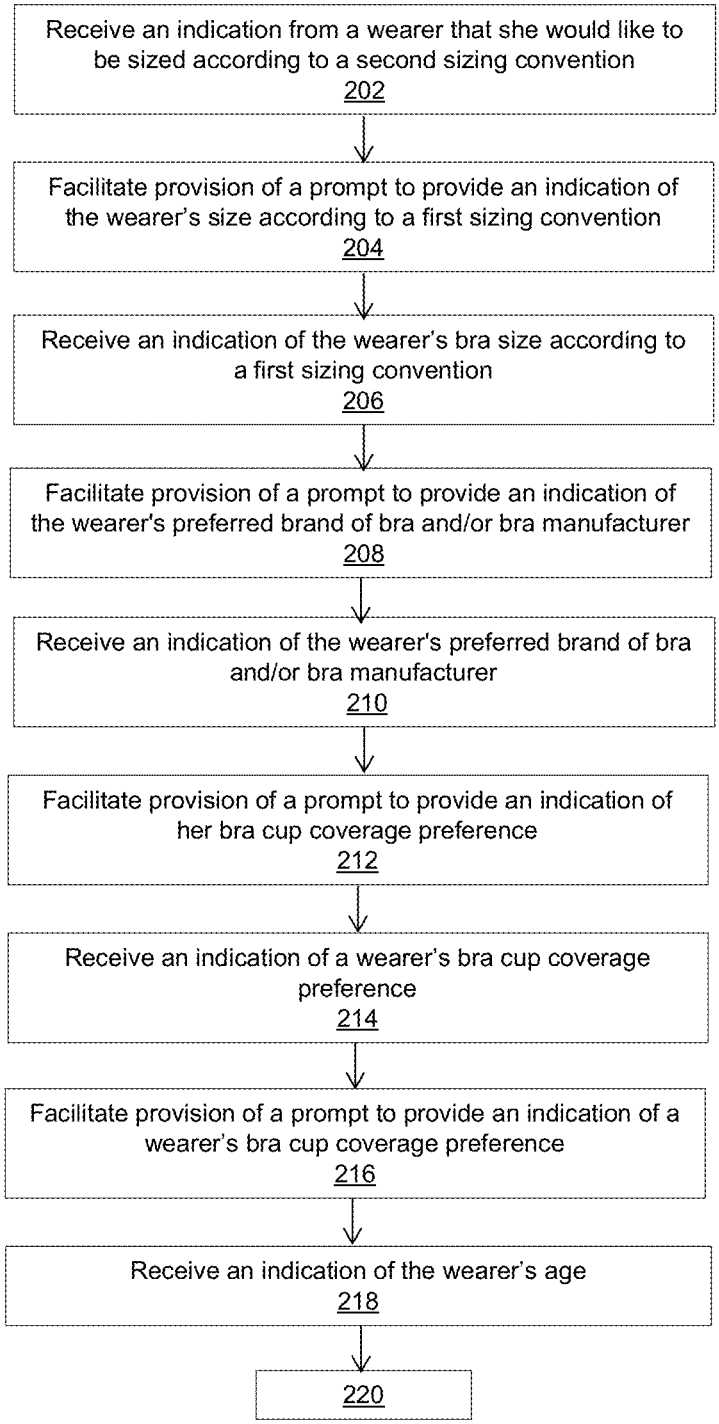
FIGS. 2A-2C, 3-4, 5A-5B, 6-11 provide flowcharts illustrating exemplary processes in accordance with embodiments of the present invention.
Figure 2B:
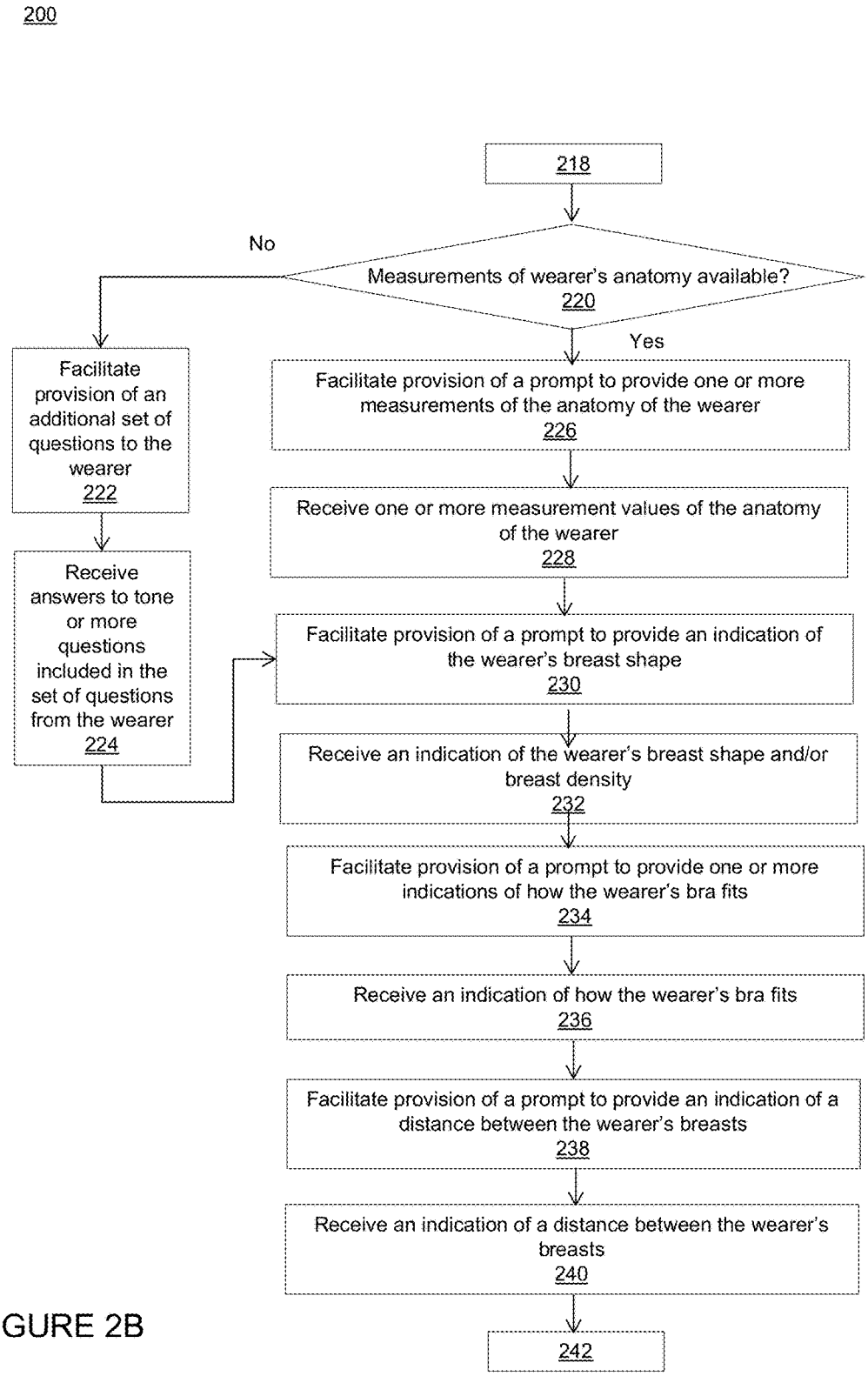
Figure 2C:
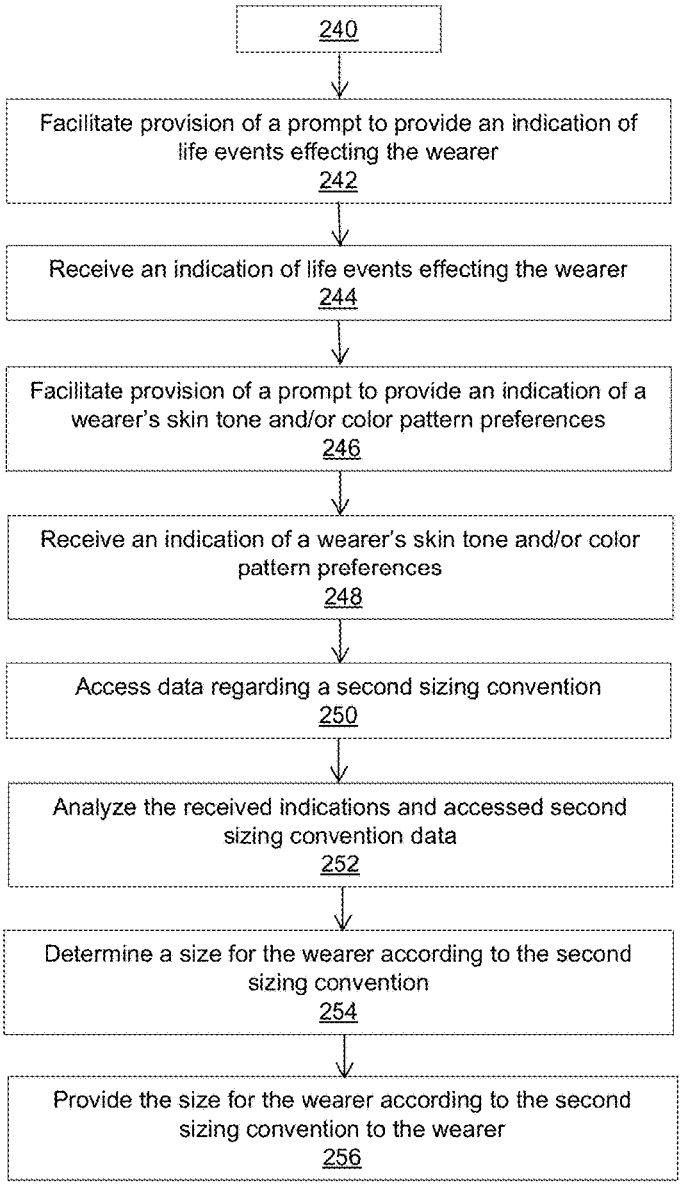

FIGS. 2A-2C provide flowcharts depicting an exemplary process 200 of determining a wearer's garment size according to a second sizing convention. The wearer may be, a male but, in most instances will be female and, on some occasions, may be referred to herein as an individual. An exemplary wearer 10, is depicted and discussed below with regard to FIGS. 12A-120. For the purposes of the discussion of process 200, the garment is a bra although a person of skill in the art will readily recognize that process 200 may be used to determine a wearer's size for a variety of garments including, but not limited to, sports bras, compression bras, bralettes, corsets, bustiers, camisoles, swimsuits, sports tops, shirts, dresses, and the like. Process 200 is executed by a computer or processor and some, or all, of process 200 may be executed by a system, such as system 100, or a component thereof such as sizing computer system 140, one or more measurement devices 110A-110N, and/or wearer/user device 115. In some instances, some or all, of the information received during process 200 is received from the wearer herself while, in other instances, another individual, referred to herein as a "user" may assist with, for example, providing requested information (e.g., the taking of measurements) and provision of the measurements to system 100, sizing computer system 140, and/or wearer/user device 115. Exemplary users include sales people, bra fitters, friends, and/or family of the wearer.

Initially, in step 202, an indication that a wearer would like to be sized according to a second sizing convention may be received by, for example, wearer/user device 115 and/or sizing computer system 140. Then, provision of a prompt to provide an indication of the wearer's current bra/garment size according to a first sizing convention may be facilitated by, for example, wearer/user device 115 (step 204). The first sizing convention may be, for example, the industry-standard bra sizing convention, which provides a torso circumferential numerical value (e.g., 28, 29, 30, etc.) and a breast-cup value (e.g., A, B, C, D, DD, etc.). In many instances, the prompt of step 204 may include a prompt for regarding a size of the wearer's favorite/most comfortable bra. In step 206, an indication of wearer's bra size according to the first sizing convention may be received.

Next, provision of one or more prompts regarding a series of one or more questions, evaluations, and/or preferences for/of the wearer may be facilitated via, for example, wearer/user device 115 and/or sizing computer system 140. In many embodiments, the prompts may be provided to the wearer and/or user via a user interface including, but not limited to, a display screen, a touch responsive interface, a keyboard, a speaker, and a microphone like the display 168, keyboard, 170, mouse 172 and/or communication interface 160 of wearer/user device 115. At times, provision of the prompts may be facilitated by a software application running on the wearer/user device 115 and/or sizing computer system 140.

In some instances, the prompts may be provided in the form of open-ended, multiple choice, or true/false questions and may be accompanied by, for example, text entry fields, selectable answers, images, and so on to facilitate receipt of an answer to the prompt and/or question. Additionally, or alternatively, the prompts may include background information, instructions, or other materials (e.g., links (e.g., hyperlinks) to further information, images, etc.) that may facilitate the user's and/or the wearer's understanding of a prompt and/or how to respond to a prompt.

Additionally, or alternatively, indications or other information (e.g., measurement values) received responsively to the prompts provided throughout execution of process 200 may be received via, for example, user and/or wearer's interactions with the user interface of wearer/user device 115, sizing computer system, or another device providing the prompts.

Substance of the prompts may provide questions and/or requests for information that may be objective or subjective in nature. Exemplary objective questions/requests may relate to measurement values and exemplary subjective questions/requests may relate to wearer preference or satisfaction with bras she's worn in the past and, in particular, her favorite or most comfortable bra. The following discussion of steps 208-248 provides examples of the prompts that may be provided to the wearer. Responses to the prompts may be received from the wearer and/or a user in assisting the wearer via, for example, wearer/user device 115 and/or a measurement/sizing device 110A-110N. In some embodiments, not all of step 208-248 may be performed. Additionally, or alternatively, one or more of steps 208-248 may be executed in an order not shown in FIGS. 2A-2C. Because many of these steps are not cumulative, they may be performed out of order.

In step 208, provision of a prompt to provide an indication of the wearer's preferred brand and/or manufacturer of bras may be facilitated. Often times, this prompt will request the wearer to provide the brand of her favorite bra which, in a preferred embodiment, corresponds to the bra size according to the first sizing convention received in step 206. In some instances, the prompt provided in step 208 may include asking an open-ended question (e.g., "what is your favorite brand") and/or providing a listing of available bra brands and/or manufacturers from which the wearer may choose. Then, in step 210, an indication of the wearer's preferred brand of bra and/or manufacturer may be received.

In step 212, provision of a prompt to provide an indication of the wearer's bra cup coverage preference may be facilitated. In some instances, the prompt provided in step 212 may include providing an image of various options for bra cup coverage along with a mechanism by which the wearer may select her preferred amount of bra cup coverage. In other instances, the prompt provided in step 212 may include providing a number of options (e.g., full coverage, minimal coverage, low neckline, etc.) from which to choose from. Then, in step 214, an indication of the wearer's bra cup coverage preference may be received.

In step 216, provision of a prompt to provide an indication of the wearer's age may be facilitated. In some instances, the prompt provided in step 216 may include providing an open-ended question (e.g., "how old are you?" and/or "when is your birthday?") and/or providing a series of age ranges (e.g., 20-25 years old, 30-40 years old, and so on) from which the wearer may choose. An indication of the wearer's age may then be received in step 218.

Proceeding now to the portion of the flowchart depicting process 200 depicted in FIG. 2B, in step 220 it may be determined whether measurements of the wearer's anatomy are available. In some embodiments, the determination of step 220 may be responsive to an indication received from the wearer that she is willing to provide measurements of her anatomy. In other embodiments, the determination of step 220 may include searching a data store such as data storage device 130, to determine if measurement(s) for the wearer are stored therein or are otherwise available. Additionally, or alternatively, the determination of step 220 may be responsive to entry of one or more measurements of the wearer's anatomy (because entry of such information would indicate that measurements are available).

When measurements of the wearer's anatomy are not available, provision of a set of additional questions to the wearer may be facilitated (step 222) and answers to one or more of the questions provided in the set of additional questions may be received (step 224). Exemplary questions that may be included in the additional set of questions include, but are not limited to, "where does your bra band sit," "which hook on your back band to you most often use" "what type of fabric is your bra," and "does your bra include lace." In some instances, these questions may be open-ended and, in other instances, they may provide one or more answer options to choose from.

When measurements of the wearer's anatomy are available, provision of a prompt to provide one or more measurements of the wearer's anatomy may be facilitated (step 226) and, in step 228, one or more measurements of the anatomy of the wearer may be received. Exemplary measurements include, but are not limited to, height, weight, body mass index (BMI), chest circumference, a breast volume measurement, and a back volume measurement. In one embodiment, the prompting of step 226 may include a request for a first, second, and third (or more) measurement of the wearer's anatomy with the first measurement being a breast volume measurement, the second measurement being back volume management, and the third measurement being a torso circumference measurement. The first, second, and/or third measurements may be taken while the wearer is wearing clothes (e.g., a bra, camisole, etc.) or is unclothed.

In some instances, the measurement values received in step 228 may include a measurement of a shape and/or size of a wearer's inframammary fold. This measurement may be taken by, for example, measuring a length of the wearer's inframammary fold from for example, a bust root on the outside of the wearer's breast (e.g., where breast 15A or 15B meets reference line 40) to the other side of the breast measuring where the breast blends into the wearer's torso at, or near, her sternum. Additionally, or alternatively, this measurement may be taken by manually placing a series of sizing arcs that provide differently shaped inframammary folds up against the wearer's inframammary fold to determine which sizing arc best matches the shape of the wearer's inframammary fold. Additionally, or alternatively, this measurement may be taken by providing a series of images, each of which depict a differently shaped inframammary fold and asking the wearer and/or user to select the image that shows an inframammary fold that best matches shape of the wearer's inframammary fold.

The first measurement may be a breast volume measurement and may correspond to a measurement of a circumference of a front side of a wearer's body at, or near, an apex of her breasts. In most cases, the first measurement will be a measurement taken from the outside of the wearer's first breast (or her bust root) to an outside of the wearer's second breast along a horizontal line that corresponds to the apex of her breasts. In some embodiments, the position from which the first measurement is taken corresponds to an intersection of the breast with a second horizontal reference line 40 (as will be discussed in greater detail below with regard to FIG. 120) on either side of the wearer's body/torso. FIGS. 13A and 13B provide images of how a user may take the first measurement of a wearer, such as wearer 10, when she is wearing a bra. More specifically, FIG. 13A provides a side-perspective view and FIG. 13B provides a front view of wearer 10 wearing a standard bra (preferably her favorite/most comfortable bra) with a first side 1310A and a second side 1310B who is being measured by a user 1350 (whose hands appear in the illustration) taking a breast volume measurement. The breast volume measurement of FIGS. 13A and 13B is taken by using a tape measure 1320 to measure the distance between the outermost side of both breasts at, or near, the apex of the breasts along second horizontal reference line 40 as discussed below with regard to FIG. 12A. In many instances, the outermost side of the wearer's breasts will correspond to where the bra's underwire 1315 sits as shown in FIGS. 13A and 13B.

Figure 13B:
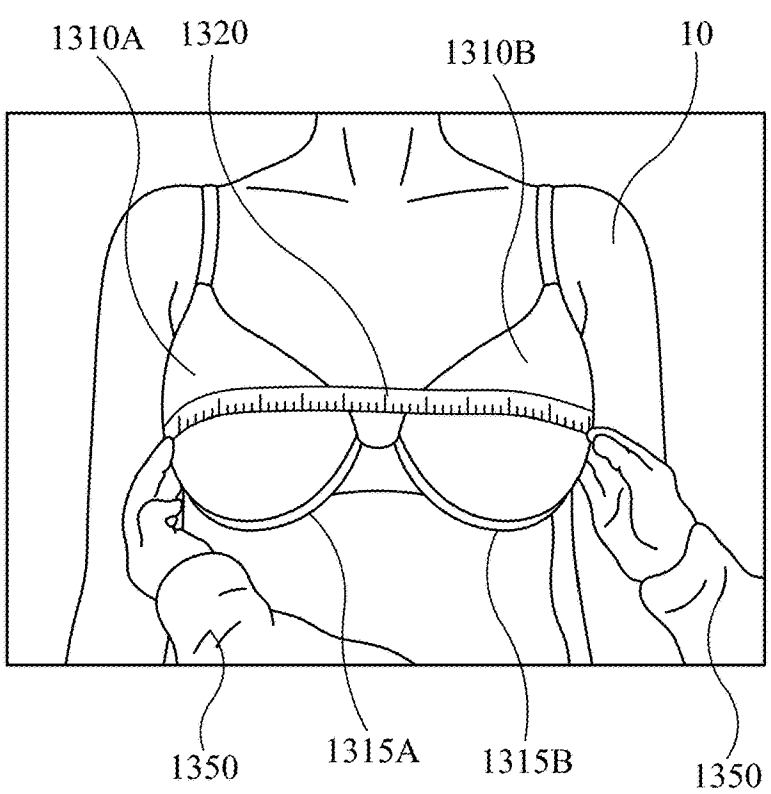
FIGS. 13A-13E provide illustrations of a user taking a measurement of a wearer in accordance with embodiments of the present invention.
Figure 13A:
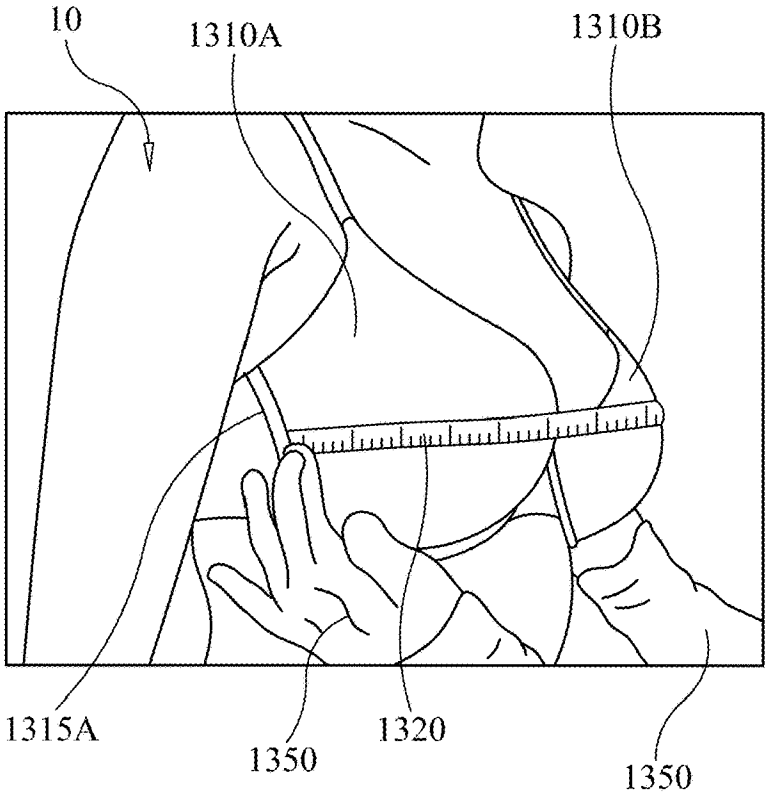
Figure 13D:
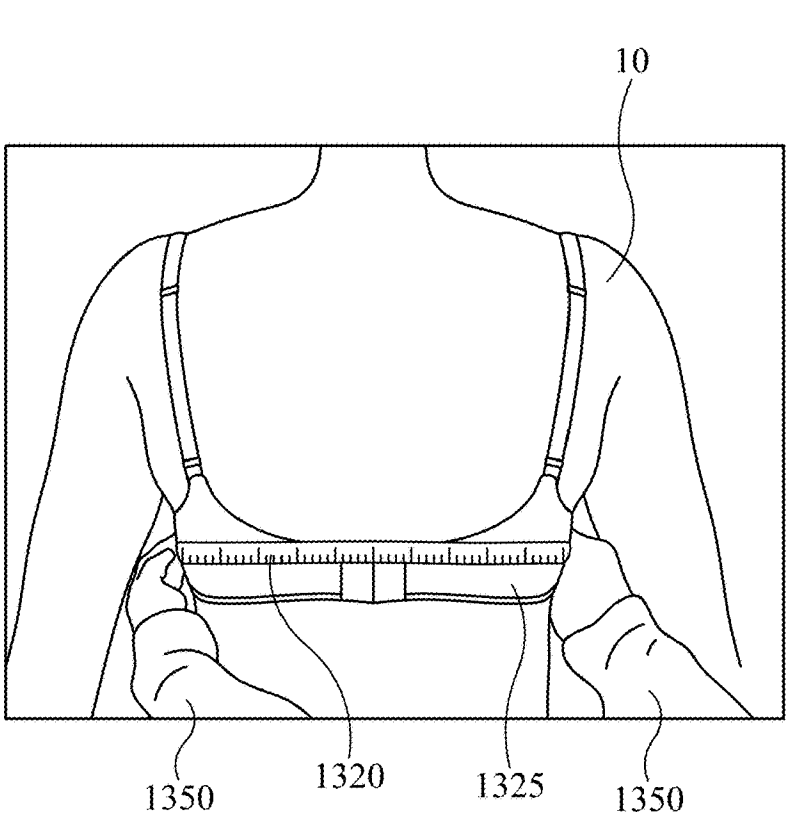
Figure 13C:
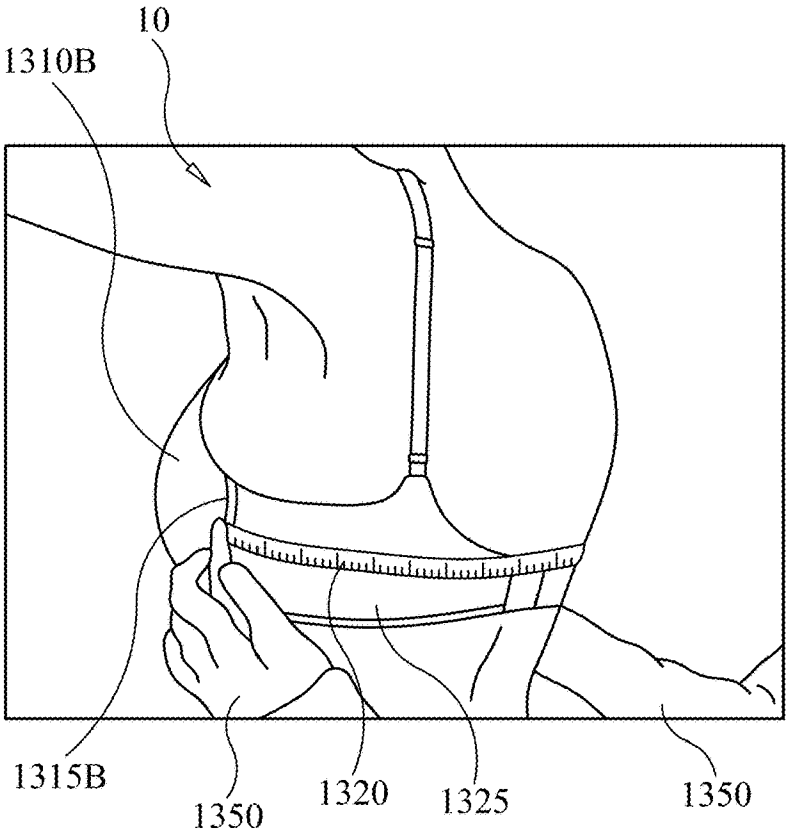

A second measurement of the wearer may correspond to a back volume measurement, which may be a measurement of a distance extending from the outside of the wearer's first breast (or bust root), around her back to the outside of her second breast as shown in FIGS. 13C and 13D, wherein FIG. 13C provides a side-perspective view of the wearer 10 and FIG. 13D provides a back view of the wearer wearing a standard bra who is being measured by user 1350 taking a back volume measurement. The back volume measurement may be taken by using tape measure 1320 to measure a distance between the outermost side of both breasts or under wire 1315 around a back of the bra 1325 along a line that is at, or near, the apex of the breasts as shown in FIGS. 13C and 13D. When the wearer is not wearing clothes, the second, or back volume, measurement may be taken by measuring the distance between an intersection of a wearer's first breast and second horizontal reference line 40 (or first bust root), around her back, to an intersection of a wearer's second breast and second horizontal reference line 40 (or second bust root).

Figure 12A:
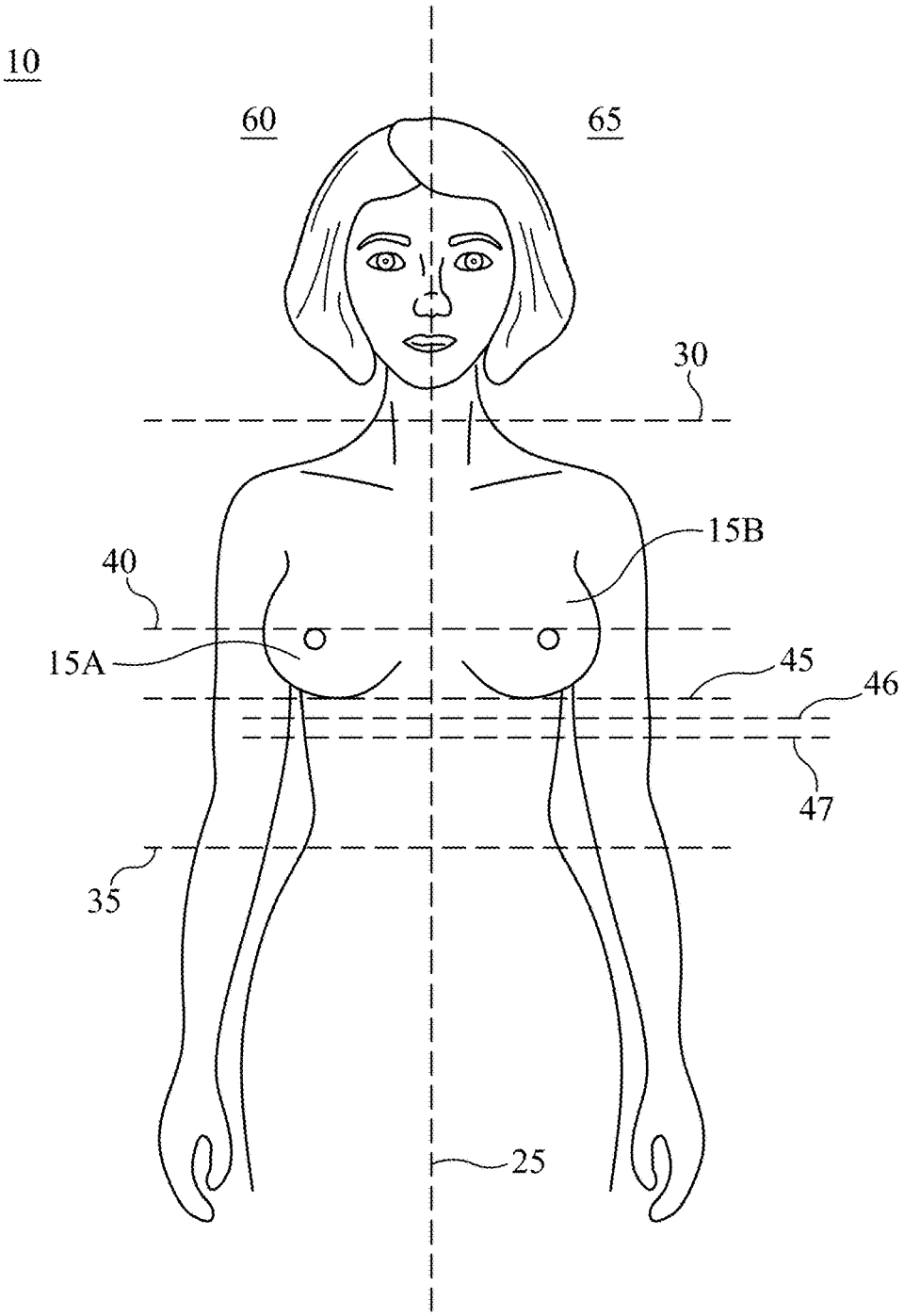
Figure 13E:
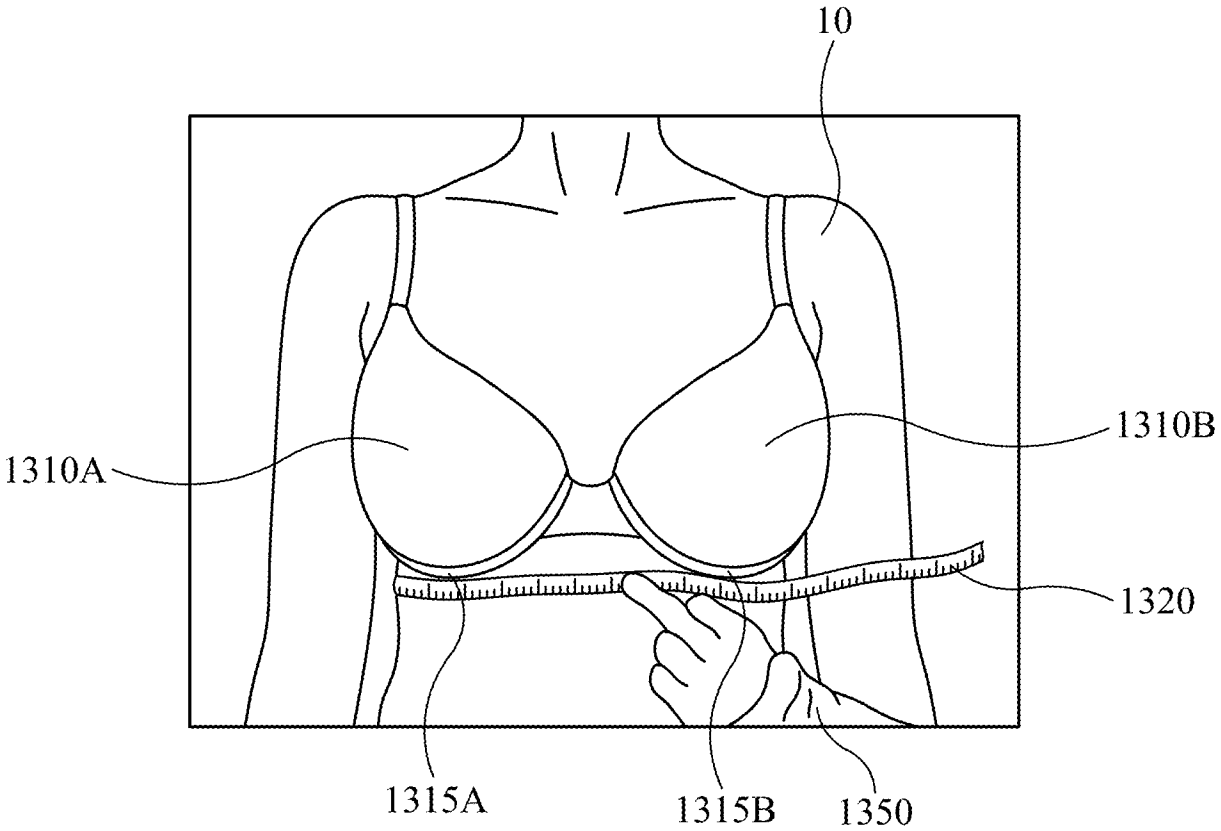

A third measurement of the wearer may correspond to a circumference of the wearer's torso at, or near her inframammary fold (see e.g., horizontal reference line 45 as discussed below with regard to FIGS. 12A-120), as shown in FIG. 13E, which provides an illustration of user 1350 measuring the circumference of wearer 10 under at her inframammary fold/under her bra's underwire 1315 with measuring tape 1320.

Although the measurements described above are taken by manually measuring the dimensions of a wearer, a person of skill in the art will recognize that other measurement methods, or schemes, are covered by the methods disclosed herein. For example, a first, second, and/or third (or more) measurement(s) may be taken, augmented, and/or confirmed by analyzing a 3D scan of the wearer's torso and/or breasts, a photograph of the wearer's torso or breasts, and/or 3D photograph of the wearer's torso and/or breasts.

Further details relating these measurements, how they may be taken, and how they may be used are discussed in greater detail below with regard to processes 300, 400, and 500, as depicted in FIGS. 3, 4, 5A, and 5B, respectively.

Whether measurements of the wearer's anatomy are available, or not, in step 230 provision of a prompt to provide an indication of the wearer's breast shape and/or breast density may be facilitated. In some instances, the prompt provided in step 230 may include providing an image of various options for breast shape and/or breast tissue density along with a mechanism by which the wearer may select her breast shape and/or breast tissue density. In other instances, the prompt provided in step 230 may include providing a number of options (e.g., high-density breast tissue, low-density breast tissue) from which to choose from. Then, in step 232, an indication of the wearer's breast shape and/or breast tissue density may be received.

In step 234, provision of a prompt to provide one or more indications of how the wearer's bra (e.g., favorite bra sized according to the first sizing convention) fits may be facilitated. In some embodiments, execution of step 234 includes facilitating provision of multiple prompts. As with step 204, the prompt(s) of step 234 may include a prompt for regarding how the wearer's favorite/most comfortable bra fits and, in some instances, may include a reference to the prompt provided in step 204 so that the bra size according to the first sizing convention received in step 206 corresponds with the indications received responsibly to the prompt(s) of step 234. The prompt(s) of step 234 may request indications regarding, for example, how the bra straps of the wearer's favorite bra are adjusted (e.g., "are your bra straps adjusted all the way out?"), how the bra cups fit/cover the wearer's breast volume (e.g., "does your breast tissue expand outside of your bra cup?" and/or "are your bra cups loose?"), is your bra painful (e.g., "do your bra straps or underwire cause you pain?"), and/or how does your underwire fit (e.g., "does your underwire press against your torso?"). In step 236 one or more indications of how the wearer's bra fits may be received.

In step 238, provision of a prompt to provide an indication of a distance between the wearer's breasts (i.e., inter-breast distance) may be facilitated. In some instances, the prompt provided in step 238 may include providing an image of various options for inter-breast distance along with a mechanism by which the wearer may select her inter-breast distance. In other instances, the prompt provided in step 238 may include providing a question (e.g., "can you fit two fingers between your breasts when wearing a bra?"). Then, in step 240, an indication of the wearer's inter-breast distance may be received.

Proceeding now with the portion of the flowchart depicting process 200 depicted in FIG. 2C, in step 242, provision of a prompt to provide an indication of one or more life events (typically life events effecting breast size) affecting the wearer may be facilitated. In some instances, the prompt provided in step 242 may include providing an open-ended question (e.g., "any big life events lately?") by which a wearer may manually enter a response and/or a list of life events (e.g., engagement, pregnancy, weight gain, weight loss, breast feeding, mastectomy, breast augmentation, etc.) from which the wearer may select one or more life events. Then, in step 244, an indication of one or more life events may be received.

In step 246, provision of a prompt to provide an indication of the wearer's skin tone and/or a color or pattern preference may be facilitated. In some instances, the prompt provided in step 230 may include providing an image of various options for skin tone, colors, and/or patterns along with a selection mechanism. In other instances, the prompt provided in step 230 may include a question regarding the wearer's race and/or ethnicity that may be later used in, for example, steps 250, 252, and/or 254 to approximate and/or determine skin tone. Then, in step 248, an indication of the wearer's skin tone and/or a color or pattern preference may be received.

Throughout process 200, one or more of the indications (e.g., the indications received in steps 210, 214, 218, 224, 232, 236, 240, 244, and/or 248) may be indirectly received and/or not received in response to a prompt. For example, if a wearer provides a photograph and/or scan of herself, then some of the prompted-for indications may be deduced therefrom without the need for prompting the wearer to provide the information directly. Exemplary indications that may be deduced from, for example, a photograph, a 3D image, and/or a 180° or 360° scan of the wearer's body include, but are not limited to, anatomical measurements, breast shape, skin tone determinations, and inter-breast distance. Additionally, or alternatively, some of the indications may already be known (as may occur if the wearer and/or the user previously provided them as may occur when the wearer has previously purchased a bra from and/or has an account with the user and/or the wearer has an account that is associated with the prompted for information with an entity that executes some, or all, of process 200 (e.g., a retailer or wholesaler of bras)).

In step 250, data regarding a second sizing convention and parameters thereof may be accessed. In some embodiments, the data accessed in step 250 is stored in second sizing convention database 135 and is accessed by wearer/user device 115 and/or sizing computer system 140. The received indications may then be analyzed along with the accessed data regarding the second sizing convention (step 252) to determine a size of the wearer according to the second sizing convention (step 254). In some embodiments, the analysis of step 252 may include accessing first sizing convention and bra brand/manufacturer database 125 so as to, for example, determine one or more dimensions, features, or other aspects of the bra brand/manufacture received in step 210.

Often times, the analysis and determination of steps 252 and 254, respectively, may include matching indications received via process 200 with parameters of a second sizing convention and, in some instances, not all information received via process 200 may be used as may be necessary when, for example, a response to a prompt is not received and/or two or more prompts are inconsistent with one another.

The analysis and/or determination of steps 252 and/or 254 may include resolving inconsistent information within the received indications. For example, in an instance where a wearer indicates that her bra size is a 34C but her third measurement indicates she has a torso circumference of 37 inches the analysis may include resolving this information to determine what the wearer's second sizing convention size should be. Once determined, the size of the wearer according to the second sizing convention may be provided to the wearer and/or user (step 256).

In some instances, execution of steps 252 and 254 may include determining one or more sub-sizes included in the one or more of the sizes of the second sizing convention. In some instances, a sub-size may indicate a particular aspect (e.g., color, cup coverage, inframammary fold shape, etc.) of a size within the second sizing convention. For example, a sub-size may be a central, or base, size within the second sizing convention that is determined using one or more measurement indications as may be received in step 288 and then, for example, adjusting that base size and/or sub-size (e.g., up or down) according to one or more other indications received via process 200. For example, if a base sub-size within the second sizing system is determined to be a 7, the indications received in, for example, steps 210, 214, 218, 224, 232, 236, 240, 244, and/or 248 may be used to adjust the base sub-size to a 6 or 8, depending on the content of the indications.

In another example, the second sizing convention may associate a plurality of parameters with each second sizing convention size. For example, a second sizing convention size may have 2, 3, 4, 5, or 6 different parameters. In these embodiments, a base size within the second sizing system may be determined using the measurement values received in step 228 and the indications received in, for example, steps 210, 214, 218, 224, 232, 236, 240, 244, and/or 248 may be used to determine values for additional parameters. In some instances, one or more of the sub-sizes and/or parameters may be combined in to a single, or small amount, of numbers using a coding or other technique so as to make it easier for the wearer to remember. In this way, a size within the second sizing convention may incorporate many different sub-sizes.

Additionally, or alternatively, a size for a wearer within the second sizing convention may incorporate a parameter value corresponding to each of the measurement values received in step 228 and, in some instances, may also incorporate one or more of the indications received in steps 210, 214, 218, 224, 232, 236, 240, 244, and/or 248. In these instances, the second sizing convention size may include a plurality of different values, or sub-sizes, each corresponding to a different aspect of the bra.

Additionally, or alternatively, execution of steps 252 and 254 may include incorporating a combination of objective and subjective measurements/indications and, in other embodiments, only objective or subjective measurements may be used to determine a wearer's size according to the second sizing convention. For example, the subjective indications regarding cup coverage preference may be incorporated into the wearer's second sizing convention size. This is different from selecting a "style" of bra that may offer the preferred cup coverage because a "style" is not consistent across different types/brands of bras or different "styles" even when those types or styles are made by the same manufacturer. Therefore, a wearer would not be able to associate this subjective preference with her size according to the traditionally used first bra sizing convention (because it does not provide for/incorporate such preferences, indications, or subjective judgements) and instead would have to experiment with different bras that are sized according to her first sizing convention size to find a bra that matches her cup coverage preference. Typically, a wearer would have to go this process for every individual bra they wear/purchase because the dimensions of bras and other garments made using the first sizing convention are not consistent across bras, bra brands, bra manufacturers, or bra styles. This lack of consistency is caused by many factors including the use of different dimensions and materials to manufacture bras of the same size using the first sizing convention across different brands, styles, and sometimes within the same brand and style. In some instances, dimensions of bras sized according to the first sizing convention vary from bra to bra even when those bras are of the same style and size and are made by the same manufacturer. Thus, even if a wearer finds a bra brand, style, and size (according to the first sizing convention) that fits her, it is quite possible that another bra of the same bra brand, style, and size will not because, for example, different dimensions or materials may have been used to manufacture these two bras of the same brand, style, and size. This leads to confusion, frustration, discomfort, and the wasting of time for the wearer.

With the second sizing convention, this experimentation is no longer necessary because the dimensions and other aspects of the wearer's size (e.g., elasticity, cup coverage, fabric, etc.) are incorporated into the second sizing convention size. Therefore, the wearer may select from multiple styles of bra provided in her second sizing convention size and receive a bra that provides her desired cup coverage as well as the other aspects/features/preferences incorporated into her second sizing convention size automatically, without the need to experiment with (e.g., try on) every individual bra she purchases/wears.

Additionally, or alternatively, execution of steps 252 and 254 may include matching the parameters associated with the wearer with parameters of a frame 1400, support structure(s) 1800, 2100, 2200, 2300, 2400, 2500, 2600, 3200, and/or 3300, casing(s) 2700 and/or 2800, and/or housing 3400 as will be discussed below. For example, the measurement values received in step 228 may be used to select a frame support structure, casing, and/or housing and/or an aspect thereof, (e.g., thickness, flexibility, shape, weight, silhouette, etc.), from a plurality of available frames, support structures, casings, and/or housings that most closely matches the measurements and the indications received in steps 210, 214, 218, 224, 232, 236, 240, 244, and/or 248 may be used to determine various aspects of a casing and/or housing for the bra size according to the second sizing convention.

Additionally, or alternatively, in some instances, as may be the case for multi-parameter second sizing convention sizes, a format for the second sizing convention sizes may be simplified by use of, for example, a single code (e.g., number or letter), or a short series of numbers of letters, whose size and/or placement within the second sizing convention size indicates values for multiple parameters prior to provision to the wearer.

While the steps of process 200 are laid out sequentially, in some instances, these steps may be performed in an order different from the one laid out in FIGS. 2A-2C. For example, step 254 may be executed without prior execution of, for example, steps 210/212,218/220, 242/244, 246/248. Additionally, or alternatively, not all of steps 208-248 may be performed in order to determine, in step 254, a size for the wearer using the second sizing convention.

FIGS. 3, 4, 5A, and 5B provide flowcharts depicting additional and/or alternative processes 300, 400, and 500, respectively, for determining a garment size according to the second sizing convention for a wearer. Process(es) 300, 400, and/or 500 (or a portion thereof) may be executed in addition to, or in lieu of, process 200 as described above with regard to FIGS. 2A-2C. As with process 200, the wearer of process(es) 300, 400, and/or 500 may be a male but, in most instances will be female and, on some occasions, may be referred to herein as an individual. An exemplary wearer 10, is depicted and discussed below with regard to FIGS. 12A-12C. In some cases, the wearer for process(es) 200, 300, 400, and/or 500 may be the same or different from one another. For the purposes of the discussion of processes 300, 400 and 500, the garment is a bra although a person of skill in the art will readily recognize that process(es) 200, 300, 400, and/or 500 may be used to determine a wearer's size for a variety of garments including, but not limited to, sports bras, compression bras, bralettes, corsets, bustiers, camisoles, swimsuits, sports tops, shirts, dresses, and the like.

Processes 200, 300, 400, and/or 500 are executed by a computer or processor and some, or all, of process(es) 200, 300, 400, and/or 500 may be executed by a system, such as system 100, or a component thereof such as sizing computer system 140, one or more measurement devices 110A-110N, and/or wearer/user device 115. In some instances, some or all, of the information received during process(es) 200, 300, 400, and/or 500 is received from the wearer herself while, in other instances, another individual, referred to herein as a "user" may assist with, for example, providing requested information (e.g., the taking of measurements) and provision of the measurements to system 100, sizing computer system 140, and/or wearer/user device 115.

Figure 3:
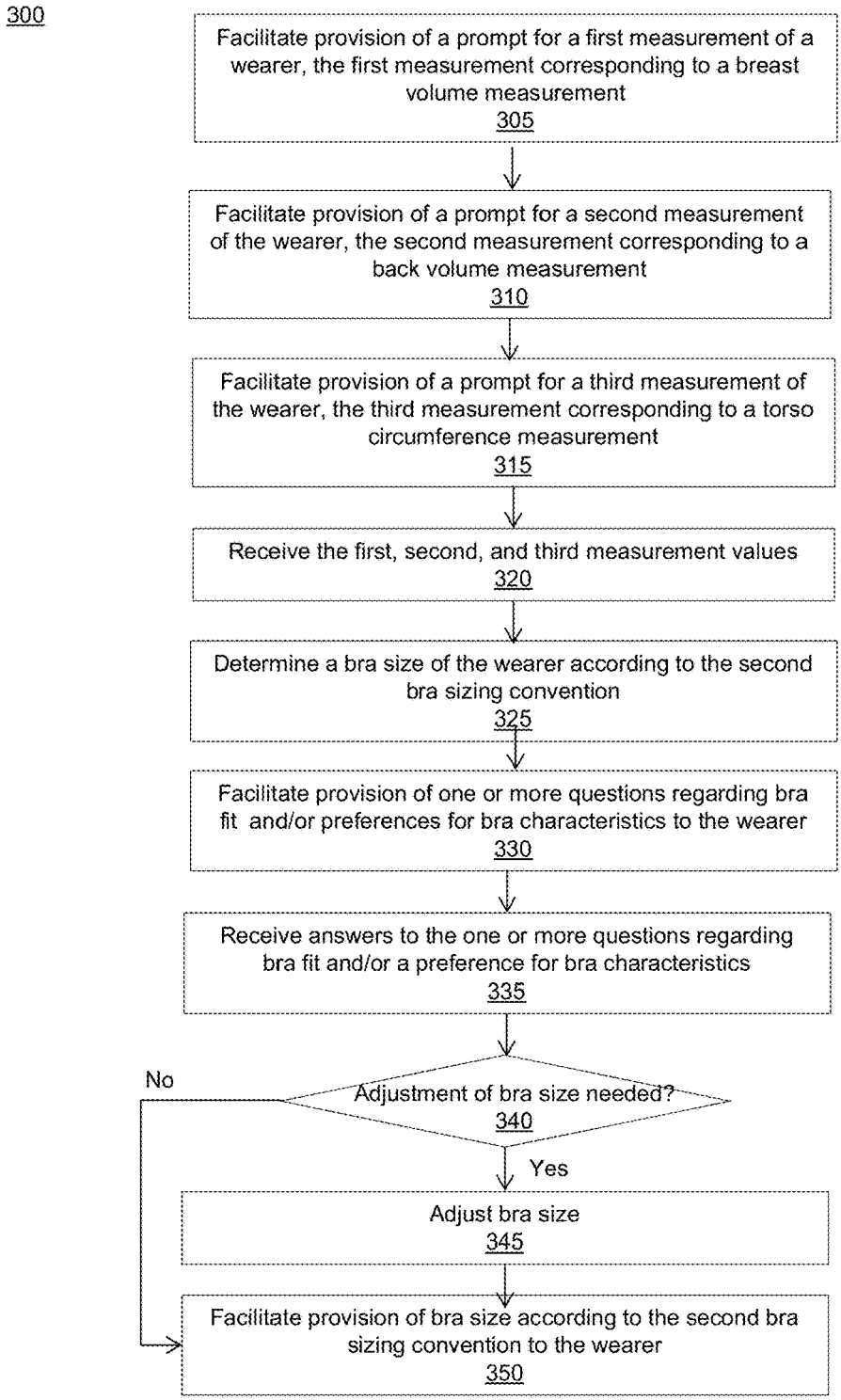

More specifically, FIG. 3 illustrates process 300 for determining and/or adjusting a bra size according to the second sizing convention for a wearer. Initially, a prompting for a first measurement of a wearer may be facilitated (step 305). In some instances, the wearer and the user may be the same person as may be the case when, for example, a wearer intends to measure herself and/or respond to prompts. Exemplary users include, but are not limited to, bra fitting specialists, sales associates, and friends or family of the wearer. The first measurement of step 305 may correspond to a breast volume measurement as discussed above with regard to steps 226 and 228 of process 200 and below with regard to FIGS. 13A and 13B.

Next, a prompting to provide a second measurement of the wearer may be facilitated (step 310). The second measurement may correspond to a back volume measurement as discussed above with regard to steps 226 and 228 of process 200 and below with regard to FIGS. 13C and 13D. Then, provision of a prompt to provide a third measurement of the wearer may be facilitated (step 315). The third measurement may correspond to a circumference of the wearer's torso at, or near her inframammary fold as discussed above with regard to steps 226 and 228 of process 200 and below with regard to FIG. 13E.

Next, the first, second, and third measurements may be received (step 320) and used to determine a bra size according to the second sizing convention for the wearer (step 325). Execution of step 325 may be similar to and/or incorporate steps 250, 252, and/or 254 of process 200 as described above.

Optionally, in step 330, provision of one or more questions regarding how a wearer's bra (or her favorite or most comfortable bra) fits and/or a preference for a bra characteristic to the user and/or wearer may be facilitated. If step 330 is not performed, then process 300 may proceed to step 350. When step 330 is performed, then process 300 may proceed to step 335 and an answer to one or more of the questions and/or a bra characteristic preference may be received. Next, in step 340, it may be determined whether an adjustment to the bra size according to the second sizing convention determined in step 325 may be needed and/or advantageous. If so, the bra size according to the second sizing convention may be adjusted (step 345) and provision of the determined and/or adjusted bra size according to the second sizing convention to the wearer and/or user may be facilitated (step 350). If the answer to the determination of step 340 is no, then process 300 may proceed directly to step 350.

Figure 4:
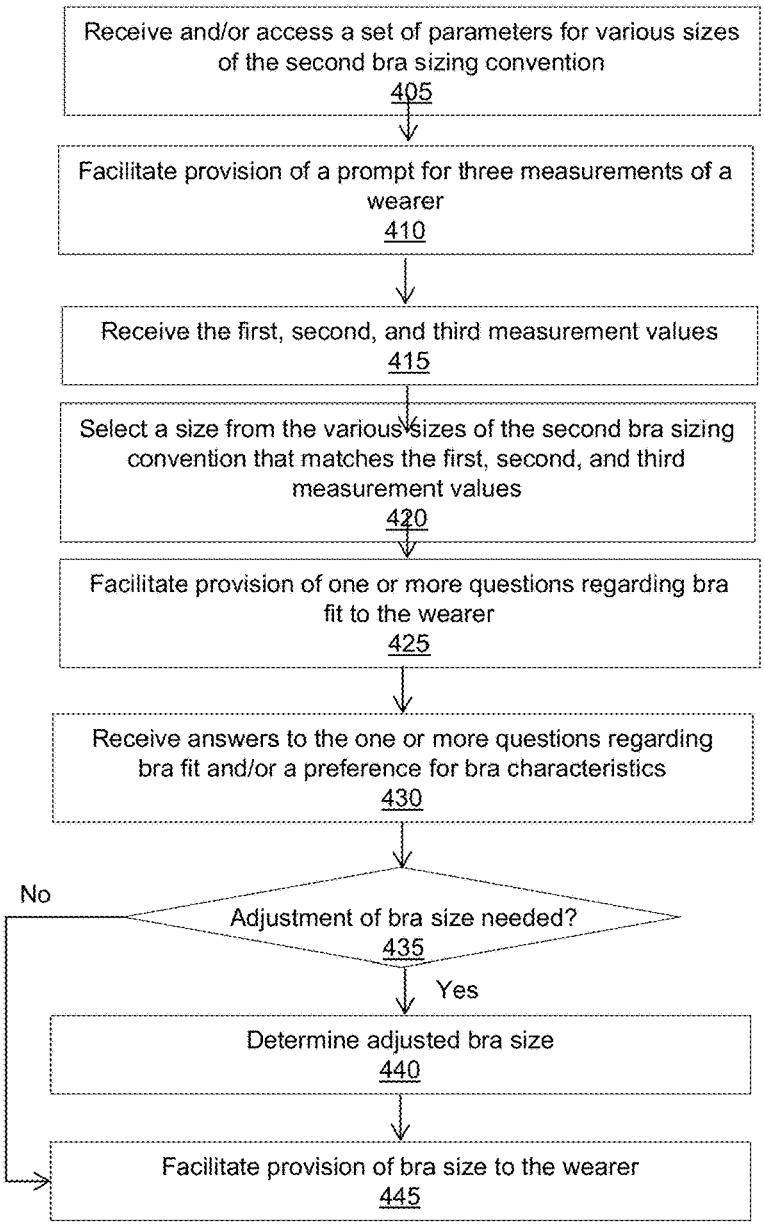

FIG. 4 provides a flowchart depicting another exemplary process 400 for determining a wearer's bra size according to the second sizing convention. In step 405, a set of parameters for various sizes of the second bra sizing convention may be received and/or accessed. In step 410, a prompt for three measurements of a wearer may be facilitated. In some instances, execution of step 410 may resemble an execution of steps 305, 310, and 315 of process 300 as described above with regard to FIG. 3. Next, in step 415, the first, second, and the third measurement values may be received and a size of various sizes of the second bra sizing convention that is most appropriate for, and/or matches the three received measurement values of the wearer, may be selected using the received and/or accessed set of parameters for the various sizes of the second bra sizing convention (step 420). Execution of step 420 may be similar to and/or incorporate steps 250, 252, and/or 254 of process 200 as described above. In some instances, performance of step 420 may include, for example, weighting one or more of the three measurement values more heavily when compared to other received measurements so as to, for example, fit a wearer preference and/or establish a priority between the three measurement values when selecting the bra size according to the second sizing convention for the wearer. For example, in some instances, the first measurement value may be more important to determining the wearer's bra size according to the second sizing convention then the third measurement value. In this instance, the first measurement value may be weighted higher when determining the wearer's bra size according to the second sizing convention when compared with the third measurement value.

Optionally, in step 425, provision of one or more questions regarding how a wearer's bra (as sized according to the first sizing convention) usually fits and/or a preference for a bra characteristic to the user and/or wearer may be facilitated. When step 425 is not executed, process 400 may proceed to step 445. When step 425 is executed, process 400 may proceed to step 430 and an answer(s) to one or more of the questions may be received. Next, in step 435, it may be determined whether an adjustment to the base bra size selected in step 420 may be needed and/or advantageous responsively to the content of the received answers and, if so, the selected bra size of step 420 may be adjusted and/or an adjusted bra size according to the second sizing convention may be determined. (step 440) by, for example, selecting another bra size according to the second sizing convention for the wearer, and provision of the determined and/or adjusted bra size to the wearer and/or user may be facilitated (step 445). In some embodiments, execution of step 420 and/or 440 may be similar to and/or incorporate steps 250, 252, and/or 254 of process 200 as described above. If the answer to the determination of stepped 435 is no, then process 400 may proceed directly to step 445.

Figure 5A:
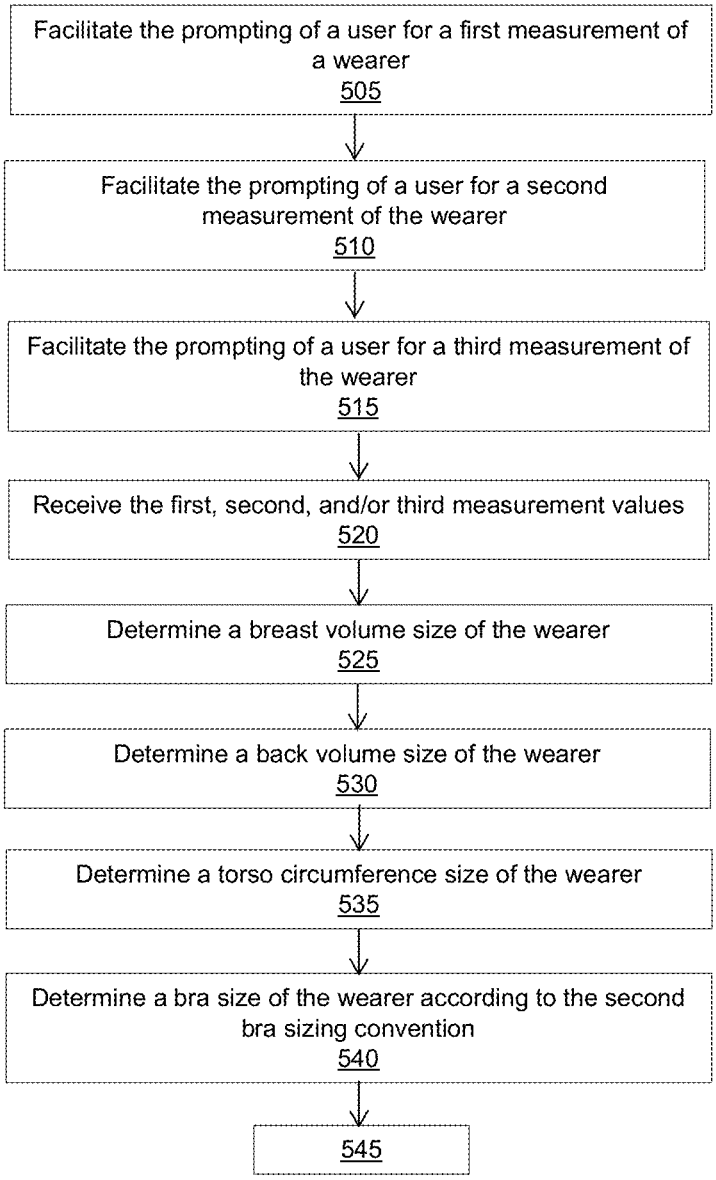
Figure 5B:
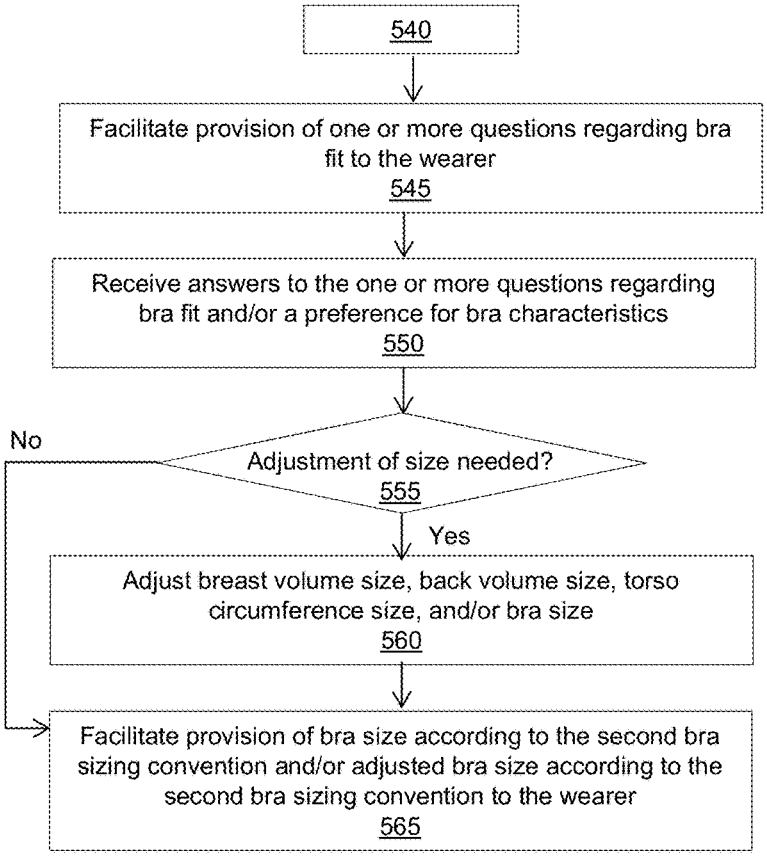

FIGS. 5A and 5B provide flowcharts depicting an exemplary process 500 that has been divided over two pages or sheets to accommodate all the steps of the process. In step 505, provision of a prompt to provide a first measurement of a wearer may be facilitated (step 505). Next, a provision of a prompt to provide a second measurement of the wearer may be facilitated (step 510). Then, provision of a prompt to provide a third measurement of the wearer may be facilitated (step 515). Next, the first, second, and/or third measurements may be received (step 520). The first, second, and third measurements of step 505, 510, 515, and 520 may correspond to a breast volume measurement, a back volume measurement, and a torso circumference measurement, respectively, and may be similar to the measurements described above with regard to steps 226 and 228 of process 200, steps 305, 310, 315, and/or 320 of process 300, and/or steps 410 and 415 of process 400.

In step 525, a breast volume size of the wearer may be determined using, for example, the first received measurement value and/or a combination of the first, second, and/or third measurement values. In step 530, a back volume size of the wearer may be determined using, for example, the second received measurement value and/or a combination of the first, second, and/or third measurement values. In step 535, a torso circumference size of the wearer may be determined using, for example, the third received measurement value and/or a combination of the first, second, and/or third measurement values. Then, a bra size of the wearer according to the second sizing convention may be determined (step 540). The determination of step 540 may be based on, for example, the determinations of steps 525, 530, and/or 535. In some embodiments, execution of step 540 may be similar to and/or include execution of steps 250, 252, and/or 254 of process 200; execution of steps 325, 340, and/or 345 of process 300; and/or execution of steps 405, 420, 435, and/or 440 of process 400 as discussed above with regard to FIGS. 2, 3, and 4, respectively.

Proceeding now with the portion of process 500 that is depicted on in FIG. 5B, optionally, in step 545, provision of one or more questions regarding how a wearer's bras usually fit, how a wearer's favorite bra fits, and/or a preference for a bra characteristic to the user and/or wearer may be facilitated. When step 545 is performed, then process 500 may proceed to step 550 and an answer to one or more of the questions and/or a bra characteristic preference may be received. Next, in step 555, it may be determined whether an adjustment to the breast volume size, back volume size, torso circumference size, and/or bra size according to the second bra sizing convention determined in step(s) 525, 530, 535, and/or 540, respectively, may be needed and/or advantageous. If so, the respective breast volume size, back volume size, torso circumference size and/or bra size may be adjusted (step 560) accordingly and provision of the determined and/or adjusted breast volume size, back volume size, torso circumference size and/or bra size to the wearer and/or user may be facilitated (step 565). If the answer to the determination of stepped 555 is no, then process 500 may proceed directly to step 550. Additionally, when step 545 is not performed, process may proceed from step 540 to step 565

In some instances, information received via processes 200, 300, 400, and/or 500 and/or determinations or adjustments made via execution thereof may be used to, for example, determine or adjust, for example, sizing dimensions for bras, or components thereof (e.g., a frame, support structure, casing, or housing) to be manufactured and/or the development or improvement of a sizing system.

Provision of the size according to the second sizing convention as performed in steps 256, 350, 445, and/or 565 may include translating the determined sizing information into a personalized size which, in some instances, may be personalized to an individual using, for example, the wearer's name or user name. Additionally, or alternatively, in some instances, as may be the case for multi-parameter second sizing convention sizes, a format for the second sizing convention sizes may be simplified by use of, for example, a single code (e.g., number or letter), or a short series (e.g., 2, 3, or 4 parameters) of numbers of letters, whose size and/or placement within the second sizing convention size indicates values for multiple parameters prior to provision to the wearer. In some cases, the second sizing convention sizes and/or an aspect thereof may be represented by an image or color.

Figure 6:
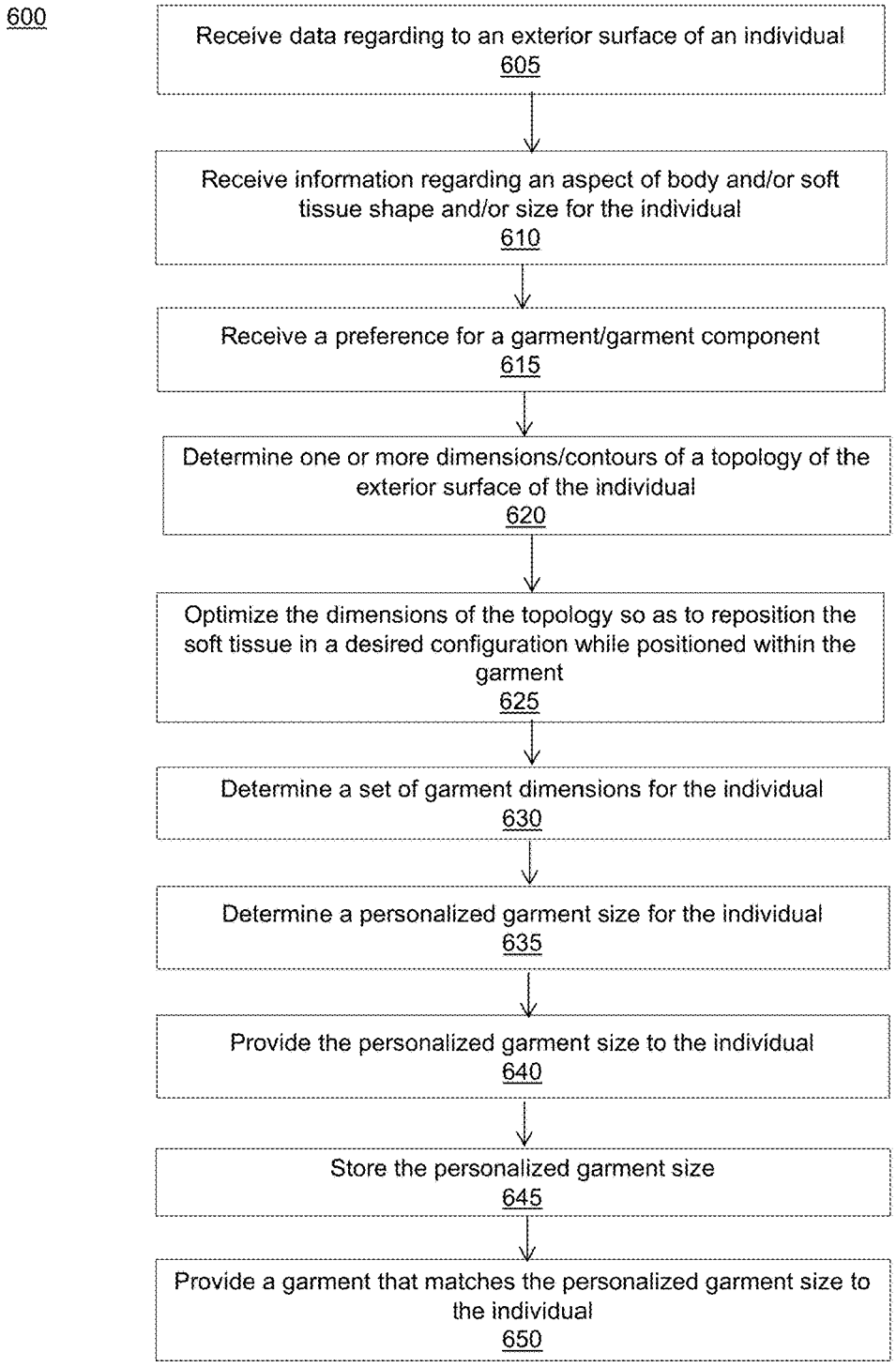

FIG. 6 is a flow chart illustrating an exemplary process 600 for determining a personalized garment size and/or second sizing convention size for an individual and providing the individual with a garment that complies with the personalized size. As described herein in some embodiments, the personalized garment size and/or second sizing convention size may be a bra size according to the second bra sizing convention. Process 600 may be executed by, for example, a system like system 100 and/or a component thereof.

For ease of discussion, process 600 will be discussed within the context of measurements and/or topological parameters for the breasts of an individual and for regions of the individual's body proximate to the individual's chest and/or torso. However, it will be understood by those of skill in the art that process 600 may be used to provide a personalized size and/or a garment designed to fit a portion of the body that does not include breasts as may be the case with, for example, stomach compression garments, hip compression garments, back braces, leg compression garments, pants, etc.

Initially, data regarding of an exterior surface of an individual may be received (step 605). Exemplary data received in step 605 includes age, a physical measurement (as measured in e.g., in inches or kilograms), a photograph, an anatomical parameter, and/or a topological parameter corresponding to, or otherwise indicating a dimension, a contour, or other feature of the exterior surface of the individual. The data may be received from, for example, one or more measurement/sizing devices 110A-110N and/or wearer/user device 115 by, for example, sizing computer system 140 via communication network 120 and/or wearer/user device 115 alone. Additionally, or alternatively, the data may be received from a third party such as a doctor or other healthcare provider. For example, if a woman has had breast augmentation surgery, the dimensions of the breast implants and/or breast contours following the surgery may be received from, for example, the individual's plastic surgeon in step 605.

In some instances, the data received in step 605 may correspond to a portion of the body of the individual where soft tissue (i.e., breast tissue, fat, muscle) is located/positioned. For example, the received measurements/parameters may correspond to the individual's breasts, abdomen, buttocks, hips, sides, and/or back. In some embodiments, the data received in step 605 may correspond to an individual's body while the individual is wearing clothing. For example, the data may correspond to the topology of the individual while wearing a bra or other garment that supports breast or other soft tissue in a desired fashion. In other embodiments, the data received in step 605 may correspond to an individual's body while not wearing clothing.

Optionally, information regarding the individual may be received in step 610. Exemplary information received in step 610 includes, but is not limited to, the individual's height, shoulder width, age, gender, race, ethnicity, prior breast-related surgeries, weight, breast shape, breast volume, body mass index (BMI), placement of the breasts on the torso of the individual, a distance between the breasts, and density of soft tissue.

In some embodiments, the data received in step 610 may relate to an amount of fat or other soft tissue positioned around the torso of the individual in addition to data relating to the breasts of the individual. This data may be used to determine, for example, compression tolerances for the garment when it is worn by the individual. For example, if an individual has a relative large amount of fat or other soft tissue positioned around her torso as may be the case when, for example, the individual is obese, then compression of the garment into the body of the individual may have the effect of pushing soft tissue that is adjacent to the compression point(s) into an undesired position. Stated differently, compressing the tissue of, for example, the breasts or back with too great of a force may create undesirable bulges of fat and other soft tissue above or below the line where the garment is pushing into the body of the individual. Therefore, an aspect of the individual's body received in step 610 and/or a preference for a garment and/or garment component (received in step 615) may be a relatively low compression tolerance for the garment so that the garment will, for example, lie adjacent to the exterior surface of the individual when worn and not press into the individual causing undesired bulges of soft tissue and/or increase a footprint of the garment so that pressure is dispersed over a greater surface area.

Optionally, in step 615, one or more preferences for the garment and/or a component of the garment of the individual may be received. Exemplary individual preferences include desired fit (e.g., snug or loose), a desired placement for the garment on the torso, a desired distance between the cups of the garment, a desired placement for the center clasp (if applicable) of the garment, a type of clasp for the garment, a type of back closure mechanism for the garment, a preferred fabric or other material or a restriction of same (as may be the case with an allergy or sensitivity to a certain fabric or material), and a desired silhouette to be produced by the garment.

Another individual preference may relate to a desired function the garment is to perform (e.g., reduce movement of soft tissue during activity, provide access when breast feeding, augment an appearance of the breast tissue, minimize an appearance of the breast tissue, support muscle or bone following an injury, compress tissue into a desired shape, and so on). A further individual preference may relate to an anatomical feature of the individual. Exemplary anatomical features include breasts of different sizes or the removal of some or all breast tissue from one or both breasts as may be the case with a lumpectomy or a mastectomy. Another individual preference may relate to a medical concern including, for example, hormonal fluctuations, recent surgery, or pregnancy.

In some embodiments, a received individual preference may relate to a shape of the garment, a desired look of the garment, materials used to manufacture the garment, a method of manufacture, or a country of origin for the garment. In other embodiments, an individual preference may relate to a preferred degree of containment of soft tissue. In yet another embodiment, an individual preference may relate to a degree of rigidity of the garment and/or a component of the garment. Optionally, step 615 may also include providing an individual with an image of what the garment will look like when worn by the individual and feedback and/or an individual preference regarding the image may be received.

Next, in step 620, one or more dimensions and/or contours of a topological feature of the exterior surface of the individual may be determined. Exemplary features include body dimensions, volume, weight, density, a circumference of the torso or breast at various points, nipple placement, location of the soft tissue on the body or chest, and location of soft tissue below the chest. In some embodiments, step 620 may include any number of processes that analyze the data in order to, for example, resolve an exterior edge, surface feature, and/or contour of the individual and/or positions of soft tissue located on the individual. For example, when the data received in step 605 are images captured via one or more 3D cameras, the images may be transformed into a point cloud that is resolved to determine, for example, an exterior edge, surface feature, and/or contour of the individual and/or positions of soft tissue located on the individual. In another example, step 620 may include using 3D and/or 2D measurement data to construct of a 3D approximation, or other graphical representation, of the dimensions or topology of the individual.

In some embodiments, execution of steps 605, 610, 615, and/or 620 may resemble and/or incorporate execution of steps 228, 320, 335, 415, 430, 520, and/or 550.

Optionally, in step 625, the dimensions and/or topological parameters of the individual may be optimized to indicate, for example, a desired placement or orientation of soft tissue and/or breast tissue for the individual. In some cases, the optimization of step 625 may be user configurable and, in those cases, one or more optimization preferences or parameters may be received in step 620.

The optimization of step 625 may include, for example, a determination of how to reposition topological features (e.g., the soft tissue) into a desired shape, contour, or silhouette for the individual. For example, an individual with relatively small breasts may desire optimization so that the soft tissue of the breasts is lifted away from the torso in a forward facing direction and an individual with relatively large breasts may desire optimization so that a portion of the soft tissue of the breasts is positioned away from a center midline of the individual.

In some instances, the optimization of step 625 may be incorporated into execution of steps 252, 254, 325, 345, 420, 440, 540, and/or 560

Next, in step 630, a series of garment dimensions for the individual that match the topological features of step 620 and/or optimized topological features of step 625 may be determined using, for example, data and/or parameters regarding the second sizing convention as may be stored in second sizing convention database 135. The garment dimensions may be selected to provide adequate support for the soft tissue of the individual as well as a desired set of contours for the individual that the garment may provide for/induce when worn by the individual. In some instances, execution of step 630 may include determining how and where to position and shape, for example, frame, support structure, casing, and/or housing features like the features of frame 1400, support structure(s) 2800, 2100, 2200, 2300, 2400, 2500, 2600, 3200, and/or 3300, casing 2700, and/or housing 3400 to, for example, maintain the repositioning and/or support of the breast tissue.

Then, the determined set of garment dimensions may be used to determine a garment size personalized to the individual and/or a second sizing convention size for the individual, which may be referred to herein as a personalized garment size and/or second sizing convention size (step 635). The personalized garment size and/or second sizing convention size may be associated with a number of features and/or identifiers including, for example, a name of the individual, a pseudonym of the individual, a characteristic of the individual (e.g., weight, height, skin color, etc.), a series of numbers and/or letters corresponding to the individual, a time of year (e.g., month, season, etc.), a status of the individual (e.g., pre-surgery, post-surgery, pregnancy, etc.) and/or combinations of same.

In step 640, the personalized garment size and/or second sizing convention size may be provided to the individual via one or more mechanisms including, but not limited to, verbally, electronic mail, short-message-service (SMS) text message, and a written message. Execution of step 640 may resemble execution of steps 256, 350, 445, and/or 565. The personalized garment size and/or second sizing convention size may then be stored in, for example, data storage device 130 and/or on the individual's mechanism for receiving the personalized garment size and/or second sizing convention size (e.g., smart phone, smart watch, computer, etc.) (step 645). In some embodiments, the personalized garment size and/or second sizing convention size may be provided to an individual coincidentally with provision of a garment that matches the personalized garment size and/or second sizing convention size (step 650).

Figure 7:
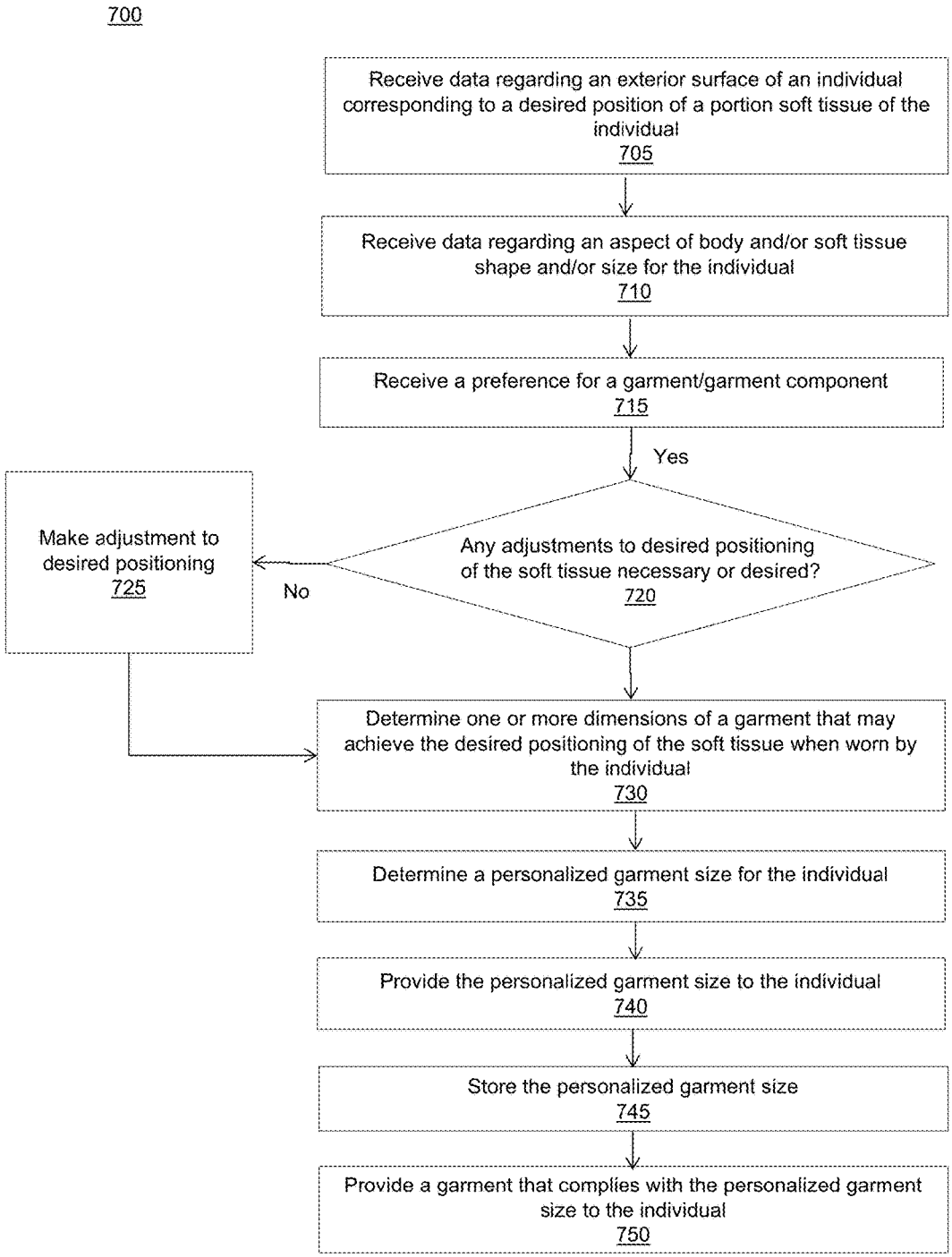

FIG. 7 is a flow chart illustrating an exemplary process 700 for determining a personalized garment size and/or second sizing convention size for an individual and providing the individual with a garment that complies with the updated personalized size/second sizing convention size. Process 700 may be executed by, for example, a system like system 100 and/or a component thereof.

For ease of discussion, process 700 will be discussed with relation to receiving data regarding an exterior surface of an individual's breasts and for regions of the individual's body proximate to the individual's chest and/or torso. However, it will be understood by those of skill in the art that process 700 may be used to provide a personalized garment size and/or second sizing convention size and/or garment to an individual designed to fit a portion of the body that does not include breasts as may be the case with, for example, stomach compression garments, hip compression garments, back braces, etc.

Initially, data regarding of an exterior surface of an individual corresponding to a desired position of a portion of soft tissue (i.e., breast tissue, fat, muscle) of the individual may be received (step 705). For example, the received measurements/parameters may correspond to the individual's breasts, abdomen, buttocks, hips, sides, and/or back. Exemplary data includes an individual's age, a physical measurement (as measured in e.g., in inches or kilograms), a photograph, an anatomical parameter, and/or a topological parameter corresponding to, or otherwise indicating a dimension, a contour, or other feature the individual. The data may be received from, for example, one or more measurement/sizing devices 110A-110N and/or wearer/user device 115 by, for example, wearer/user device 115 and/or sizing computer system 140 via communication network 120. Additionally, or alternatively, the data may be received from a third party such as a doctor or other healthcare provider. For example, if a woman has had breast augmentation surgery, the dimensions of the breast implants and/or breast contours following the surgery may be received from, for example, the individual's plastic surgeon in step 705.

In some embodiments, the data received in step 705 may correspond to an individual's body while wearing a garment that pushes, or holds, the soft tissue in a desired position or configuration. For example, the data may correspond to the topology of the exterior surface of the individual while wearing a bra or other garment that supports breast or other soft tissue in a desired fashion. In other embodiments, the data received in step 705 may correspond to aspirational/desired features of the individual's exterior surface topology.

In some instances, the individual may wear an adjustable garment that positions (via, for example, straps, laces, or other adjustable features) the soft tissue into a desired configuration so that measurements and other data (e.g., 2D or 3D photographs) regarding the desired position of the soft tissue may be taken.

Optionally, information regarding an aspect of the individual's body and/or soft tissue shape and/or size may be received in step 710. Exemplary information received in step 710 includes, but is not limited to, the individual's height, shoulder width, weight, breast shape, placement of the breasts on the torso of the individual, BMI, breast volume, a distance between the breasts, and density of soft tissue.

In some embodiments, the data received in step 710 may relate to an amount of fat or other soft tissue positioned around the torso of the individual in addition to data relating to the breasts of the individual. This data may be used to determine, for example, compression tolerances for the garment when worn by the individual. For example, if an individual has a relatively large amount of fat or other soft tissue positioned around her torso as may be the case when, for example, the individual is obese, then compression of the garment into the body of the individual may have the effect of pushing soft tissue that is adjacent to the compression point into an undesired position. Stated differently, compressing the tissue of, for example, the breasts or back with too great of a force may create undesirable bulges of fat and other soft tissue above and/or below the line where the garment is pushing into the body of the individual. Therefore, an aspect of the individual's body received in step 710 and/or a preference for a garment and/or garment component (received in step 715) may be a relatively low compression tolerance for the garment so that the garment will, for example, lie adjacent to the exterior surface of the individual when worn and not press into the individual causing undesired bulges of soft tissue.

Optionally, in step 715, one or more preferences of the individual may be received. Exemplary individual preferences include desired fit (e.g., snug or loose), desired compression force for one or more garment components, a desired placement for the garment on the torso, a desired distance between the cups of the garment, a desired placement for the center clasp (if applicable) of the garment, a type of clasp for the garment, a type of back closure mechanism for the garment, a preferred fabric or other material or a restriction of same (as may be the case with an allergy or sensitivity to a certain fabric or material), and a desired silhouette.

Another individual preference may relate to a desired function the garment may perform (e.g., reduce movement of soft tissue during activity, provide access when breast feeding, augment an appearance of the breast tissue, minimize an appearance of the breast tissue). A further individual preference may relate to an anatomical feature of the individual. Exemplary anatomical features include breasts of different sizes or the removal of some or all breast tissue from one or both breasts as may be the case with a lumpectomy or a mastectomy. Another individual preference may relate to a medical concern including, for example, hormonal fluctuations, recent surgery, or pregnancy.

In some embodiments, a received individual preference may relate to materials used to manufacture the garment, a method of manufacture, or a country of origin for the garment. In other embodiments, an individual preference may relate to a preferred degree of containment of soft tissue. In yet another embodiment, an individual preference may relate to a degree of rigidity of the garment and/or a component of the garment.

Optionally, step 715 may also include providing the individual with an image of what the garment may look like when worn by the individual and feedback and/or an individual preference regarding the image may be received.

Next, in step 720, the data and/or preference(s) received in steps 705-715 may be analyzed so as to determine whether any adjustments to the desired positioning of the soft tissue are necessary and/or desired. The analysis of step 720 may include, for example, resolution of a point cloud into a topology of an exterior surface of the individual, location of certain features of the individual's exterior surface (e.g., breast apex, position of inframammary fold, etc.) and/or resolution of an exterior edge, surface feature, and/or contour of the individual and/or positions of soft tissue located on the individual. In some instances, performance of step 720 may include normalization of the data, removal of erroneous data points, and/or removal of some data that may not be relevant to process 700. Data that may not be relevant to process 700 includes, but is not limited to, data regarding a garment the individual may be wearing when the data received in step 705 is originally captured.

When adjustments to the desired position of the soft tissue are needed or desired, these adjustments may be made in step 725. Exemplary adjustments include optimization of the dimensions and/or topological parameters of the individual so as to indicate, for example, a desired placement or orientation of soft tissue and/or breast tissue for the individual. In some cases, the adjustments of step 725 may be user configurable and, in those cases, one or more adjustment/optimization preferences or parameters may be received in step 715.

The adjustments of step 725 may include, for example, a determination of how to reposition topological features (e.g., the soft tissue) into a desired shape, contour, or silhouette for the individual. For example, an individual with relatively small breasts may desire the soft tissue of the breasts is lifted away from the torso in a forward facing direction and an individual with relatively large breasts may desire optimization so that a portion of the soft tissue of the breasts is positioned away from a center midline of the individual.

In some embodiments, an adjustment may be made in step 725 so as to accommodate an article of clothing the individual would like to wear (e.g., a dress with a low-cut neckline).

When no adjustments are necessary, a series of garment dimensions that may achieve the desired positioning of the soft tissue when the garment is worn by the individual may be determined (step 730). IN some embodiments, the determination of step 730 may include determining the wearer's second sizing convention size and may include, for example, execution of steps 250, 252, and/or 254. The garment dimensions may be determined so as to provide adequate support for the soft tissue of the individual as well as a desired set of contours for the individual that the garment may provide for/induce when worn by the individual.

Then, the determined set of garment dimensions may be used to determine a garment size personalized to the individual and/or a second sizing convention size, which may be referred to herein as a personalized garment size and/or second sizing convention size (step 735). The personalized garment size and/or second sizing convention size may be associated with a number of features and/or identifiers including, for example, a name of the individual, a pseudonym of the individual, a characteristic of the individual (e.g., weight, height, skin color, etc.), a series of numbers corresponding to the individual, a time of year (e.g., month, season, etc.), a status of the individual (e.g., pre-surgery, post-surgery, pregnancy, etc.) and/or combinations of same.

In step 740, the personalized garment size and/or second sizing convention size may be provided to the individual via one or more mechanisms including, but not limited to, verbally, electronic mail, short-message-service (SMS) text message, and a written message. The personalized garment size and/or second sizing convention size may then be stored in, for example, data storage device 130 and/or on the individual's mechanism for receiving the personalized garment size and/or second sizing convention size (e.g., smart phone, smart watch, computer, etc.) (step 745). In some embodiments, the personalized garment size and/or second sizing convention size may be provided to an individual coincidentally with provision of a garment that matches the personalized garment size and/or second sizing convention size (step 750).

Figure 8:
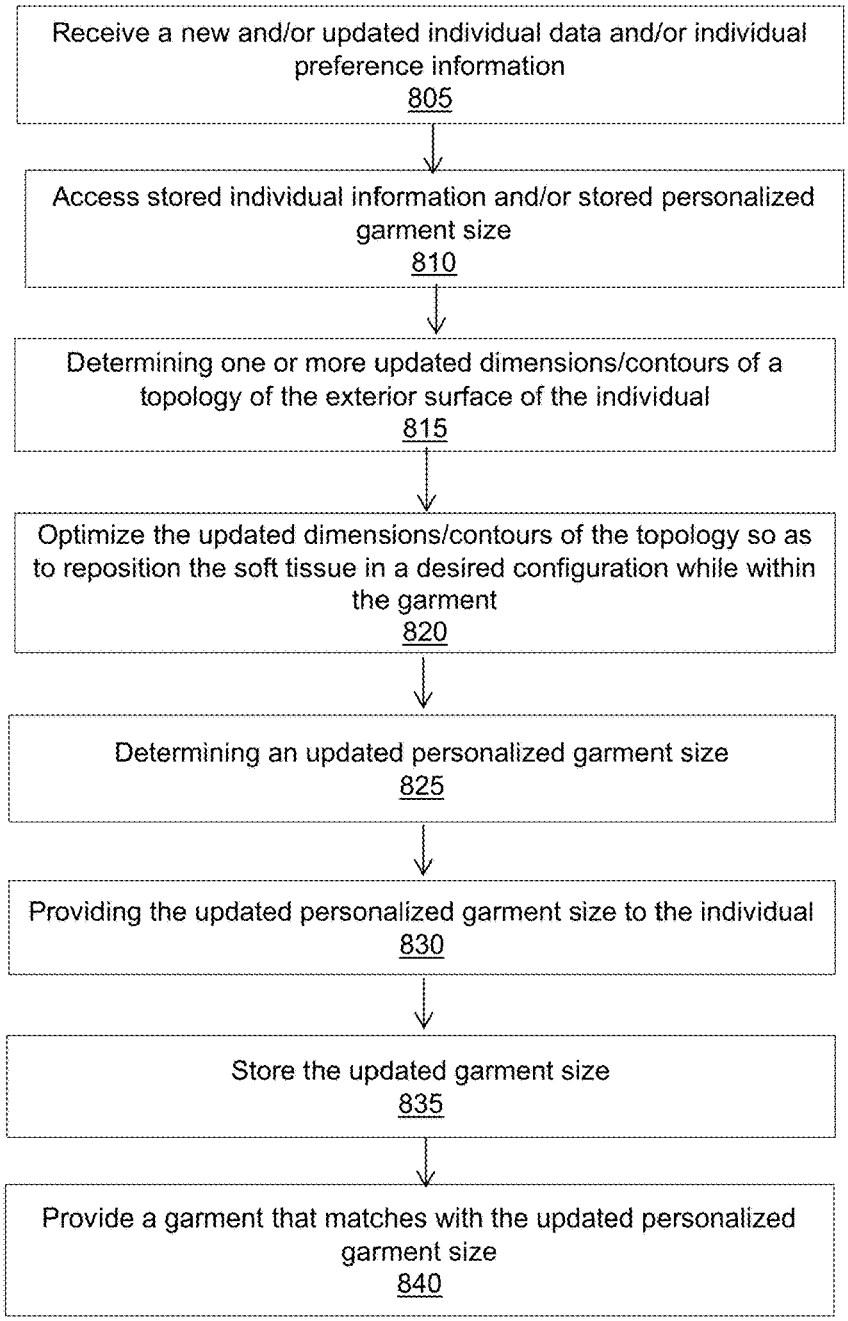

FIG. 8 is a flow chart illustrating an exemplary process 800 for updating a personalized garment size and/or second sizing convention size for an individual and providing the individual with a garment that complies with the updated personalized/second sizing convention size. Process 800 may be executed by, for example, a system like system 100 and/or a component thereof. In some instances, a user login, or other user identification, process for the individual may occur prior to starting process 800. In some embodiments, process 800 may be executed so as to accommodate for changes in, for example, garment manufacturing processes and/or materials available from which to construct the garment. Additionally, or alternatively, process 800 may be executed to accommodate for changes in the dimensions of the wearer that may be caused by, for example, fluctuations in weight or hormone levels.

Initially, new and/or updated data for the individual and/or a new or updated preference of the individual may be received (step 805). The new and/or updated data may be available due to, for example, a change in one or more body dimensions or topographical features of the individual or because new and/or different equipment is used to measure a dimension or topographical feature of the individual and/or construct the garment. Exemplary new and/or updated data includes an individual's age, a physical measurement (as measured in e.g., in inches or kilograms), a photograph, an anatomical parameter, and/or a topological parameter corresponding to, or otherwise indicating a dimension, a contour, or other feature the individual. The data may be received from, for example, one or more measurement/sizing devices 110A-110N and/or wearer/user device 115 by, for example, sizing computer system 140 via communication network 120. Additionally, or alternatively, the data may be received from a third party such as a doctor or other healthcare provider.

In some instances, the new/updated data received in step 805 is a new/updated preference of the individual. For example, an individual may have his or her size determined via process 600 and/or 700 and may then add one or more new or updated preferences regarding, for example, the design, color, style, or function of the garment.

Next, in step 810 stored information about the individual may be accessed. Exemplary stored information includes, but is not limited to, a measurement of a body dimension of the individual, a topographical feature of the individual, a preference of the individual, a skin tone of the individual, a previously determined personalized garment size and/or second sizing convention size of the individual, and feedback from the individual regarding a previously provided personalized garment size and/or second sizing convention size of the individual and/or a garment previously provided to the individual. Some of the information accessed in step 810 may be received and/or determined via one or more steps of process 600 and/or 700 as described above with regard to FIGS. 6 and/or 7.

Optionally, when, for example, the data received in step 805 relates to an exterior surface of the individual, one or more topological features of the exterior surface of the individual may be determined and/or updated (step 815). At times, execution of step 815 may resemble execution of steps 228, 320, 415, 520, and/or 620.

Optionally, in step 820, the dimensions and/or contours of the topological parameters of the individual may be optimized using, for example, the determination of step 815, so as to, for example, reposition the soft tissue of the individual in a desired configuration while within the garment. In some cases, the optimization of step 820 may be user configurable and, in those cases, one or more optimization preferences or parameters may be received in step 805.

In some instances, the optimization of step 820 may include, for example, a determination of how to reposition topological features (e.g., the soft tissue) into a desired shape, contour, or silhouette for the individual. For example, an individual with relatively small breasts may desire optimization so that the soft tissue of the breasts is lifted away from the torso in a forward facing direction and an individual with relatively large breasts may desire optimization so that a portion of the soft tissue of the breasts is positioned away from a center midline of the individual.

Next, in step 825, an updated personalized garment size and/or second sizing convention size may be determined based on, for example, the determinations of steps 815 and/or 820. Then, in step 830, the updated personalized garment size and/or second sizing convention size may be provided to the individual via one or more mechanisms including, but not limited to, verbally, electronic mail, short-message-service (SMS) text message, and a written message. The personalized garment size and/or second sizing convention size may then be stored in, for example, data storage device 130 and/or on the individual's mechanism for receiving the personalized garment size and/or second sizing convention size (e.g., smart phone, smart watch, computer, etc.) (step 835). In some embodiments, the personalized garment size and/or second sizing convention size may be provided to an individual coincidentally with provision of a garment that matches the personalized garment size and/or second sizing convention size (step 840).

In some embodiments, the new and/or updated information received in step 805 may be used to predict an individual's new and/or updated garment size. For example, when the new and/or updated information received in step 805 corresponds to a change in weight of the individual, process 800 and/or another process described herein may be used to predict the individual's new garment size. In some instances, this prediction may be based on historical data for the particular individual and/or data for individuals that share one or more aspects or characteristics with the particular individual. For example, if a particular individual had a first garment personalized size prior to her first pregnancy, and a second personalized garment size and/or second sizing convention size during her the third trimester of that pregnancy, process 800 may be used to predict the personalized garment size and/or second sizing convention size for the individual immediately following the birth of her child and/or for a phase of a subsequent pregnancy.

Figure 9:
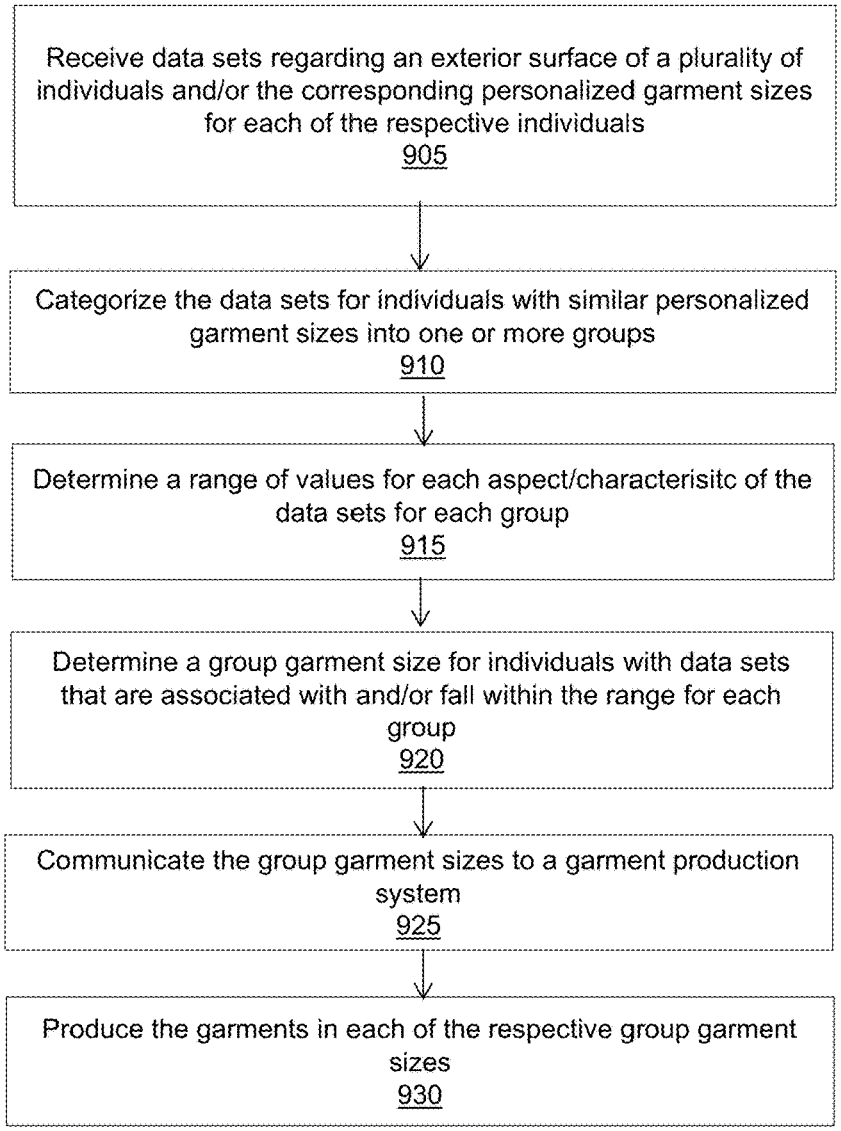

FIG. 9 is a flow chart illustrating an exemplary process 900 for determining a set of sizes within, for example, the second sizing convention, for a garment using data sets regarding a plurality of individuals and the corresponding personalized garment size and/or second sizing convention size for each of the respective individuals. Process 900 may be executed by, for example, a system like system 100 and/or a component thereof.

Initially, in step 905, data sets regarding an exterior surface of a plurality of individuals and the corresponding personalized garment size and/or second sizing convention size for each of the respective individuals may be received. The data regarding the individuals may include, for example, data similar to the data received in steps 605, 610, and/or 615 of process 600; steps 705, 710, and/or 715 of process 700; and/or step 805 of process 800. The received personalized garment size and/or second sizing convention size s may have been determined, for example, using processes 600, 700, and/or 800. The data sets may have one or more aspects and/or categories of data included therein. Exemplary aspects and/or categories for the data within a particular data set include, but are not limited to an individual's height, shoulder width, weight, breast shape, breast volume, BMI, a distance between the breasts, placement of the breasts on the torso of the individual, density of soft tissue, and individual preferences. In some embodiments, the individual data sets may not be complete (i.e., include data regarding every aspect/category).

In step 910, the data sets for individuals with the same and/or similar personalized garment size and/or second sizing convention size may be categorized into one or more groups. In some instances, the data set for an individual may appear in only one group/second sizing convention size and, in other instances, the data set for an individual may appear in a plurality of groups/second sizing convention sizes.

Next, in step 915, a range of values and/or parameters for each aspect/category of the data sets within each group and/or second garment size may be determined. For some aspects/categories (e.g., height or weight) a wide range of values (e.g., 5-30% standard of deviation) may be present within a group while for other aspects/categories (e.g., torso circumference or BMI), a narrower range of values (e.g., 0.01-5% standard of deviation) may be present within the group.

Then, in step 920, a garment size and/or second sizing convention size for individuals with data sets that are associated with and/or fall within the range for each group/second sizing convention size may be determined for each group. In some embodiments, the group garment/second sizing convention size may be associated with a set of aspects and/or characteristics of individuals within the group so that when a new set of data regarding an individual is received, the individual may be categorized into the appropriate group/second sizing convention size or groups/second sizing convention sizes and an appropriate group garment size/second sizing convention size may be selected for the individual.

In step 925, the group garment sizes/second sizing convention sizes may be communicated to a garment production facility, such as production system 150 so that garments in each of the respective group garment sizes may be produced (step 930).

Figure 10:
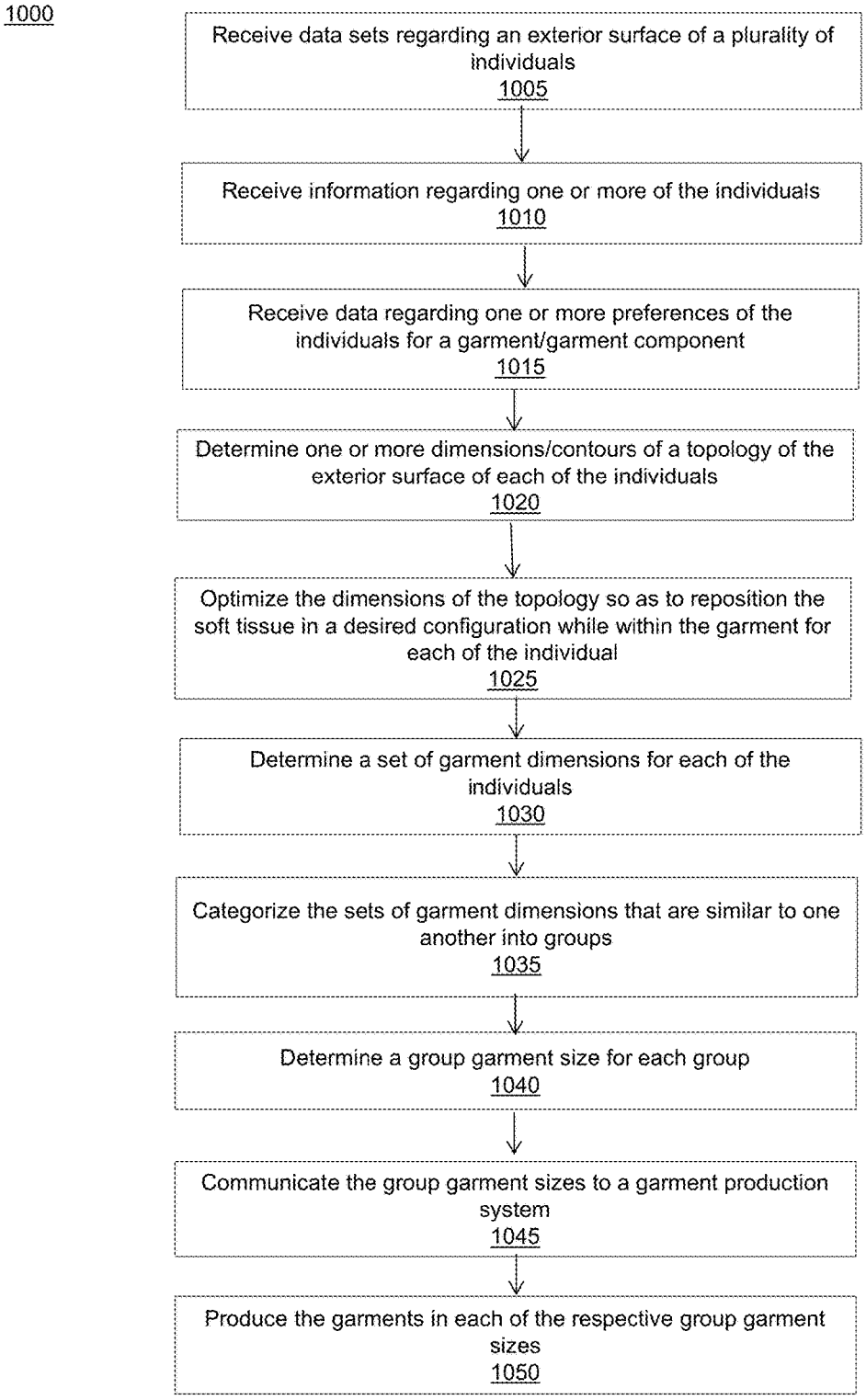

FIG. 10 is a flow chart illustrating an exemplary process 1000 for determining a set of sizes for a garment using data sets regarding a plurality of individuals. Process 1000 may be executed by, for example, a system like system 100 and/or a component thereof.

In step 1005, data sets regarding an exterior surface of a plurality of individuals may be received. The received data may include, for example, data similar to the data received in steps 605, 610, and/or 615 of process 600; steps 705, 710, and/or 715 of process 700; and/or step 805 of process 800. The received personalized garment sizes and/or second sizing convention sizes may have been determined, for example, using processes 200, 300, 400, 500, 600, 700, and/or 800. The data sets may have one or more aspects and/or categories of data included therein. Exemplary aspects and/or categories for the data within a particular data set include, but are not limited to, an individual's height, shoulder width, weight, breast shape, breast volume, BMI, a distance between the breasts, placement of the breasts on the torso of the individual, density of soft tissue, and individual preferences. In some embodiments, the individual data sets may not be complete (i.e., include data regarding every aspect/category).

Optionally, information regarding one or more of the individuals may be received in step 1010. The received information may relate to the shape, size, or other dimension of a region of an individual's body and/or soft tissue located thereon. Exemplary information received in step 1010 includes, but is not limited to, the individual's height, shoulder width, weight, breast shape, breast volume, body mass index (BMI), placement of the breasts on the torso of the individual, and density of soft tissue.

In some embodiments, the data received in step 1010 may relate to an amount of fat or other soft tissue positioned around the torso of the individual in addition to data relating to the breasts of the individual. This data may be used to determine, for example, compression tolerances for the garment when worn by the individual. For example, if an individual has a relative large amount of fat or other soft tissue positioned around her torso, as may be the case when an individual is obese, then compression of the garment into the body of the individual may have the effect of pushing soft tissue that is adjacent to the compression point into an undesired position. Stated differently, compressing the tissue of, for example, the breasts or back with too great of a force may create undesirable bulges of fat and other soft tissue above or below the line where the garment is pushing into the body of the individual. Therefore, an aspect of the individual's body received in step 1010 and/or a preference for a garment and/or garment component (received in step 1015) may be a relatively low compression tolerance for the garment so that the garment will, for example, lie adjacent to the exterior surface of the individual when worn and not press into the individual causing undesired bulges of soft tissue.

Optionally, in step 1015, one or more preferences of the individual for a garment and/or garment component may be received. Exemplary individual preferences include desired fit (e.g., snug or loose), a desired placement for the garment on the torso, a desired distance between the cups of the garment, a desired placement for the center clasp (if applicable) of the garment, a type of clasp for the garment, a type of back closure mechanism for the garment, a preferred fabric or other material or a restriction of same (as may be the case with an allergy or sensitivity to a certain fabric or material), and a desired silhouette.

Another individual preference that may be received in step 1015 includes a desired function the garment may perform (e.g., reduce movement of soft tissue during activity, provide access when breast feeding, augment an appearance of the breast tissue, minimize an appearance of the breast tissue). A further individual preference may relate to an anatomical feature of the individual. Exemplary anatomical features include breasts of different sizes or the removal of some or all breast tissue from one or both breasts as may be the case with a lumpectomy or a mastectomy. Another individual preference may relate to a medical concern including, for example, hormonal fluctuations, recent surgery, or pregnancy.

In some embodiments, a received individual preference may relate to materials used to manufacture the garment, a method of manufacture, or a country of origin for the garment. In other embodiments, an individual preference may relate to a preferred degree of containment of soft tissue. In yet another embodiment, an individual preference may relate to a degree of rigidity of the garment and/or a component of the garment.

Next, in step 1020, one or more topological features of the exterior surface for each of the individual may be determined. Exemplary features include body dimensions, volume, weight, density, a circumference of the torso or breast at various points, nipple placement, location of the soft tissue on the body or chest, and location of soft tissue below the chest. In some embodiments, step 1020 may include any number of processes that process the data in order to, for example, resolve an exterior edge, surface feature, and/or contour of the individual and/or positions of soft tissue located on the individual.

For example, when the data received in step 1005 are images captured via one or more 3D cameras, the images may be transformed into a point cloud that is resolve to determine, for example, an exterior edge, surface feature, and/or contour of the individual and/or positions of soft tissue located on the individual. In another example, step 1020 may include using 3D and/or 2D measurement data to construct a 3D approximation, or other graphical representation, of the dimensions or topology of the individual.

Optionally, in step 1025, the dimensions and/or topological parameters of the individual may be optimized so as to indicate, for example, a desired placement or orientation of soft tissue and/or breast tissue for the individual and/or incorporate one or more individual preferences. In some cases, the optimization of step 1025 may be user configurable and, in those cases, one or more optimization preferences or parameters may be received in step 1015.

The optimization of step 1025 may include, for example, a determination of how to reposition topological features (e.g., the soft tissue) into a desired shape, contour, or silhouette for the individual. For example, an individual with relatively small breasts may desire optimization so that the soft tissue of the breasts is lifted away from the torso in a forward facing direction and an individual with relatively large breasts may desire optimization so that a portion of the soft tissue of the breasts is positioned away from a center midline of the individual.

Next, in step 1030, a set of garment dimensions that match the topological features of step 1020 and/or optimized topological features of step 1025 may be determined for each of the individuals. The garment dimensions may be determined so as to provide adequate support for the soft tissue of the individual as well as a desired set of contours for the individual that the garment may provide for/induce when worn by the individual.

Then, sets of garment dimensions that are similar to one another may be categorized together into groups (step 1035). A garment size and/or second sizing convention size for each group (also referred to herein as a "group garment size" or "second sizing convention size") may then be determined for each group (step 1040).

In step 1045, the group garment sizes may be communicated to a garment production facility, such as production system 150 so that garments in each of the respective group garment sizes/second sizing convention sizes may be produced (step 1050).

Figure 11:
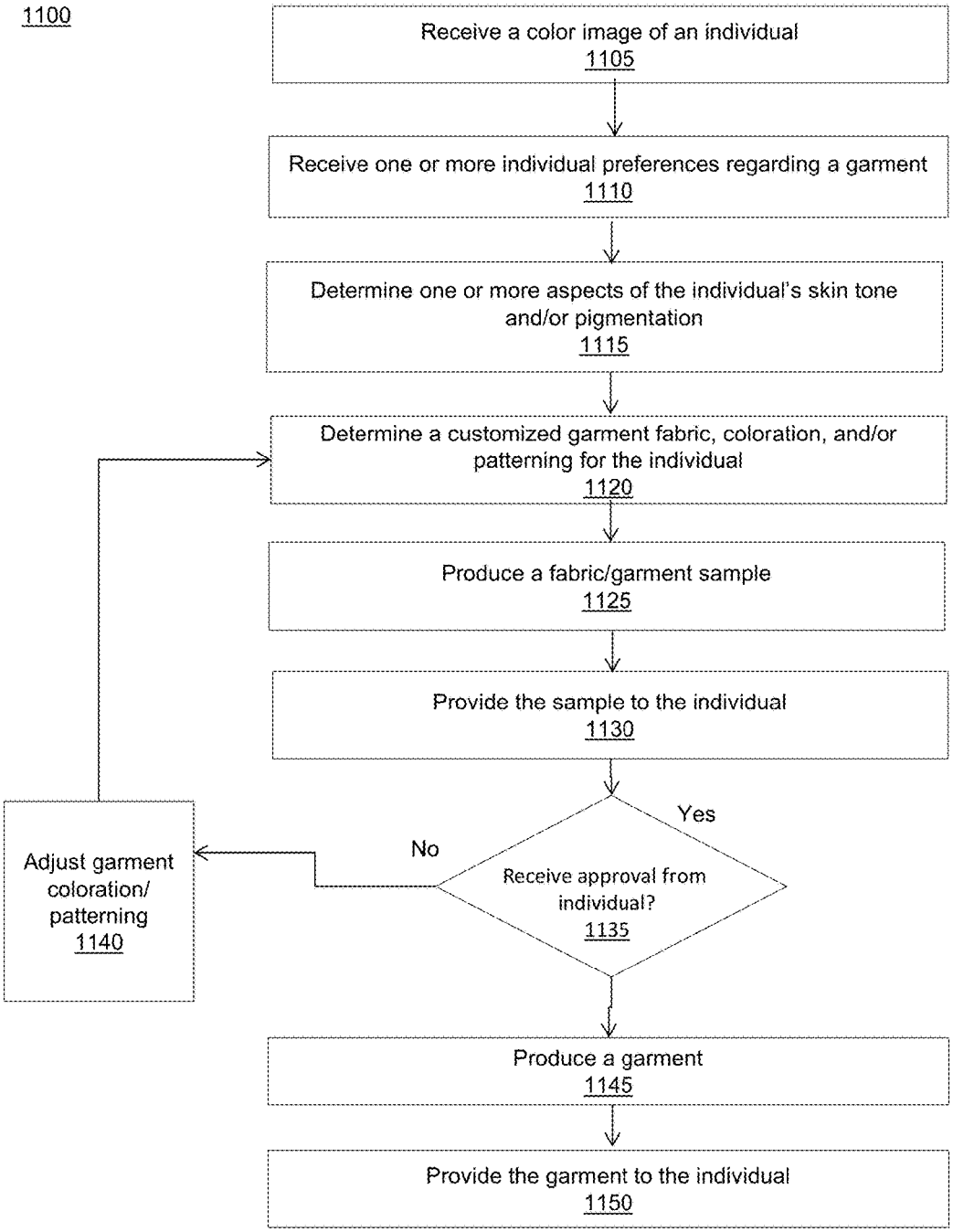

FIG. 11 is a flow chart illustrating an exemplary process 1100 for providing a customized garment that matches the individual's pigmentation. Process 1100 may be executed by, for example, a system like system 100 and/or a component thereof.

In step 1105, a color image of an individual may be received. The color image may be received from, for example, one of the measurement/sizing devices 110A-110N and/or wearer/user device 115. One or more preferences of the individual may then be received (step 1110). Exemplary preferences include preferences for fabric, coloration, patterning, and/or styling of a garment. In some embodiments, patterning and/or styling of the garment may facilitate matching of the garment color with the individual's pigmentation/skin tone.

In step 1115, the color image may be analyzed to determine one or more aspects of the individual's skin tone and/or pigmentation. In some instances, step 1115 may include comparing the color image to a known color that is also included in the image. This may occur when, for example, the individual is standing within the presence of various known and labeled colors as may be provided via, for example, a PANTONE™ chart. Then, in step 1120, a customized garment fabric, coloration, and/or patterning for a garment may be determined based on the determined aspects of the individual's skin tone and/or pigmentation.

In step 1125, a garment and/or fabric sample may be produced based on the determinations of steps 1115 and 1120 and provided to the individual (step 1130). When the individual approves of the sample (step 1135), a garment using the sample information from step 1130 may be produced and/or manufactured using, for example, production system 150 (step 1145) and provided to the individual (step 1150). When the individual does not approve of the sample (step 1135), the garment and/or sample coloration and/or patterning may be adjusted according to, for example, the individual's feedback (step 1140) and steps 1120-1135 may be repeated until the individual provides approval whereupon process 1100 may proceed to steps 1145 and 1150.

Processes 200, 300, 400, 500, 600, 700, 800, 900, 1000, and/or 1100 and/or a portion thereof may be used to determine a wearer's size according to the second sizing convention. Additionally, or alternatively, these processes and/or a portion thereof may assist with the determination of feature and/or a dimension, or a plurality of dimensions, of a frame, support structure, casing and/or housing as discussed herein. Exemplary features and dimensions include, but are not limited to, size, shape, thickness, degree of flexibility, degree of rigidity, placement of perforations, size of perforations, how a frame, support structure, casing and/or housing may be joined and/or used together, materials to be used for manufacture of the frame, support structure, casing and/or housing and/or manufacturing process for the frame, support structure, casing and/or housing.

Figure 12B:
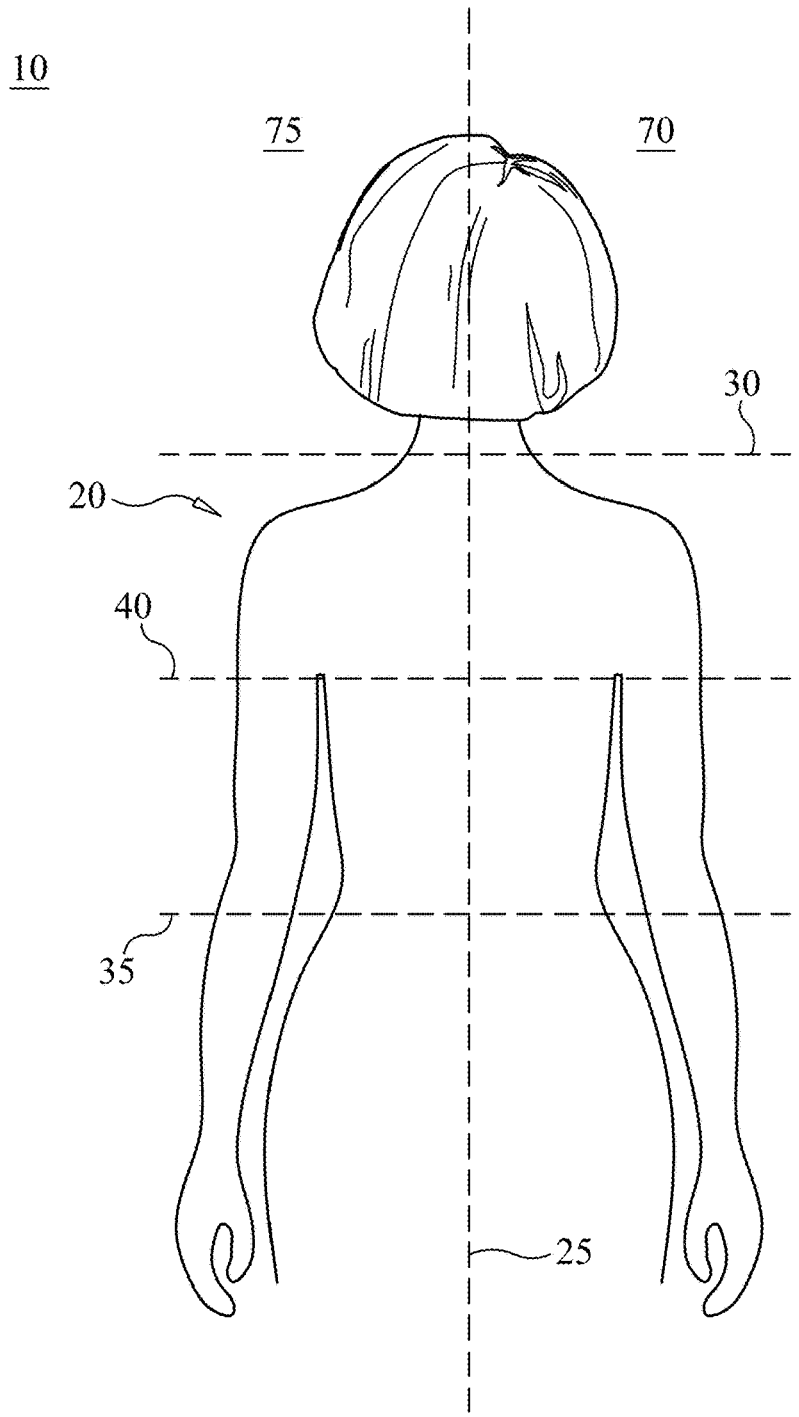
Figure 12C:
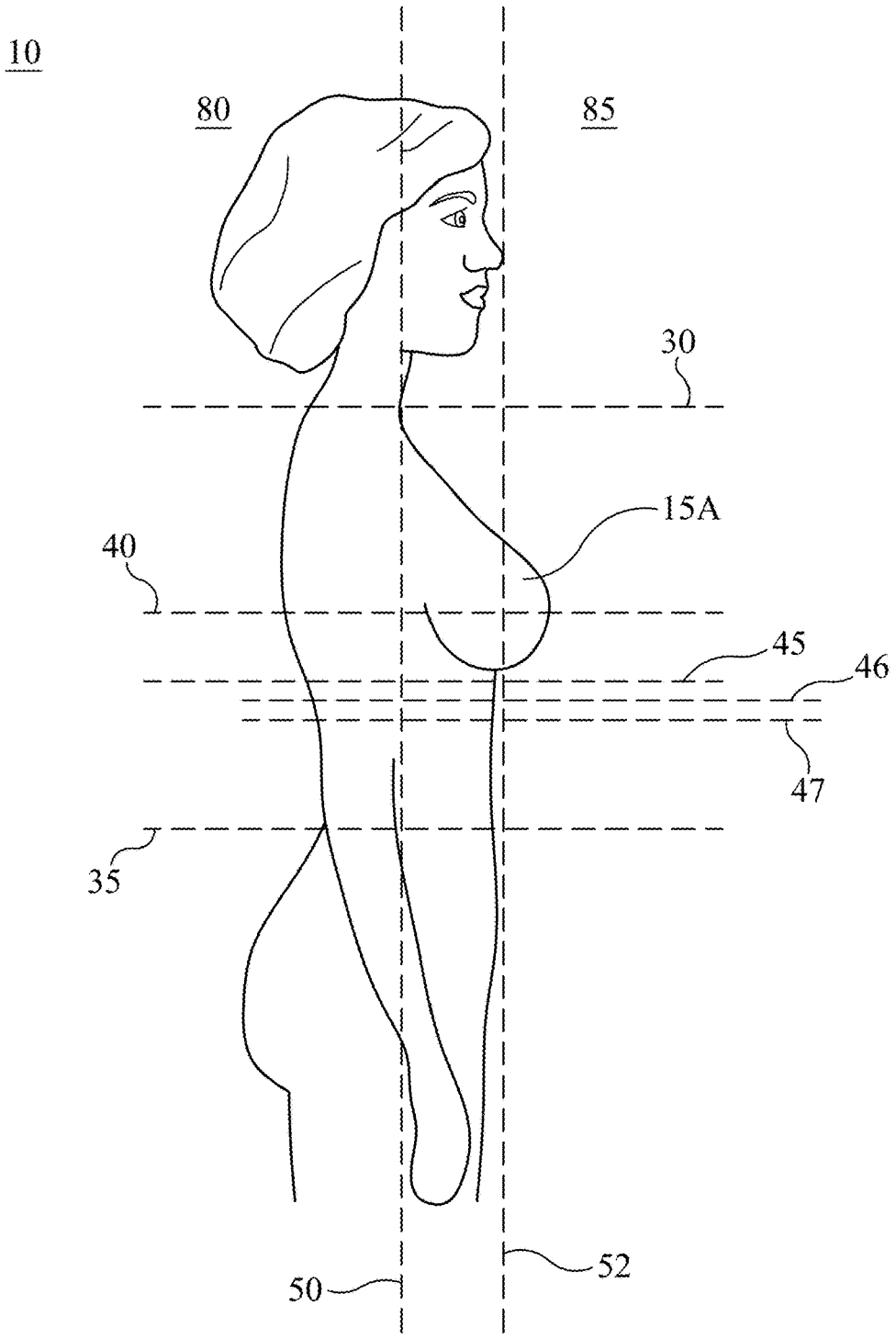

FIG. 12A is illustrates an anterior plan view of an exemplary wearer 10 with a first (i.e., left) anterior side 60 and a second (i.e., right) anterior side 65 separated by a sagittal plane center midline 25. FIG. 12B is a posterior plan view of an exemplary wearer 10 with a first posterior side 70 and a second posterior side 75. FIG. 12C is a side view of wearer that shows a lateral side of wearer 10. Wearer 10 has a first breast $\mathbf{15}_A$ and a second breast $\mathbf{15}_B$ positioned on an anterior side of her torso 20 on either side of an intermammary cleft. In most cases, wearer 10 will be a woman, but this need not always be the case. In some instances, wearer 10 may not have one, or both, breasts as may be the case following, for example, a single or double mastectomy. Additionally, or alternatively, wearer 10 may use one or more breast prosthesis.

A number of reference points/lines are superimposed upon wearer 10 in FIGS. 12A-120 so as to facilitate discussion of the invention. For example, in FIG. 12A, sagittal plane center midline 25 bisects wearer 10 through a vertical midline that extends through the intermammary cleft (i.e., between the breasts) and through the center of the wearer's torso as viewed from the front. Sagittal plane center vertical line 25 acts to differentiate between first anterior side 60 and second anterior side 65 of wearer 10. Additionally, an upper torso reference line 30 and a lower torso reference line 35 define the approximate upper and lower limits of a wearer's torso 20. A mid-torso reference line 40 defines an approximate midpoint between the upper and lower torso reference lines 30 and 35, respectively. In some embodiments, mid-torso reference line 40 may correspond with an apex, high point, and/or nipple of wearer's breasts 15 and/or a desired apex, high point, and/or nipple of wearer's breasts 15 when wearing a garment or garment component. For ease of discussion, the apex, high point, and/or nipple of wearer's breasts 15 may be referred to herein as simply an apex. A horizontal inframammary fold reference line 45 defines an approximate position for the wearer's inframammary fold (i.e., where the breast 15 meets or joins with the wearer's torso 20), a first horizontal reference line 46 defines a first position below the wearer's inframammary fold and a second horizontal reference line 47 defines a second position below the wearer's inframammary fold that is below the first horizontal reference line 46.

In FIG. 12B, sagittal plane center midline 25 bisects wearer 10 through center of the head along the spine thereby defining first posterior side 70 and second posterior side 75 of wearer 10. In FIG. 12C, a side vertical midline 50 bisects the anterior and posterior of wearer 10 through a vertical midline that extends through the center of the wearer's torso as viewed from the side and a vertical inframammary fold reference line 52 represents where the inframammary fold for the wearer is as seen from the side.

As described above, FIGS. 13A-13E provide images showing how the first, second, third measurements of wearer 10 may be taken and/or values for these measurements may be determined as described in, for example, processes 300, 400, and/or 500.

FIGS. 14A-14D provide drawings of an exemplary frame 1400 as viewed from the front, a first side, a second side, and bottom, respectively. In many circumstances, frame 1400 is adapted for positioning in a first side of a frame or garment (not shown) including two frames 1400, one positioned on first and second sides of the frame/garment that are a mirror image of one another. In most instances, the first side of the frame/garment corresponds to the first anterior side 60 of wearer 10 and the second side of the frame/garment corresponds to the second anterior side 65 of wearer 10. Exemplary garments that may incorporate frames 1400 include, but are not limited to, bras, sports bras, compression bras, corsets, bustiers, camisoles, swimsuits, sports tops, shirts, and dresses. In some embodiments, frame 1400 may be used to, for example, establish dimensions for, and/or a shape of, a frame that may be adaptable to many (e.g., 4-40) different sizes via, for example, scaling up or down one or more dimensions thereof.

Frame 1400 may act to provide support for a wearer's 10 breast weight by, for example, redistributing breast weight to the wearer's torso 20. In some circumstances, frame 1400 may also act to maintain proper placement of the frame and/or a casing or garment including the frame on the wearer's body (i.e., under the wearer's breast 15) when a garment and/or casing including frame 1400 is worn by wearer 10.

Frame 1400 and/or portions thereof may be adjusted (e.g., scaled up or down) based on sizing and/or support needs or preferences of wearer 10. For example, frames 1400 adapted for wear by women with relatively large breasts may be thicker or made from different materials than frames 1400 adapted for wearers with smaller breasts. In another example, frames 1400 for wearer 10 may be sized/adapted based on one or more dimensions or measurements of wearer 10, such as, for example, circumference of wearer's torso 20 measured at an apex or underside of wearer's breasts 15 at, for example, mid-torso reference line 40, horizontal inframammary fold reference line 45, first horizontal reference line 46, and/or second horizontal reference line 46. In most circumstances, an array of differently sized/shaped frames may be made to, for example, accommodate wearers of different sizes and/or different wearer preferences and/or garment, support structure, casing, and/or frame specifications.

Although frame 1400 is shown as a solid structure (e.g., no holes or openings), this need not be the case. For example, frame 1400 may have one or more openings or holes placed throughout. These holes or openings may be made by, for example, punching, cutting, and/or stamping out material and/or may be part of the manufacturing process using, for example, 3D printing or the overlay of materials perforations or openings therebetween. The holes or openings may serve to, for example, provide ventilation, decrease weight, improve flexibility, and so on.

Frame 1400 may be made from any appropriate material including, but not limited to, plastic, foam, resin, metal, metal wire, plastic wire, and combinations thereof. Exemplary plastics that may be used to manufacture the frame include, but are not limited to, PVC, thermoset plastics, and thermoplastics such as TPR, TPU, or TPE, all of which may be used in varying grades and durometers.

Although frame 1400 is shown as a single piece, this need not be the case. For example, a frame 1400 may include two or more pieces that may be coupled together via, for example, a flexible or rigid bond induced via, for example, a chemical or mechanical bonding process. In some instances, joints between two or more pieces that make up a frame 1400 may be flexible and, in other instances, the joints may be rigid.

In some embodiments, a thickness of a frame 1400 may be uniform throughout the respective frame and, in other embodiments; a thickness of a frame 1400 may vary in different part(s) of the respective frame. For example, a frame 1400 may be thicker in areas where greater rigidity/support is desired and may be thinner in areas where greater flexibility/less support is desired. For instance, a material making up a region of a frame 1400 positioned underneath a breast cup may be thicker that the material making up a region of on an inner edge. An exemplary range of thickness for a frame 1400 is 0.01 mm-20 mm. In some cases, the thickness and/or range of thicknesses of a particular frame may depend on the overall size of the frame, support structure, and/or a casing, and/or garment the frame is designed to fit into and/or cooperate with.

As may be seen in FIGS. 14A-14D, frame 1400 includes three sections: an under-bust band 1430 positioned in an approximate center of frame 1400 when viewed from the front between an intermammary-cleft portion 1410 and a wrap-around portion 1445. A transition between under-bust band 1430 and intermammary-cleft portion 1410 is delineated by intermammary-cleft portion reference line 1405 and a transition between under-bust band 1430 and wrap-around portion 1445 is delineated by wrap-around portion reference line 1470. Both intermammary-cleft portion reference line 1405 and wrap-around portion reference line 1470 are not part of frame 1400 and are superimposed on the figures provided herein to facilitate discussion of frame 1400 and portions thereof.

In some instances, a dimension of wrap-around portion 1445 (e.g., length, width, thickness) may be responsive to a size (e.g., a second sizing convention size) and/or a shape of an intended wearer so that, for example, wrap-around portion 1445 may provide proper support for a cantilever projection (typically in the form of a breast cup or a portion thereof, an example of which is discussed below with regard to support structure 1800).

Boundaries of intermammary-cleft portion 1410 may be defined by a combination of an intermammary-cleft portion reference line 1405, an intermammary-cleft portion upper edge 1415, an inner edge 1420, and an intermammary-cleft portion lower edge 1425. In most embodiments, a junction between any two of these edges/lines is not a right angle and may be rounded in shape. For example, intermammary-cleft portion reference line 1405 is oriented at an angle (i.e., not parallel to an wrap-around portion reference line 1470) so that a length of intermammary-cleft portion lower edge 1425 is greater than a length of intermammary-cleft portion upper edge 1415. A size or shape of intermammary-cleft portion 1410 may be varied in order to accommodate, for example, an actual position of a wearer's breast or breasts 15 on wearer's torso 20 (e.g., breasts that are positioned close together or far apart on the chest), a desired position of a wearer's breast or breasts 15 on wearer's torso 20, and/or a width of a wearer's intermammary cleft. An exemplary way of varying the shape or size of intermammary-cleft portion 1410 is to vary an angel at which intermammary-cleft portion reference line 1405 is oriented, adjust a length of intermammary-cleft portion upper edge 1415, adjust a length of intermammary-cleft portion lower edge 1425, and/or adjust a length of inner edge 1420 and/or otherwise adjust relative dimensions of intermammary-cleft portion upper edge 1415, intermammary-cleft portion lower edge 1425, and/or inner edge 1420.

In some instances, a vertical plane, such as a plane of intermammary-cleft portion 1410, is intended to coincide with wearer's 10 inframammary cleft when frame 1400 is coincident with wearer's torso 20 (i.e., wearer 10 is wearing frame 1400). In some embodiments, intermammary-cleft portion 1410 may be flat (i.e., planar) and, in other instances, the vertical plane intermammary-cleft portion 1410 may be curved (e.g., concavely curved).

Under-bust band 1430 may have an upper edge 1440 and a lower edge 1435. An overall shape of under-bust band lower edge 1435, as well as a curvature of upper edge 1440 and lower edge 1435, may approximate a shape of wearer's 10 inframammary fold. In some instances, a size of a frame may incorporate one or more measurements of the wearer's 10 inframammary fold as may be dictated by, for example, the wearer's second sizing convention size.

In some embodiments, frame 1400 may be configured so that under-bust band lower edge 1435 corresponds to a position of 0.4-15 cm below a wearer's 10 inframammary fold. In some instances, a distance between under-bust band lower edge 1435 and the wearer's 10 inframammary fold may be constant and, in other instances, it may vary (e.g., a distance between under-bust band lower edge 1435 and the inframammary fold gradually increases from intermammary-cleft portion reference line 1405 toward wrap-around portion reference line 1470). For example, in the embodiment of frame 1400, upper edge 1440 and lower edge 1435 are approximately parallel with one another at, or near, intermammary-cleft portion reference line 1405 until approximately a center point of under-bust band 1430 after which a width of under-bust band 1430 increases to a maximum width at wrap-around portion reference line 1470 so that under-bust band lower edge 1435 from approximately the center of under-bust band 1430 to wrap-around portion reference line 1470 is only slightly curved (i.e., nearly a straight line) In this way, the breast weight is supported by the portion of the frame 1400 positioned on the outside of the wearer's breast 15.

In some embodiments, a shape, or curvature of under-bust band lower edge 1435 may change along its length. For example, a shape of under-bust band lower edge 1435 may approximate a shape of wearer's 10 inframammary fold at the center and may change (e.g., curve in the opposite direction) at, or near, wrap-around portion reference line 1470 and/or intermammary-cleft portion reference line 1405. In this way, the under-bust band lower edge 1435 is curved so as to, for example, prevent the frame 1400 from extending too far down wearer's 10 body when worn. This may serve to increase the comfort of wearing frame 20 as well as decrease likelihood that wearing frame 1400 will interfere with wearer's movement or breathing.

Under-bust band upper edge 1440 may be curved in a manner approximating a wearer's inframammary fold (i.e., where an underside of a woman's breast meets her torso). One or more dimensions of under-bust band upper edge 1440 (e.g., length, radius of curvature, etc.) may be adjusted based on a size (according to, for example, the second sizing convention) or shape of a wearer 10, a size or shape of her breasts 15, her breast mass, and/or her breast volume as is discussed in greater detail below. In some instances, a radius of curvature for the under-bust band upper edge 1440 remains consistent through the length of under-bust band upper edge 1440 and, in other instances, a radius of curvature for the under-bust band upper edge 1440 may change along a length of under-bust band upper edge 1440 in, for example, a parabolic shape or an irregular shape so as to, for example, effect repositioning of breast tissue and/or the wearer's 10 anatomy.

In some cases, a shape of under-bust band upper edge 1440 may be such that a height of under-bust band 1440 is greater toward a wrap-around portion 1445 portion of frame 1400 than toward the intermammary-cleft portion 1410 of frame 1400. This may act to, for example, shape an outer edge of a wearer's breast 15 and push the breast volume toward the center of wearer's torso.

In many instances, a distance between under-bust band upper edge 1440 and under-bust band lower edge 1435 at wrap-around portion reference line 1470 may be greater than a distance between under-bust band upper edge 1440 and under-bust band lower edge 1435 at intermammary-cleft portion reference line 1405. This may provide support for the distribution of weight from the wearer's breast 15 to her torso 20 by, for example, providing support for a cantilever projection extending from under-bust band upper edge 1440 as will be discussed below.

Wrap-around portion 1445 may begin at, or near, wrap-around portion reference line 1470 and extend toward outside edge 1450. A size and shape of wrap-around portion 1445 is delineated by a wrap-around portion outer edge 1450, a wrap-around portion lower edge 1455, a wrap-around portion upper edge 1460 and wrap-around portion reference line 1470. As may be seen in FIGS. 14B and 14C, wrap-around portion outer edge 1450 is a substantially straight, substantially vertically oriented edge however, this need not be the case. For example, wrap-around portion outer edge 1450 may be oriented at an angle, may have a curved edge, and/or may have an irregular edge so as to, for example, minimize a profile of the edge when worn.

Wrap-around portion lower edge 1455 meets wrap-around portion outer edge 1450 at an angle of greater than 90° thereby creating an upwardly sloping line, or edge, as wrap-around portion lower edge 1455 extends from wrap-around portion outer edge 1450 toward wrap-around portion reference line 1470 meeting at a peak 1465. The shape of wrap-around portion 1445 may be such that it avoids contact with the under-arm region of a wearer when worn. Although peak 1465 is shown to be fairly pointy, or sharp, in FIGS. 14A-14C, this need not be the case as peak 1465 may, in some instances, be curved or square shaped and/or an angle between edges 1440 and 1460 may be larger than shown in FIGS. 14A-14D. In some instances, frame 1400 may bend inwards (in the Z direction) at peak 1465 so that when worn by a wearer 10, the peak portion of the frame may press into the wearer's skin or otherwise conform to a surface of the wearer's skin. In other instances, frame 1400 may bend outwards (in the Z direction) at peak 1465 so that when worn by a wearer 10, the peak 1465 of the frame may not come into contact with the wearer's skin or otherwise conform to a surface of the wearer's skin.

As pictured in FIGS. 14A-14D, wrap-around portion lower edge 1455 has a slightly concave curvature so that it tapers upwards. This need not always be the case for other frames like frame 1400 as a wrap-around portion lower edge 1455 of a different frame may be straight or may be at an angle oriented downwards.

One or more dimensions of wrap-around portion 1445 may be adjusted to accommodate differences in size or shape of a wearer 10. For example, wrap-around portion 1445 may be configured to extend in the direction of side vertical midline 50 of a wearer 10 when worn and, on some occasions, wrap-around portion 1445 may extend to side vertical midline 50 and on other occasions, wrap-around portion 1445 may extend beyond side vertical midline 50 to the wearer's posterior side 70 (e.g., wrap around the wearer's lateral side and a portion of her posterior). In some instances, a thickness of wrap-around portion 1445 may vary so that, for example, the wrap-around portion 1445 is thicker at, or near, the wrap-around portion reference line 1470 and thinner toward wrap-around portion outside edge 1445.

Figure 14A:
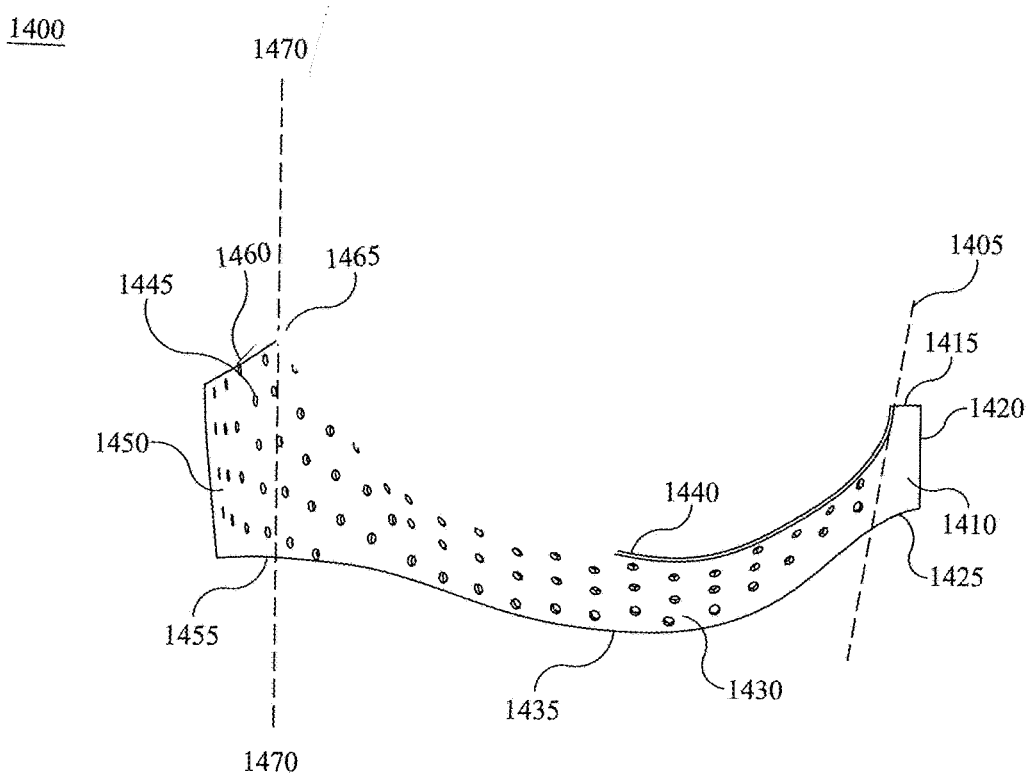
FIGS. 14A-14D provide drawings of an exemplary frame as viewed from the front, a first side, a second side, and bottom, respectively in accordance with embodiments of the present invention.
Figure 14B:
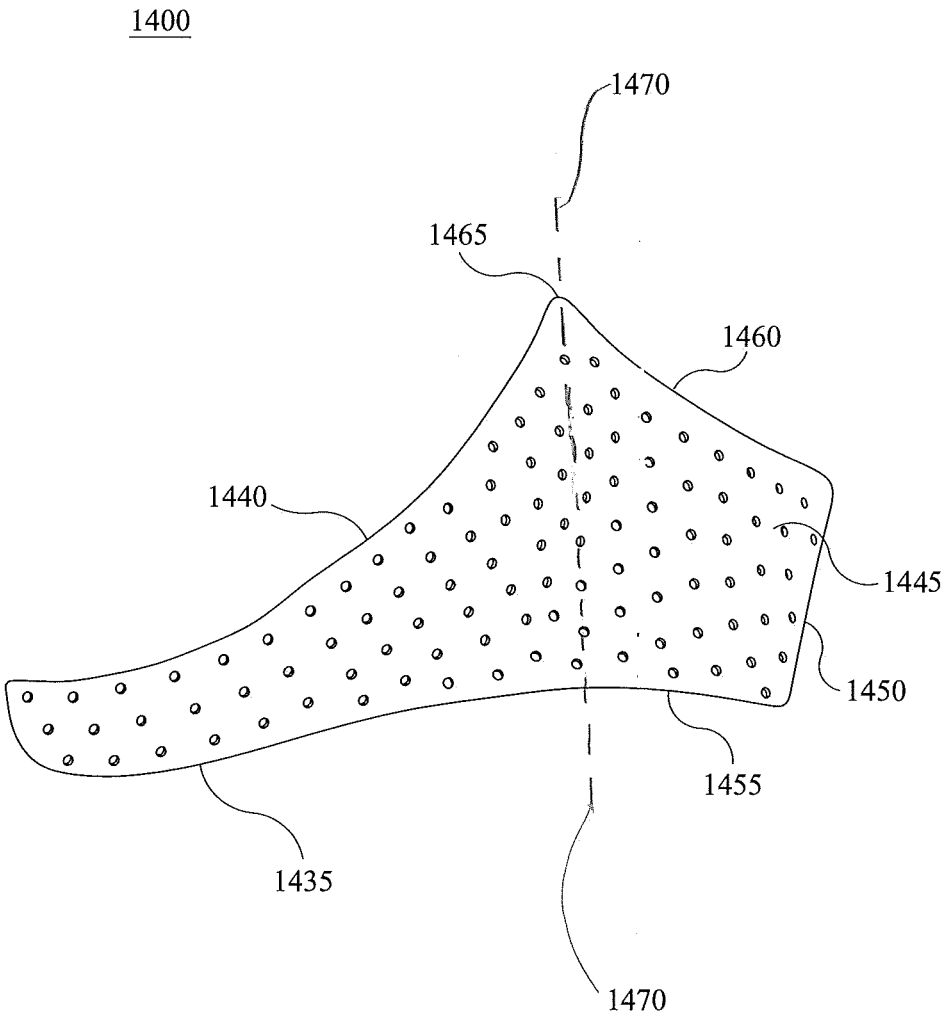
Figure 14C:
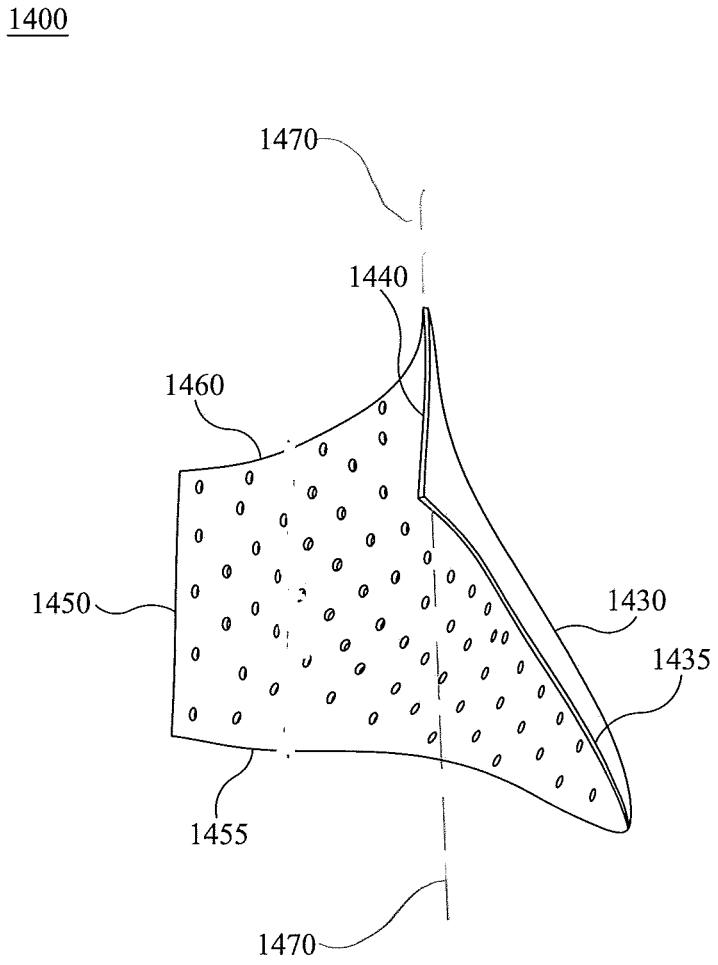
Figure 14D:
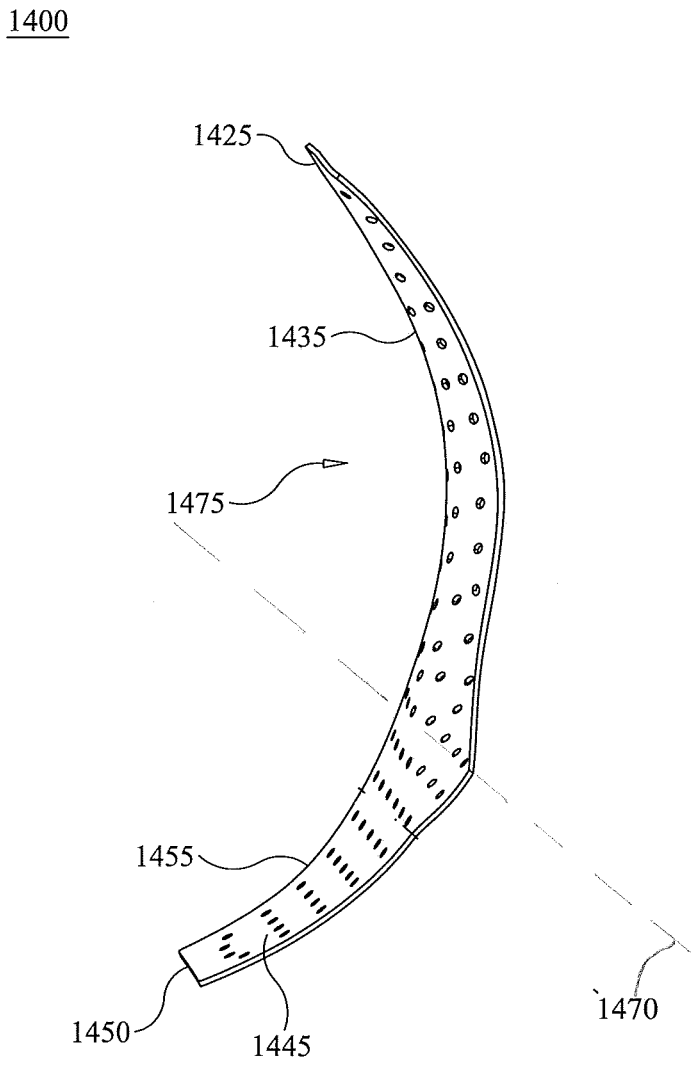

The lower edge of frame 1400 (i.e., inframammary-cleft portion lower edge 1425, under-bust portion lower edge 1435, and wrap-around portion lower edge 1455) form one continuous arc 1475 as shown in FIG. 14D. At times, arc 1475 may be a regularly shaped ellipse and in other instances, curve 1475 may be irregularly shaped (i.e., the radius of curvature may change along the arc). In many instances, a shape of arc 1475 may approximate a cross-sectional shape of a wearer's torso 20 at, or near, her inframammary fold (i.e., at or near horizontal inframammary fold reference line 45) or below her inframammary fold (i.e., at or near first horizontal reference line and/or second horizontal reference line 47). When held in an upright position (as shown in FIG. 14A) arc 1475 extends in the −Z direction on a Cartesian axis whereby an apex of arc 1475 is positioned roughly in the center of under-bust band 1430 and a portion of arc 1475 near inside edge 1420 and a portion of arc 1475 near wrap-around portion outside edge 1450 extends into the −Z plane to make the curvature of arc 1475. Further details regarding a shape of arc 1475 and how a wearer is sized (according to, for example, the second sizing convention) with an appropriately shaped arc 1475 are provided above with regard to processes 200, 300, 400, 500, 600, 700, 800, 900, 1000, and/or 1100 as shown in FIGS. 2A-11.

Although FIGS. 14A-14D show a frame 1400 designed to be worn on first breast 15A, it will be understood that frame 1400, and/or the dimensions or manufacturing instructions used to manufacture frame 1400, may be adapted to correspond to the wearer's second breast $\mathbf{15}_B$ by, for example, using a mirror image of the dimensions used to manufacture frame 1400.

FIGS. 15A-15D provide four exemplary ellipse-like shapes 1500, 1501, 1502 and 1503, respectively that approximate circumferential dimensions of a respective first, second, third, and fourth wearer's torso 20 as measured at horizontal inframammary fold reference line 45. As shown in FIGS. 15A-15D, the circumference of the second wearer's torso/the size of ellipse 1501 is larger than the circumference of the first wearer's torso/the size of ellipse 1500; the circumference of the third wearer's torso/the size of ellipse 1502 is larger than the circumference of the second wearer's torso/the size of ellipse 1501; and the circumference of the fourth wearer's torso/the size of ellipse 1503 is larger than the circumference of the third wearer's torso/the size of ellipse 1502 so as to represent that the relatively increasing size of the first, second, third, and fourth wearer's torso along the series. It will be understood by those of skill in the art that other shapes, or combinations of shapes, (e.g., square, oval, circle, etc.) may better approximate the dimensions of the wearer's torso.

For the purpose of discussion, each of ellipses 1500, 1501, 1502, and 1503 are divided into four quadrants, or arcs and is discussed as though it is in an X-Z plane that is perpendicular to the sagittal plane center midline 25 with reference line 1510 representing the Z-axis and reference line 50 representing the X-axis. Reference line 50 of FIG. 15A corresponds with vertical midline 50. An upper left arc 1525A, 1525B, 1525C, and 1525D of ellipses 1500, 1501, 1502, and 1503, respectively, correspond to the first (i.e., left) anterior side 60 of wearer 10. An upper right arc 1530A, 1530B, 1530C, and 1530D of ellipses 1500, 1501, 1502, and 1503, respectively, corresponds to the second (i.e., right) anterior side 65 of wearer 10. A lower left arc 1535A, 1535B, 1535C, and 1535D of ellipses 1500, 1501, 1502, and 1503, respectively, corresponds to the first (i.e., left) posterior side 70 of wearer 10. A lower right arc 1540A, 1540B, 1540C, and 1540D of ellipses 1500, 1501, 1502, and 1503, respectively, corresponds to the second (i.e., right) posterior side 75 of wearer 10.

FIGS. 15A-15D also provide an exemplary sizing arc 1520A, 1520B, 1520C, and 1520D, respectively. Sizing arcs

1520A, 1520B, 1520C, and 1520D may approximate a shape of the wearer's torso at, or near, horizontal inframammary fold reference line 45 and, in some instances; one or more dimensions (e.g., length, radius of curvature, shape, etc.) of sizing arcs 1520A, 1520B, 1520C, and 1520D may be determined using dimensions of ellipses 1500, 1501, 1502, and 1503, respectively, (e.g., upper right arc 1530 and/or lower right arc 1540). In some instances, sizing arcs 1520A, 1520B, 1520C, and 1520D may be a virtual, or mathematical, approximation of the shape of the wearer's torso 20 generated by a processor based on a mathematical approximation of a wearer's torso 20. In other instances, a one or more virtual pre-generated sizing arcs 1520A, 1520B, 1520C, and 1520D may be matched with an ellipse like ellipses 1520A, 1520B, 1520C, and 1520D approximating one or more dimensions of a particular wearer 10. Additionally, or alternatively, one or more sizing arcs 1520A, 1520B, 1520C, and 1520D may be manufactured and/or physically rendered using, for example, plastic or other material for manually matching a particular sizing arc 1520A, 1520B, 1520C, and 1520D with a wearer's torso 20 as described in greater detail below.

One or more dimensions and/or relative proportions of a particular sizing arc 1520A, 1520B, 1520C, and 1520D may be determined and/or used to select a sizing arc from a plurality of predetermined and/or previously manufactured sizing arcs based on one or more of the dimensions and/or relative proportions of arc(s) 1530A, 1530B, 1530C, 1530D, 1540A, 1540B, 1540C, and/or 1540D for a respective one of first, second, third, and/or fourth wearer, respectively. In some instances, the dimensions along the entire curvature of arc(s) 1530A, 1530B, 1530C, 1530D, 1540A, 1540B, 1540C, and/or 1540D may be used so determine a size for a respective one of first, second, third, and/or fourth wearer, respectively.

In other instances, one or more points along arc(s) 1530A, 1530B, 1530C, 1530D, 1540A, 1540B, 1540C, and/or 1540D for a respective one of first, second, third, and/or fourth wearer, respectively (as opposed to the entire curvature) may be used to determine a dimension of sizing arc 1520A, 1520B, 1520C, and/or 1520D and/or select a particular sizing arc 1520A, 1520B, 1520C, and/or 1520D from the plurality for a respective one of first, second, third, and/or fourth wearer. For example, an approximation of the shape of a wearer's torso may be made by determining a value along the X-axis when Z equals 0, a value along the Z-axis when X equals 0, and, in some instances, a set of coordinates for one or more points along the arc(s) 1530A, 1530B, 1530C, 1530D, 1540A, 1540B, 1540C, and/or 1540D may be used to determine dimensions for a sizing arc 1520A, 1520B, 1520C, and/or 1520D and/or select a sizing arc 1520A, 1520B, 1520C, and/or 1520D from the plurality of sizing arcs. In some embodiments, the plurality of sizing arcs 1520A, 1520B, 1520C, and/or 1520D may be manufactured as a tool for manually determining a size of a wearer 10 (via, e.g., placing a number of sizing arcs up against the wearer 10 in order to determine which one best approximates the size and shape of the wearer) without the use of ellipses 1500, 1501, 1502, and/or 1503 and/or measurements of the wearer 10.

Although not shown in FIG. 15A, 15B, 15C, or 15D it will be understood by those of skill in the art that another sizing arc (not shown) with dimensions that may mirror one or more dimensions of sizing arc(s) 1520A, 1520B, 1520C, and/or 1520D may also be used. This sizing arc have many of the same characteristics as sizing arc 1520A, 1520B, 1520C, and/or 1520D but may be designed to approximate and/or correspond to the dimensions of arc(s) 1525A, 1525B, 1525C, 1525D, 1535A, 1535B, 1535C, and/or 1535D.

In one embodiment, one or more dimensions of sizing arc 1520 may be used to design, make, or select an exemplary frame, support structure, and/or casing, such as the frames, support structures, and casings disclosed herein. For example, sizing arc 1525A, 1525B, 1525C, and/or 1525D may be used to determine one or more dimensions (e.g., curvature, length, width, etc.) for arc 1475 and, in other instances, the dimensions of sizing arc(s) 1525A, 1525B, 1525C, 1525D may correspond to the dimensions of intermammary-cleft portion, 1410, under-bust band 1430, and/or wrap-around portion 1445 such as intermammary-cleft portion lower edge 1425, under-bust band lower edge 1435, and/or wrap-around portion lower edge 1455.

In another embodiment, a plurality of physical sizing arcs like sizing arcs 1525A, 1525B, 1525C, 1525D (corresponding to the wearers dimensions at, or near, horizontal inframammary fold reference line 45) may be generated/produced and each sizing arc of the plurality may have a different set of dimensions (i.e., be of a different size/shape). Each of the sizing arcs of the plurality may correspond to a frame, support structure, and/or casing as described herein of a different size and/or shape (e.g., a different set of dimensions for arc 1475, intermammary-cleft portion 1410, under-bust band 1430, and/or wrap-around portion 1445).

In the examples of FIGS. 15A, 15B, 15C, and 15D, the curvature of the sizing arcs 1520A, 1520*b*, 1520C, and 1520D very closely matches the curvature of the arc 1530A 1530B, 1530C, or 1530D, respectively, and a respective portion of arc 1540A, 1540B, 1540C, or 1540D. In this example, the sizing arc 1520A, 1520*b*, 1520C, and 1520D is intended to wrap around the side of the wearer's torso past reference line 50, but not extend all the way around to the wearer's posterior to, for example, reference line 1510. However, in some instances, a curvature of the sizing arc 1520A, 1520B, 1520C, and 1520D may be selected that does not closely match the curvature of, for example, arc 1530A 1530B, 1530C, or 1530D and a respective portion of arc 1540A, 1540B, 1540C, or 1540D. In these instances, a differently shaped curvature for sizing arc 1520A, 1520*b*, 1520C, or 1520C may be desired so as to, for example, reposition breast volume in a desired way and/or optimize comfort for wearing a garment including a frame, support structure, and/or casing manufactured and/or selected for the wearer.

Additionally, or alternatively, the size and shape of ellipse(s) 1500, 1501, 1502, or 1503 may be used to determine an appropriate distance between reference line 1510 and the starting point of sizing arc(s) 1520, 1520B, 1520C and/or 1520D so that, for example, a positioning of a frame, support structure, and/or casing within a housing or garment may be responsive to the dimensions of the wearer.

Figure 15A:
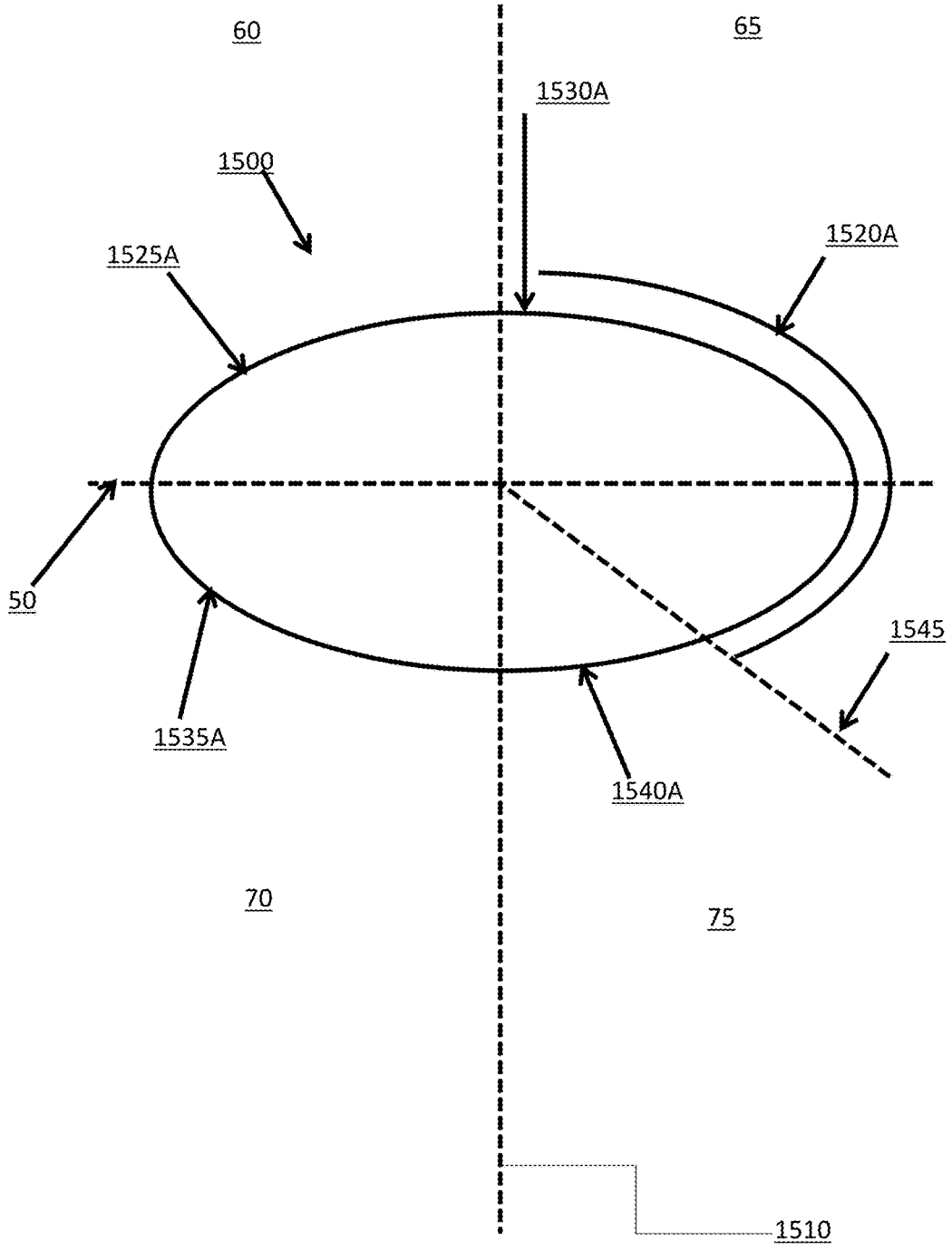
FIGS. 15A-15D provide illustrations four exemplary ellipse-like shapes and corresponding sizing arcs in accordance with embodiments of the present invention.
Figure 15B:
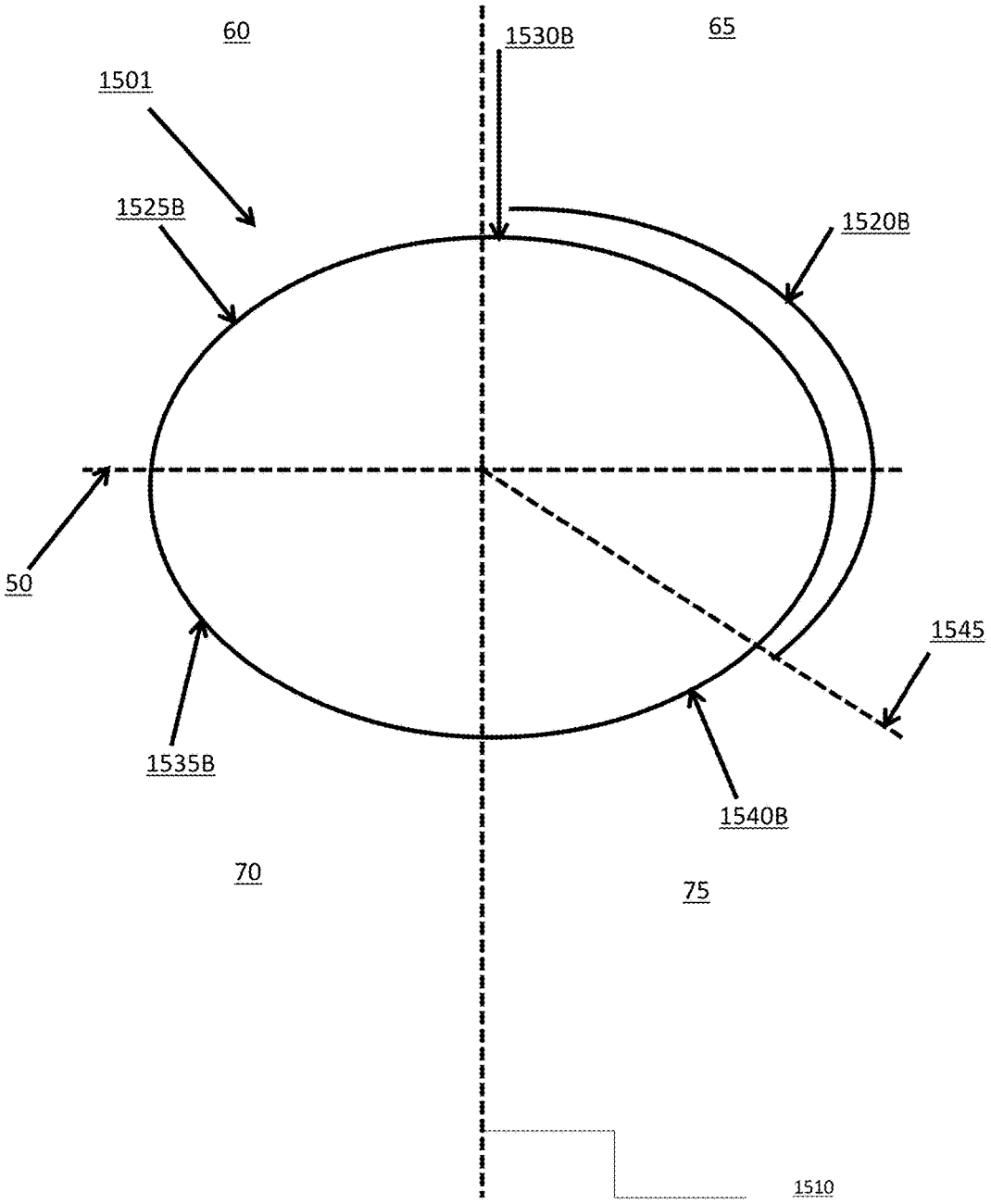
Figure 15C:
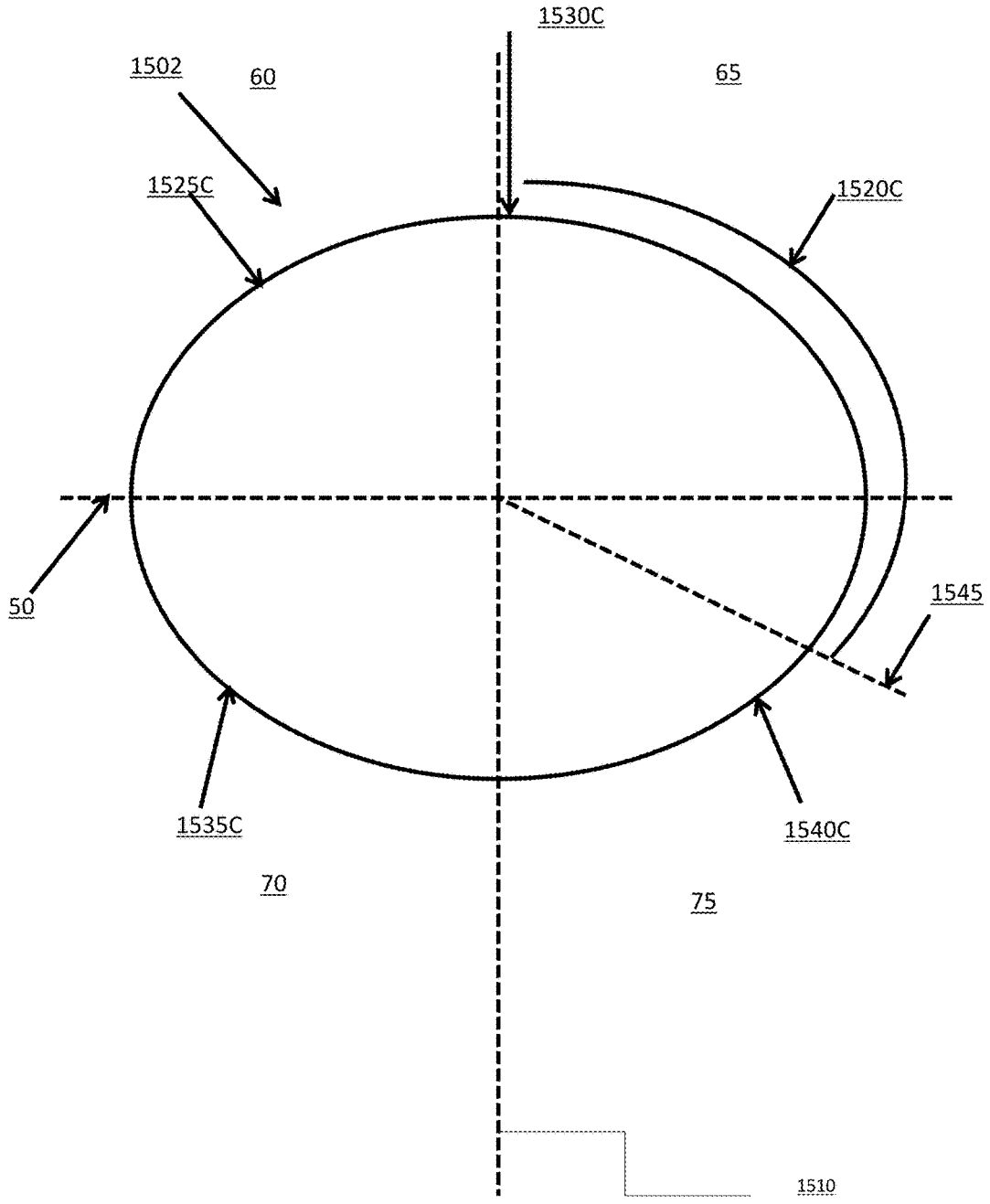
Figure 15D:
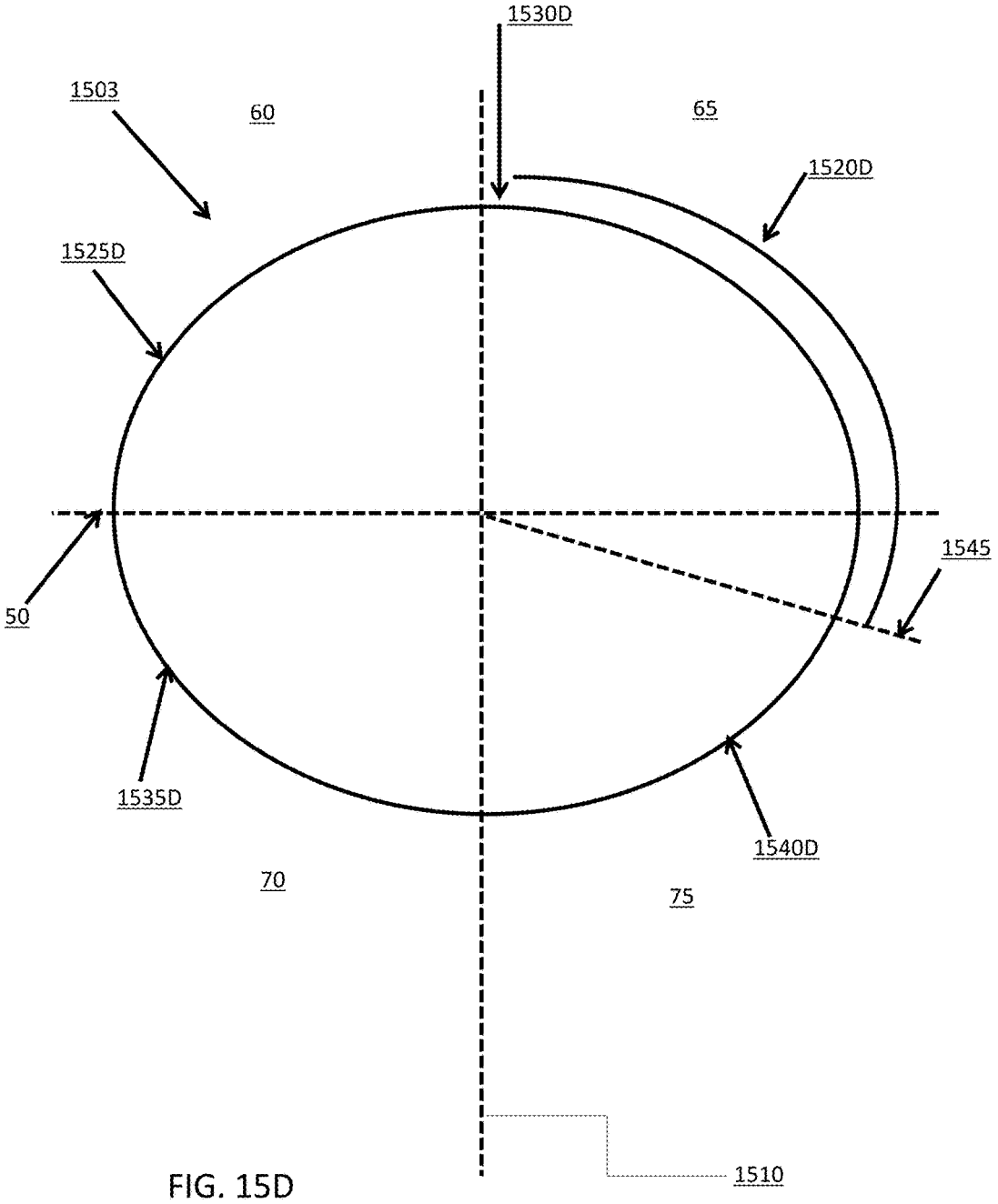
Figure 16A:
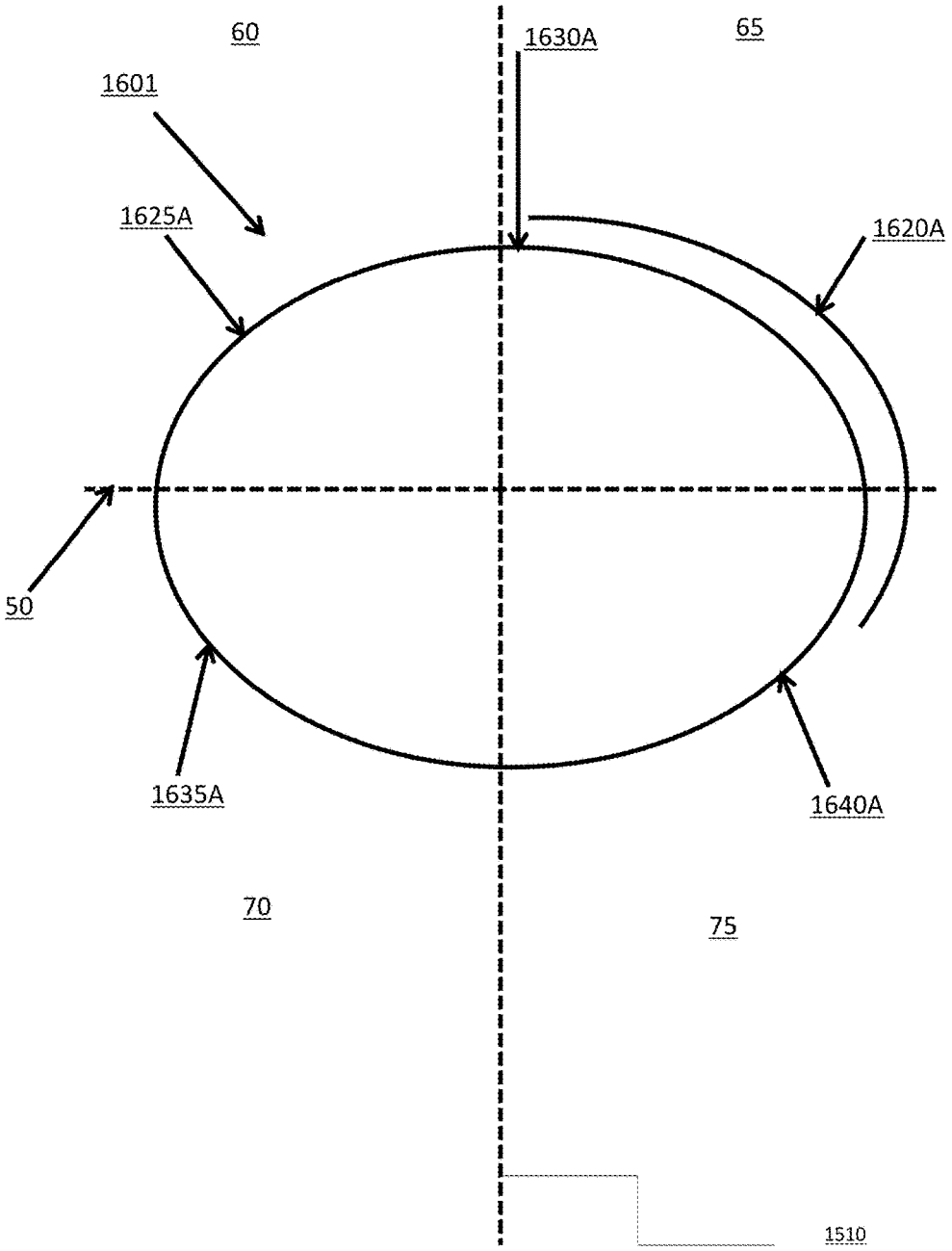
FIGS. 16A-16F provide illustrations of sizing arc sets in accordance with embodiments of the present invention.
Figure 16B:
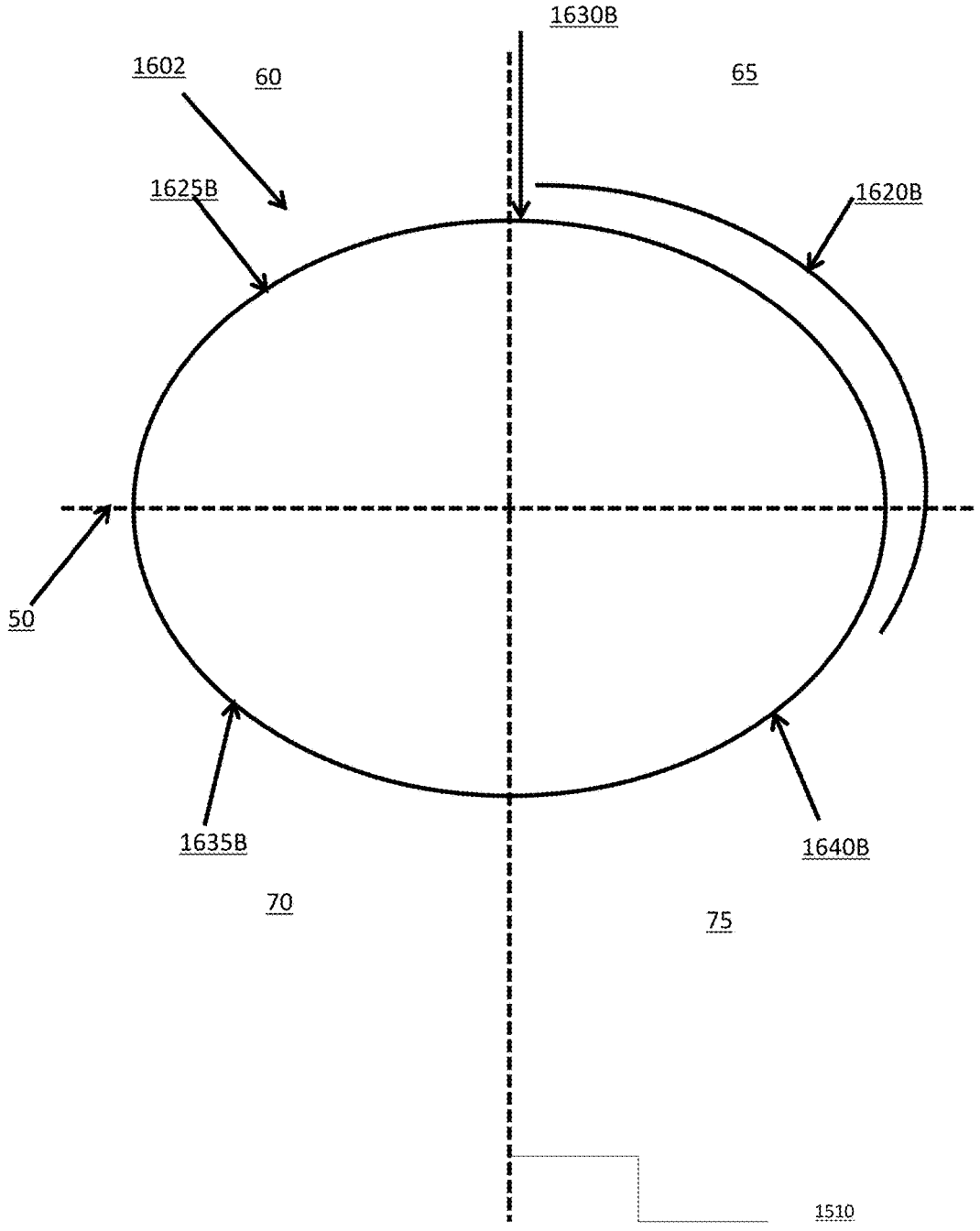
Figure 16C:
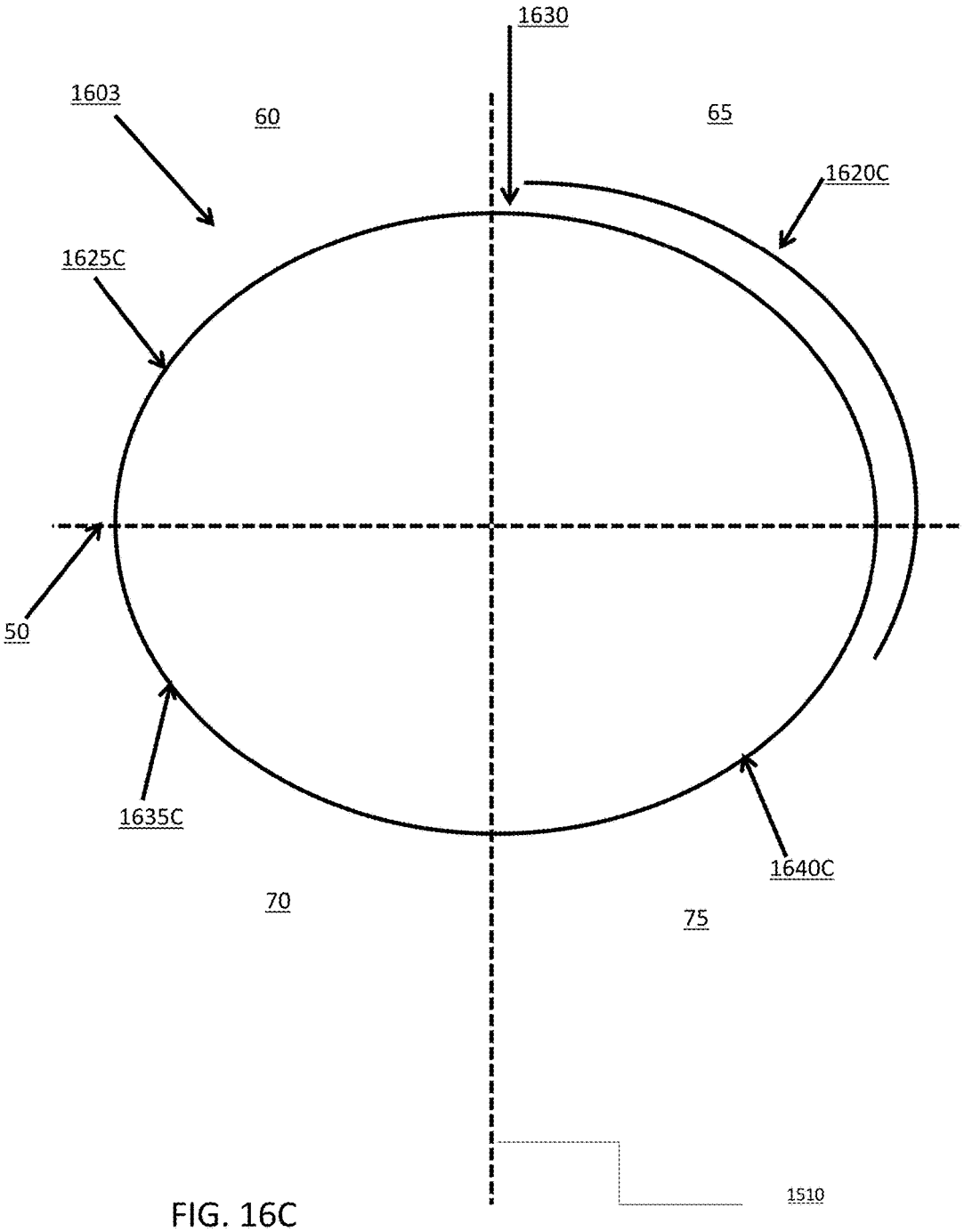

As shown in FIGS. 15A, 15B, 15C, and 15D, a length of sizing arcs 1520A, 1520*b*, 1520C, and 1520D (i.e., how far the arc wraps around a wearer) may be responsive to the size of the wearer. In the embodiments of these figures, the sizing arcs 1520A, 1520B, 1520C, and 1520D wrap around to a reference line 1545, which extends from the intersection of reference line 1510 and vertical reference line 50 at an angle to vertical reference line 50 so that reference line 1545 coincident with the end of sizing arc 1520A, 1520B, 1520C, and 1520D. In the embodiments of FIGS. 15A, 15B, 15C, and 15D, the angle between vertical reference line 50 and reference line 1545 decreases in magnitude (i.e., reference line 1545 moves closer to vertical reference line 50) as the size of ellipse 1500, 1501, 1052, and 1503 increases. In this way, the sizing arc does not extend as far around the relatively large ellipse 1503 when compared with the relatively small ellipse 1502. This may offer a few benefits such as, for example, interchangeability of frames, support structures, and/or casings between sizes (e.g., a sizing arc 1520A may be adapted so that it may be worn with a wearer who approximates ellipse 1502 by expanding sizing arc 1502A around her). Another benefit is that larger wearers typically have softer tissue on their back. Having less of their back covered with the sizing arc or a corresponding frame, support structure, or casing would mean the sizing arc would be less likely to press into the soft tissue and create unwanted bulges of tissue. A further benefit is that when the angle between vertical reference line 50 and reference line 1545 is relatively small, this enables a larger portion of the cantilevering of the frame, support structure, and/or casing to be provided closer to the breast tissue than when the angle is relatively larger, a sizing arc or a corresponding frame, support structure, or casing that extends FIGS. 16A-16F provide a set of figures that illustrate a set of sizing arcs 1620A, 1620B, and 1620C that may be determined, used, and/or selected to approximate dimensions of a wearer's torso 20 and/or determine a size or shape for a frame, support structure, and/or casing for a wearer 10. While only three sizing arcs are shown in FIGS. 16A-16F, it will be understood that any number (e.g., 1, 2, 16, 5, 6, 7, 8, and so on) of sizing arcs may be appropriate/used. Sizing arcs may correspond to dimensions of a frame, support structure, and/or casing, such as frame 1400, support structure 1800, and/or casing 2700 as is discussed below in greater detail with regard to FIGS. 16D-16F. More particularly, FIGS. 16A-16C show a set of ellipses that approximately correspond to a size and shape of cross sections of an exemplary wearer's 10 torsi at horizontal inframammary fold reference line 45, first horizontal reference line 46, and second horizontal reference line 47, respectively. In the example of FIGS. 16A-16C, the dimensions of wearer as they progress from horizontal inframammary fold reference line 45 through second horizontal reference line 47 increase in size (i.e., a circumference of the wearer's torso at second horizontal reference line 47 is larger than a circumference of wearer's torso 20 at horizontal inframammary fold reference line 45) as may be the case when wearer 10 is overweight. More specifically, FIG. 16A shows ellipse 1601, which represents an approximation of the cross-sectional dimensions of the wearer's 10 torso at, or near, horizontal inframammary fold reference line 45. Ellipse 1601 is similar in many respects to ellipse 1500 except that it is larger. Ellipse 1601 is in the Z-Y plane that is perpendicular to the sagittal plane center midline 25 with reference line 1510 representing the Z-axis and vertical reference line 50 (which corresponds with vertical reference line 50) representing the X-axis. An upper left arc 1625A of ellipse 1601 corresponds to the first (i.e., left) anterior side 60 of wearer 10, an upper right arc 1630A of ellipse 1601 corresponds to the second (i.e., right) anterior side 65 of wearer 10, a lower left arc 1635A of ellipse 1601 corresponds to the first (i.e., left) posterior side 160 of wearer 10, a lower right arc 1640A of ellipse 1601 corresponds to the second (i.e., right) posterior side 45 of wearer 10.

FIG. 16A also illustrates an exemplary first sizing arc 1620A that bears similarity to sizing arc 1520 except that it is of a different size/has a different set of dimensions (e.g., length, radius of curvature, shape, etc.) that correspond to the size and shape of upper right arc 1630A and/or a portion of lower right arc 1640A. Like sizing arc 1520, one or more dimensions of first sizing arc 1620A may be used to design and/or make an exemplary frame, support structure, and/or casing, such as the frames, support structures, and casings disclosed herein as will be discussed below.

FIG. 16B shows ellipse 1602, which represents an approximation of the cross-sectional dimensions of the wearer's 10 torso at, or near, first horizontal reference line 46. Ellipse 1602 is similar in many respects to ellipse 1601 except that it is larger because a diameter/size of the wearer at first horizontal reference line 46 is larger than a diameter/size of the wearer at horizontal inframammary fold reference line 45. An upper left arc 1625B of ellipse 1602 corresponds to the first (i.e., left) anterior side 60 of wearer 10, an upper right arc 1630B of ellipse 1602 corresponds to the second (i.e., right) anterior side 65 of wearer 10, a lower left arc 1635B of ellipse 1602 corresponds to the first (i.e., left) posterior side 70 of wearer 10, and a lower right arc 1640B of ellipse 1602 corresponds to the second (i.e., right) posterior side 75 of wearer 10.

FIG. 16B also illustrates an exemplary second sizing arc 1620A that bears similarity to first sizing arc 1620A except that it is of a different size/has a different set of dimensions (e.g., length, radius of curvature, shape, etc.) that correspond to the size and shape of upper right arc 1630B and/or a portion of lower right arc 1640B. Like first sizing arc 1620A, one or more dimensions of second sizing arc 1620B may be used to design and/or make an exemplary frame, support structure, or casing, such as the frames and casings disclosed herein as will be discussed below.

FIG. 16C shows ellipse 1603, which represents an approximation of the cross-sectional dimensions of the wearer's 10 torso at, or near, second horizontal reference line 47. Ellipse 1603 is similar in many respects to ellipse 1602 except that it is larger because a diameter/size of the wearer 10 at first horizontal reference line 46 is larger than a diameter/size of the wearer 10 at horizontal inframammary fold reference line 45. An upper left arc 1625C of ellipse 1603 corresponds to the first (i.e., left) anterior side 60 of wearer 10, an upper right arc 1630C of ellipse 1603 corresponds to the second (i.e., right) anterior side 65 of wearer 10, a lower left arc 1635C of ellipse 1603 corresponds to the first (i.e., left) posterior side 70 of wearer 10, and a lower right arc 1640C of ellipse 1603 corresponds to the second (i.e., right) posterior side 75 of wearer 10.

FIG. 16C also illustrates an exemplary third sizing arc 1620C that bears similarity to second sizing arc 1620B except that it is of a different size/has a different set of dimensions (e.g., length, radius of curvature, shape, etc.) that correspond to the size and shape of upper right arc 1630C and/or a portion of lower right arc 1640B. Like second sizing arc 1620A, one or more dimensions of third sizing arc 1620C may be used to design and/or make an exemplary frame, support structure, and/or casing, such as the frames support structures, and/or casings disclosed herein as will be discussed below.

Figure 16D:
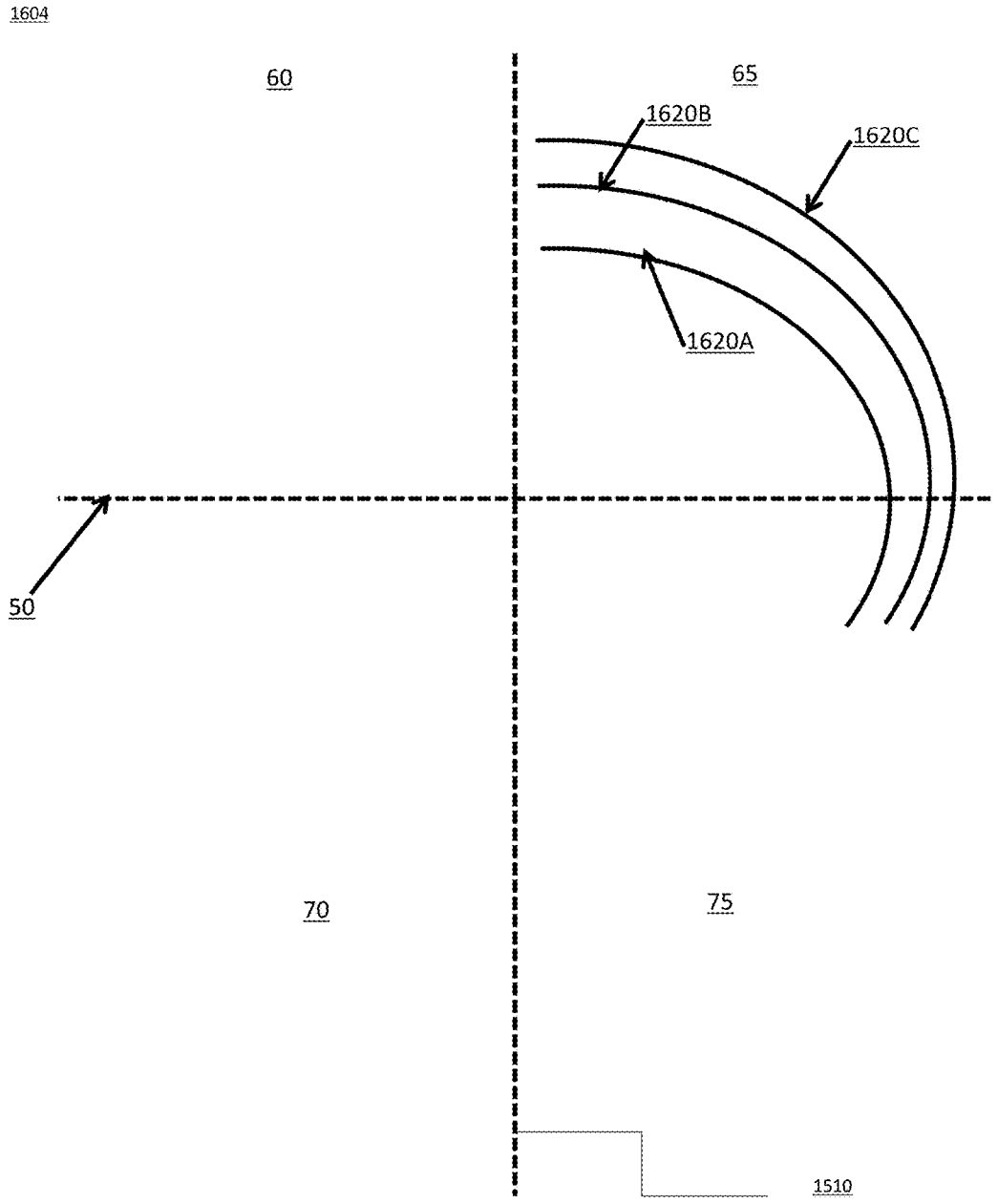

FIG. 16D provides a diagram of first, second, and third sizing arcs 1620A, 1620B, and 1620C, respectively, as viewed from above and superimposed with one another thereby providing a contour map 1604 showing how the size, shape, and/or position of sizing arcs 1620A, 1620B, and 1620C relate to one another with regard to reference lines 50 and 1510. Contour map 1604 may then be used to determine various dimensions (e.g., curvature, length, width, etc.) for arc 1475, frame 1400, support structure 1800, and/or casing 2700 as shown in FIGS. 16E and 16F.

Figure 16E:
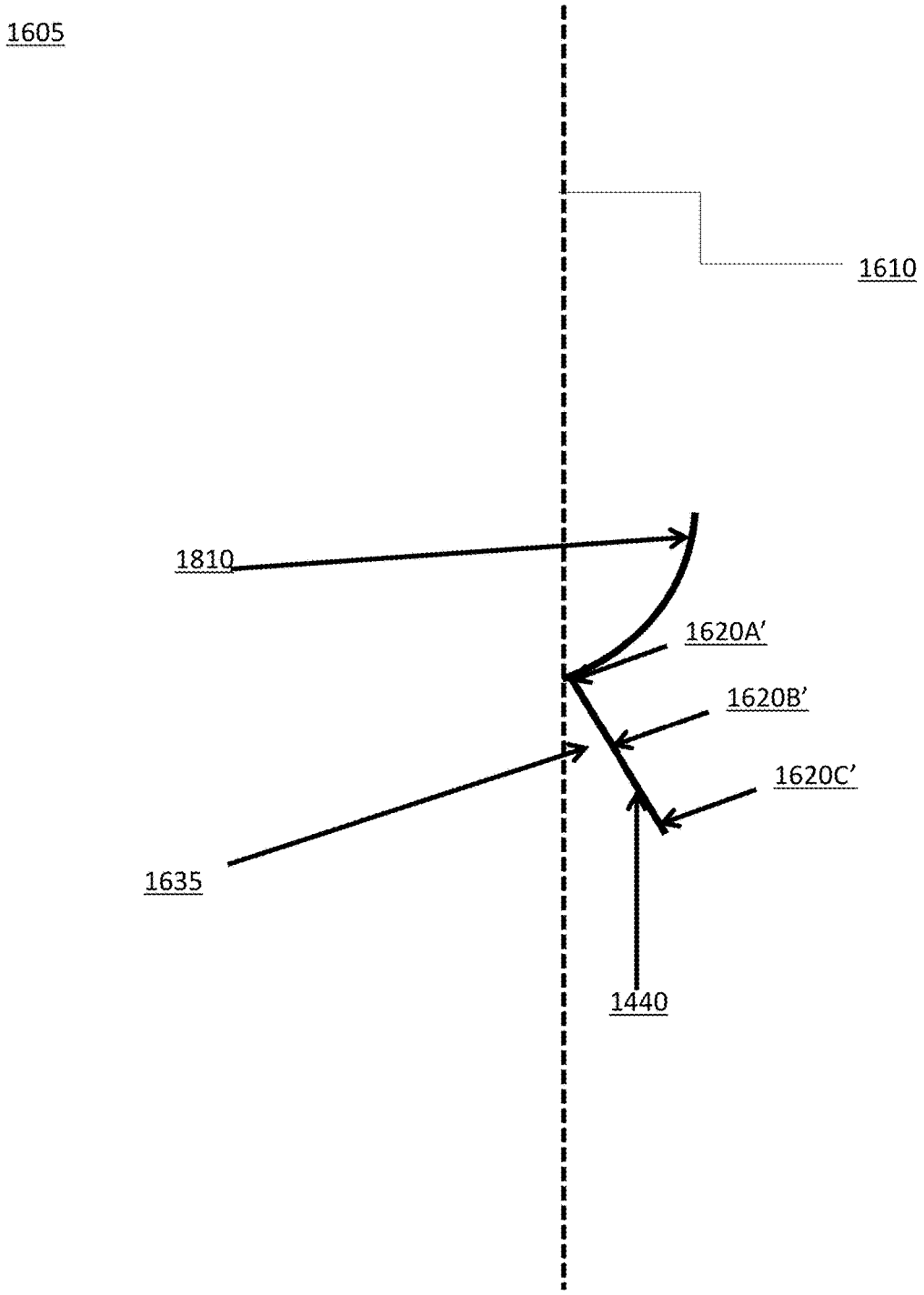

FIG. 16E shows a cross-section of an exemplary support structure 1605 that includes a volumetric cup portion 1810 and an under-bust band 1440 as bisected vertically through a center of the volumetric cup portion 1810. Support structures like support structure 1605 and volumetric cup portions like volumetric cup portion 1810 will be discussed in greater detail below with regard to FIG. 6. FIG. 16E also shows a first sizing arc position 1620A', a second sizing arc position 1620B', and third sizing arc position 1620C', all of which have positions that correspond with different portions under-bust band 1440.

Support structure 1605 may be manufactured and/or selected for the wearer 10 whose measurements were used to determine ellipses 1601, 1602, and 1603 and/or first, second, and/or third sizing arcs 1620A, 1620B, and 1620C. Support structure 1605 has a length determined by the distance between first sizing arc position 1620A' and third sizing arc position 1620C' that is positioned at an angle 1635 relative to vertical reference line 1610. Horizontal reference line 1610 is intended to approximately superimpose, or line up, with vertical inframammary fold reference line 52. The size of angle 1635 may be determined by a relative distance between first sizing arc position 1620A' and second sizing arc position 1620B', first sizing arc position 1620A' and third sizing arc position 1620C', and/or second sizing arc position 1620B' and third sizing arc position 1620C' as provided by, for example, contour map like contour map 1604. In the example of support structure 1605, the angle/plane of under-bust band 1440 is constant for the length of under-bust band 1440 (i.e., the magnitude of angle 1635 does not change).

Figure 16F:
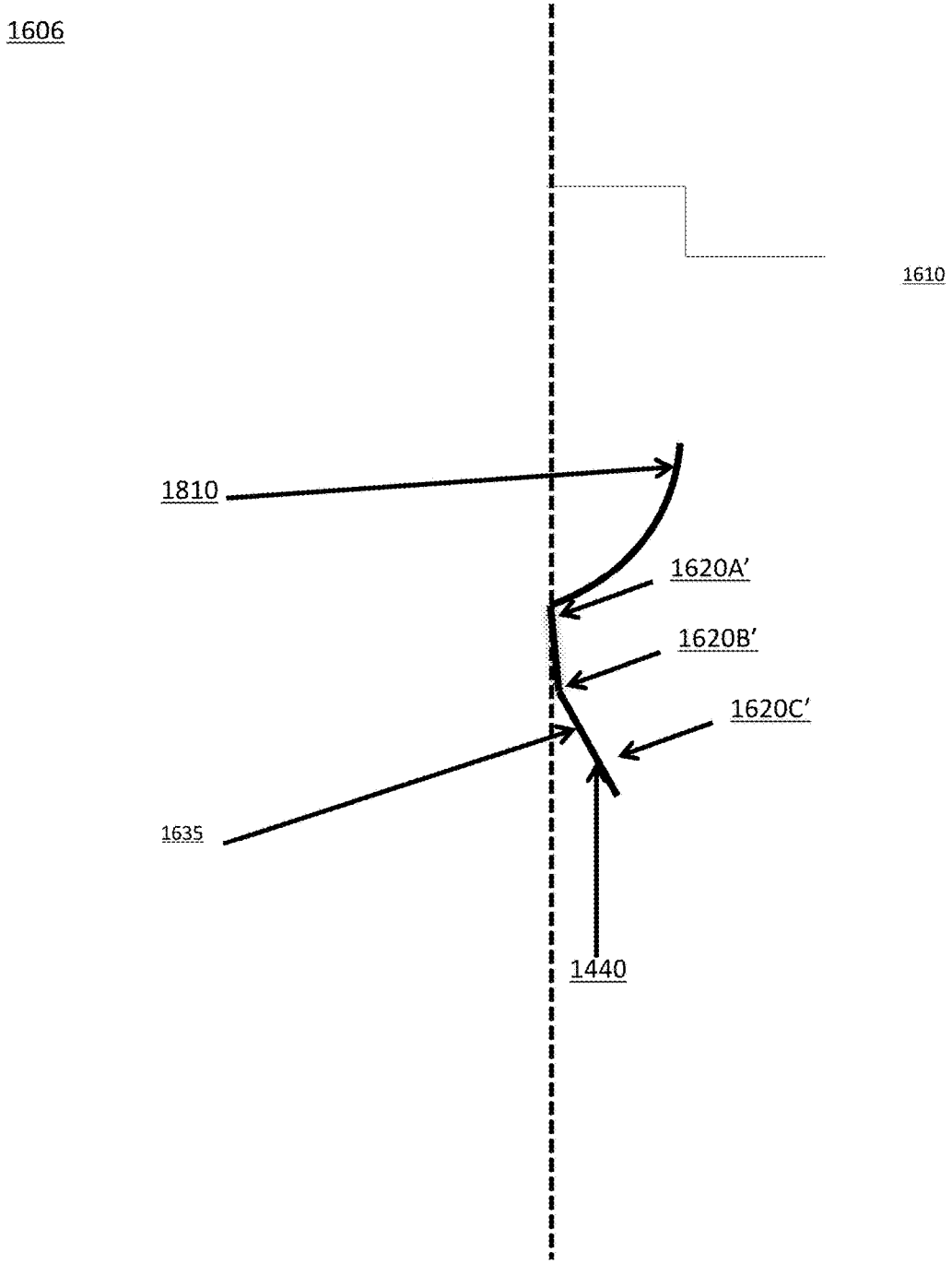

In some embodiments, like the support structure 1606 provided by FIG. 16F, the cross-section of under-bust band 1440 may vary according to, for example, dimensions of a wearer 10 and/or ellipses 1610, 1602, and/or 1603. As shown in FIG. 16F, a first portion of under-bust band 1440 between first sizing arc position 1620A' and second sizing arc position 1620B' is substantially parallel with vertical reference line 1610 and a second portion of under-bust band 1440 between second sizing arc position 1620B' and third sizing arc position 1620C' is oriented at an angle 1635 relative to vertical reference line 1610. This shape of support structure 1606 and/or under-bust band 1440 may fit a wearer who is smaller than the wearer for support structure 1605.

In some instances, the sizing arcs of FIGS. 15A-15D and 16A-16F may be similar to, and/or the same as, the under-bust bands discussed herein. At times, a frame, support structure, casing, and/or housing as discussed herein may be substituted for the sizing arcs disclosed herein to, for example, establish a size of a wearer by directly comparing her body with the respective frame, support structure, casing, and/or housing.

Additionally, or alternatively, the sizing arcs of FIGS. 15A-15D and 16A-16F may be adapted to determine a size and/or shape of a wearer's inframammary fold by, for example, providing a series of different sizes and shapes for an inframammary fold for comparison to the wearer's anatomy/inframammary fold.

Figure 17A:
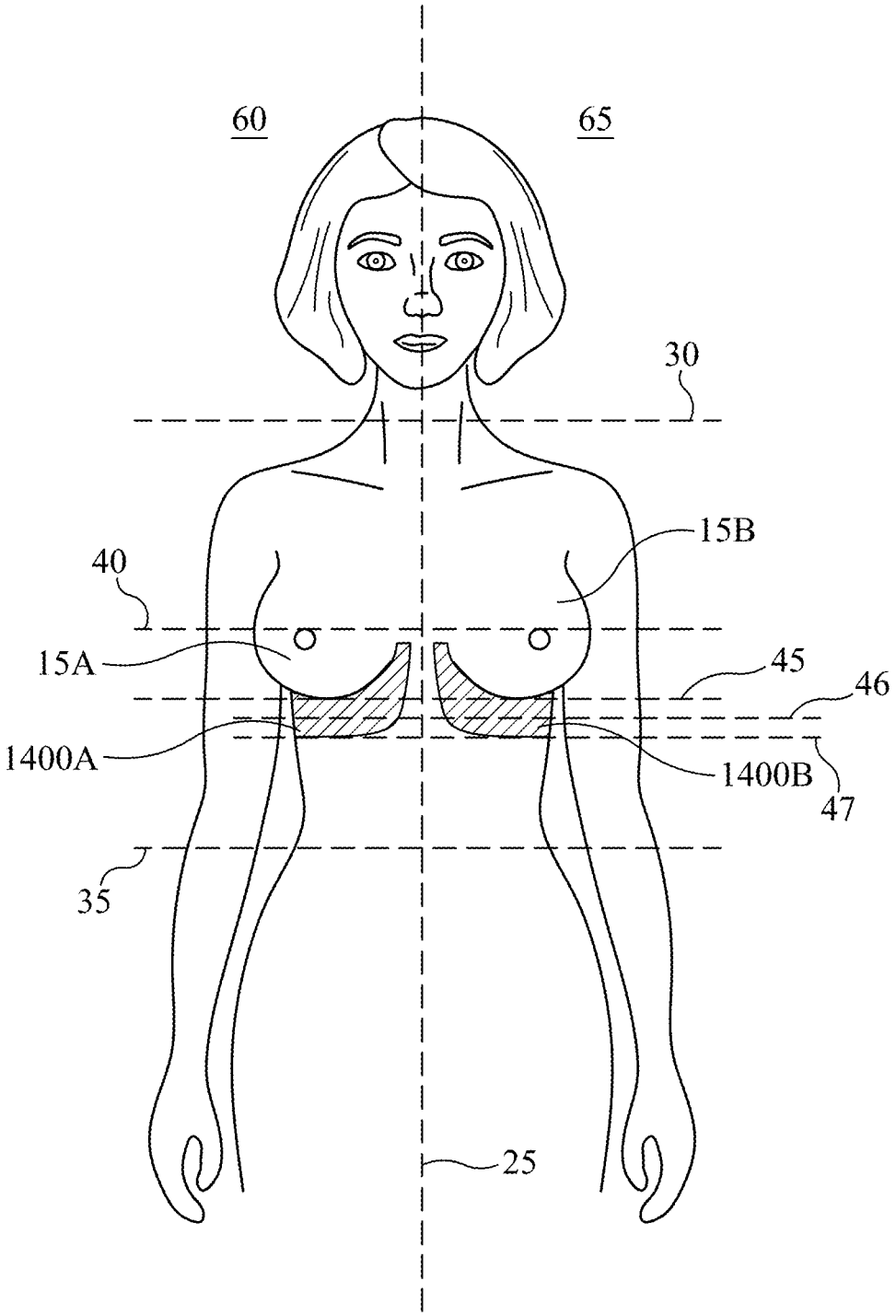
Figure 17B:
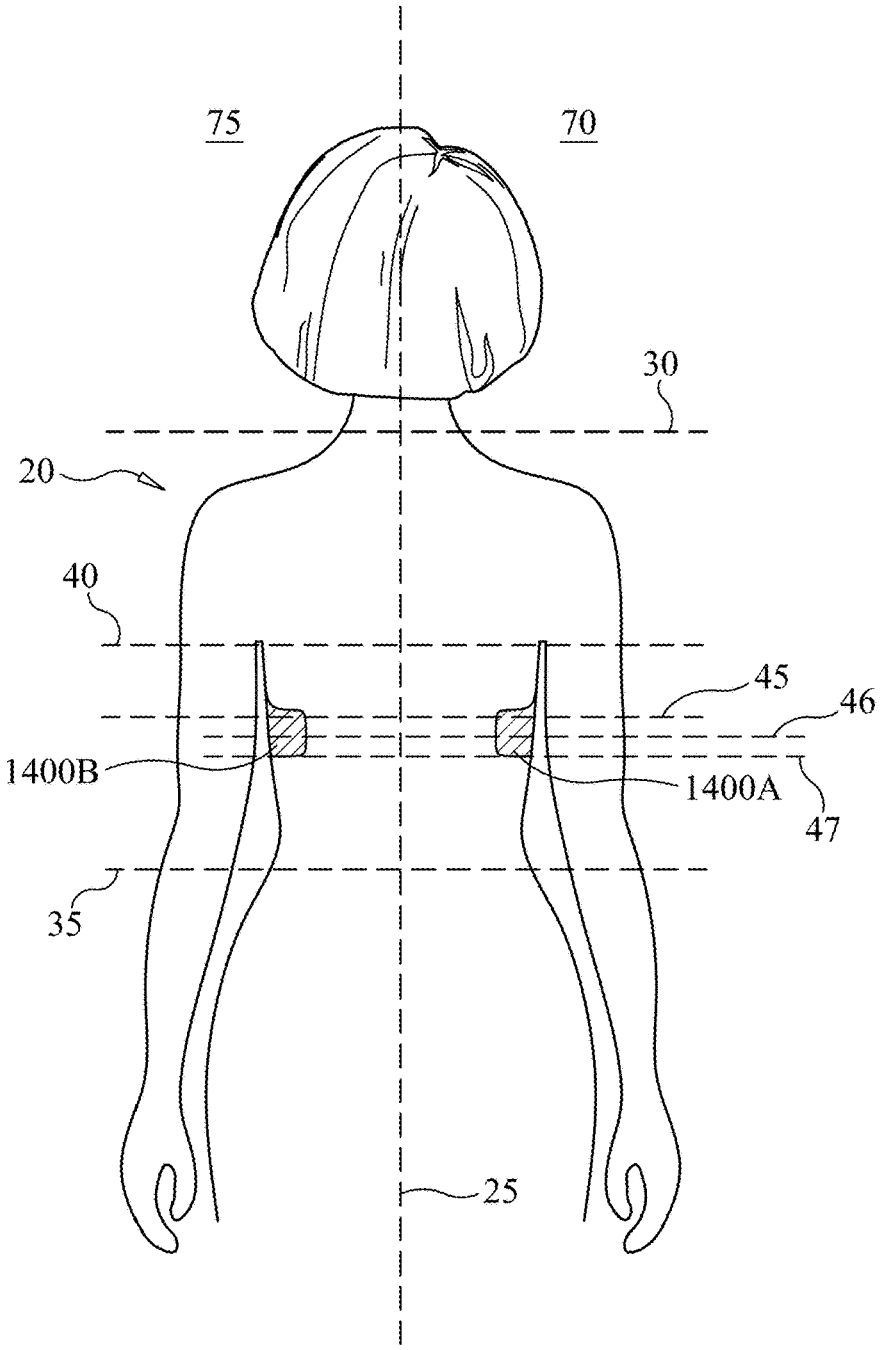
Figure 17C:
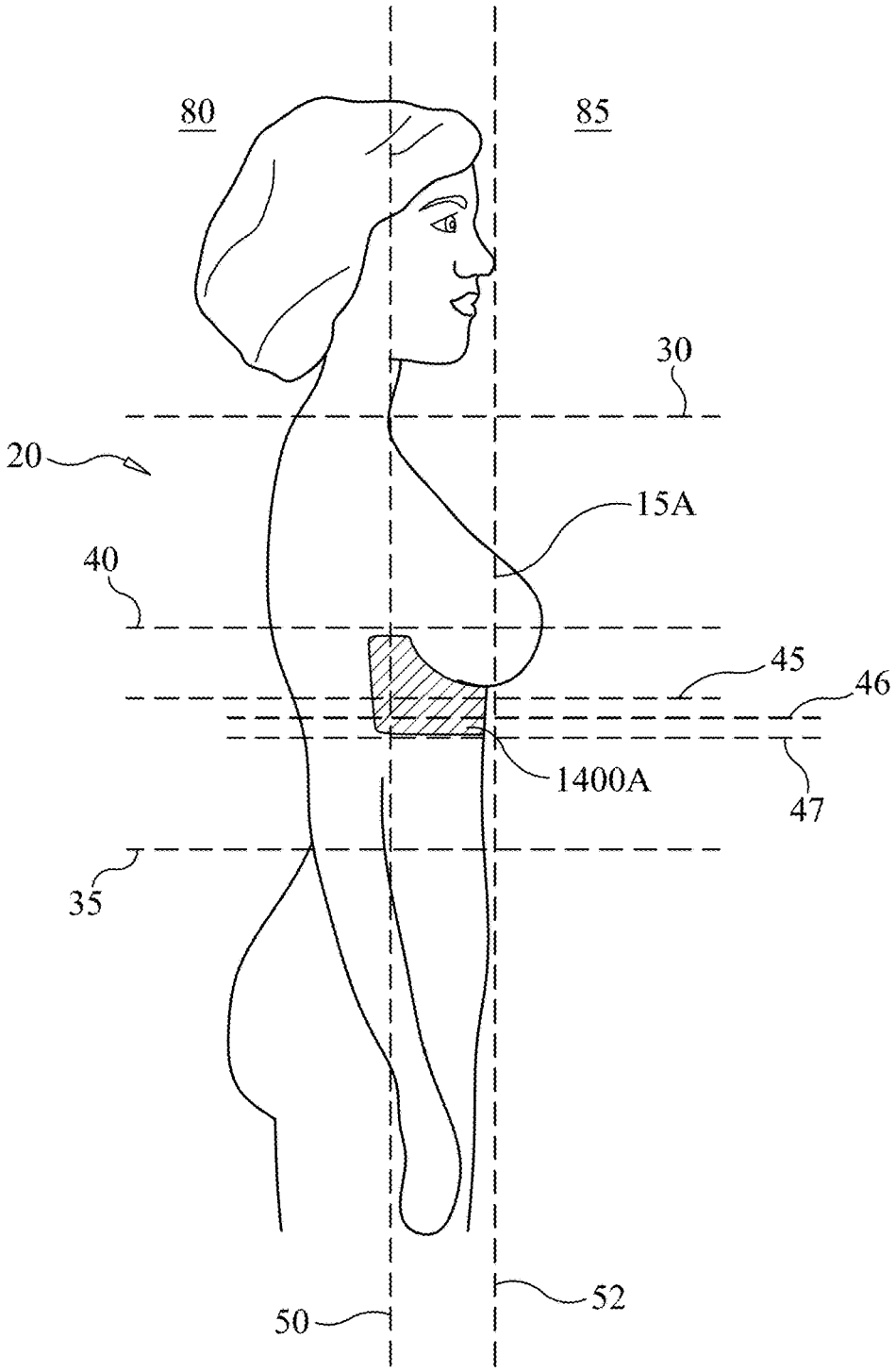

FIGS. 17A, 17B, and 17C provide an image of wearer 10 wearing an exemplary frame $\mathbf{1400}_A$ on her first anterior side 60 and a frame $\mathbf{1400}_B$ on her second anterior side 65 as seen from the anterior, lateral, and posterior of wearer 10, respectively. Frames $\mathbf{1400}_A$ and $\mathbf{1400}_B$ are primarily positioned underneath the wearer's first breast $\mathbf{15}_A$ and second breast $\mathbf{15}_B$. It is expected that wearer 10 will wear frames $\mathbf{1400}_A$ and $\mathbf{1400}_B$ when they are positioned within and/or coupled to a support structure, casing, housing, and/or garment (not shown) as discussed herein and FIGS. 17A-17D provide an example of how frames $\mathbf{1400}_A$ and $\mathbf{1400}_B$ would be correspond with wearer's torso 20 when so positioned. In some embodiments, frames $\mathbf{1400}_A$ and $\mathbf{1400}_B$ may be of the same, or similar, dimensions but may be mirror images of one another and, in other embodiments, a size or shape of frame $\mathbf{1400}_A$ may be different from a size or shape of frame $\mathbf{1400}_B$ (and vise-versa) as may be needed or preferred when, for example, breast $\mathbf{15}_A$ is not the same size or shape as breast $\mathbf{15}_B$ or when a breast $\mathbf{15}_A$ and/or $\mathbf{15}_B$ has been removed (via, for example, mastectomy) or is being replaced or augmented with a prosthetic breast or other padding.

A shape and/or intended position of frames $\mathbf{1400}_A$ and $\mathbf{1400}_B$ may serve to improve the comfort of wearing the respective frame and/or a support structure, casing, and/or garment including same. For example, frames $\mathbf{1400}_A$ and $\mathbf{1400}_B$ may redistribute breast weight to the wearer's torso and serve to increase the surface area of the wearer's body to which the breast weight is applied/redistributed, which thereby decreases the pressure applied to the wearer's skin/torso compared with traditional bras and bra-like garments.

As may be seen in FIG. 17A, inner edge 1420 of intermammary-cleft portion 1410 of frames $\mathbf{1400}_A$ and $\mathbf{1400}_B$ are positioned near, and approximately parallel to, sagittal plane center midline 25. In most cases, inner edge 1420 of frames $\mathbf{1400}_A$ and $\mathbf{1400}_B$ will not touch one another when worn so as to, for example, provide flexibility for a garment into which frames $\mathbf{1400}_A$ and $\mathbf{1400}_B$ are included and/or enable the opening of the garment via, for example, a center closure device. However, in some cases, frames $\mathbf{1400}_A$ and $\mathbf{1400}_B$ may touch along inner edge 1420 and/or be two sides of a single frame structure that is one piece, or multiple pieces coupled or bonded together via, for example, a flexible junction. In this way, frames $\mathbf{1400}_A$ and $\mathbf{1400}_B$ may be incorporated into a garment or bra that opens in the front, back, or doesn't open (e.g., is pulled on over the wearer's head).

Intermammary-cleft portions 1410 of frames $\mathbf{1400}_A$ and $\mathbf{1400}_B$, respectively, may be, for example, positioned along the vertical axis intersecting with line 40 or underneath a bottom portion of wearer's respective first and second breasts $\mathbf{15}_A$ and $\mathbf{15}_B$. The intermammary-cleft portions 1410 may serve to, for example, separate and/or shape wearer's respective first and second breasts $\mathbf{15}_A$ and $\mathbf{15}_B$ and a size and/or shape of under-bust band upper edge 1440 may approximate a shape of the bottom portion of breasts $\mathbf{15}_A$ and/or $\mathbf{15}_B$ and/or the an underside of breasts $\mathbf{15}_A$ and/or $\mathbf{15}_B$ and/or the wearer's inframammary fold surrounding breasts $\mathbf{15}_A$ and/or $\mathbf{15}_B$. Intermammary-cleft portion 1410 and/or under-bust band portion 1430 may assist with (i.e., provide support for) a cantilevered volumetric cup portion proximate thereto as will be discussed in further detail below.

FIG. 17B provides a lateral side view of wearer's first side 60 and first breast $\mathbf{15}_A$, which shows an example of how wrap-around portion 1445 may correspond to wearer's torso 20 under her arm (in FIG. 17B, a portion of wearer's arm has been removed so that the positioning of wrap-around portion 1445 may be clearly seen). In the example of FIG. 17B, wrap-around portion 1445 spans the width of the lateral side of wearer's torso and wraps around a portion of her posterior as shown in FIG. 17C. In this way, wrap-around portion 1445 may assist with (i.e., provide support for) a cantilevered volumetric cup portion proximate thereto as will be discussed in further detail below.

FIGS. 18A-18F provide front, back, outside, inside, top, and bottom views, respectively, of an exemplary support structure 1800 that includes a frame 1400 and a volumetric cup portion 1810. Volumetric cup portion 1810 is proximate to under-bust band 1430 along the curvature of upper edge of under-bust band 1440 and abuts intermammary-cleft portion 1410 along intermammary-cleft portion reference line 1405 on the inner side and wrap-around portion 1445 along wrap-around portion reference line 1470. Volumetric cup portion 1810 may be shaped, or configured, to define a lower portion of a substantially semi-spherical-like or parabolic-like shape that extends orthogonally, or substantially orthogonally, from the under-bust band 1430. Volumetric cup portion 1810 may be adapted to be positioned in an underside portion of a breast cup of a frame, casing, garment, or other structure (not shown) and is shaped so as to accommodate acceptance of a portion of an underside of a breast, such as breast 15, therein.

In some instances, volumetric cup portion 1810 is a cantilever anchored or supported by the frame 1400 and/or a portion thereof. When volumetric cup portion 1810 is subjected to a load via, for example, placement of a wearer's breast (or portion thereof) therein, frame 1400, wrap-around portion 1445, and/or under-bust band 1430 may anchor that load and redistribute it to the wearer's torso 20 when support structure 1800 is worn by a wearer 10. Volumetric cup portion 1810 may also act to shape the wearer's breasts 15 in a desired fashion by repositioning breast volume to a preferred location (e.g., in toward the intermammary cleft, away from the intermammary cleft, upward (i.e., toward the wearer's head), outward, and/or inward).

An upper edge of volumetric cup portion 1810 may be of a uniform shape and/or may have one or more shapes, such as first curved edge 1815 and second curved edge 1820 along its length. It will be understood by those of skill in the art that other embodiments of volumetric cup portion 1810 may have any number of edges or curves (e.g., a single edge (i.e., not a combination of first and second curved edges), or three curved edges). For example, in some embodiments, an upper edge of volumetric cup portion 1810 may have a relatively uniformly curving edge while, in other embodiments, an upper edge of volumetric cup portion 1810 may have repetitive arc or organic shapes that may act to interrupt a straight, or curved line along upper edge of volumetric cup portion 1810. The features along upper edge of volumetric cup portion 1810 may provide greater flexibility for support structure 1800 by allowing the support structure 1800 to flex and contour depending on and/or in response to, for example, a weight of a breast, like breast 15A or 15B positioned within volumetric cup portion 1810, a size according to the second sizing convention, and/or a movement of a wearer and/or breast when positioned within volumetric cup portion 1810.

In some instances, upper edge of under-bust band 1430 may be configured to sit, or abut, the wearer's torso 20 under her breast $\mathbf{15}_A$ or $\mathbf{15}_B$ (e.g., at, or near, her inframammary fold) and may be adapted to join with volumetric cup portion 1810 to create cantilever projection in a shape that surrounds a portion of the breast tissue of breast $\mathbf{15}_A$ or $\mathbf{15}_B$ and shapes the breast tissue into a pre-determined volumetric cup shape as defined by the shape or contours of volumetric cup portion 1810, upper edge of under-bust band 1430, support structure 1800, and/or frame 1400 or a casings and/or housing like casing 2700 and/or housing 3400 as discussed below.

In some embodiments, upper edge of under-bust band 1430 may create a shelf edge to contour the breast tissue into the shape of volumetric cup portion 1810. Upper edge of under-bust band 1430 may also serve as a junction point for the cantilever projection of volumetric cup 1810 where the volumetric cup 1810 joins under-bust band 1410 and extends outward therefrom at an angle (e.g., 45°-160°). The magnitude of projection (i.e., how far volumetric cup portion 1810 extends from under-bust band 1430) may vary along the length of the upper edge of under-bust band 1430. In some embodiments, a magnitude of projection may be at a maximum in the center of the volumetric cup portion 1810 that may align, along the Y-axis, with an apex of volumetric cup portion 1810 and/or a desired apex of the wearer's breasts when wearing support structure 1800. Additionally, or alternatively, a magnitude of cantilever projection of volumetric cup portion 1810 may be at maximum at, or near, a lowest point in the curvature of the upper edge of under-bust band 1430. The amount of projection of volumetric cup portion 1810 may gradually decrease (to e.g., zero, or nearly zero) along its length moving toward wrap-around portion 1445 and/or intermammary-cleft portion 1405 at, or near, wrap-around portion reference line 1470 and/or intermammary-cleft portion 1410 at, or near, intermammary-cleft portion reference line 1405, respectively.

Stated differently, a magnitude of cantilever projection of volumetric cup portion 1810 from under-bust band 1430 may blend into one another at wrap-around portion 1445 so they form a planar surface at, or near, wrap-around portion reference line 1470 for wrap-around portion 1445 and/or the volumetric cup portion 1810 and under-bust band 1430 blend into one another into so they form a planar surface at, or near, intermammary-cleft portion reference line 1405.

This tapering may increase the comfort of wearing support structure 1800 and/or a casing or housing including a support structure 1800 at least because it may position the breast tissue forward in volumetric cup portion 1810 while, in some instances, removing/reducing friction between the wearer's side (under her arm) and/or breast (when for example, compared with a traditional under-wire bra).

In some embodiments, an angle between volumetric cup portion 1810 and the upper edge of under-bust band 1430 may be consistent along its length. In other embodiments, the angle between volumetric cup portion 1810 and the upper edge of under-bust band 1430 may very along its length so that, for example, a magnitude of the angle is at a minimum at, or near, a lowest point in the curvature of the upper edge of under-bust band 1430 and gradually increases along its length moving toward wrap-around portion 1445 (e.g., wrap-around portion reference line 1470) and/or intermammary-cleft portion 1410 (e.g., intermammary-cleft portion reference line 1405) to become close to 180° so that the cantilever projection of volumetric cup portion 1810 may gradually taper into wrap-around portion 1445 and/or intermammary-cleft portion 1410 at, or near, wrap-around portion reference line 1470 and/or intermammary-cleft portion reference line 1405, respectively. Stated differently, volumetric cup portion 1810 and under-bust band 1430 blend into one another at wrap-around portion 1445 so they form a planar surface at, or near, wrap-around portion reference line 1470 for wrap-around portion 1445 and/or the volumetric cup portion 1810 and under-bust band 1430 blend into one another into so they form a planar surface at, or near, intermammary-cleft portion reference line 1405.

This tapering may increase the comfort of wearing support structure 1800 and/or a casing or housing including a support structure 1800 at least because it will position the breast tissue forward in volumetric cup portion 1810 but removes/reduces friction and/or pressure points between the wearer's side (under her arm) and/or breast (when for example, compared with a traditional under-wire bra).

In most embodiments, a curvature, or shape, of upper edge of under-bust band 1430, or the shelf created therewith, transitions from the front most part of inframammary cleft portion 1410 to the wrap-around portion 1445, which is configured to align with the wearer's underarm area when worn. The contour of this shelf may be most prominent (i.e., extend the furthest outward) at, or near, a portion of the volumetric cup portion 1810 configured to align (along the Y-axis) with an apex of the wearer's breast tissue and/or near the center under-bust band 1430 as measured as the midpoint between inframammary cleft portion reference line 1405 and wrap around portion reference line 1470 to create a ridge that transitions (or decreases in size) by gradually blending into wrap around portion 1445 at a mid-point height of support structure 1800. The wrap-around portion 1445 may be configured to contour the breast shape into the volumetric cup portion 1810 and, in some instances, may be adapted to minimizes any friction between the wearer's torso 20 and/or breast $\mathbf{15}_A$ or $\mathbf{15}_B$ and at, or near, wrap around portion reference line 1470 by way of, for example, a ridge, or shelf, gradually blending into the wrap-around portion 1445 so that it is flush, or planar, with the plane of the wrap-around portion 1445.

In the embodiment pictured in FIGS. 18A-18F, first curved edge 1815 extends from peak 1465 downward in a curved c-shaped fashion and meets second curved edge 1820 at, or near, an apex of volumetric cup portion 1820. In some embodiments, a material used to manufacture volumetric cup portion 1810 may be the same as the material used to manufacture frame 1400. When different materials are used, a more-rigid material (e.g., plastic) may be used for frame 1400 and a less-rigid material (e.g., thinner plastic and/or foam) may be used for volumetric cup portion 1810.

In some instances, support structure 1800 and/or frame 1400 may include two or more pieces joined together via, for example, chemical, mechanical, or heat bonding processes. Additionally, or alternatively, support structure 1800 and/or frame 1400 may be coupled together via mechanical means. Joints between two or more pieces that make up a support structure 1800 and/or a frame 1400 and/or join together a frame 1400 and a support structure 1800 may be flexible via, for example, use of a flexible joining material and/or a structure of frame 140 and/or support structure 1800 and, in other instances, the joints may be rigid via, for example, use of a rigid joining material and/or a structure of frame 140 and/or support structure 1800. Additionally, or alternatively, one or more joints may vary in thickness when compared with surrounding material comprising support structure 1800, under-bust band 1430, and/or volumetric cup portion 1810. This variation in thickness may be configured to provide flexibility to, for example, support structure 1800, under-bust band 1430, and/or volumetric cup portion 1810. Additional flexibility may be created via the use of multiple joints throughout the frame 1400 or volumetric cup 1810. The flexibility may be configured accommodate a change in breast size and/or volume that may be caused by, for example, hormonal or weight fluctuations or movement by, for example, expanding and/or contracting of frame 1400, support structure 1800, and/or joints therebetween.

In other embodiments, a material used to manufacture both frame 1400 and volumetric cup portion 1810 may be the same throughout, but a thickness of the material may be different. In this embodiment, a thickness of frame 1400 may be greater than that of volumetric cup portion 1810 and/or a thickness of material used to manufacture support structure 1800 may be thickest at, or near, under-bust band upper edge 1440 and may get increasingly thinner as under-bust band extends toward under-bust-band lower edge 1435 and volumetric-cup-portion upper first and/or second edges 1815 and/or 1820. Additionally, or alternatively, an outer side (e.g., near wrap around portion reference line 1470) of volumetric cup of 1810 may be thicker and/or stiffer or more rigid than other portions of support structure 1800 and/or frame 1400 to support the weight of a breast $\mathbf{15}_A$ or $\mathbf{15}_B$ and, in some instances, reposition breast volume toward a front portion of volumetric cup 1810 near, for example, an apex or center of volumetric cup 1810. Stated differently, the outer portion of volumetric cup 1810 may be configured to push, or otherwise reposition, breast volume located at the side of breast $\mathbf{15}_A$ or $\mathbf{15}_B$ when, for example, no bra is worn toward the center of the wearer's chest, or center vertical midline 25, thereby repositioning breast volume toward the center of the wearer's body and away from her sides (i.e., away from vertical midline 50). In this example, the relative thinness of a front portion of volumetric cup 1810 when compared with the thickness of the side may be configured to provide flexibility to the support structure. In some instances, variations in a thickness of support structure 1800 and/or frame 1400 may be responsive to a wearer's breast volume, size as determined by, for example, one or more of process(es) 1400, 300, 400, 500, 1800, 700, 800, 900, 1000, and 1100 as discussed above with regard to FIGS. 2, 3, 4A, 4B, 5, 6, 7, 8, 9, 10, and 11, respectively. Additionally, or alternatively, a volumetric cup portion 1810 and frame 1400 may comprise material of differing thickness and/or structure depending on, for example, the wearer's cup volume and/or desired breast volume displacement.

Exemplary garments that may incorporate support structure 1800 include, but are not limited to, bras, sports bras, compression bras, bralettes, corsets, bustiers, camisoles, swimsuits, sports tops, shirts, and dresses. Although FIGS. 18A-18F show a support structure 1800 designed to be worn on breast $\mathbf{15}_A$, it will be understood that the support structure 1800, and/or the dimensions or manufacturing instructions used to manufacture support structure 1800, may be adapted to correspond to the wearer's breast $\mathbf{15}_B$ by, for example, using a mirror image of the dimensions used to manufacture support structure 1800. In some embodiments, support structure 1800 may be used to, for example, establish dimensions for, and/or a shape of, a support structure that may be adaptable to many (e.g., 4-40) different sizes (of, for example, the second sizing convention) via, for example, scaling up or down one or more dimensions thereof.

Holes present in support structure 1800 and/or frame 1400 (as shown in FIGS. 14A-14D, 18A-18F are optional and, in some instances may not be included in an exemplary support structure 1800 and/or frame 1400. These holes may be made by, for example, injection molds that include the holes, and/or punching, cutting, and/or stamping out material and/or may be part of the manufacturing process using, for example, 3D printing or the overlay of materials with perforations or openings therebetween. The placement of holes throughout support structure 1800 and frame 1400 shown in FIGS. 14A-14D and 18A-18F is just one example of how holes may be placed throughout support structure 1800 and frame 1400. For example, the holes or perforations provided throughout support structure 1800 and frame 1400 may be arranged in a regular pattern (e.g., a grid-like pattern) and/or may be spaced so as to concentrate rigidity (i.e., less holes) in areas of the support structure 1800 and/or frame 1400 configured to bear more breast weight, such as in wrap around portion 1445, upper edge of under-bust band 1440. Additionally, or alternatively, holes or perforations provided throughout support structure 1800 and frame 1400 may be arranged in areas of the support structure 1800 and/or frame 1400 configured to bear less breast weight and provide flexibility via, for example, the use of more holes, in areas of the support structure 1800 and/or frame 1400 configured to bear less breast weight, such as near intermammary cleft portion 1410 or first curved upper edge 1815. Additionally, or alternatively, the holes may be of various sizes so that, for example, greater rigidity may be achieved through the use of relatively small holes and greater flexibility may be achieved by the use of regularly large holes.

Support structure 1800 may be made from any appropriate material including, but not limited to, plastic, foam, resin, metal, metal wire, plastic wire, and combinations thereof. Exemplary plastics that may be used to manufacture the frame include, but are not limited to, PVC, thermoset plastics, and thermoplastics such as TPR, TPU, or TPE, all of which may be used in varying grades and durometers.

In some embodiments, a thickness of a support structure 1800 and/or frame 1400 may be uniform throughout the respective support structure/frame and, in other embodiments, a thickness of a support structure 1800 and/or frame 1400 may vary in different part(s) of the respective support structure/frame. For example, a support structure 1800 and/or frame 1400 may be thicker in areas where greater rigidity/support is desired and may be thinner in areas where greater flexibility/less support is desired. For instance, a material making up a region of a support structure 1800 positioned at, or near, a junction between volumetric cup portion 1810 and under-bust band 1430 may be thicker than the material making up a region of support structure 1800 along first curved upper edge 1815 and/or second curved upper edge 1820. An exemplary range of thickness for a support structure 1800 and/or frame 1400 is 0.01 mm-20 mm. In some cases, the thickness and/or range of thicknesses of a particular frame/support structure may depend on the overall size of the support structure 1800 and/or a casing or garment the support structure is designed to fit into. For example, a support structure 1800 adapted to be worn by a wearer with relatively large breasts 15 may have a thicker cross-sectional dimension than a support structure 1800 adapted to be worn by a wearer with relatively small breasts 15.

Figure 18A:
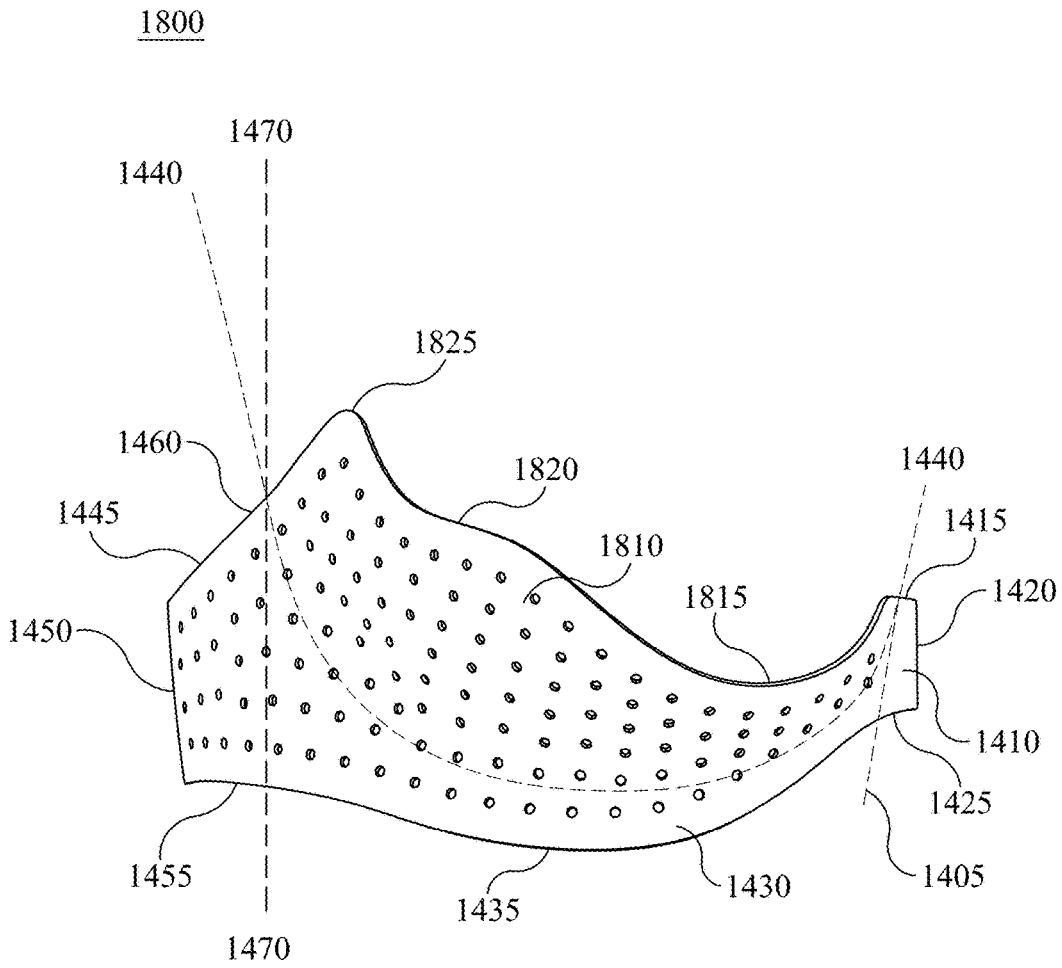
FIGS. 18A-18F provide front, back, outside, inside, top, and bottom views, respectively, of an exemplary support structure in accordance with embodiments of the present invention.
Figure 18B:
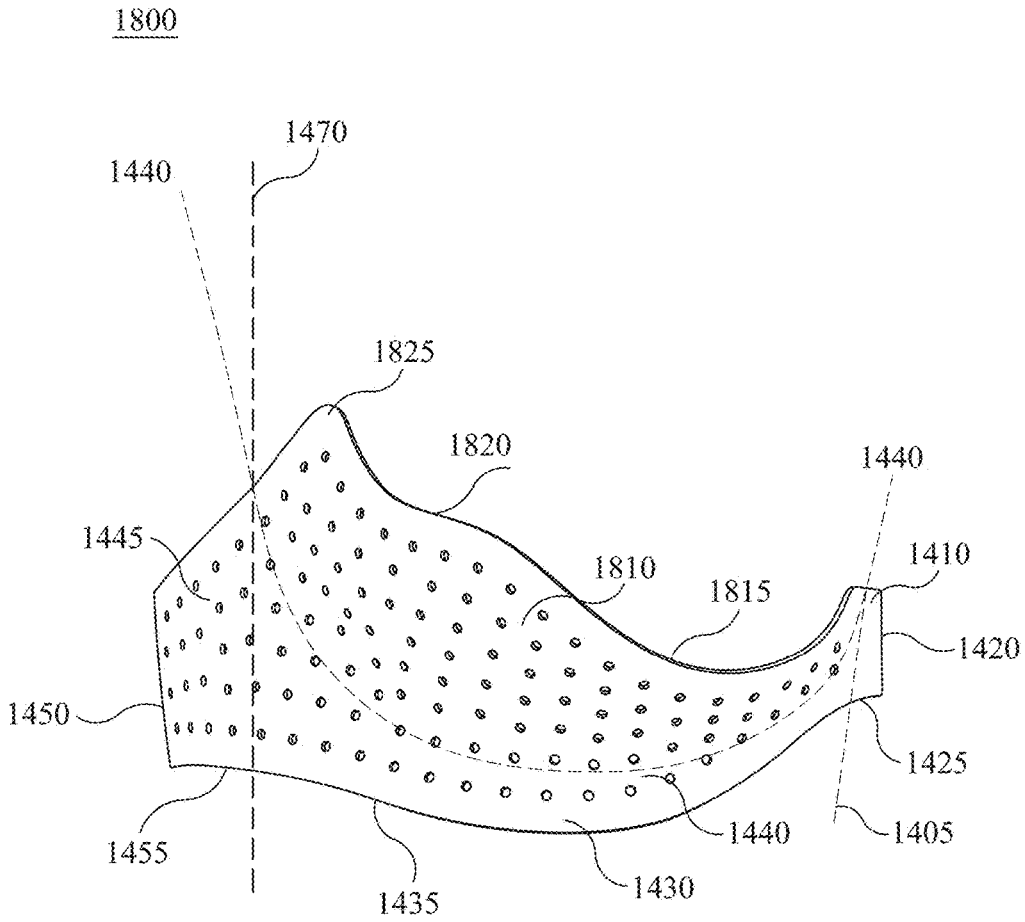
Figure 18C:
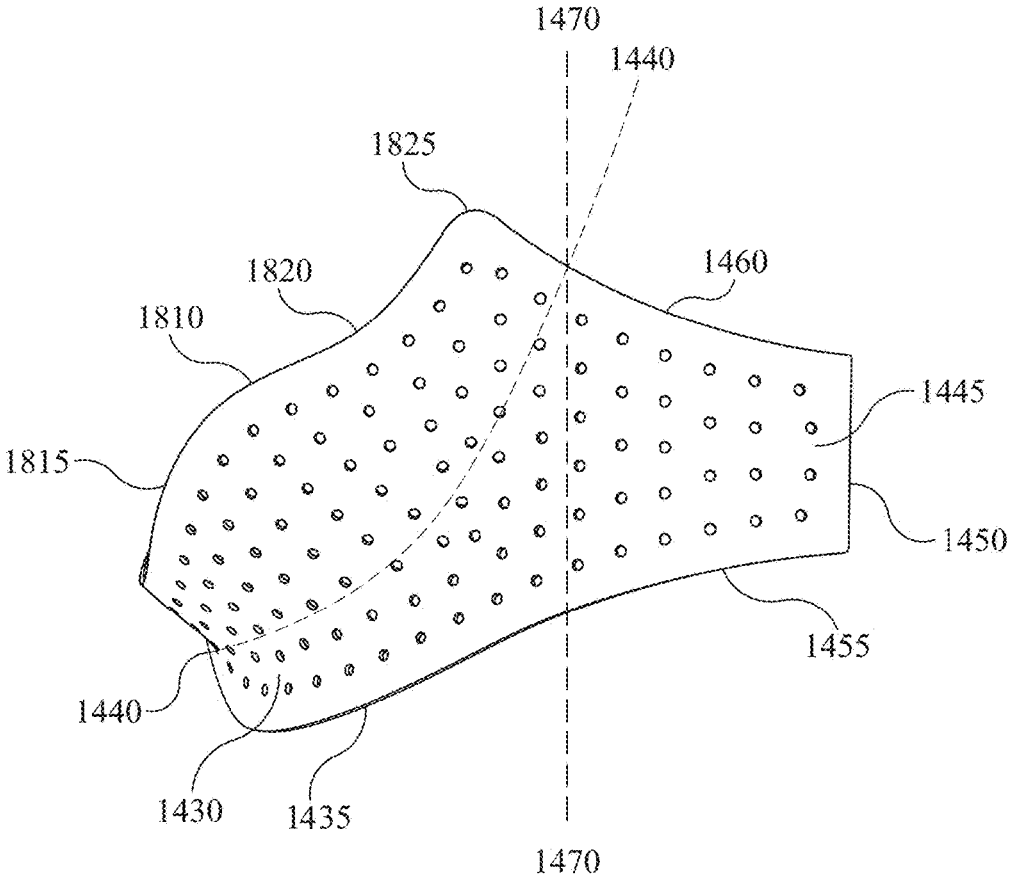
Figure 18D:
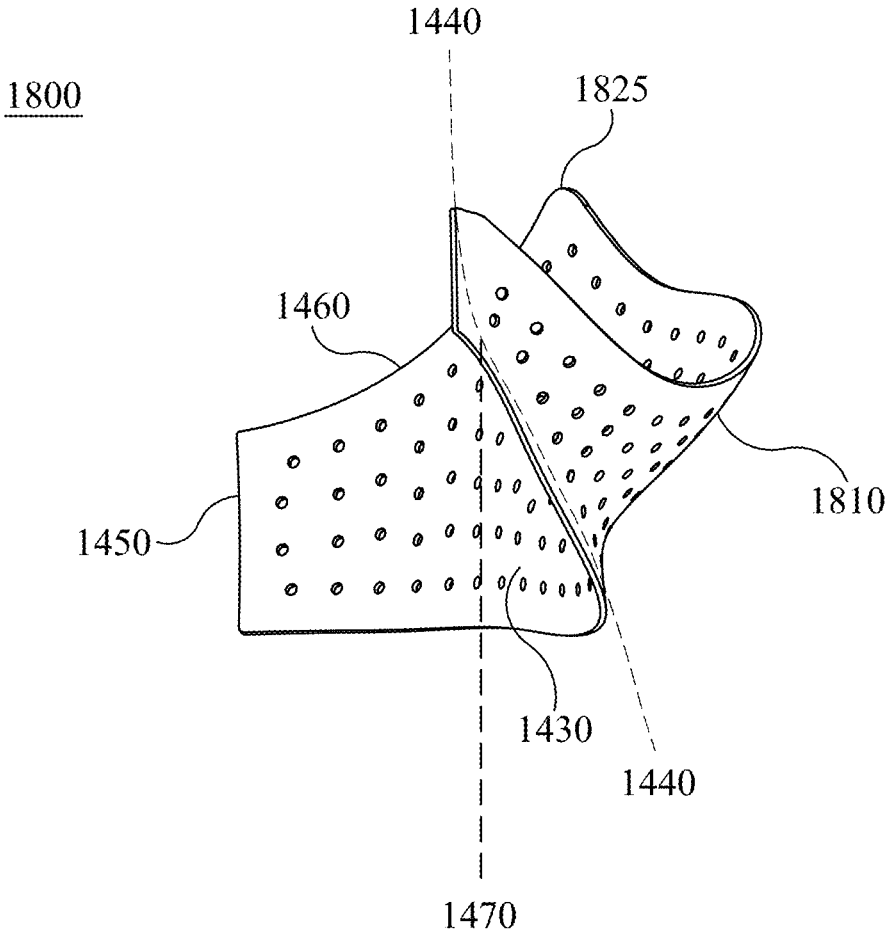
Figure 18E:
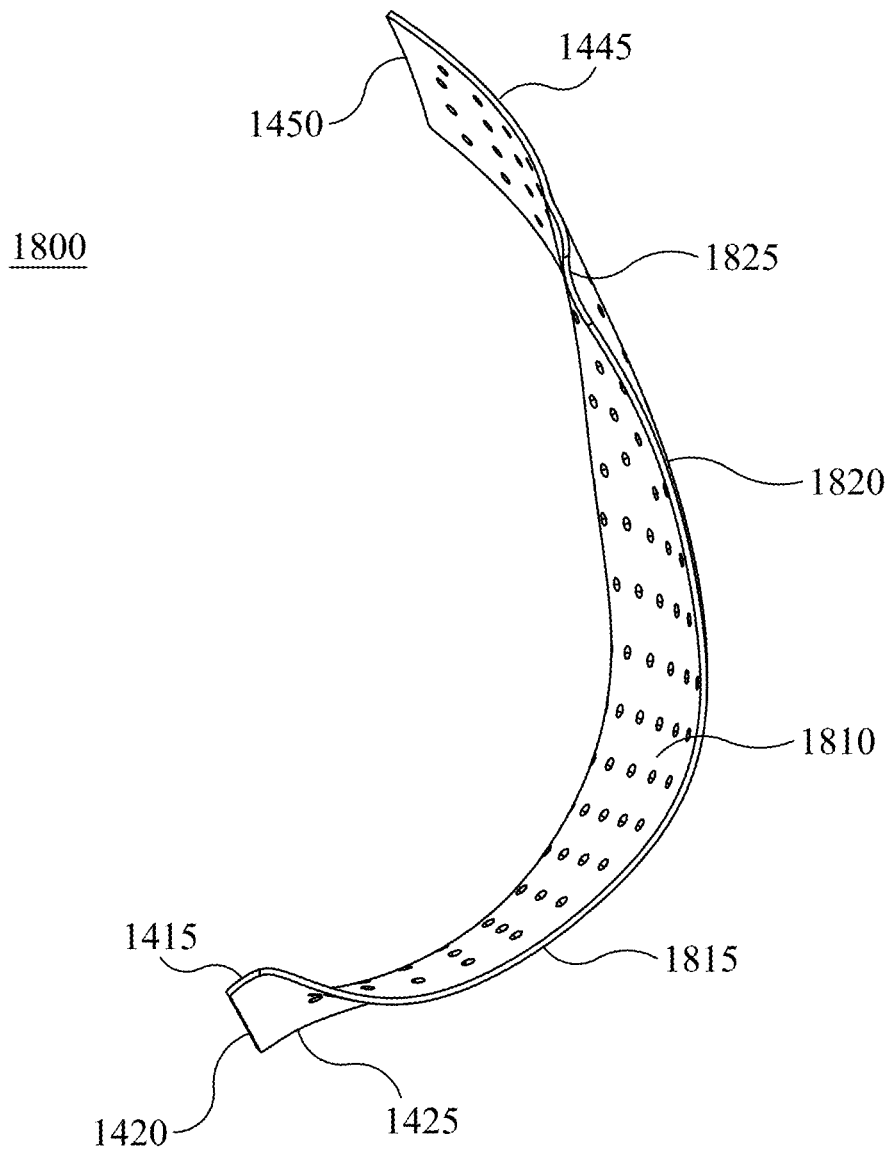
Figure 18F:
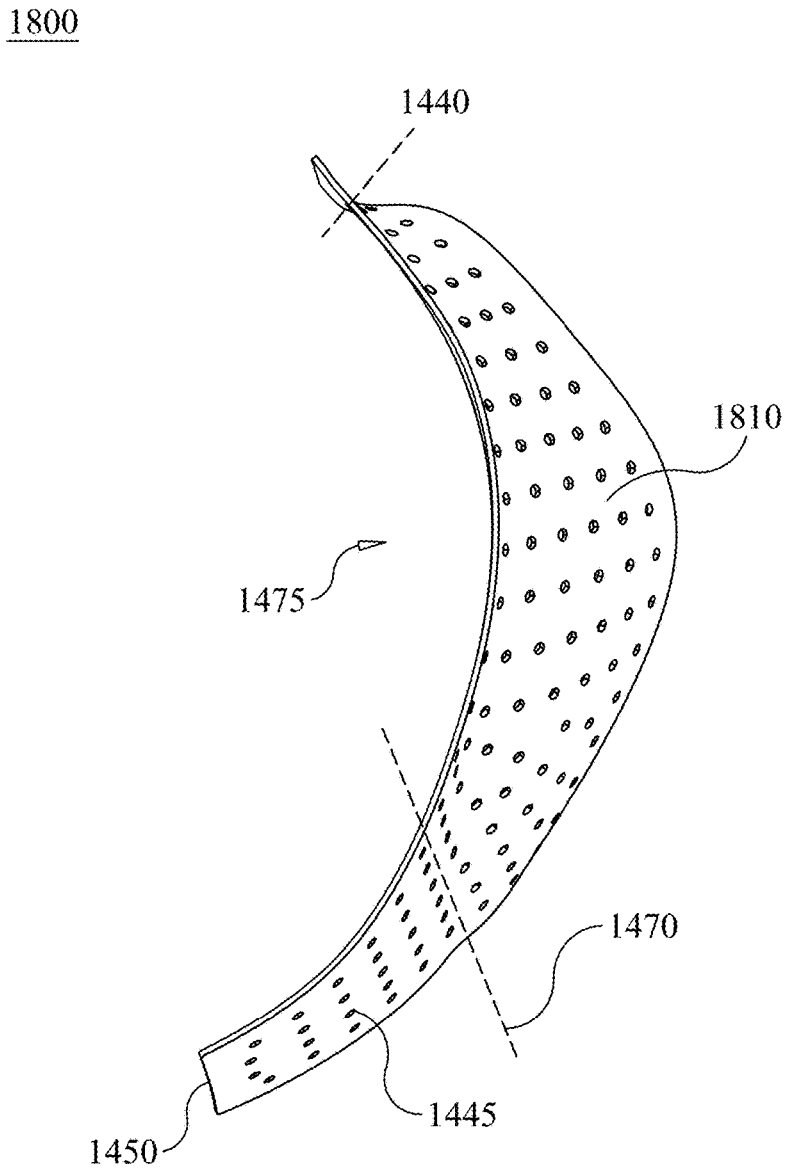

FIG. 18B shows an interior view of support structure 1800. This view illustrates the gradual transition between under-bust band upper edge 1440 and the lower edge of volumetric cup portion 1810, which is a curved, or gradual, transition. In some embodiments, this transition may abut the inframammary fold of wearer 10 and, in this way may support the wearer's breast tissue from underneath. In other embodiments, this transition may be coincident with inframammary fold of wearer 10 but may sit above it (i.e., the curvature of the transition may approximate the curvature of the inframammary fold of wearer 10 but may not touch the wearer's 10 skin). This may be preferred in situations when wearer 10 would prefer the skin and tissue located at, or near, the inframammary fold of wearer 10 not be touched or that pressure not be exerted thereon. Having the transition sit above the inframammary fold of wearer 10, may, in some instances, make movement of the wearer easier and may reduce fatigue that may have otherwise been induced by wearing support structure 1800.

It will be seen in FIGS. 18A-18F, that a shape of support structure 1800 is consistent with arc 1475 in that the shape of volumetric cup portion 1810 conforms to the shape of arc 1475 so that it wraps around a wearer in a manner consistent with frame 1400.

Figure 19A:
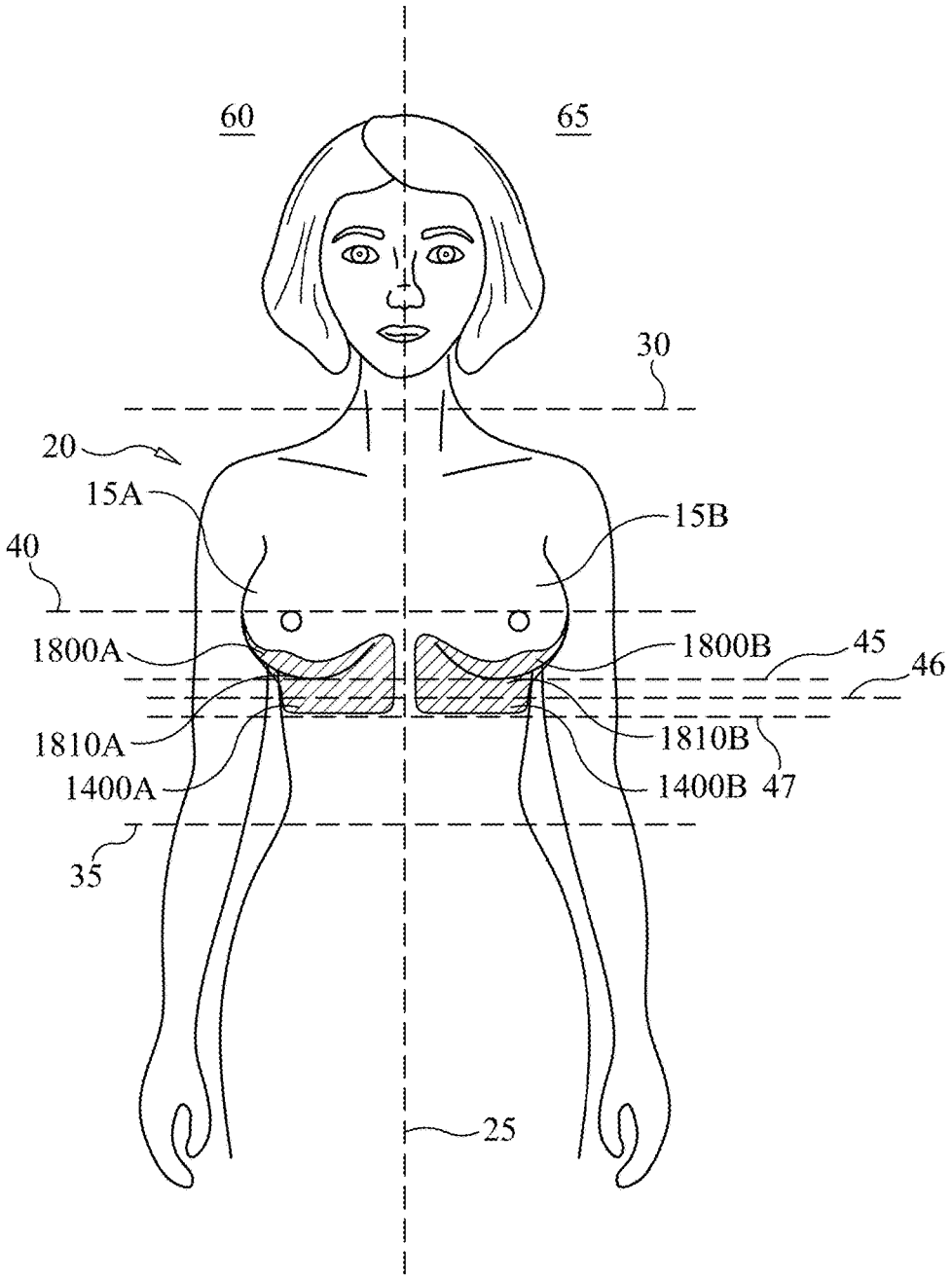
FIGS. 19A and 19B provide illustrations of wearer wearing an exemplary support structure in accordance with embodiments of the present invention.

FIG. 19A provides an anterior view of wearer 10 wearing a support structure $\mathbf{1800}_A$ on first breast $\mathbf{15}_A$ and a support structure $\mathbf{1800}_B$ on second breast $\mathbf{15}_B$ positioned on the wearer's second anterior side 65. Support structure $\mathbf{1800}_A$ includes frame $\mathbf{1400}_A$ and support structure $\mathbf{1800}_B$ includes frame $\mathbf{1400}_B$ as discussed above. FIG. 19A provides one example of relative dimensions of support structures $\mathbf{1800}_A$ and $\mathbf{1800}_B$ to wearer's torso 20. It is expected that wearer 10 will wear support structures $\mathbf{1800}_A$ and $\mathbf{1800}_B$, when they are positioned within a casing, housing, and/or garment (not shown) and FIG. 19A provides an example of how support structures $\mathbf{1800}_A$ and $\mathbf{1800}_B$, would correspond with wearer's torso 20 and breasts 15A and 15B when so positioned.

In some embodiments, support structures $\mathbf{1800}_A$ and $\mathbf{1800}_B$ may be of the same or similar dimensions and, in many instances, will be mirror images of one another. In other embodiments, a size or shape of support structure $\mathbf{1800}_A$ may be different from a size or shape of support structure $\mathbf{1800}_B$ (and vise-versa) as may be needed or preferred when, for example, breast $\mathbf{15}_A$ is not the same size or shape as breast $\mathbf{15}_B$ or when a breast $\mathbf{15}_A$ and/or $\mathbf{15}_B$ has been removed (via, for example, mastectomy).

As may be seen in FIG. 19A, volumetric cup portion 1810 of support structures $\mathbf{1800}_A$ and $\mathbf{1800}_B$, respectively, partially covers a bottom, or underside, of wearer's respective first and second breasts $\mathbf{15}_A$ and $\mathbf{15}_B$ with the junction between first curved upper edge 1815 and second curved upper edge 1820 positioned in line with the wearer's nipples but not extending up the first and second breasts $\mathbf{15}_A$ and $\mathbf{15}_B$ far enough to cover the nipples. In this way, the volumetric cup portions 1810 of support structures $\mathbf{1800}_A$ and $\mathbf{1800}_B$, respectively, may cover 5-40% of a lower portion of an exterior surface of each respective breast 15. In some instances, volumetric cup portions of support structures $\mathbf{1800}_A$ and $\mathbf{1800}_B$, respectively, may act as shelf or cantilever upon which a portion of the wearer's respective first and second breasts $\mathbf{15}_A$ and $\mathbf{15}_B$ may rest as may be seen in FIGS. 19A and 19B.

Figure 19B:
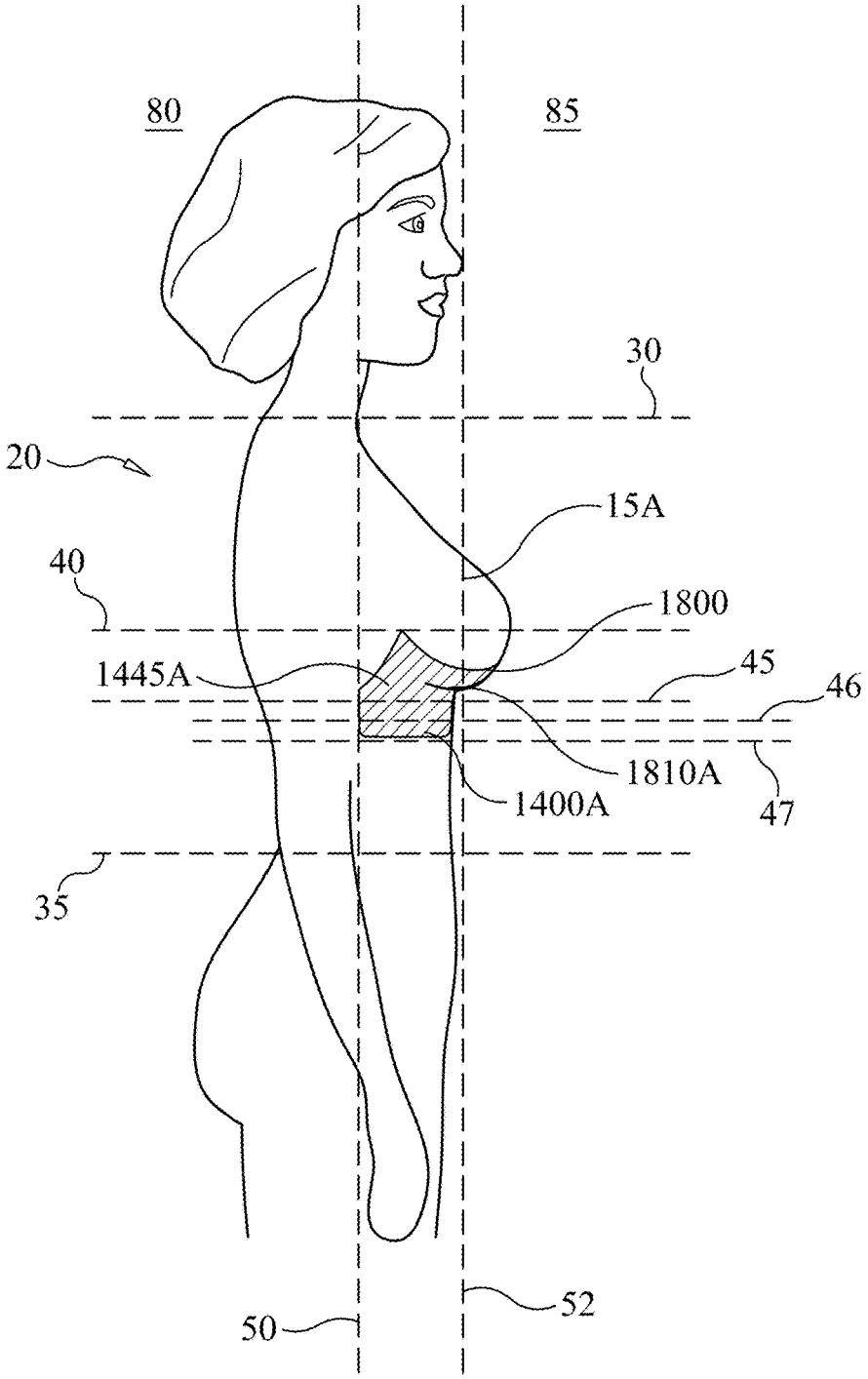

FIG. 19B provides a side view of wearer 10 wearing support structure $\mathbf{1800}_A$, wherein wrap-around portion $\mathbf{1445}_A$ extends approximately to the vertical midline 50 (as opposed to through vertical midline 50 and around to wearer's posterior as shown in FIGS. 17B and 170) as may be more appropriate when, for example, respective first and second breasts $\mathbf{15}_A$ and $\mathbf{15}_B$ are relatively small and thereby do not require as much support for the cantilever of volumetric cup portion 1810 to support the wearer's breast weight. Alternatively, in some embodiments, the configuration of wrap-around portions 1445A and 1455B shown in FIGS. 19A and 19B may be appropriate for a wearer with relatively large breasts 15A and 15B so that the support for the cantilever projection of volumetric cups 1810A and 1810B may be provided closer to the cantilever projection.

Figure 20A:
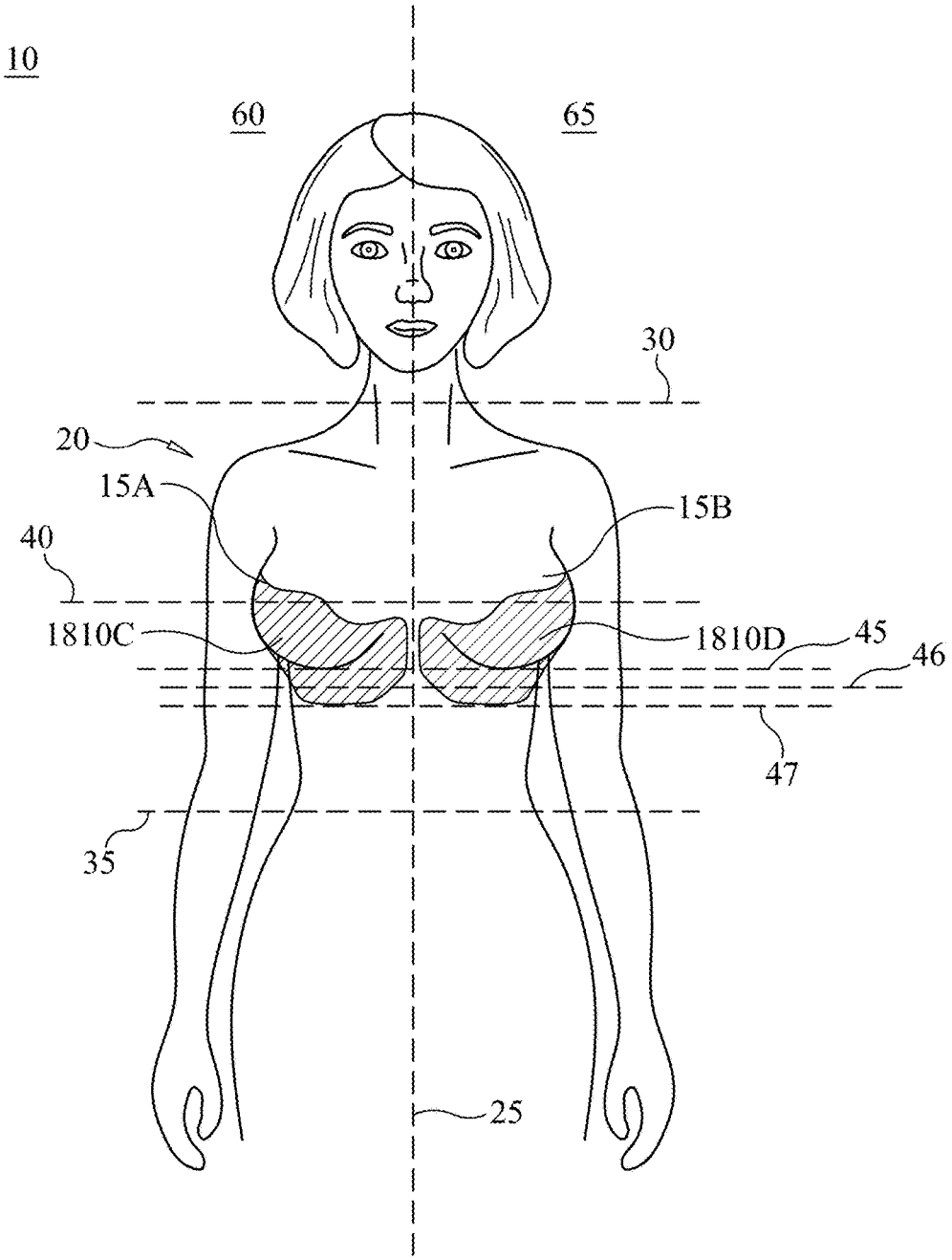
FIGS. 20A-20C provide illustrations of wearer wearing another exemplary support structure in accordance with embodiments of the present invention.
Figure 20B:
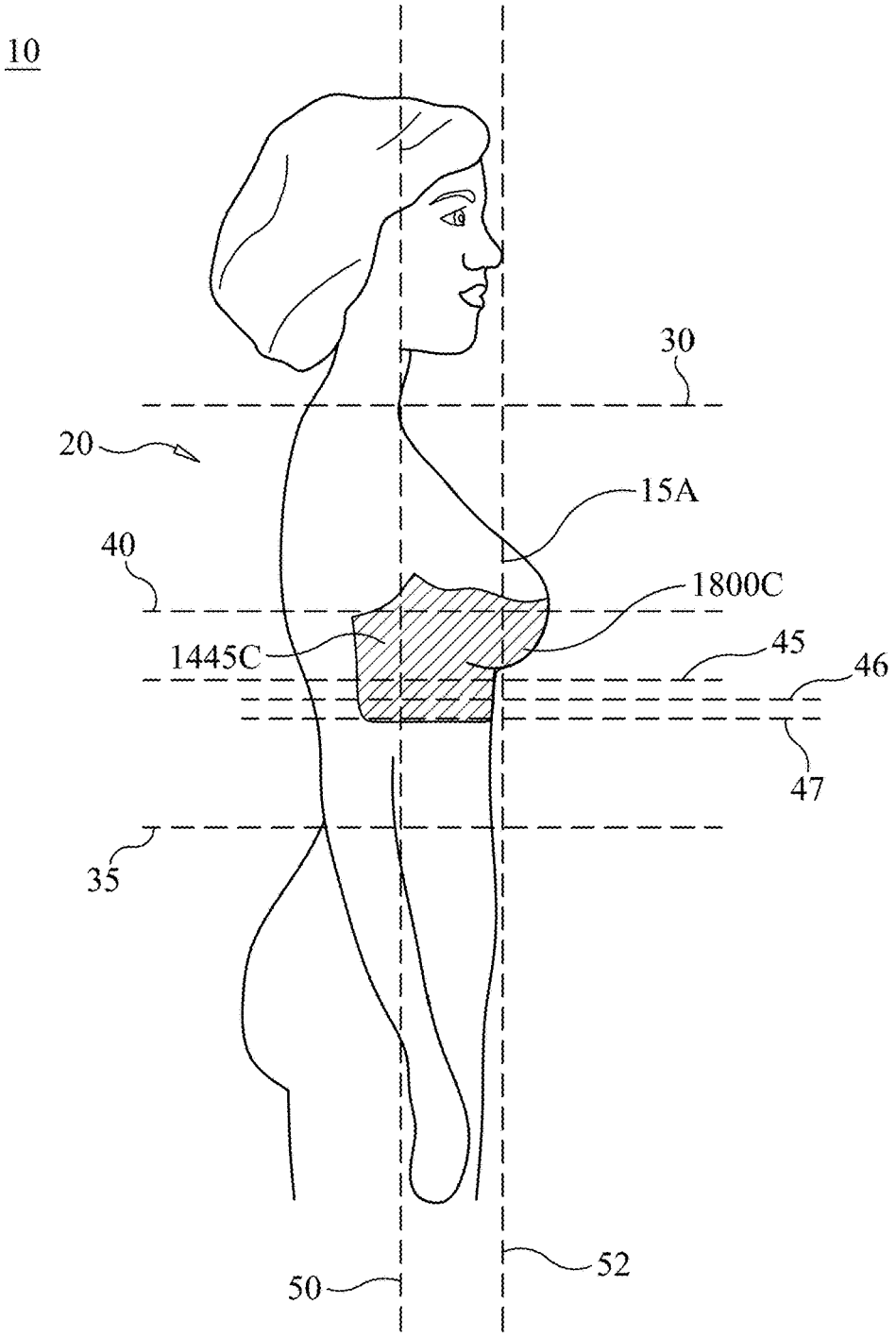
Figure 20C:
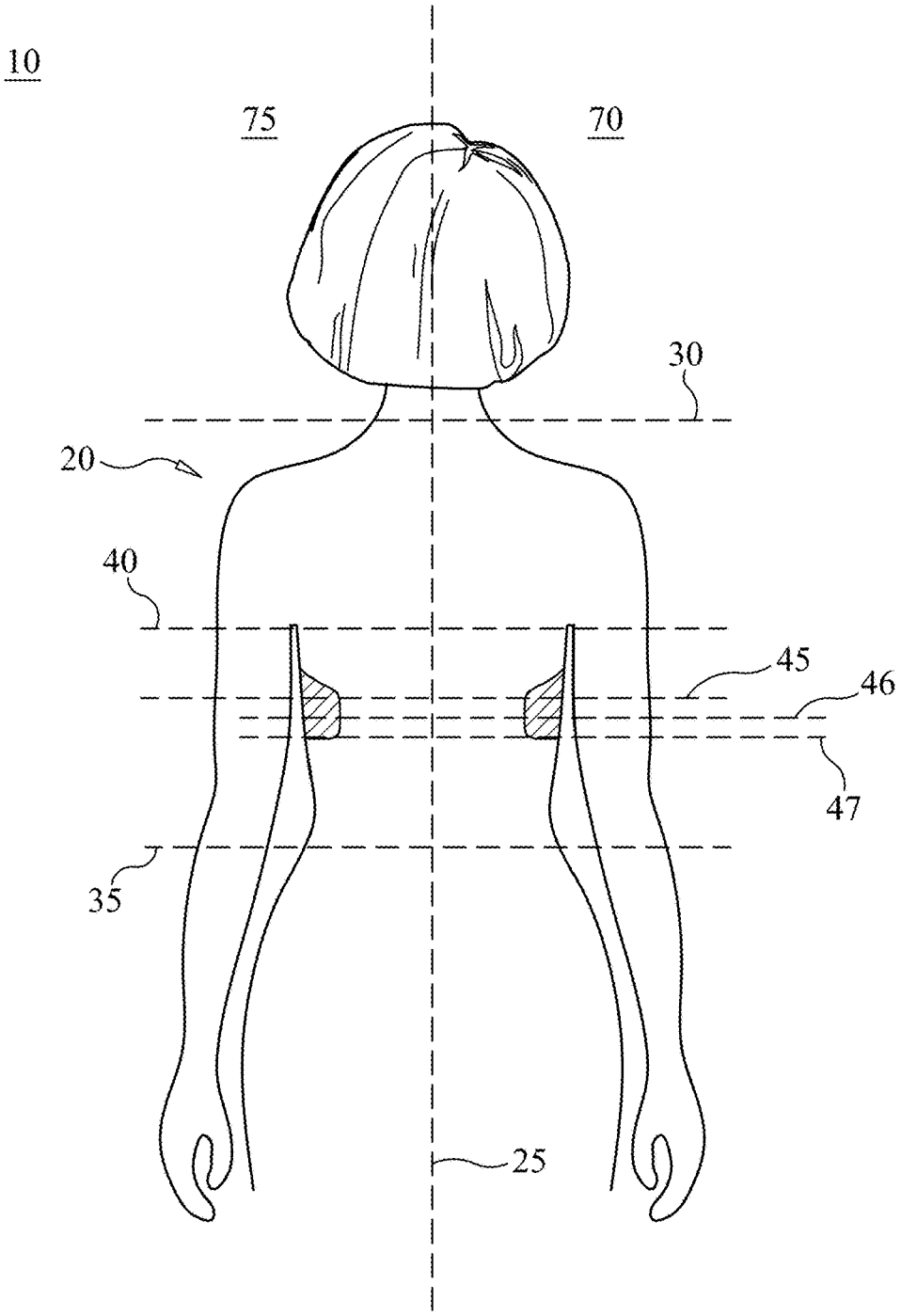

FIGS. 20A-20C provide images of wearer 10 wearing a set of support structure $\mathbf{1810}_C$ and $\mathbf{1810}_D$ on her respective first and second breasts $\mathbf{15}_A$ and $\mathbf{15}_B$. Support structures $\mathbf{1810}_C$ and $\mathbf{1810}_D$ are larger and cover more of the wearer's torso 20 and breasts $\mathbf{15}_A$ and $\mathbf{15}_B$ than support structures $\mathbf{1800}_A$ and $\mathbf{1800}_B$ as shown in FIGS. 19A and 19B. The example of FIGS. 20A-20C provides one example of relative dimensions of support structures $\mathbf{1800}_C$ and $\mathbf{1800}_D$ to wearer's torso 20. It is expected that wearer 10 will wear support structures $\mathbf{1800}_C$ and $\mathbf{1800}_D$ when they are positioned within a casing, housing, and/or garment (not shown) and FIGS. 20A-20C provide an example of how support structures $\mathbf{1800}_C$ and $\mathbf{1800}_D$ would correspond to wearer's torso 20 when so positioned.

As may be seen in FIG. 20A, volumetric cup portion 1810 of support structures $\mathbf{1800}_C$ and $\mathbf{1800}_D$, respectively, covers a bottom, or underside, of wearer's respective first and second breasts $\mathbf{15}_A$ and $\mathbf{15}_B$ with the junction between first curved upper edge 1815 and second curved upper edge 1820 positioned above the wearer's nipples and extending up the breasts to cover the nipples. In this way, the volumetric cup portions 1810 of support structures $\mathbf{1800}_C$ and $\mathbf{1800}_{D'}$ respectively, may cover 20-80% of a lower portion of an exterior surface of wearer's respective first and second breasts $\mathbf{15}_A$ and $\mathbf{15}_B$. Support structures $\mathbf{1800}_C$ and $\mathbf{1800}_D$ also cover a side of wearer's first and second breasts $\mathbf{15}_A$ and $\mathbf{15}_B$, which may act to reposition breast volume to provide a desired breast shape or silhouette for breast tissue by, for example, pushing breast tissue towards the sagittal plane center midline 25 and/or providing a rounded shape for breast tissue to be positioned in.

FIG. 20B provides a side view of wearer 10 wearing support structure $\mathbf{1800}_C$, wherein wrap-around portion $\mathbf{1445}_C$ extends approximately through the vertical midline 50 and wraps around the wearer's lateral side to her posterior as may be appropriate when, for example, respective first and second breasts $\mathbf{15}_A$ and $\mathbf{15}_B$ are relatively large and/or wearer 10 is relatively large and thereby require relatively more support for the cantilever of volumetric cup portion 1810 to support the wearer's breast weight than for the wearer 10 shown in FIGS. 18A and 18B. Alternatively, in some embodiments, the configuration of wrap-around portions of volumetric cup portions 1810A and 1810B shown in FIGS. 20A-20C may be appropriate for a wearer with relatively small breasts 15A and 15B so that the support for the cantilever projection of volumetric cups 18100 and 1810D may be spread out over a wider area of wearer's torso.

FIG. 20C provides a view of wearer's posterior side with wrap-around portions $\mathbf{1445}_C$ and $\mathbf{1445}_D$ extending around wearer's side to her posterior torso. As may be seen in FIG. 20C, wrap-around portions $\mathbf{1445}_C$ and $\mathbf{1445}_D$ extend across a portion of wearer's posterior by do not touch one another or extend to sagittal plane center midline 25. The amount wrap-around portions $\mathbf{1445}_D$ and $\mathbf{1445}_D$ extend across a portion of wearer's posterior may be dependent upon various factors including, but not limited to, torso circumference, breast volume, breast mass, torso shape, torso girth, and the wearer's mass. Although the wrap-around portion outside edge 1450 for both wrap-around portions $\mathbf{1445}_C$ and $\mathbf{1445}_D$ is shown as a straight line that is substantially parallel with sagittal plane center midline 25, this need not be the case as this edge may be oriented at an angle or have a rounded (e.g., semi-circular or oval-like) shape.

FIGS. 21A-25B provide illustrations of various exemplary support structures 2100, 2200, 2300, 2400, and 2500, respectively, in accordance with embodiments of the present invention. Support structures 2100, 2200, 2300, 2400, and 2500 are exemplary components of a bra, bustier, or other similar type of garment designed to be worn so as to coincide, at least partially, with the breasts of a wearer.

Support structures 2100, 2200, 2300, 2400, and/or 2500 may be produced by, for example, a production system such as production system 150 that produces a support structure using instructions and/or measurements received from a sizing computer system such as sizing computer system 140.

Support structures 2100, 2200, 2300, 2400, and/or 2500 may include two portions, the first portion may include a curvilinear surface that extends outward, in a three-dimensional manner, toward an apex in a roughly spherical- or parabolic-type of shape. The first portion may be configured to accommodate placement of breast tissue within the volumetric space created by the curvilinear surface in a manner similar to a bra cup. For ease of discussion, this portion of the support structures described below will be referred to as a cup.

The second portion of support structure may be a side, or wrap-around, extension. The wrap-around extension may be configured to, for example, wrap around a side of a wearer's torso, like torso 20, under the wearer's arm. In some embodiments, the side extension may be oriented at an angle (e.g., 90°, 80°, 70°, etc.) relative to the cup in a shape, when viewed from above, that approximates a L-type of shape. In some embodiments, the wrap-around extension may further include a portion designed to wrap around a back of a wearer 10. In these embodiments, the cup and side extension combination may have a C-like shape when viewed from above.

The wrap-around extension may be configured to redistribute weight from the wearer's breasts to the wearer's torso, side, or back. The wrap-around extension may also serve to lift or otherwise reposition and/or reshape an outline or profile of the wearer's breast tissue into a desired position and/or shape.

In some instances, the cup, side extension, or a portion thereof, may include a mesh or other configuration of material that is not uniform (i.e., includes one or more holes or perforations). The mesh may include one or more patterns including, but not limited to, overlapping circles, curved lines, straight lines, interconnected shapes (e.g., diamonds, squares, ovals, circles, etc.), interconnecting straight and/or curved lines, or some combination thereof. Features of the mesh may be designed/configured to increase and/or decrease, as appropriate, for example, breathability, structural rigidity, flexibility, weight, and/or cost of production of an assembled garment. Features of the mesh may also be designed/configured for aesthetic purposes.

The dimensions, or other features (e.g., mesh pattern, placement of openings, degree of thickness, etc.) of the cup, wrap-around extension and/or support structure as a whole may be adjusted prior to fabrication to accommodate a wide variety of factors including, but not limited to, a body shape of the wearer, a body mass/weight of the wearer, wearer/individual preference, a desired position for the wearer's breast or breasts, physical or mechanical constraints required by the material from which the support structure is made, physical or mechanical constraints required by the design or an aspect of the design for the support structure, a thickness of the support structure, a degree of flexibility of the support structure, a method of manufacture for the support structure, and some combination thereof.

In some instances, the cup and side extension of the support structure will be a single manufactured component and, in other instances, the support structure may comprise a plurality of pieces. For example, a support structure may include a cup piece and a side extension piece that are joined together to form a single support structure. When support structure includes two or more pieces, the pieces may be joined/bonded using any appropriate technique including, but not limited to, heat bonding, chemical bonding, ultrasonic bonding, mechanical bonding, and some combination thereof.

The relative dimensions of various aspects of the support structures 2100, 2200, 2300, 2400, and/or 2500 are provided for exemplary purposes and are not intended to limit the scope of the invention. Additionally, the various patterns and shapes used to illustrate the shape and/or size of different features of the support structures disclosed herein are only exemplary and are not intended to limit the scope of the invention.

One or more exterior edges of support structures 2100, 2200, 2300, 2400, and/or 2500 may be solid and/or feature one or more extensions. In general, the exterior edges of support structures 2100, 2200, 2300, 2400, and/or 2500 may include features that contribute to the overall flexibility of the support structure and assembled garment. In some embodiments, the features of the exterior edges may be configured to create a smooth transition between the garment and the skin of the wearer when worn and/or provide for a form fitting garment that directly coincides with the skin/breasts of the wearer when worn without gaps or creating bulges of soft tissue that extend from, or are adjacent to, a garment when worn by the wearer. In this way, an assembled garment employing a support structure 2100, 2200, 2300, 2400, and/or 2500 may provide an invisible profile such that the fully assembled garment cannot be directly, or indirectly (via e.g., bulges of soft tissue or depressions in soft tissue) seen when worn under clothing.

In some embodiments, support structures 2100, 2200, 2300, 2400, and/or 2500 and/or portions thereof may act as a shelf-like support structure upon which a portion of breast weight and/or volume is supported.

Figure 21A:
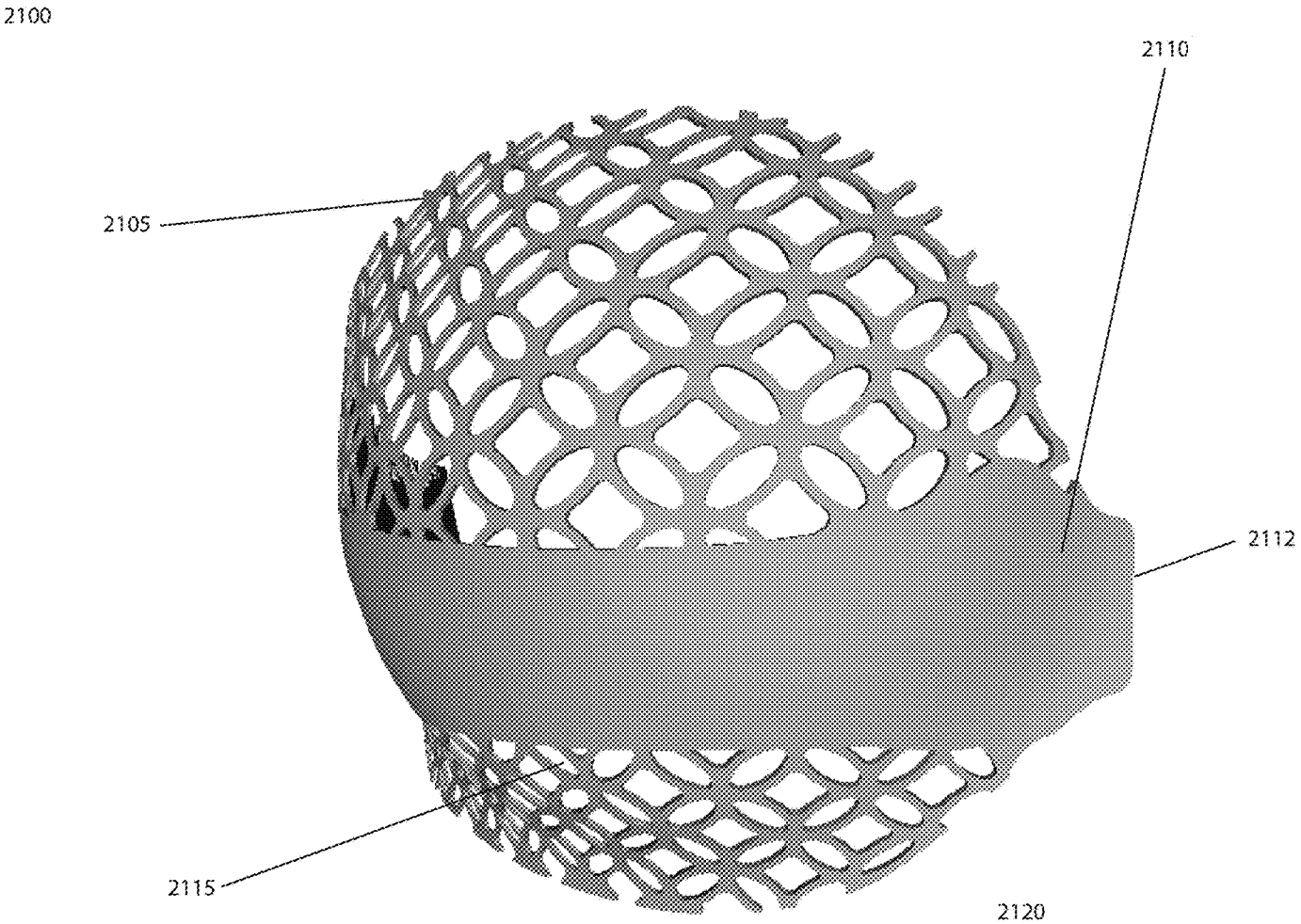
FIGS. 21A-21B, 22A-22B, 23A-23B, 24A-24B, 25A-25B, and 26A-26C provides illustrations of a variety of exemplary support structures in accordance with embodiments of the present invention.
Figure 21B:
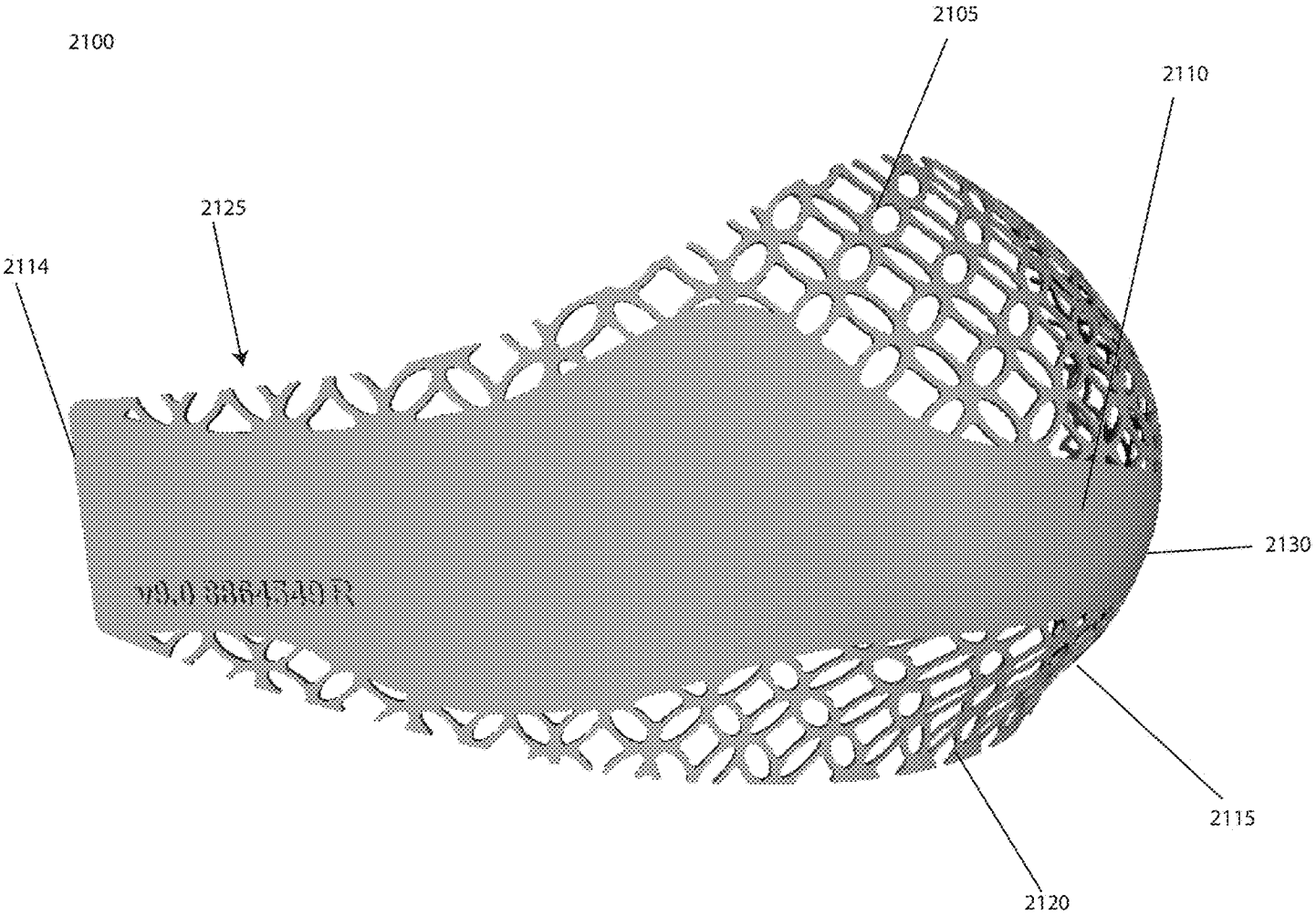

FIG. 21A provides a front perspective view of an exemplary support structure 2100 and FIG. 21B is a side view of the support structure 2100. A cup of garment component 2400 may include an upper cup region 2105, a band 2110, an interior edge 2112, an outer edge 2114, a lower cup region 2115, a structural element 2120, a side extension 2125, an apex 2130. Interior edge 2112 may correspond to a vertical midline of the wearer positioned between the breasts and an exterior edge 2114 that may correspond to a side (under the arm) or back of the wearer's torso when support structure 2100 is worn by the wearer.

As shown in FIGS. 21A and 21B, upper cup region 2105, lower cup region 2115, and structural element 2120 comprise a mesh with a pattern of overlapping circles that joins and/or is coincident with band 2110. Band 2110 extends across the cup region of support structure and divides the upper cup region 2105 from the lower cup region 2115. At interior edge 2112, band 2110 has a small extension that may, in some instances, facilitate attachment of a closure mechanism to support structure 2100 and/or an assembled garment that incorporates support structure 2100. Band 2110 may also have an extension, or wider portion, positioned at, or near, interior edge 2112 that may be configured to provide rigidity/structural support to the support structure 2100 as well as assist in the containment and/or repositioning of breast tissue when worn. Band 2110 may gradually narrow in width as it extends away from interior edge 2112 toward apex 2130 and then increase in width as it extends toward side extension 2125 and/or exterior edge 2114. As band 2110 extends across support structure 2100, the shape, thickness, and/or width of the band 2110 may change so as to, for example, add or subtract structural rigidity, assist with containment, assist with weight redistribution, increase flexibility of support structure 2100, and/or decrease weight of support structure 2100. Additionally, although the band 2110 of the embodiment shown in FIGS. 21A and 21B extends all the way to exterior edge 2114, this need not be the case.

Upper cup region 2105 may be shaped so as to contain breast volume to, for example, keep the breast tissue of the wearer in a desired position. The pattern of material comprising upper cup region 2105 connects to the upper edge of band 2110 so as to, for example, create a smooth profile between the upper cup region 2105 and band 2110 when the support structure 2100 is positioned within the housing and/or provide flexibility to the support structure 2100 along the upper edge of the support structure 2100.

Upper cup region 2105 may have a solid (not shown) or patterned upper edge so as to facilitate, for example, flexibility of the support structure 2100 when worn thereby creating a soft upper edge of the garment, and/or creating, or contributing to, a form fitting garment that directly coincides with the skin/breasts of the wearer when worn.

Lower cup region 2115 may be shaped so as to, for example, keep the breast tissue of the wearer in a desired position and may serve to transfer breast weight to the structural element 2120 that, in the embodiment shown, employs an extension of the pattern used in lower cup region 2115. Structural element 2120 may be positioned at an angle (e.g., 90°, 110°, 135°, or 150°) relative to a lower edge of lower cup region 2115 and may be configured to be adjacent to the rib cage of the wearer when support structure 2100 is worn by the wearer.

Structural element 2120 may be serve to support breast weight and redistribute the breast weight to the torso by, for example, pulling breast weight in toward the ribcage of the wearer. Structural element 2120 may also serve to facilitate the wrapping of an assembled garment around the torso of the wearer. The pattern of structural element 2120 extends along the lower edge of band 2110 so as to, for example, create a smooth profile when the support structure 2100 is positioned within the housing and/or provide flexibility to the support structure 2100 along the lower edge of the support structure 2100.

Figure 22A:
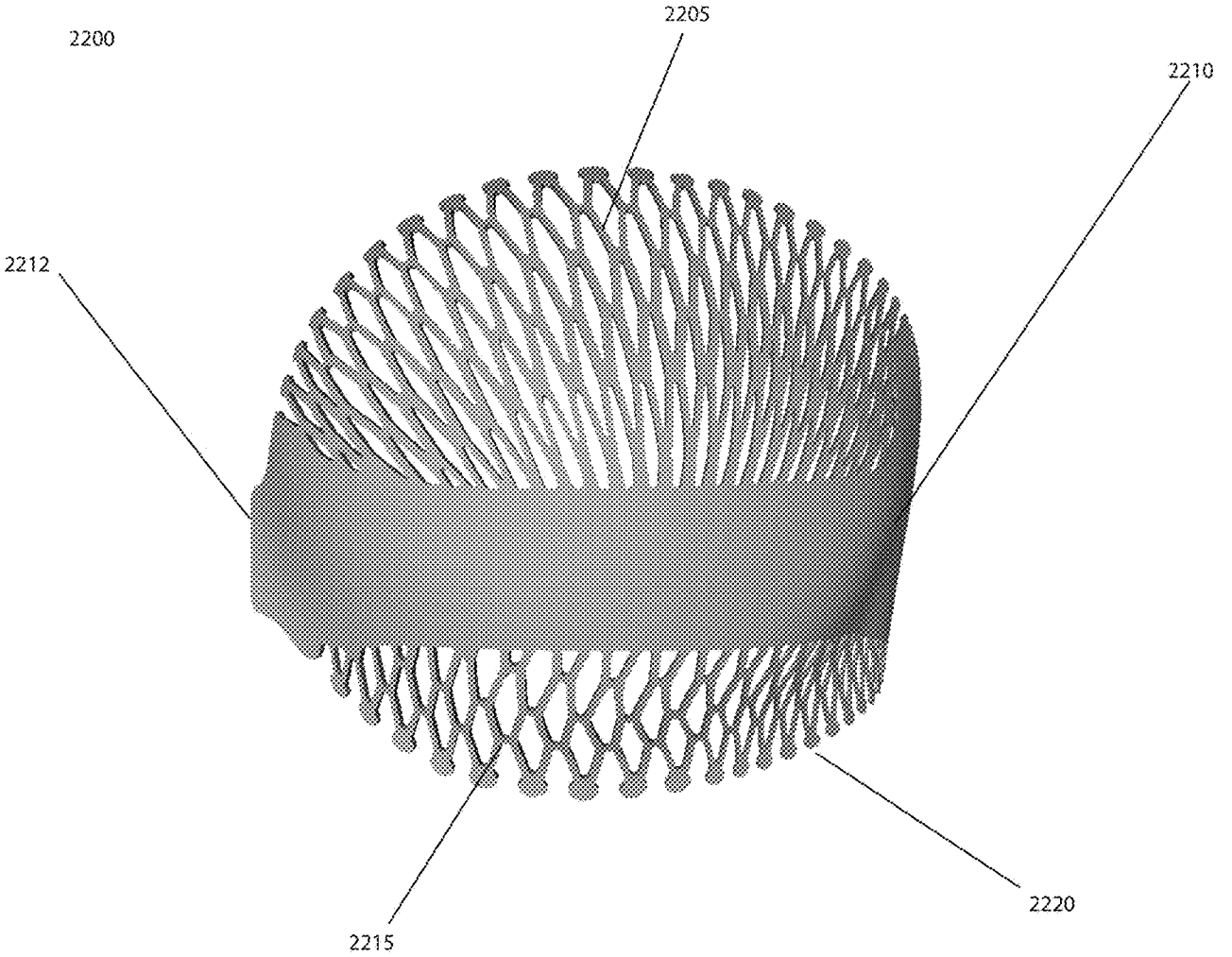
Figure 22B:
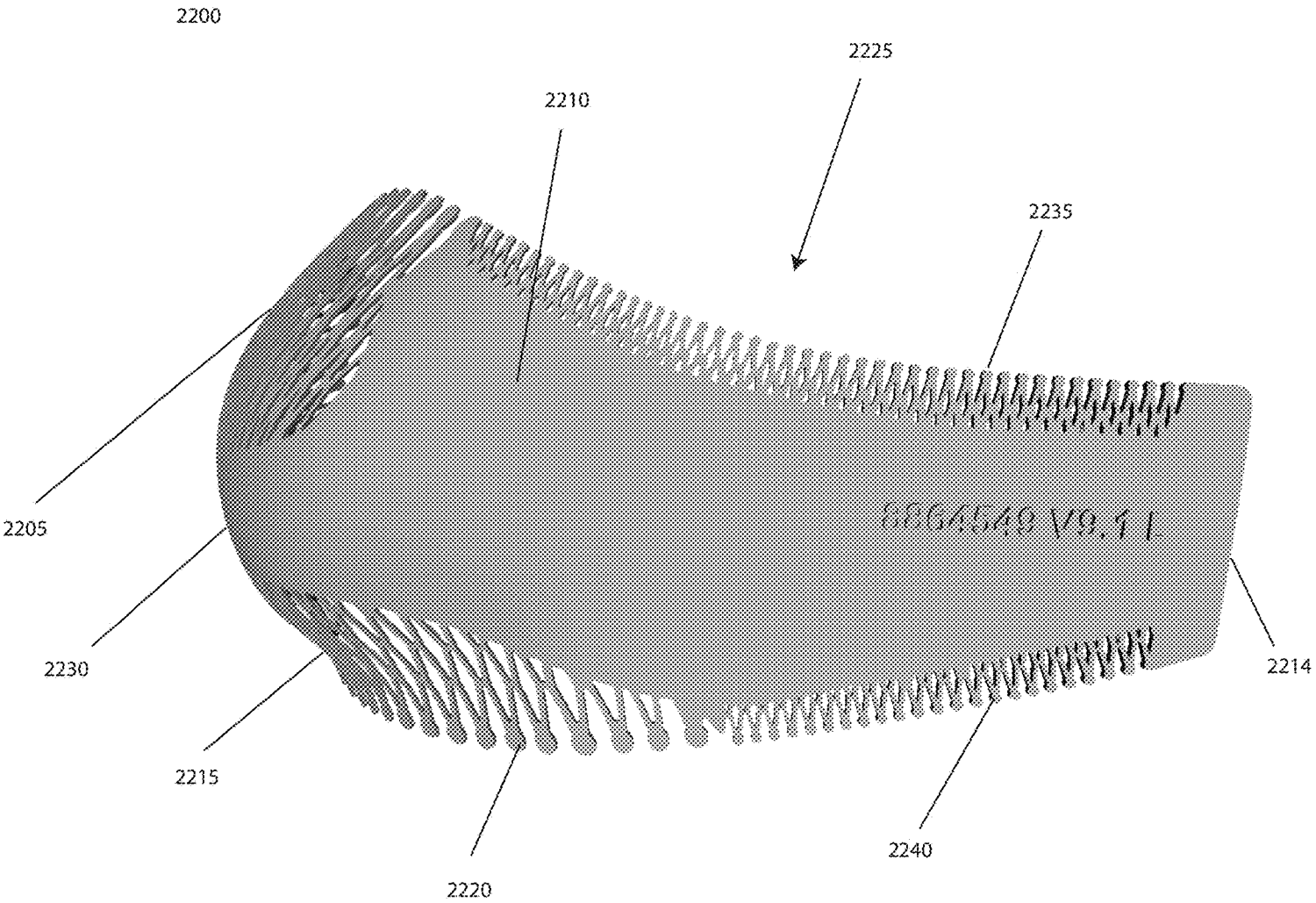

FIG. 22A is a front perspective view of an exemplary support structure 2200 and FIG. 22B is a side view of the support structure 2200. A cup of support structure 2200 may include a band 2210, an upper cup region 2205, a lower cup region 2215, a structural element 2220, and an apex 2230. The second portion of support structure 2200 may include a side extension 2225 that includes a series of upper extension edge features 2235, a series of lower edge features 2240, and an extension of band 2210, upper cup region 2205, lower cup region 2215, and structural element 2220. Support structure 2200 may have an interior edge 2212 that may correspond to a vertical midline of the wearer positioned between the breasts and an exterior edge 2214 that may correspond to a side (under the arm) or back of the wearer's torso when support structure 2200 is worn by the wearer.

As shown in FIGS. 22A and 22B, upper cup region 2205, lower cup region 2215, and structural element 2220 comprise a mesh with a pattern of intersecting lines that joins, and/or is coincident with, band 2210. Band 2210 extends across the cup and divides the upper cup region 2205 from the lower cup region 2215. At interior edge 2212, band 2210 has a small extension that may, in some instances, facilitate attachment of a closure mechanism to support structure 2200 and/or an assembled garment that incorporates support structure 2200. Band 2210 may also have an extension, or wider portion, positioned at, or near, interior edge 2212 that may be configured to provide rigidity/structural support to the support structure 2200 as well as assist in the containment of breast tissue when worn. Band 2210 may gradually narrow in width as it extends away from interior edge 2212 toward apex 2230 and then increase in width as it extends toward side extension 2225 and/or exterior edge 2214. As band 2210 extends across support structure 2200, the shape, thickness, and/or width of the band 2210 may change so as to, for example, add or subtract structural rigidity, assist with containment, assist with weight redistribution, and/or decrease weight of the support structure 2200.

Upper cup region 2205 may be shaped so as to contain breast volume so as to, for example, keep the breast tissue of the wearer in a desired position. Upper cup region 2205 may have a solid or patterned edge so as to facilitate being housed in a housing. The pattern of upper cup region 2205 extends along the upper edge of band 2210 so as to, for example, create a smooth profile when the support structure 2200 is positioned within the housing and/or provide flexibility to the support structure 2200 along the upper edge of the support structure 2200. Features that are positioned along the upper edge of upper cup region 2205 may not be connected to one another so as to facilitate movement between the features and/or provide a relatively soft upper edge to support structure 2200 and/or an assembled garment incorporating support structure 2200.

Lower cup region 2215 may also be shaped so as to, for example, keep the breast tissue of the wearer in a desired position. Lower cup region 2210 may have a solid or patterned edge so as to facilitate, for example, flexibility and/or an attractive and/or comfortable edge when housed in a housing.

Lower cup region 2215 also serves to transfer weight to the structural element 2220 that, in the embodiment shown, employs an extension of the pattern used in lower cup region 2215. Structural element 2220 is positioned at an angle to the lower edge of lower cup region 2215 and may be configured to be adjacent to the rib cage of the wearer when a garment incorporating support structure 2200 is worn. Structural element 2220 may be positioned so as to support breast weight and redistribute the breast weight to the torso. The pattern of structural element 2220 extends along the lower edge of band 2210 so as to, for example, create a smooth profile when the support structure 2200 is positioned within the housing and/or provide flexibility to the support structure 2200 along the lower edge of the support structure 2200.

An upper edge of side extension 2225 may include a series of upper features 2235 that extend from band 2210 where lines of the mesh pattern intersect. The series of upper features 2235 may be configured to add flexibility to support structure 2200. A lower edge of side extension 2225 may include a series of lower features 2240 that extend from band 2210. The series of lower features 2240 may be configured to add flexibility to support structure 2200.

Figure 23A:
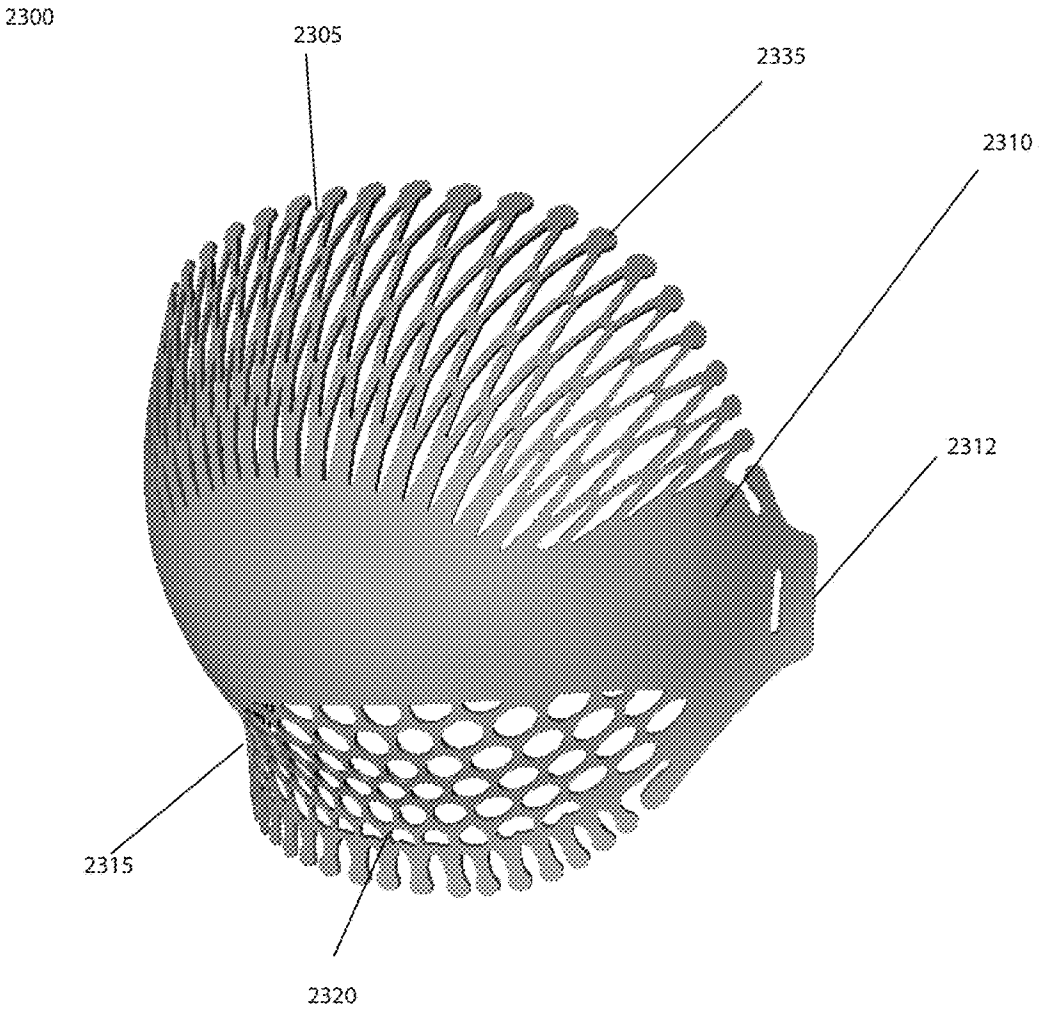
Figure 23B:
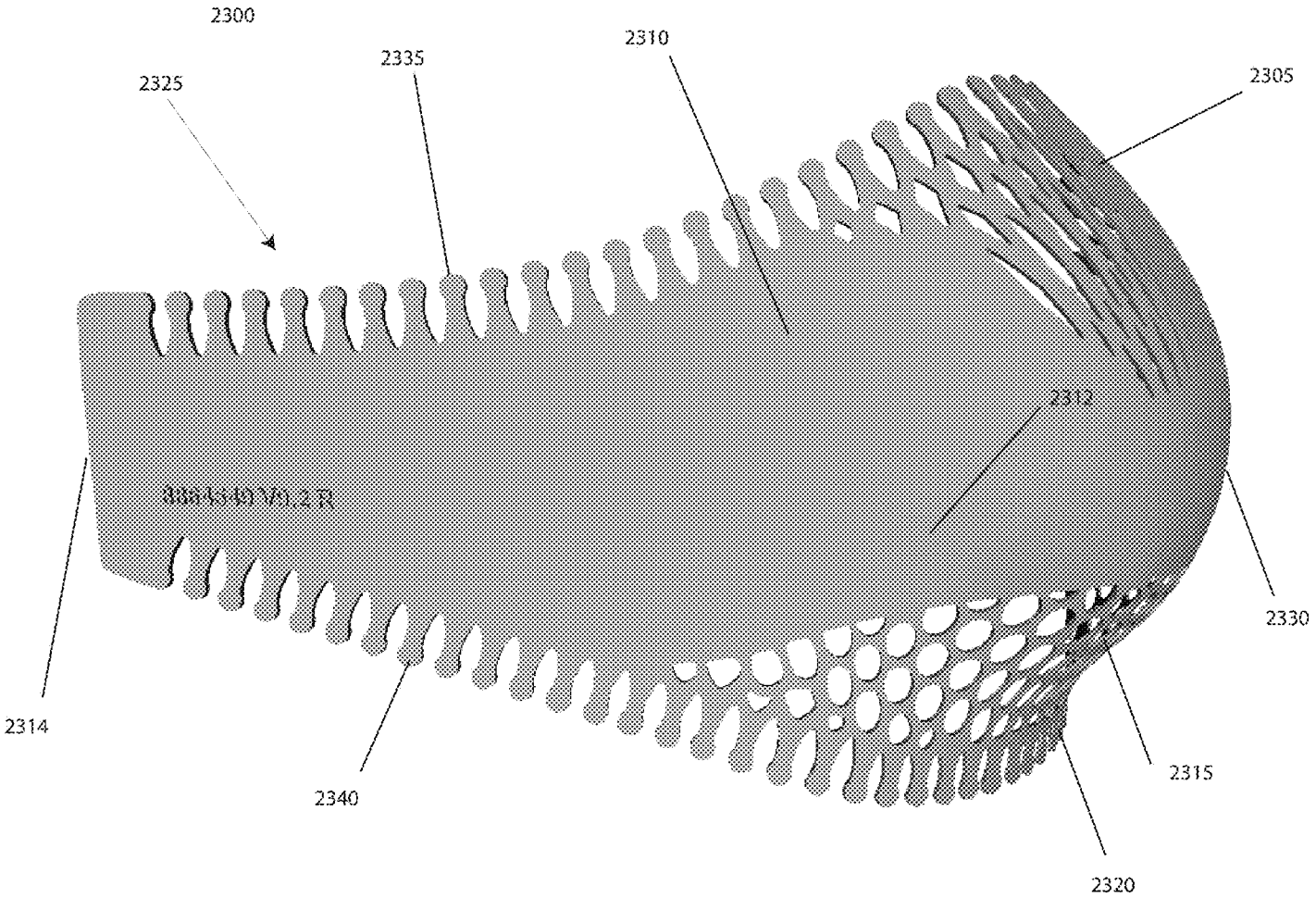

FIG. 23A is a front perspective view of an exemplary support structure 2300 and FIG. 23B is a side view of the support structure 2300. A cup of support structure 2300 may include a band 2310, an upper cup region 2305, a lower cup region 2315, a structural element 2320, and an apex 2330. The second portion of support structure 2300 may include a side extension 2325 that includes an upper extension edge feature 2335, a lower edge feature 2340, as well as an extension of band 2310, upper cup region 2305, lower cup region 2315, and structural element 2320. Support structure 2300 may have an interior edge 2312 that may correspond to a vertical midline of the wearer positioned between the breasts and an exterior edge 2314 that may correspond to a side (under the arm) or back of the wearer's torso when a garment incorporating support structure 2300 is worn by the wearer. Support structure 2300 may also have an opening 2350, or notch, positioned near interior edge 2312. Opening 2350 may be configured to accept, for example, an attachment mechanism for an assembled garment.

As shown in FIGS. 23A and 23B, upper cup region 2305 comprises a first mesh pattern of intersecting lines that joins and/or is coincident with band 2310, lower cup region 2315 and a portion structural element 2320 comprise a mesh with a pattern of substantially circular openings, and a second portion (along the lower edge) of structural element 2320 comprises a plurality of extensions with a circularly-shaped tip, or end. Band 2310 extends across the cup and divides the upper cup region 2305 from the lower cup region 2315.

Band 2310 may have an extension, or wider portion, positioned at, or near, interior edge 2312 that may be configured to provide rigidity/structural support to the support structure 2300 as well as assist in the containment of breast tissue when worn. Band 2310 may gradually narrow in width as it extends away from interior edge 2312 toward apex 2330 and then increase in width as it extends toward side extension 2325 and/or exterior edge 2314. As band 2310 extends across support structure 2300, the shape, thickness, and/or width of the band 2310 may change so as to, for example, add or subtract structural rigidity, assist with containment of breast tissue, assist with weight redistribution, and/or decrease weight of the support structure 2300.

Upper cup region 2305 may be shaped so as to contain breast volume so as to, for example, keep the breast tissue of the wearer in a desired position within support structure 2300 and/or a garment incorporating support structure 2300. Upper cup region 2305 may have a solid or patterned edge. The pattern of upper cup region 2305 extends along the upper edge of band 2310 so as to, for example, create a smooth profile when the support structure 2300 is positioned within the housing and/or provide flexibility to the support structure 2300 along the upper edge of the support structure 2300. Features that are positioned along the upper edge of upper cup region 2305 may not be connected to one another so as to facilitate movement between the features and/or provide a relatively soft upper edge to support structure 2300 and/or an assembled garment incorporating support structure 2300.

Lower cup region 2315 may also be shaped so as to, for example, keep the breast tissue of the wearer in a desired position. Lower cup region 2310 may have a solid or patterned edge so as to facilitate, for example, flexibility and/or an attractive and/or comfortable edge when housed in a housing.

Lower cup region 2315 also serves to transfer weight to the structural element 2320 that, in the embodiment shown, employs an extension of the pattern used in lower cup region 2315. Structural element 2320 is positioned at an angle to the lower edge of lower cup region 2315 and may be configured to be adjacent to the rib cage of the wearer when support structure 2300 is worn. Structural element 2320 may be positioned so as to support breast weight and redistribute the breast weight to the torso. The pattern of structural element 2320 extends along the lower edge of band 2310 so as to, for example, create a smooth profile when the support structure 2300 is positioned within the housing and/or provide flexibility to the support structure 2300 along the lower edge of the support structure 2300.

An upper edge of side extension 2325 may include a plurality of upper features 2335 that extend from band 2310. Upper features 2335 may be configured to add flexibility to support structure 2300. A lower edge of side extension 2325 may include a plurality of lower features 2340 that extend from band 2310. Lower features 2340 may be configured to add flexibility to support structure 2300.

Figure 24A:
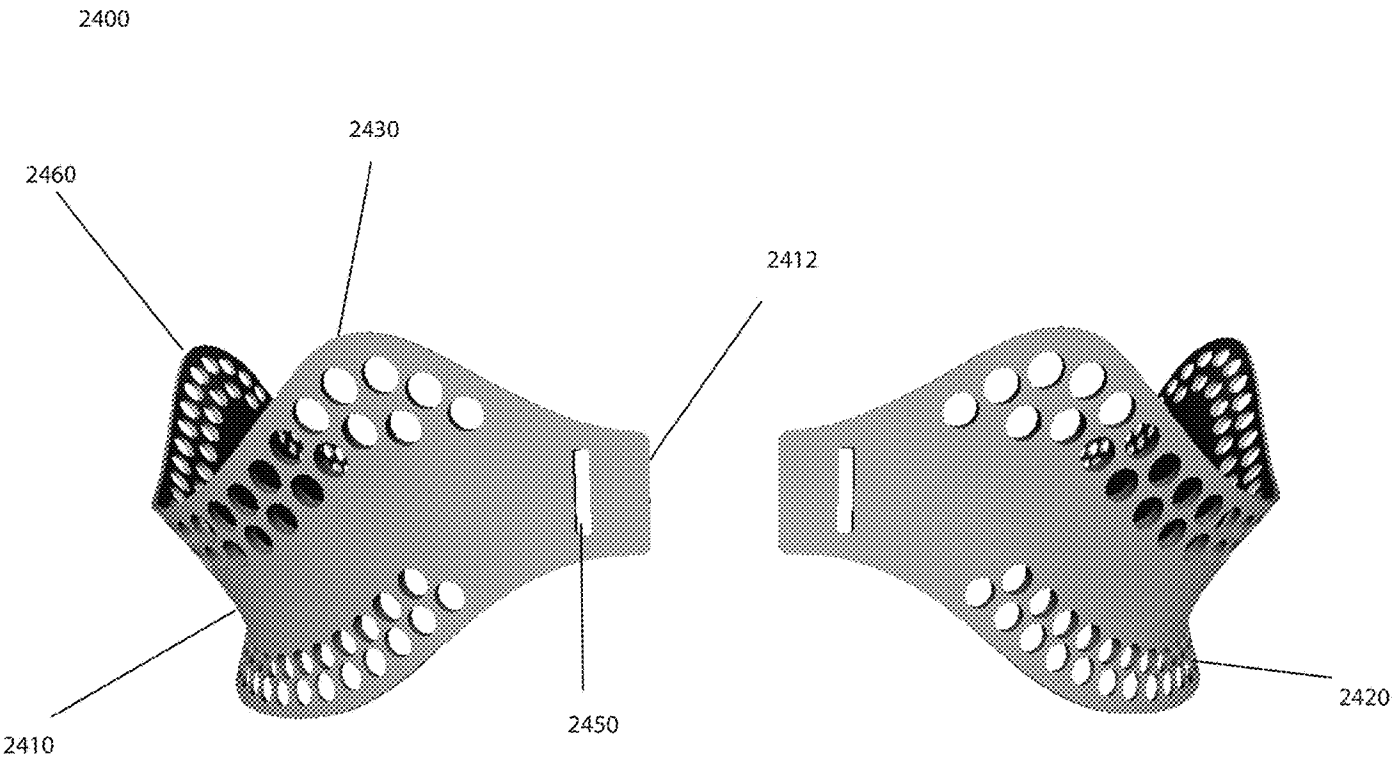
Figure 24B:
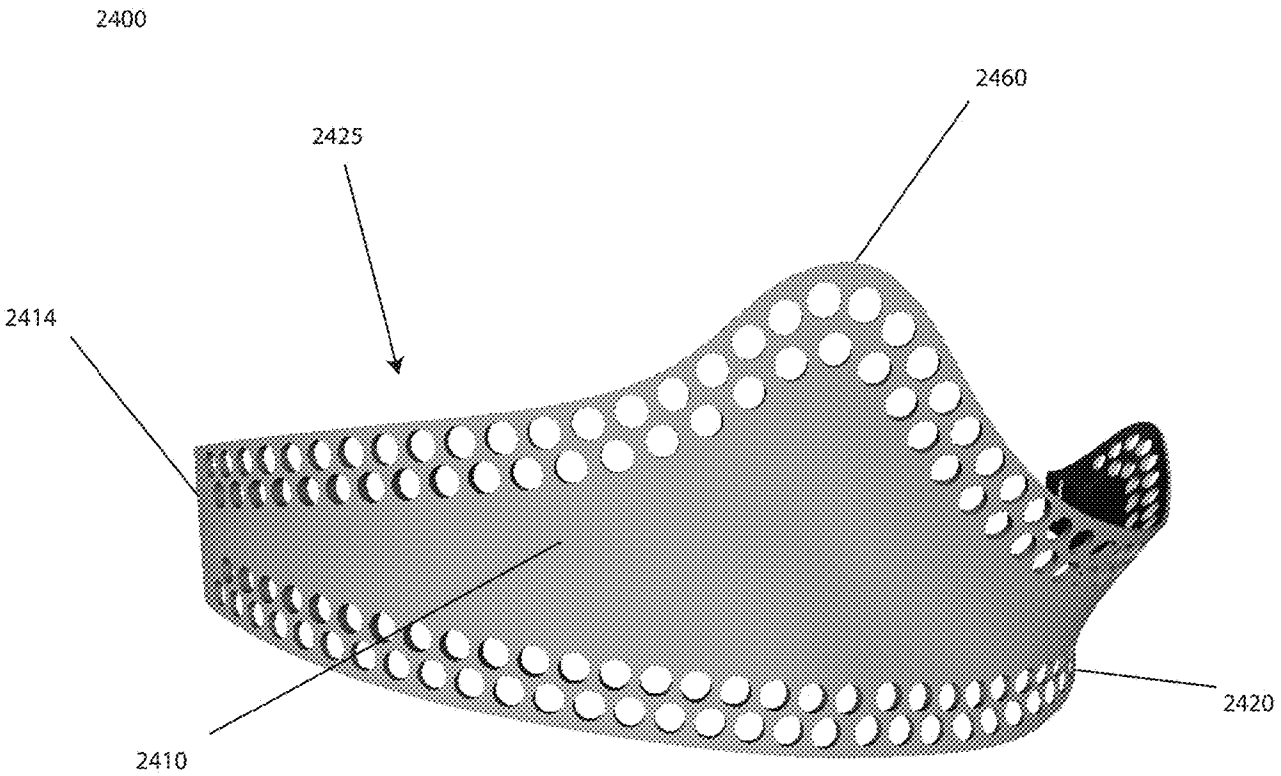

FIGS. 24A-24B provide examples of an exemplary support structure 2400. More specifically, FIG. 24A shows a front perspective view of an exemplary support structure 2400 and FIG. 24B shows a side view of the support structure 2400. Support structure 2400 does not include upper cup regions like upper cup regions 2105, 2205, or 2305. Instead, support structure 2400 is configured as a shelf-like band adapted to partially fit underneath a wearer's breasts and support the wearer's breast weight.

Support structure 2400 may include a band 2410, a structural element, or under-bust band 2420, a side extension 2425, a first peak 2430, an opening 2450, and a second peak 2460. Support structure 2400 may have an interior edge 2412 that may correspond to a vertical midline of the wearer positioned between the breasts and an exterior edge 2414 that may correspond to a side (under the arm) or back of the wearer's torso when a garment incorporating support structure 2400 is worn by the wearer. Interior edge 2412 may be similar to inner edge 220 and exterior edge 2414 may be similar to wrap-around portion outer edge 250. Opening 2450 may be configured to accept, for example, an attachment mechanism for an assembled garment.

An upper edge of band 2410 may include first and second peaks 2430 and 2460. First and second peaks may act to reposition a portion of breast volume into a desired position and/or may act to contain a portion of breast volume. The structural elements 2420 and upper portion of band 2410 may include one or more perforations or a patterned mesh. The perforations may, for example, increase the flexibility and/or decrease a weight/mass of support structure 2400.

Under-bust band 2420 may be similar in form and function to under-bust band 1430 and band 2410, or a portion thereof (e.g., between first and second peaks 2430 and 2460), may be similar in form and function to volumetric cup portion 1810. Side extension 2425 may be similar in form and function to wrap-around portion 1425. The portion of band 2410 at, or near, opening 2450 and/or interior edge 2412 may be similar in form and function to inframammary cleft portion 210. An overall shape of support structure 2400 as may be seen in FIGS. 24A and 24B and/or when, for example, viewed from above or below is that of an arc like arc 1475. More specifically, a shape of a lower edge of under-bust band 2450 may have a radius of curvature similar to arc 1475.

Figure 25A:
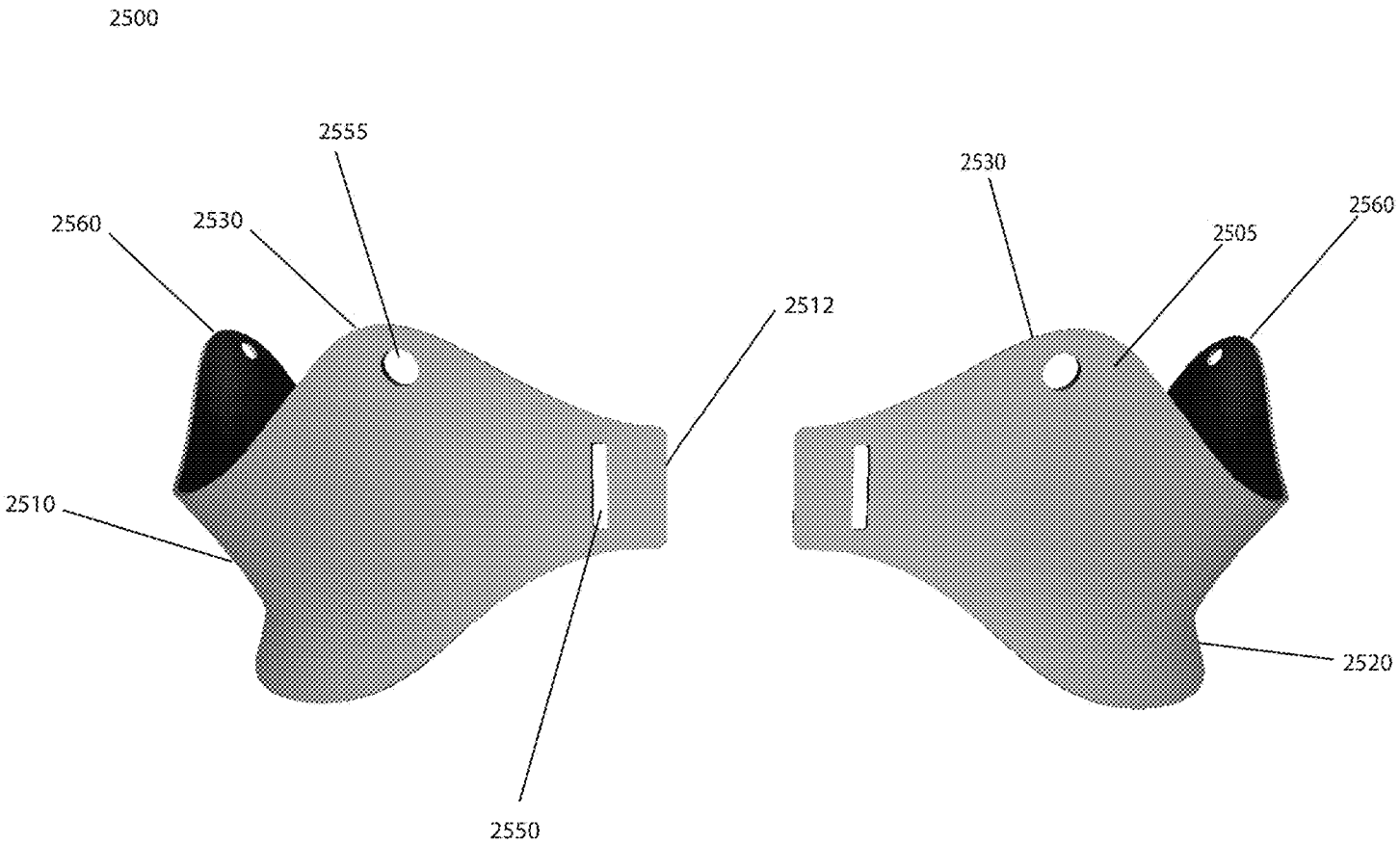
Figure 25B:
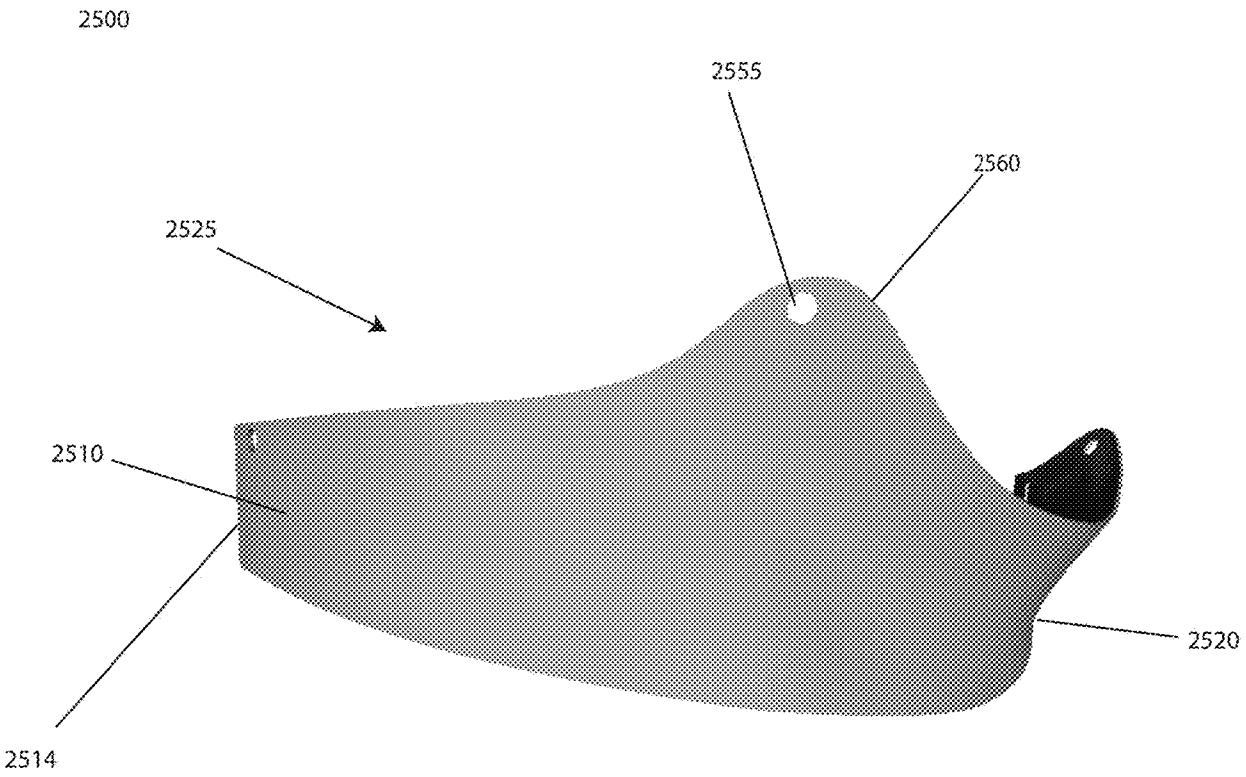

FIGS. 25A-25B provide examples of an exemplary support structure 2500. More specifically, FIG. 25A shows a front perspective view of an exemplary support structure 2500 and FIG. 25B shows a side view of the support structure 2500. Support structure 2500 does not include upper cup regions like upper cup regions 2105, 2205, or 2305. Instead, support structure 2500 is configured as a shelf-like band adapted to partially fit underneath a wearer's breasts and support the wearer's breast weight. Support structure is similar to support structure 2400, with the exception that it does not include the perforations or patterned mesh of support structure 2400.

Support structure 2500 may include a band 2510, a structural element, or under-bust band 2520, a side extension 2525, a first peak 2530, an opening 2550, and a second peak 2560. Support structure 2500 may have an interior edge 2512 that may correspond to a vertical midline of the wearer positioned between the breasts and an exterior edge 2514 that may correspond to a side (under the arm) or back of the wearer's torso when a garment incorporating support structure 2500 is worn by the wearer. Interior edge 2512 may be similar to inner edge 220 and exterior edge 2514 may be similar to wrap-around portion outer edge 250. Opening 2550 may be configured to accept, for example, an attachment mechanism for an assembled garment.

An upper edge of band 2510 may include first and second peaks 2530 and 2560, each of which may include an opening 2555. Opening 2555 may facilitate, for example, attachment of support structure 2500 to a casement and/or housing like casing 2700 and/or housing 3400. First and second peaks may act to reposition a portion of breast volume into a desired position and/or may act to contain a portion of breast volume.

Under-bust band 2520 may be similar in form and function to under-bust band 1430 and band 2510, or a portion thereof (e.g., between first and second peaks 2530 and 2560), may be similar in form and function to volumetric cup portion 1810. Side extension 2525 may be similar in form and function to wrap-around portion 255. The portion of band 2510 at, or near, opening 2550 and/or interior edge 2512 may be similar in form and function to inframammary cleft portion 210. An overall shape of support structure 2500 as may be seen in FIGS. 25A and 25B and/or when, for example, viewed from above or below is that of an arc like arc 1475. More specifically, a shape of a lower edge of under-bust band 2550 may have a radius of curvature similar to arc 1475.

FIGS. 25A-25B provide examples of an exemplary support structure 2500. More specifically, FIG. 25A shows a front perspective view of an exemplary support structure 2500 and FIG. 25B shows a side view of the support structure 2500. Support structure 2500 does not include upper cup regions like upper cup regions 2105, 2205, or 2305. Instead, support structure 2500 is configured as a shelf-like band adapted to partially fit underneath a wearer's breasts and support the wearer's breast weight. Support structure is similar to support structure 2400, with the exception that it does not include the perforations or patterned mesh of support structure 2400.

Support structure 2500 may include a band 2510, a structural element, or under-bust band 2520, a side extension 2525, a first peak 2530, an opening 2550, and a second peak 2560. Support structure 2500 may have an interior edge 2512 that may correspond to a vertical midline of the wearer positioned between the breasts and an exterior edge 2514 that may correspond to a side (under the arm) or back of the wearer's torso when a garment incorporating support structure 2500 is worn by the wearer. Interior edge 2512 may be similar to inner edge 220 and exterior edge 2514 may be similar to wrap-around portion outer edge 250. Opening 2550 may be configured to accept, for example, an attachment mechanism for an assembled garment.

An upper edge of band 2510 may include first and second peaks 2530 and 2560, each of which may include an opening 2555. Opening 2555 may facilitate, for example, attachment of support structure 2500 to a casement and/or housing like casing 2700 and/or housing 3400. First and second peaks may act to reposition a portion of breast volume into a desired position and/or may act to contain a portion of breast volume.

Under-bust band 2520 may be similar in form and function to under-bust band 1430 and band 2510, or a portion thereof (e.g., between first and second peaks 2530 and 2560), may be similar in form and function to volumetric cup portion 1810. Side extension 2525 may be similar in form and function to wrap-around portion 255. The portion of band 2510 at, or near, opening 2550 and/or interior edge 2512 may be similar in form and function to inframammary cleft portion 210. An overall shape of support structure 2500 as may be seen in FIGS. 25A and 25B and/or when, for example, viewed from above or below is that of an arc like arc 1475. More specifically, a shape of a lower edge of under-bust band 2550 may have a radius of curvature similar to arc 1475.

Figure 26A:
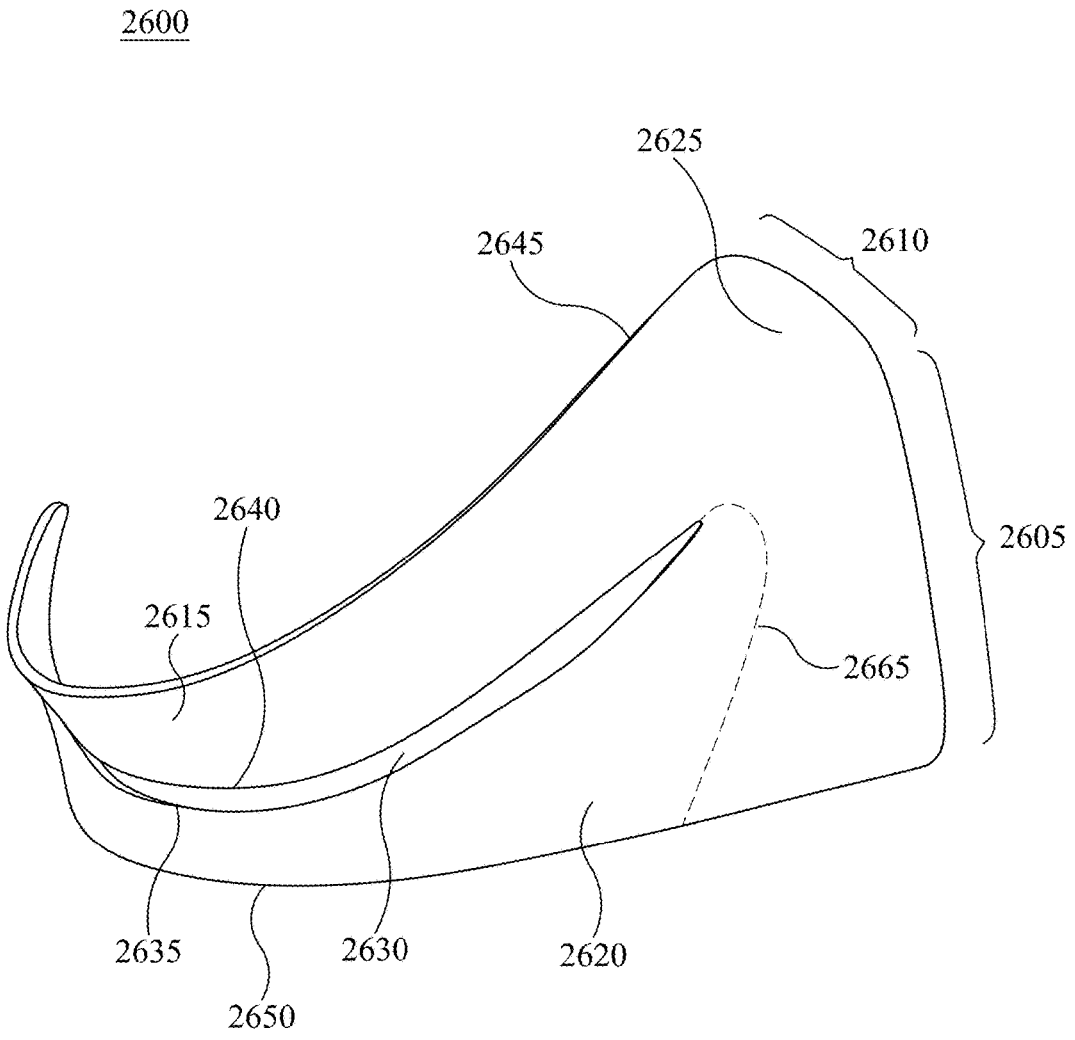
Figure 26B:
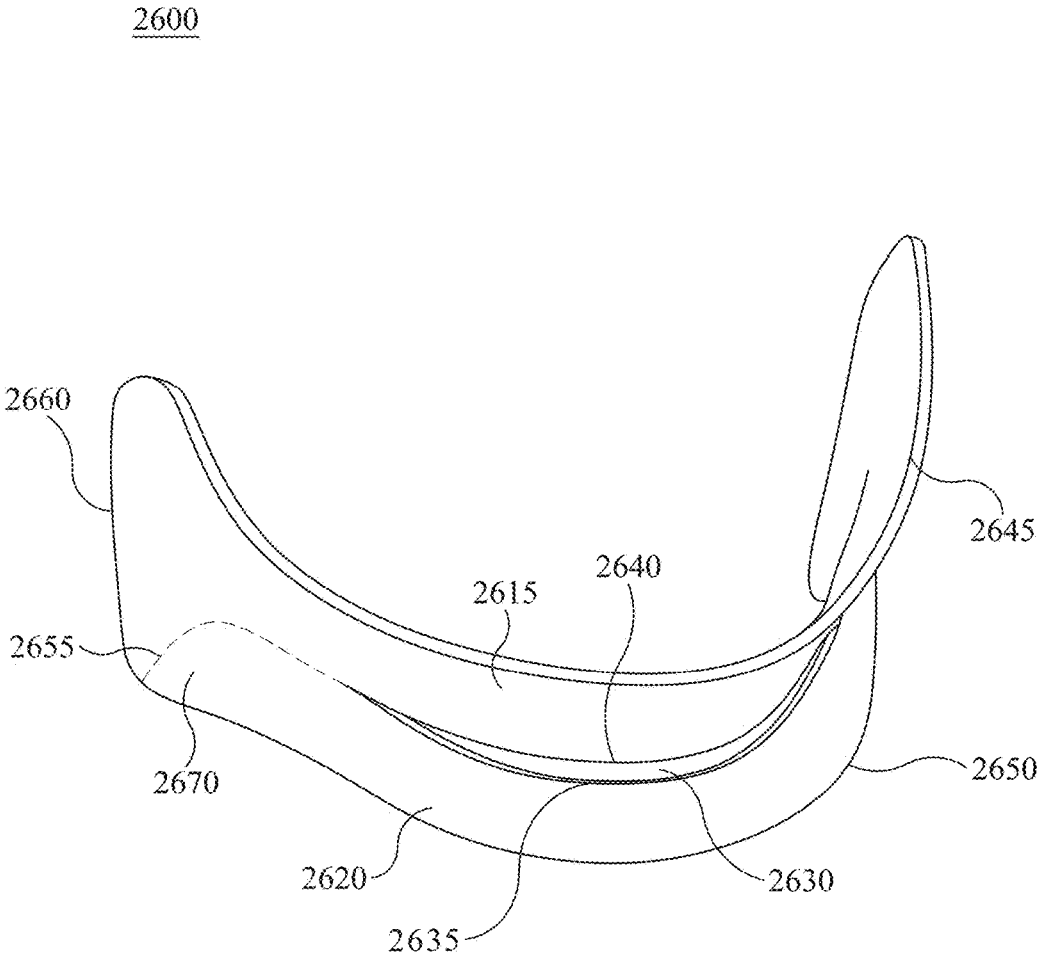
Figure 26C:
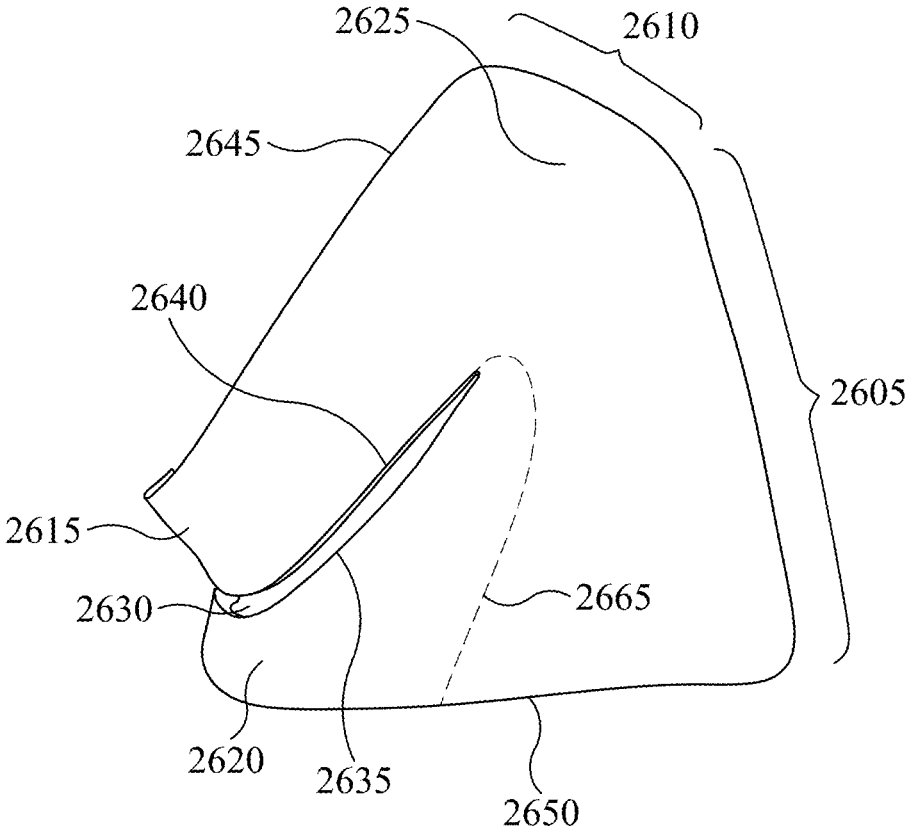

FIGS. 26A-26C provide three different views of another exemplary support structure 2600. More specifically, FIG.

26A provides a front-outside perspective view of an exemplary support structure 2600, FIG. 26B provides a front-inside perspective view of exemplary support structure 2600, and FIG. 26C provides a plan view of an outer side of the exemplary support structure 2600. Support structure 2600 includes an upper band 2615 and a lower band 2620 separated by a curved opening 2630 that includes a lower opening edge 2635 and an upper opening edge 2640. Upper band 2615 and lower band 2620 meet at a wrap-around extension 2625 that includes a first edge 2605 and a second edge 2610. Support structure 2600 also includes an upper edge 2645, a lower edge 2650, a first curvature 2655, an inner edge 2660, a second curvature 2665, and an intermammary-cleft portion 2670.

Aspects of lower band 2620 (e.g., size, shape, radius of curvature) may be similar to frame 1400 and/or under-bust band 1430 and may be curved in, for example, the X-, Y-, and/or Z-planes so as to approximate a curvature and/or a contour of an exterior surface of wearer's torso in a manner similar to frame 1400. In some embodiments, lower band 2620 may be shaped to fit up against the torso of wearer 10 and conform to the shape of the wearer's torso 20 where lower band 2620 meets, or is expected to meet, the wearer's torso (e.g., at, or near, the wearer's inframammary fold). Lower band 2620 may be joined to upper band 2615 at intermammary-cleft portion 2670 and wrap-around extension 2625 of the support structure 2600.

First curvature 2665 may define a curvature and/or transition between the lower band 2620 and the upper band 2615 and/or intermammary-cleft portion 2670 and the second curvature 2655 may define a curvature and/or transition between the lower band 2620 and the upper band 2615 and/or the wrap-around extension 2625 on a second side of the support structure 2600. In some embodiments, first and/or second curvatures 2655 and 2665 may be flexible joints that are, for example, thinner than the material comprising the surrounding wrap-around extension 2625, upper band 2615 and/or lower band 2620. The relative thinness of the material may act to provide flexibility to support structure 2600 and, in this way, may be adapted to act like a hinge between wrap-around extension 2625, upper band 2615 and/or lower band 2620.

In some embodiments, lower opening edge 2635 and an upper opening edge 2640 may be adapted to allow movement of upper band 2615 relative to lower band 2620. The movement may be, for example, translational, linear, or rotational. In some embodiments, the movement may be uniform across the upper band 2615 and/or lower band 2620 and, in other instances, it may be non-uniform as may be the case when, for example, upper band 2615 and/or lower band 2620 stretches or compresses.

The upper band 2615 may be configured in a manner similar to volumetric cup portion 1810 and, in some instances, may be sized, shaped, and positioned so as to correspond with a bottom portion of a wearer's breast 15A or 15B when worn. In some instances, upper band 2615 may support a portion of breast weight for wearer 10 in a manner similar to a sling or hammock anchored by the first extension 2635 and second extension 2605 and/or upper edge 2610. Upper band 2615 may also reposition breast volume into a desired location.

Curved opening 2630 is situated between upper band 2615 and lower band 2620 and the dimensions of curved opening are defined by lower opening edge 2635 and an upper opening edge 2640. In most instances, a width of curved opening 2630 will vary along its length. For example, the width of curved opening 2630 may be its widest at, or near, a center point of the support structure 2600, upper band 2615, and/or lower band 2620 and the width of curved opening 2630 may gradually decrease as the curvature extends out toward intermammary-cleft portion 2670 and wrap-around extension 2625.

In some instances, the center point of the support structure 2600 may correspond with an apex of a system 200 as described below with regard to FIGS. 31A and 31B. In some embodiments, curved opening 2630 may be sized, shaped, and/or positioned so as to coincide with an inframammary fold of wearer 10 and thereby may allow for free movement of the underlying breast tissue and/or torso of the wearer when wearing a casing and/or garment that includes support structure 2600. In some embodiments, an exemplary support structure 2600 may be adapted to accommodate sensitive under-breast tissue caused by, for example, an incision or scaring following surgery.

In some embodiments, support structure 2600 may be adapted so that the upper band 2615 and lower band 2620 may move relative to one another. For example, upper band 2615 and lower band 2620 may flex toward one another in the Z-plane and may be free to do so without buckling or otherwise deforming because of the open space provided by curved opening 2630. In some instances, upper band 2615 may move in the Y-plane relative to the lower band 2620.

Intermarry cleft portion 2670 may extend substantially along the Y-plane and may be adapted to sit at, or near, sagittal plane center midline 25 of wearer 10 when worn. In some embodiments, two support structures 2600 may be joined at the center and an intermarry cleft portion 2670 of a first support structure 2600 may be joined to an intermarry cleft portion 2670 of a second support structure 2600. In some instances, a hinge or other flexible coupling may reside between the two first extensions 2635 as with a front- or back-closure bra.

Wrap-around extension 2625 may be adapted to sit at, or near, an outer edge, or side, of wearer's torso 20 when worn in a manner similar to, for example, wrap-around portion 1425 and as discussed below with regard to FIGS. 15A and/or 15B. In some instances, second extension 2605 may be adapted to wrap around a portion of the wearer's torso as shown in, for example, FIGS. 17B, 17C, 20B and/or 20C. An outer edge of wrap-around extension 2625 is defined by first edge 2605 and a second edge 2610. Second edge 2610 is at an angle of between, for example, −5° and −50° relative to first edge 2610. Thus, the second edge 2610 is angled downward and this may serve to make the support structure 2600 more comfortable when worn because the support structure 2600 and/or second extension 2605 may comfortably fit under the wearer's arm without pushing into the wearer's sensitive tissue located above the breast near the under-arm region.

In some embodiments, a size and/or shape of support structure 2600 and/or a component thereof may increase or decrease in size in proportion with an increase or decrease in size of the support structure 2600 as may be required to accommodate wearers and/or breasts of different sizes. Additionally, or alternatively, a thickness of support structure 2600 and/or a portion thereof may increase or decrease proportionally to an increase or decrease in size of the support structure 2600. For example, support structure 2600 and/or wrap-around extension 2625 and/or a portion of upper band 2615 and/or lower band 2620 proximate to wrap-around extension 2625 may be thicker than other portions of support structure 2600 so as to provide support for breast weight and/or the repositioning of breast tissue to a desired location (e.g., towards the center of the wearers body and/or upward) and maintenance of the breast tissue at the desired location.

While support structure 2600 is shown as being made from a single uniform material and is of uniform thickness, this need not necessarily be the case. For example, lower band 2620 may be made from a first material and upper band 2615 may be made from a second material. In some instances, support structure 2600 may be designed to flex in a particular direction, or set of directions, but not in other directions so as to accommodate, for example, breathing or movement of the wearer. In some embodiments, couplings between lower band 2620 and first extension 2635 and/or upper band 2615 and second extension 2605 may be hinged or expandable.

Figure 27A:
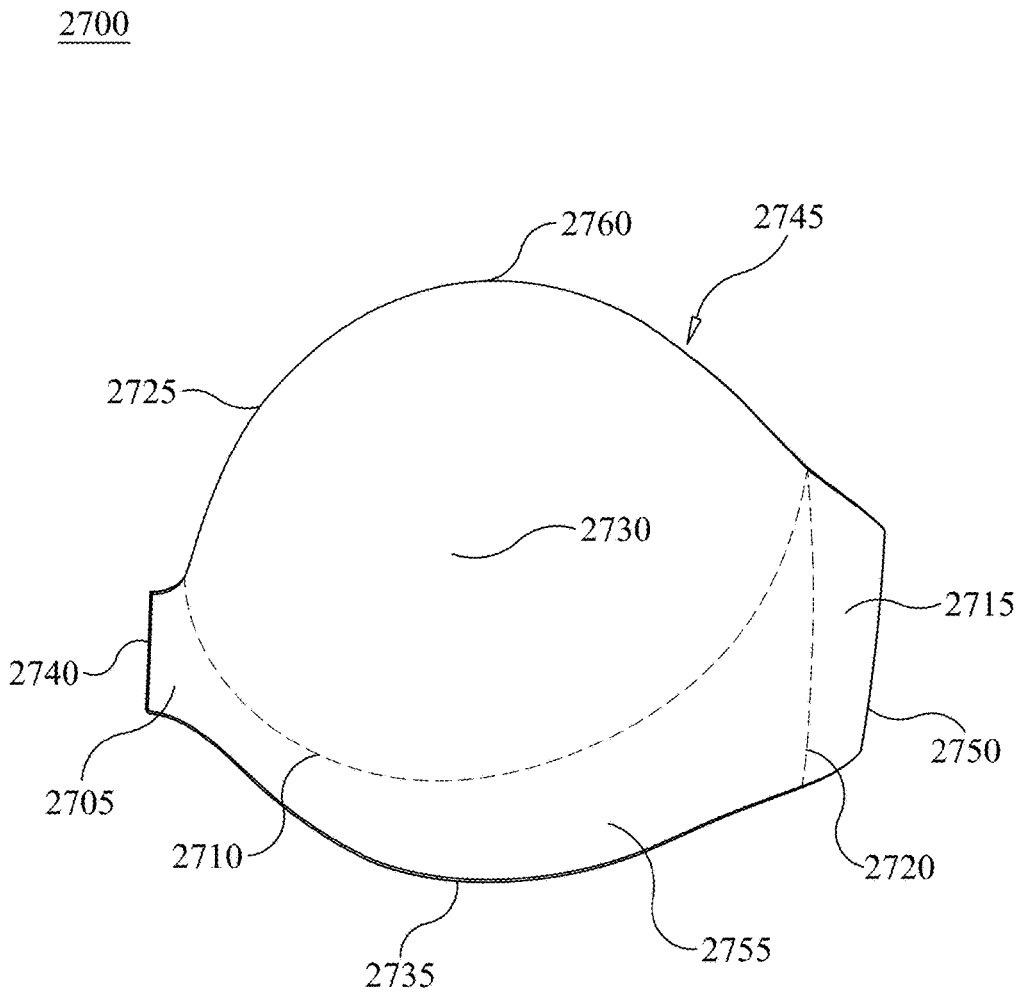
FIGS. 27A-27F provide illustrations of an exemplary casing in accordance with embodiments of the present invention.
Figure 27B:
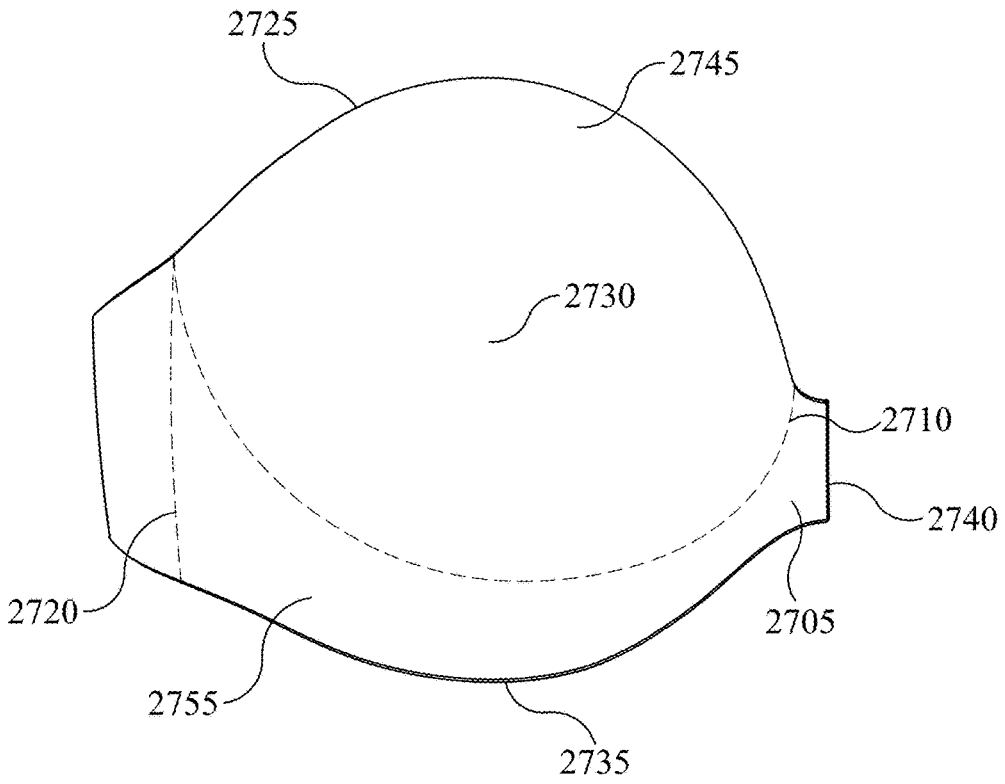
Figure 27C:
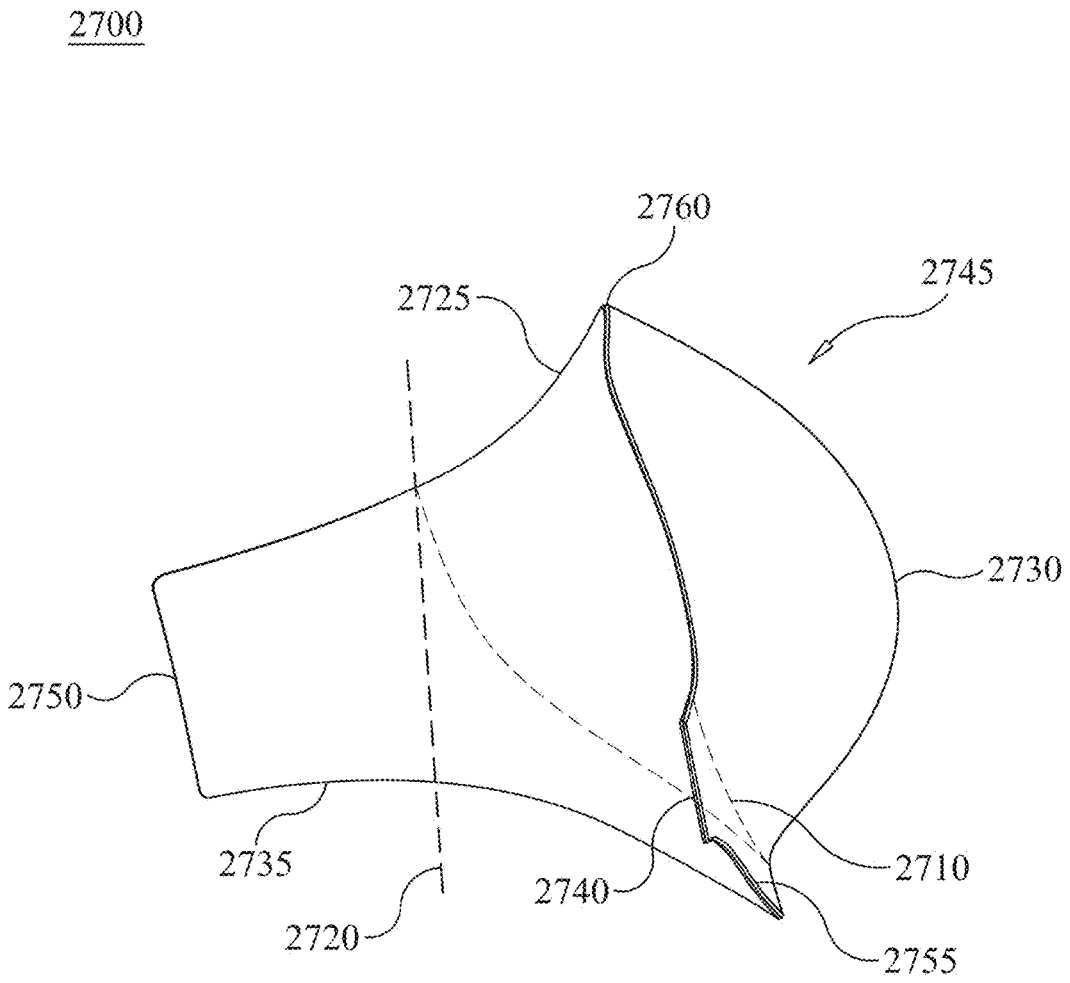
Figure 27D:
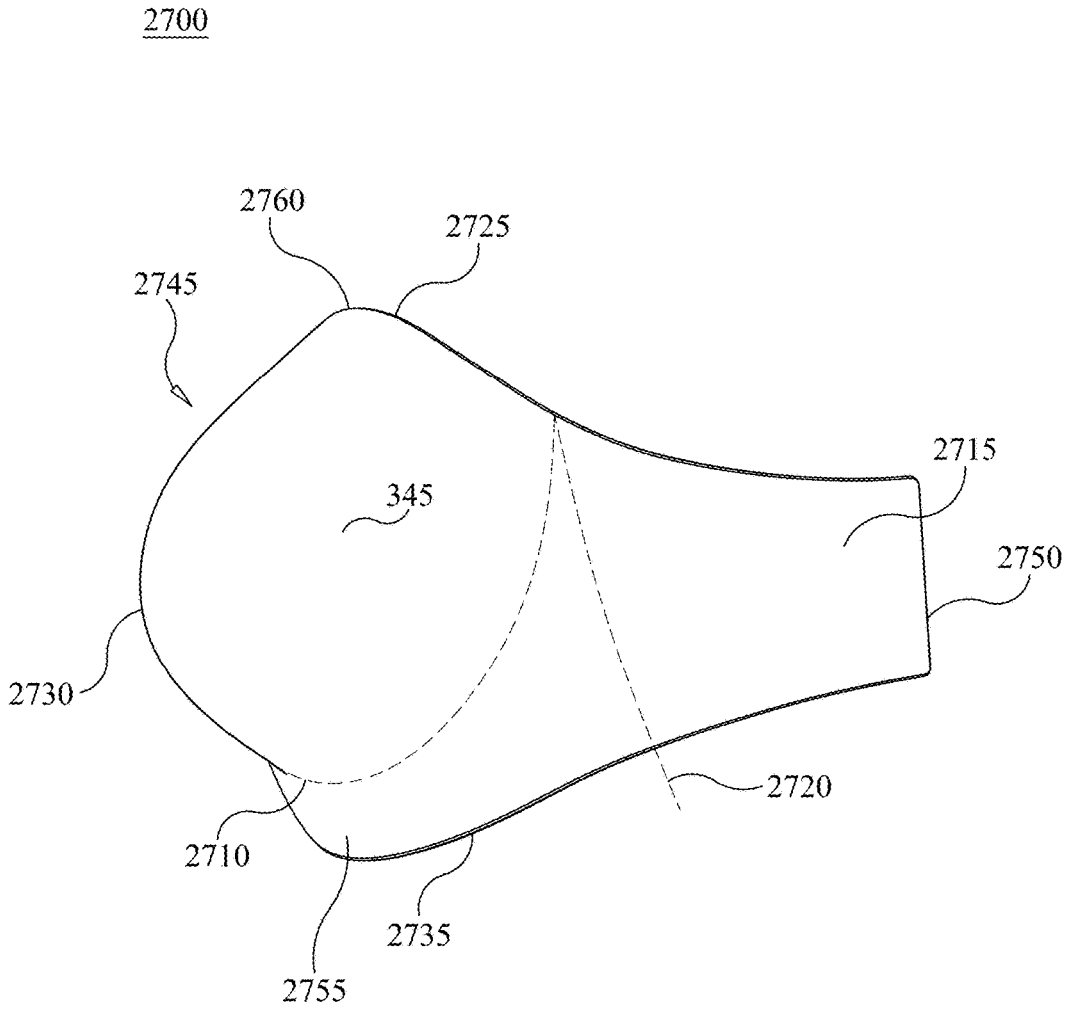
Figure 27E:
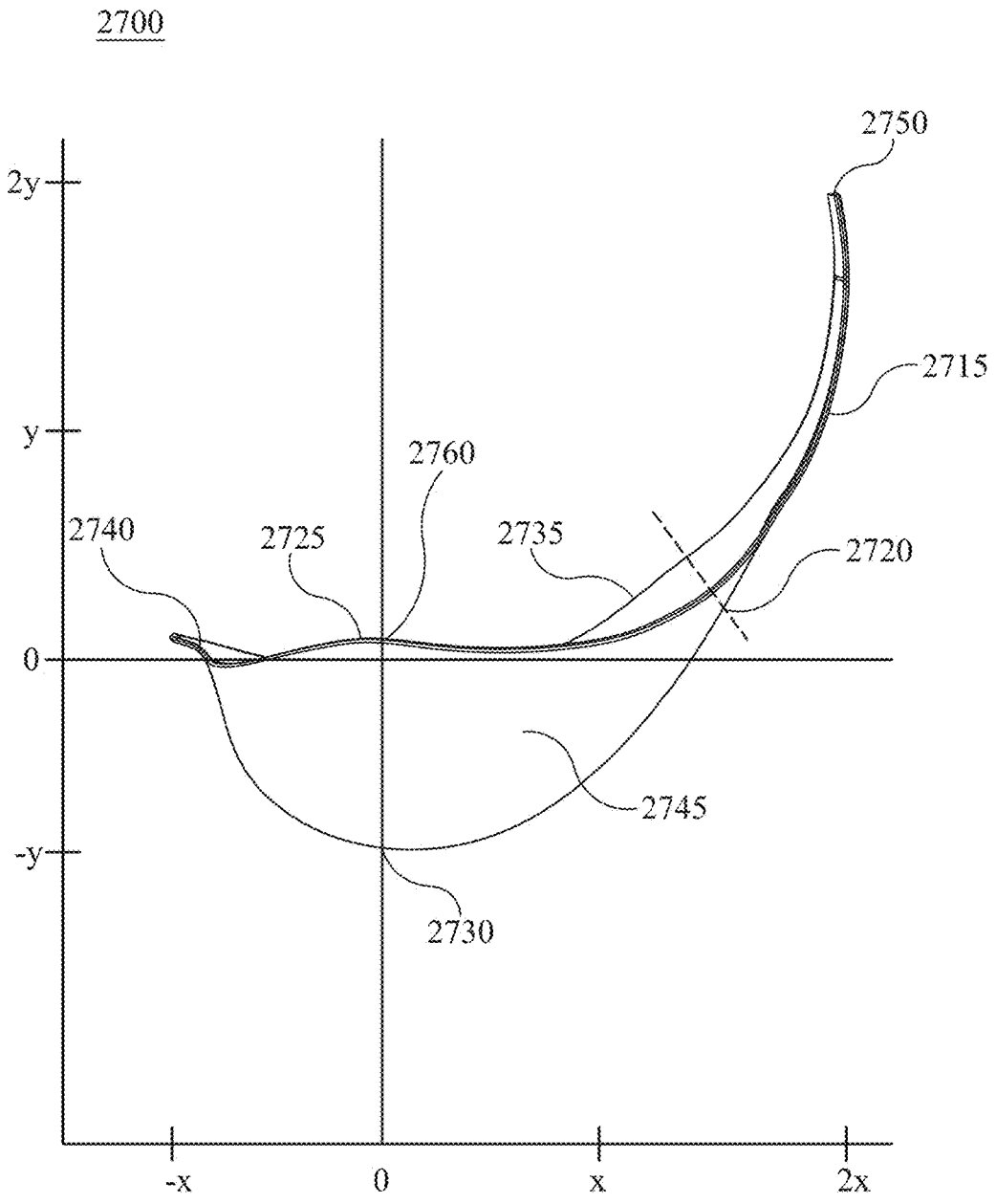
Figure 27F:
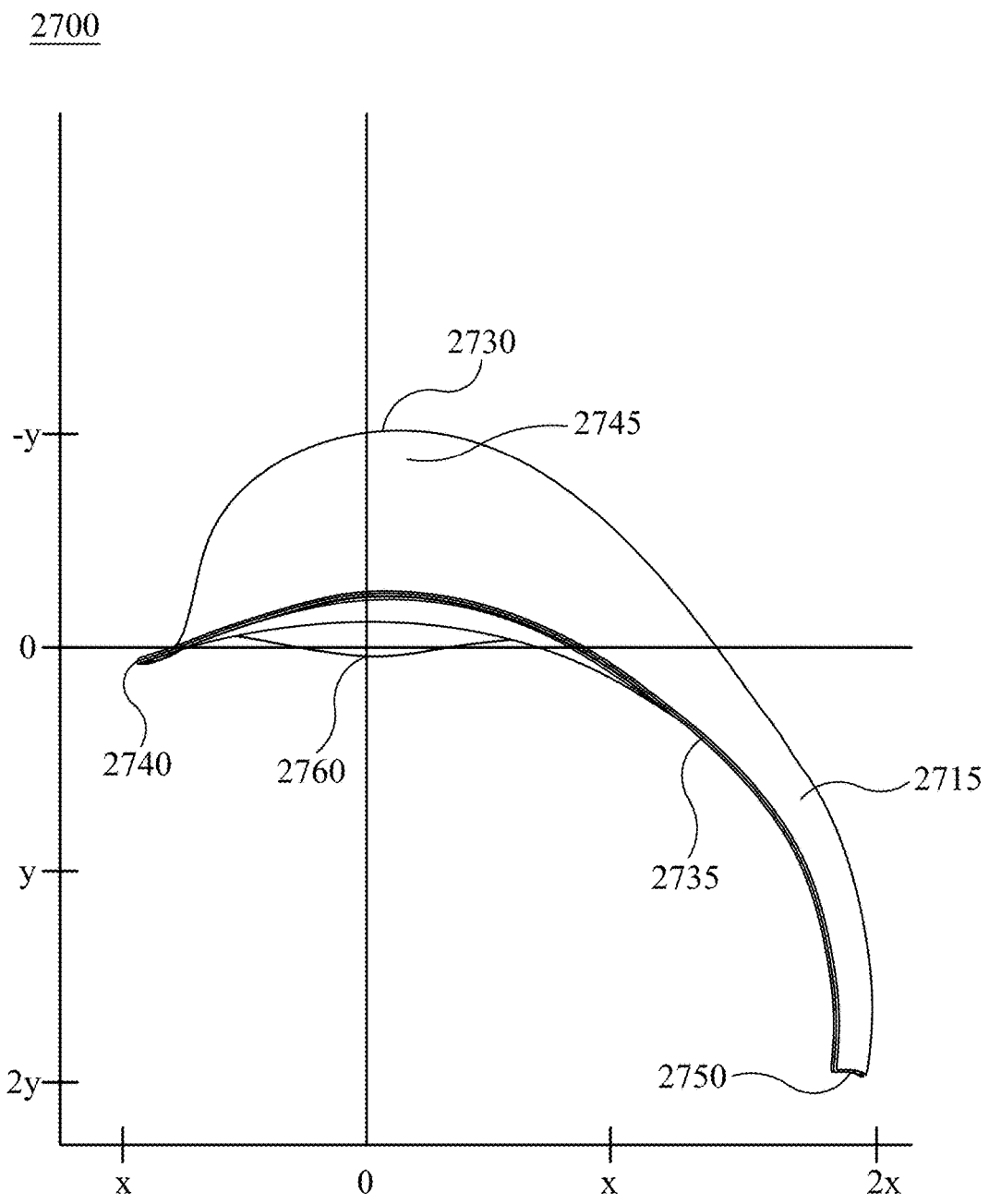

FIGS. 27A-27F provide images of an exemplary three-dimensional casing 2700. More particularly, FIG. 27A provides a front plan view of casing 2700, FIG. 27B provides back plan view of casing 2700, FIG. 27C provides an inside view of casing 2700, FIG. 27D provides an outside plan view of casing 2700, FIG. 27E provides a top view of casing 2700, and FIG. 27F provides a bottom view of casing 2700. Casing 2700 includes an indentation line 2710, a wrap-around portion 2715, an end-of-indentation line 2720, an upper edge 2725, an apex 2730, a lower edge 2735, an inside edge 2740, a volumetric cup 2745, an outer edge 2750, an under-bust band 2755, and an apex of the curvature of the upper edge 2760.

Features of casing 2700 may correspond with, and/or align to, a frame and/or support structure, such as frame 1400 and/or the support structure(s) described herein as may be encased/included therein. For example, indentation line 2710 may correspond with under-bust band upper edge 1440 and/or a curvature thereof and end-of-indentation line 2720 may correspond with wrap-around portion reference line 1470.

When casing 2700 is held in an upright position (as shown in FIGS. 27A-27D), the under-bust band 2755 is configured/adapted to be oriented substantially along the X-axis in a manner substantially perpendicular to a sagittal plane center midline of a wearer, such as sagittal plane center midline 25 of wearer 10. Under-bust band 2755 extends from the inside edge 2740 along the lower edge of casing 2700 underneath indentation line 2710 until end-of-indentation line 2720.

Wrap-around portion 2715 may begin at, or near, end-of-indentation line 2720 and extend away from volumetric cup 2745 toward outside edge 2750 thereby forming wrap-around portion 2715. The size and shape of wrap-around portion 2715 may mimic the size and shape of an encased frame's and/or support structure's wrap-around portion 1430. End-of-indentation line 2720 is a vertical reference line superimposed on the depictions shown in of FIGS. 27A-27F to indicate where indentation line 2710 ends. Volumetric cup 2725 may have similar characteristics to volumetric cup portion 1810 and may be designed to contain and/or cover, for example, 25%, 50%, 75%, 80%, 90%, 95% and/or 100% of a wearer's breast inserted therein. An amount of breast volume contained by volumetric cup 2725 may be dependent upon the overall size and/or shape of volumetric cup 2725 which, in turn, may be based upon a shape or curvature of upper edge 2725 as well as a distance between an apex 2730 and under-bust band 2755.

Volumetric cup 2725 may have an apex 2730, which corresponds to an outer most point of the volumetric spherical-like shape of volumetric cup 2725 and a positioning of apex 2730 may correspond with a desired apex of the wearer's breast tissue when she is wearing casing 2700, which in some instances, may correspond with a position of a wearer's nipple (when the wearer's breast is repositioned within the volumetric cup 2725). In the embodiment of FIGS. 27A-27F, the upper edge 2725 of casing 2700 is curved so that a position of apex 2730 of the volumetric cup along the Y-axis approximately corresponds with an apex of the curvature of the upper edge 2760 along the Y-axis. However, this correspondence is not required and, in some instances, may not be preferred.

FIG. 27C provides a side view of an inside of casing 2700 and FIG. 27D provides a side view of an outside of casing 2700, both of which show how the three-dimensional volumetric cup 2745 extends in the X, Y, and Z directions relative to under-bust band 2755. FIGS. 27C and 27D show a relative distance between apex 2730 and inner edge 2740 as well as a relative distance between apex 2730 and outer edge 2750. Further information regarding these relative distances is provided in with regard to the discussion of FIGS. 27E and 27F. FIGS. 27C and 27D show the curved shape of upper casing edge 2725 as it curves downward from apex of the curvature of the upper edge 2760 and extends outward to form the upper edge of the wrap-around portion 2715 may be seen. This shape of upper casing edge 2725 may serve to support breast tissue from the side of the breast/wearer under her arm and/or around her back when worn while not aligning with the wearer's sensitive armpit region. In this way, casing 2700 is not expected to press into the wearer's skin in, or near, her armpit. FIGS. 27C and 27D also show the upward curvature of the lower edge of under-bust band 2755 so that it tapers upward as it approaches outer edge 2750.

FIG. 27E provides a top-side view of casing 2700 and FIG. 27F provides a bottom-side view of casing 2700, both of which show a curvature of the lower edge of casing 2700, and of casing 2700 in general, in the X-Y plane as viewed from above and below, respectively. As may be seen in both FIGS. 27E and 27F, a curvature 2725 of casing 2700 as a whole as well as casing's 2700 lower edge, under-bust band 2735, and wrap-around portion 2715 may approximate a curvature of a wearer's torso 20 and/or arc 1475.

The images of FIGS. 27E and 27F have a grid superimposed thereon which show relative dimensions for casing 2700 along the X- and Y-axis, wherein a unit of measure along the Y-axis is denoted as "Y" and a unit of measure along the X-axis is denoted as "X". In FIGS. 27E and 27F, it can be seen that an exterior edge of volumetric cup 2745 has a substantially parabola-like shape that spreads wider toward the inside edge 2740 and outside edge 2750. The exterior edge of volumetric cup 2745 primarily occupies the third and fourth quadrants of the grid with the portion of the exterior edge of volumetric cup 2745 closest to the interior edge 2740 being in the third quadrant and the portion of the volumetric cup 2745 closest to the exterior edge 2750 being in the fourth quadrant. With relative dimensions, the apex 2730 aligns with −Y on the X-axis and 0 on the Y-axis. Inside edge 2740 aligns with 0 on the X-axis and −Y on the Y-axis. A position of end-of-indentation line 2720 aligns with 1.5X on the X-axis and 0 on the Y-axis. Wrap-around portion begins approximately at end-of-indentation line 2720 and extends to outer edge 2750, which is positioned at 2X on the X-axis and 2Y on the Y-axis.

FIG. 27F shows casing 2700 rotated along the Y-axis 180° so that the bottom side of casing 2700 is shown and the Cartesian axis superimposed thereon is in the reverse orientation of FIG. 27E so that it is consistent with the positions along the X- and Y-axis defined with regard to FIG. 27E. As may be seen in FIG. 27F, the lower edge of casing 2700 that corresponds with the apex 2730 of the volumetric cup along the Y-axis (Y=0) aligns with −0.3X along the X-axis, the inside edge 2740 is aligned with −X along the X-axis and 0 along the Y-axis, and the outer edge 2750.

Figure 28:
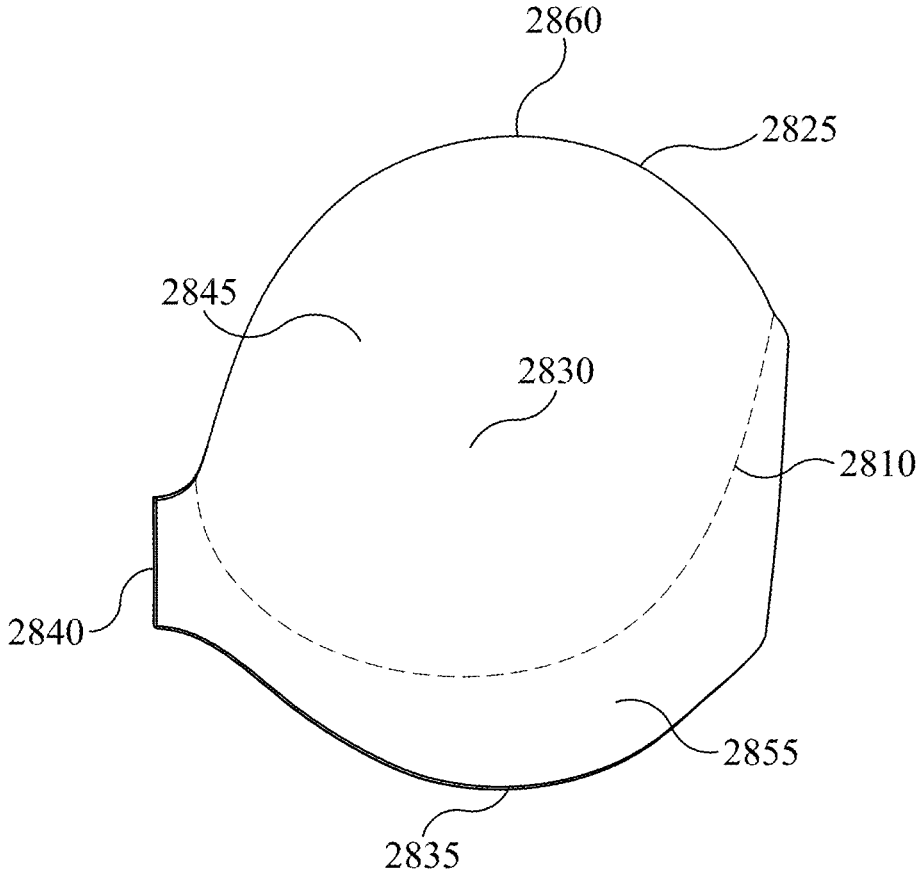
FIG. 28 provides illustrations of another exemplary casing in accordance with embodiments of the present invention.

FIG. 28 provides a front view of an additional exemplary casing 2800. Casing 2800 includes an indentation line 2810, a wrap-around portion 2815, an end-of-indentation line 2820, an upper edge 2825, an apex 2830, a lower edge 2835, an inside edge 2840, a volumetric cup 2845, an outer edge 2850, and an under-bust band 2855.

Features of casing 2800 may correspond with and/or align to a frame and/or support structure, such as frame 1400 and/or the support structure(s) disclosed herein that may be encased/included therein and may be similar to features of casing 2700. For example, indentation line 2810 may correspond with under-bust band upper edge 1440 and/or a curvature thereof and end-of-indentation line 2820 may correspond with wrap-around portion reference line 1470.

Volumetric cup 2845 may be similar to volumetric cup 2745 and/or a volumetric cup portion 1810 encased therein. However, the overall size of volumetric cup 2845 is larger for casing 2800 than casing 2700 and has a different shape, particularly along the upper edge. For example, a relative distance between lower edge 2835 and upper edge 2825 of casing 2800 is larger than a relative distance between lower edge 2735 and upper edge 2725 of casing 2700. In addition, a width of under-bust band 2830 is larger than a width of under-bust band 2735. A casing such as casing 2800 may be preferred when compared with casing 2700 when, for example, the wearer's breasts are relatively large and/or the wearer has a relatively high body mass index.

Volumetric cup 2845 may be designed to contain and/or cover, for example, 25%, 50%, 75%, 80%, 90%, 95% and/or 100% of a wearer's breast inserted therein. An amount of breast volume contained by volumetric cup 2845 may be dependent upon the overall size of volumetric cup 2845, which, in turn, may be based upon a shape, or curvature of upper edge 2825. Volumetric cup 2845 may have an apex 2830, which corresponds to an outer most point of the volumetric spherical shape of volumetric cup 2845 along the Z-axis and a positioning of apex 2830 may correspond with a desired apex of the wearer's breast tissue, which in some instances, may correspond with a position of a wearer's nipple (when the wearer's breast is repositioned within the volumetric cup 2845).

Volumetric cup(s) 2745 and/or 2845 may displace breast tissue across different sizes of wearers and breasts differently so as to provide appropriate breast weight support and/or shaping across a range of wearer and/or breast sizes. In some instances, the apex of volumetric cup(s) 2745 and/or 2845 may not correspond the wearer's apex natural point (as seen when she is not wearing a bra, or clothes) but to force it into a predetermined/desired apex position. This displacement of breast tissue may be achieved via volume placement within the volumetric cup(s) 2745 and/or 2845, and/or a thickness and/or durometer of materials used to manufacture volumetric cup(s) 2745 and/or 2845.

An interior of volumetric cup(s) 2745 and/or 2845 may be adapted so that when they sit against the body/breasts of the wearer 10, they contour around the volumetric cup portion 1810 and the under-bust band 1430 to create a shape that surrounds the breast tissue and shapes the tissue into a pre-determined and/or volumetric cup shape. In some instances, under-bust band 1430 and/or volumetric cup portion 1810 may create a shelf edge to contour, or guide, breast tissue inserted therein into a shape of volumetric cup portion 1810 and/or volumetric cup(s) 2745 and/or 2845.

Casings 2700 and/or 2800 may act to provide padding or other cushioning for frame 1400 and/or support structures disclosed herein so as to, for example, increase the comfort of wearing same. Additionally, or alternatively, casings 2700 and/or 2800 may be adapted to reduce breast motion of breasts included therein by the use of, for example, motion dampening materials like foam or memory foam.

Figure 29A:
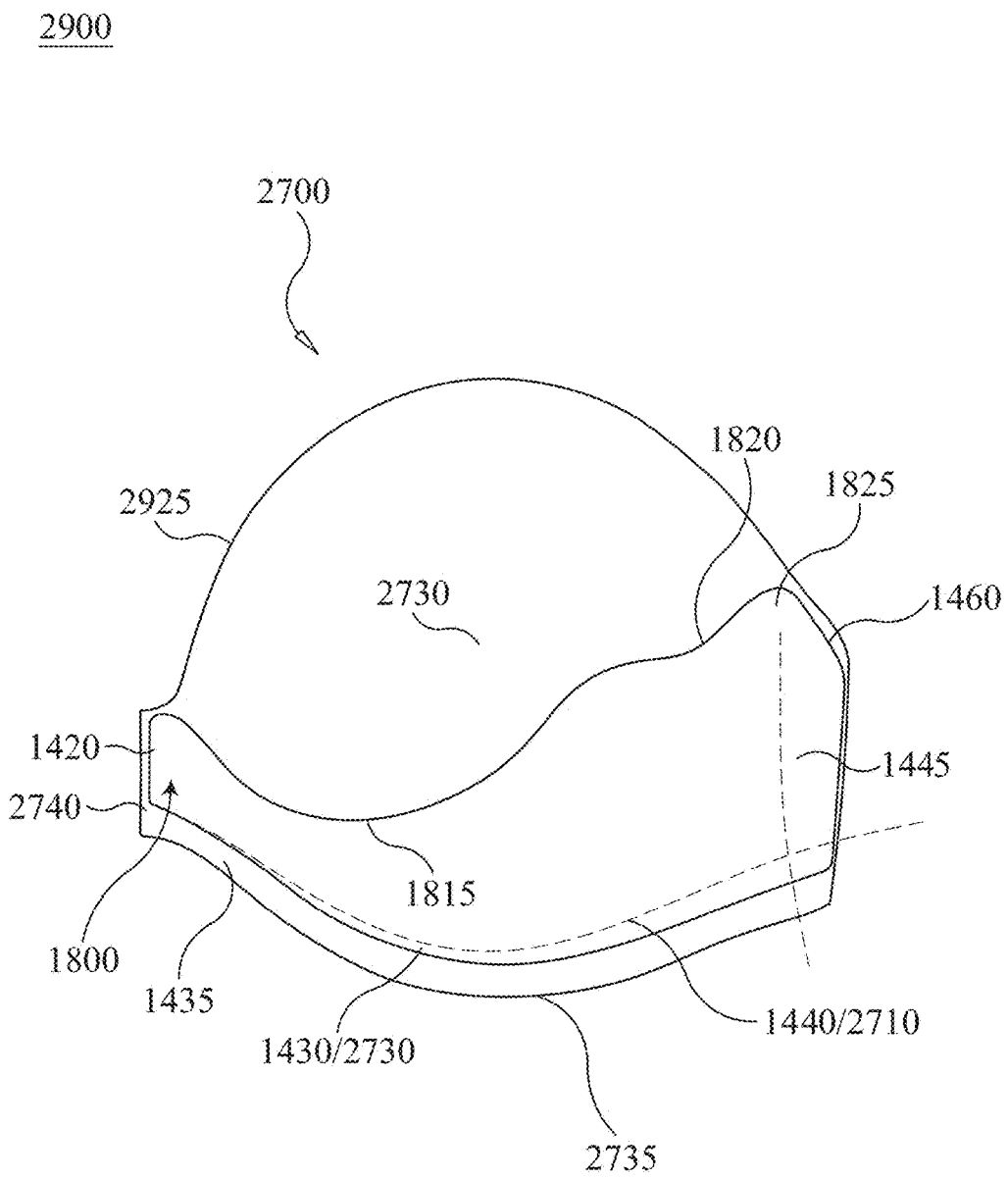
FIGS. 29A-29F provide illustrations of exemplary systems that include a casing with an exemplary support structure encased therein in accordance with embodiments of the present invention.
Figure 29B:
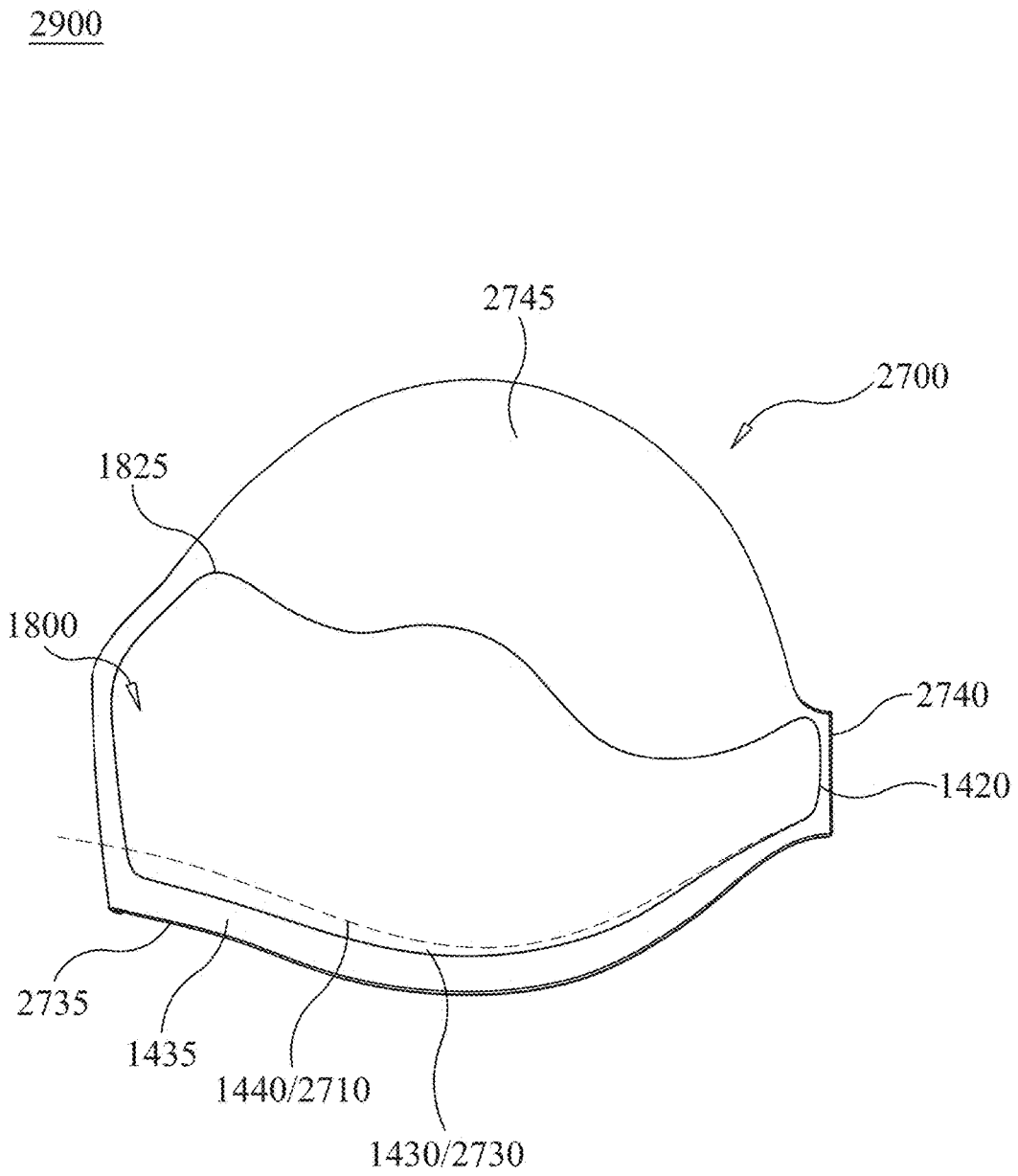
Figure 29C:
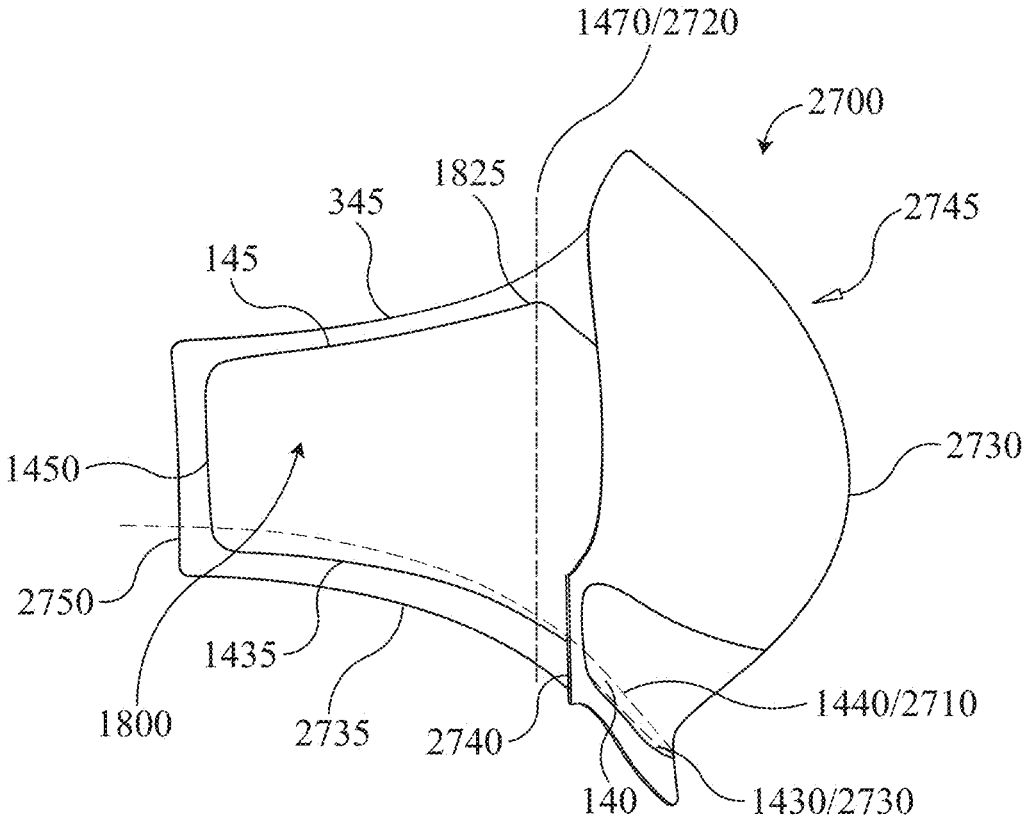
Figure 29D:
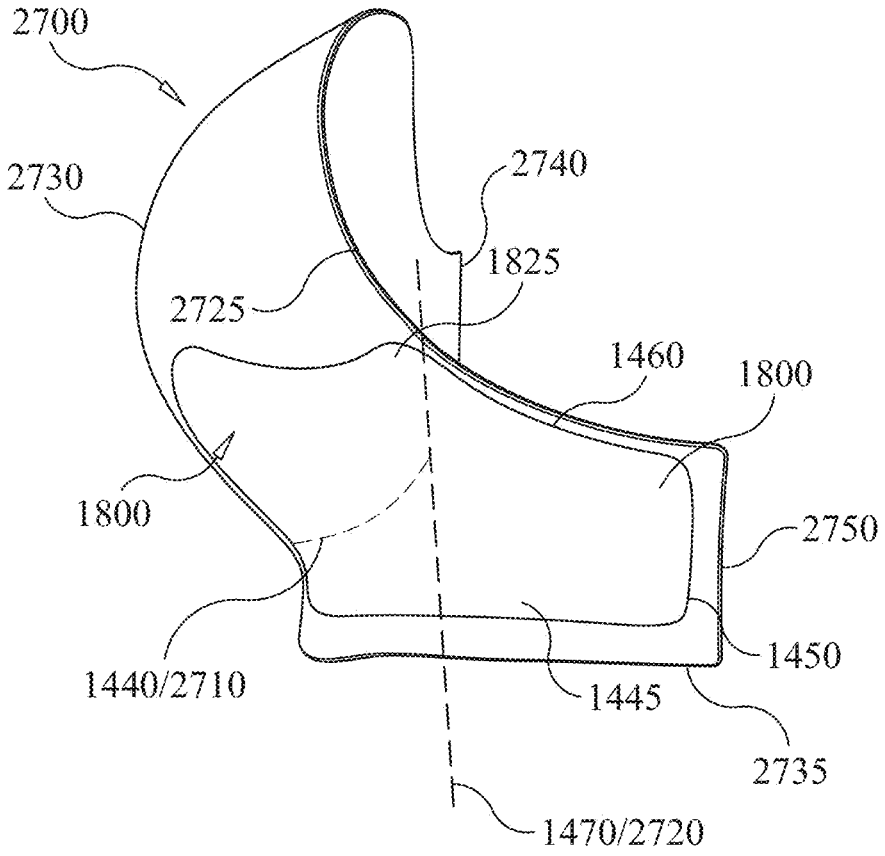
Figure 29E:
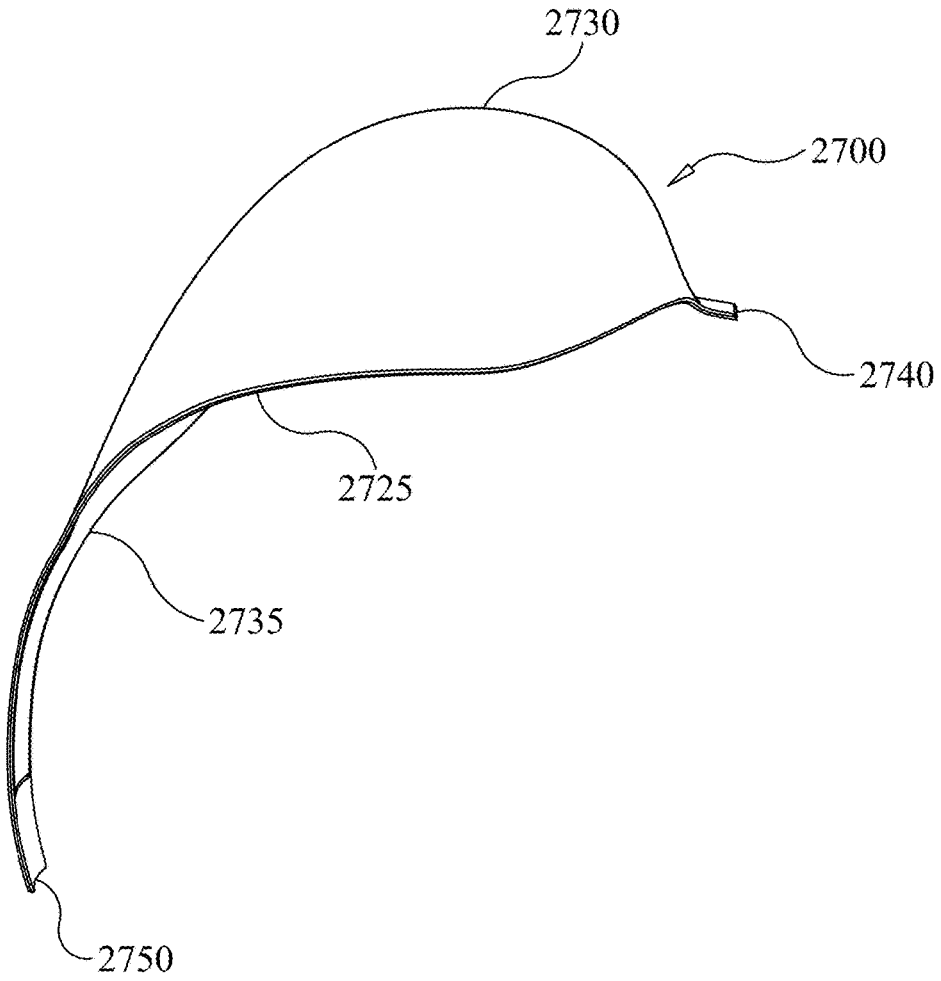
Figure 29F:
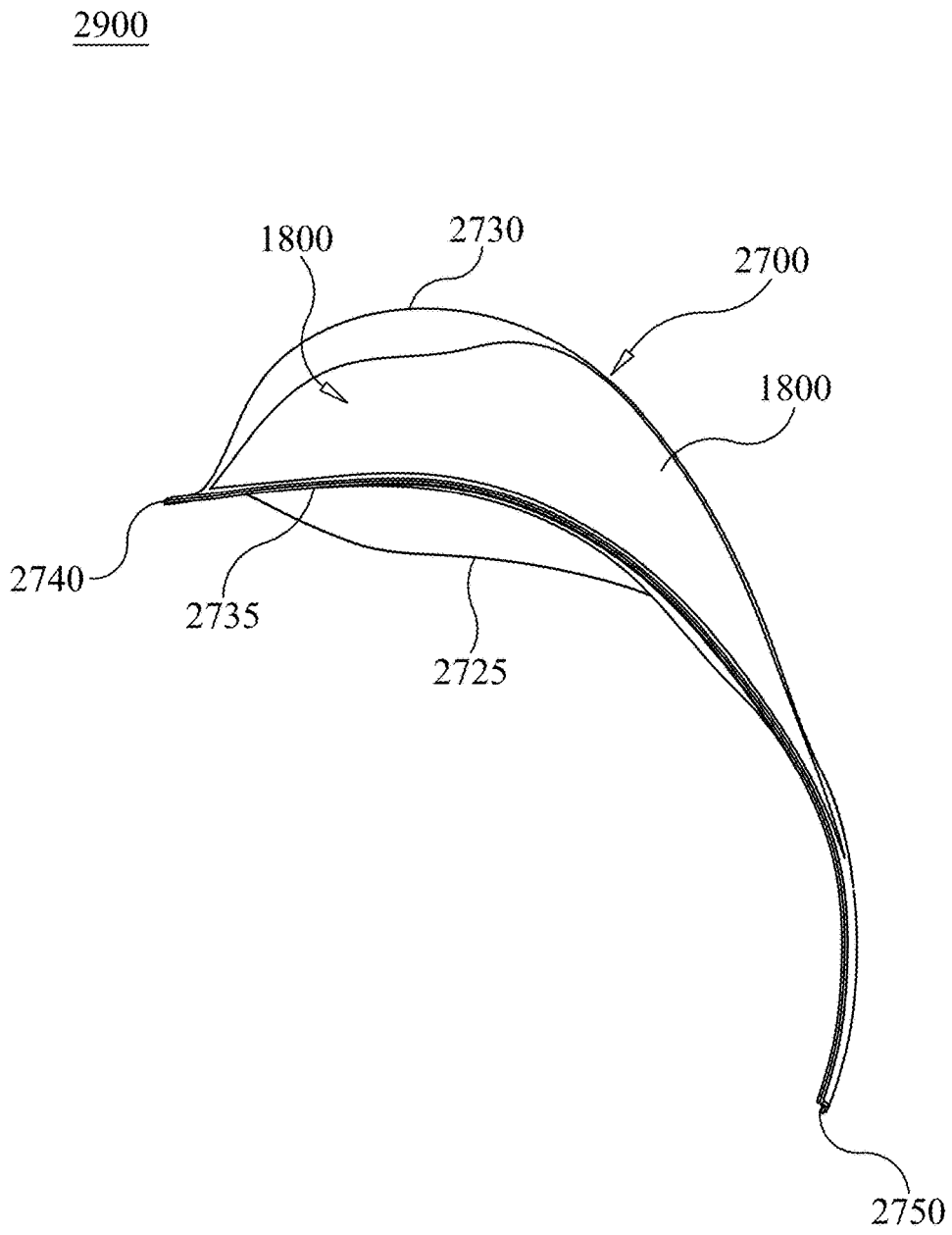

FIGS. 29A-29F provide images of exemplary systems 2900 of casing 2700 with an exemplary support structure 1800 encased therein. More specifically, FIG. 29A shows a front plan view of system 2900, which includes casing 2700 with support structure 1800 inserted/encased therein and shows how support structure 1800 fits within casing 2700. FIG. 29B shows a back side view of system 2900, FIG. 29C shows a side view of an inside of system 2900, FIG. 29D shows a side view of an outside of system 2900, FIG. 29E shows a top side view of system 2900, and FIG. 29F shows a bottom side view of system 2900. More specifically, FIGS. 29A-29F show how features of support structure 1800 and/or frame 1400 align with and/or are encased by casing 2700 so that, for example, volumetric cup portion 1810 is positioned within a lower portion of volumetric cup 2745, upper edge of lower bust band 1440 aligns with end-of-indentation line 2710, wrap-around portion reference line 1470 aligns with end-of-indentation line 2720, and so on.

Figure 30A:
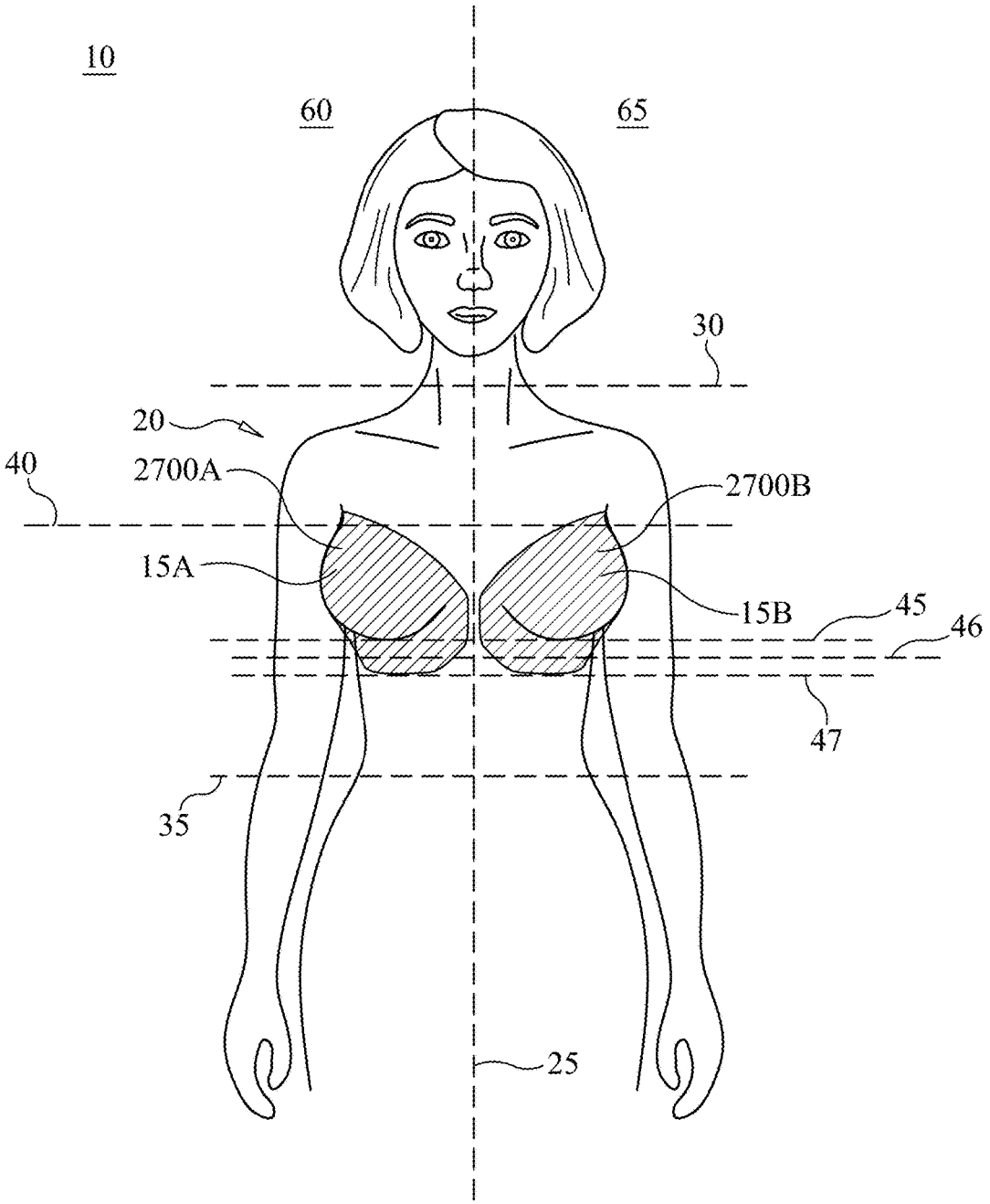
FIGS. 30A-30C provide illustrations of wearer wearing a set of casings in accordance with embodiments of the present invention.
Figure 30B:
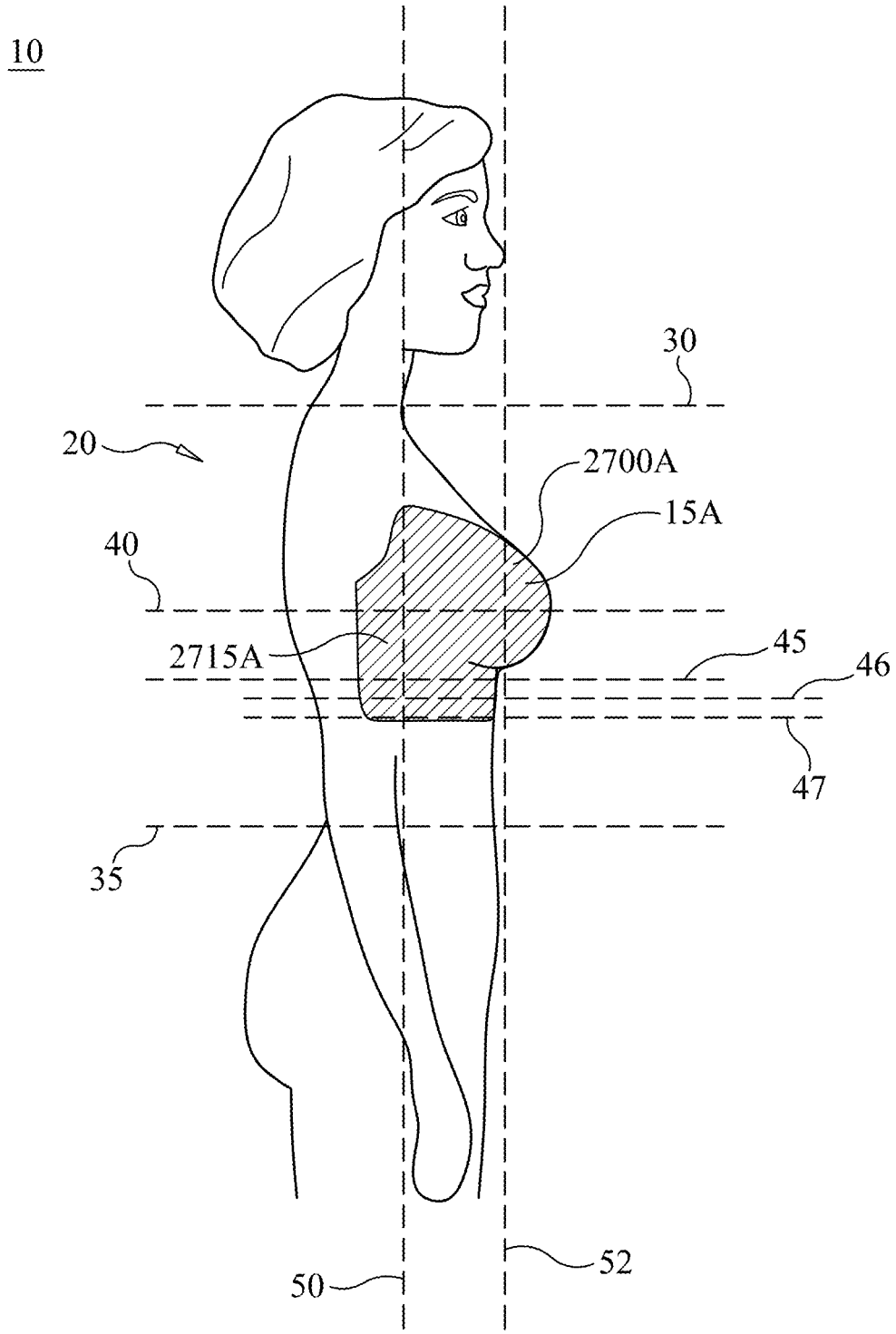
Figure 30C:
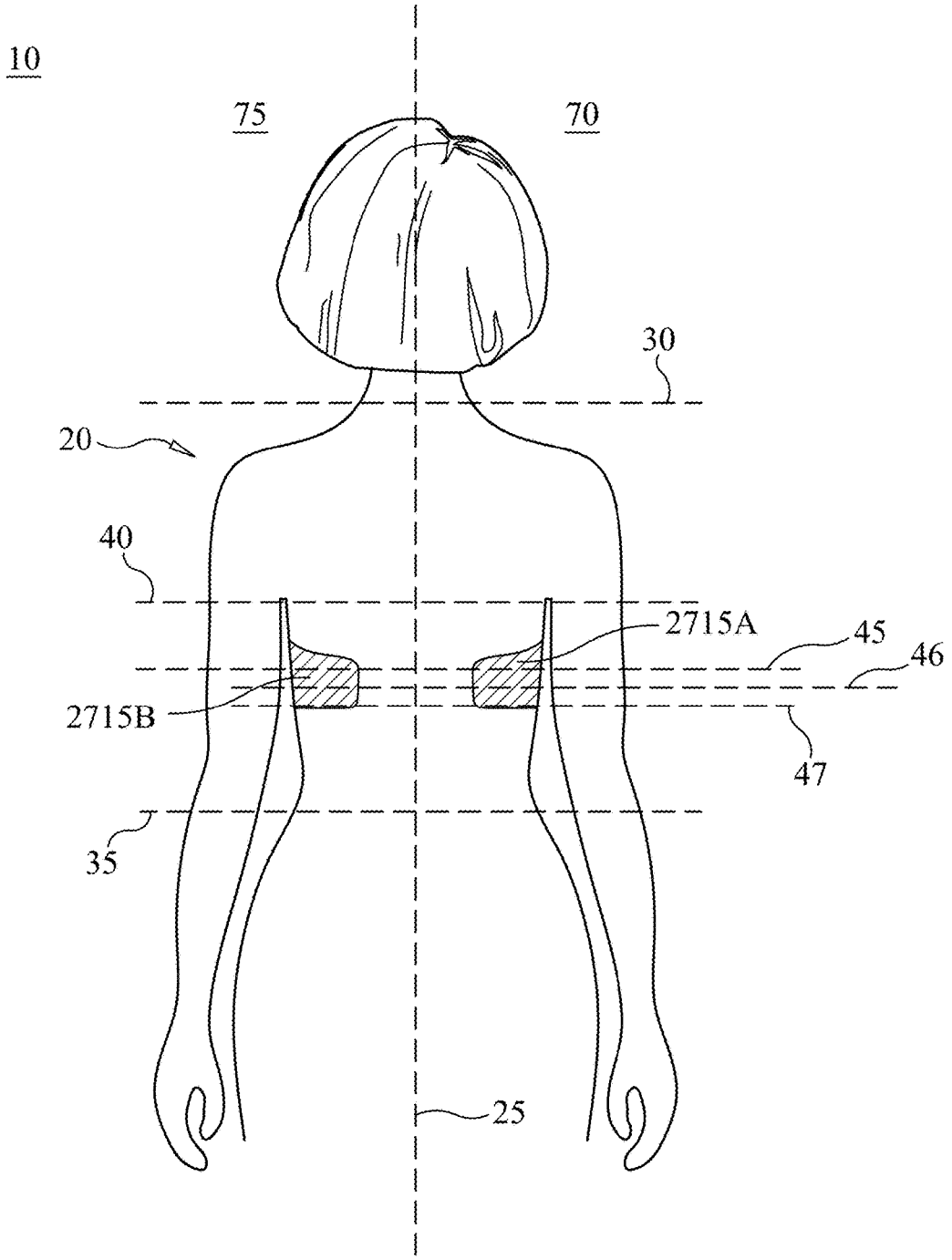

FIGS. 30A-30C provide images of wearer 10 wearing a set of casings 2700A and 2700B on her respective first and second breasts $\mathbf{15}_A$ and $\mathbf{15}_B$. Casings 2700A and 2700B cover nearly all of breasts $\mathbf{15}_A$ and $\mathbf{15}_B$. The example of FIGS. 30A-30C provides one example of relative dimensions of casings 2700A and 2700B to wearer's torso 20. It is expected that wearer 10 will wear casings 2700A and 2700B when they are positioned within a housing, and/or garment (not shown) and FIGS. 30A-30C provide an example of how casings 2700A and 2700B would correspond to wearer's torso 20 when so positioned. In some embodiments, casings 2700A and 2700B may be positioned within a housing like housing 3400 as discussed below. In other embodiments, a housing may include a band, or other mechanism (e.g., clasp, fabric, etc.) that connects the outer edges 2750 casings 2700A and 2700B and/or inner edges 2740 of casings 2700A and 2700B with no fabric overlaid on casings 2700A and 2700B.

Casings 2700A and 2700B also cover a side of wearer's first and second breasts $\mathbf{15}_A$ and $\mathbf{15}_B$, which may act to reposition breast volume to provide a desired breast shape or silhouette for breast tissue by, for example, pushing breast tissue towards the sagittal plane center midline 25 and/or providing a rounded shape for breast tissue to be positioned in.

FIG. 30B provides a side view of wearer 10 wearing casing 2700A, wherein wrap-around portion 2715 extends approximately through the vertical midline 50 and wraps around the wearer's lateral side to her posterior as may be appropriate when, for example, respective first and second breasts $\mathbf{15}_A$ and $\mathbf{15}_B$ are relatively large and/or wearer 10 is relatively large and thereby requires relatively more support for the cantilever of volumetric cup portion 1810 to support the wearer's breast weight than for a smaller wearer 10 with a lower breast weight.

FIG. 30C provides a view of wearer's posterior side with wrap-around portions 2715A and 2715B extending around wearer's lateral side to her posterior. As may be seen in FIG. 30C, wrap-around portions 2715A and 2715B extend across a portion of wearer's posterior by do not touch one another or extend to sagittal plane center midline 25. However, in some instances, a relative distance between wrap-around portions 2715A and 2715B may vary depending on, for example, the girth and shape of wearer 10 as discussed above with regard to FIG. 15A-16F. Although the wrap-around portion outside edge for both wrap-around portions 2715A and 2715B is shown as a straight line that is substantially parallel with sagittal plane center midline 25, this need not be the case as this edge may be oriented at an angle or have a rounded (e.g., semi-circular or oval-like) shape.

The frames, support structures, and/or casings disclosed herein may also be flexible so that they may bend, or flex, (via, for example, application of pressure or force by a housing in which a frame and/or casing is housed) when worn so as to abut the wearer's torso. The contoured shape of arc 1475 and/or a portion thereof (particularly in the X-Z plane on a Cartesian axis when the frame, support structure, and/or casing is held in an upright orientation) may act to support a wearer's breast weight and redistribute weight from a wearer's breast to her torso or rib cage. This is in contrast to a traditional under-wire type of bra that surrounds a perimeter (front, sides and bottom) of breast tissue, which facilitates pulling the breast tissue upwards and supporting that weight by the wearer's shoulders.

In some instances, a size, shape, thickness, width, and/or material used to make a frame and/or casing disclosed herein may be responsive to, for example, a type of garment (e.g., sports bra, bathing suit, compression bra, etc.) in which the frame and/or casing will be included) and/or physical characteristics of a wearer (e.g., body size, shape, body mass index (BMI), mass, relative positioning of body features, breast size) who will wear same. For instance, in some embodiments, the shape, thickness, and/or width of a frame, support structure, casing, and/or a portion thereof, may be responsive to a volume and/or mass of a wearer's breast. For example, when a wearer has a breast mass of 6 pounds per breast then, a thickness and/or size of frame 1400, support structure(s) 1800, 2100, 2200, 2300, 2400, 2500, 2600, 3200, and/or 3300 and/or, and/or casing 2700 and/or 2800 may be greater than a thickness for a for a wearer that has a breast weight of 1.5 pounds per breast. Additionally, or alternatively, a material, or materials, used to manufacture a frame and/or casing may be responsive to the mass and/or volume of the wearer and/or her wearer breasts. For example, a material with a higher durability rating may be used to manufacture a frame or casing disclosed herein for a wearer with a breast weight of 6 pounds per breast than for a wearer with a breast weight of 1.5 pounds per breast.

Additionally, or alternatively, materials may be layered to create a frame, support structure, and/or casing disclosed herein and a number of layers, positioning of layers, shape or size of layers, and/or materials used to manufacture the layers may be responsive to a wearer's size (e.g., second sizing convention size) and/or a type of garment (e.g., sports bra, bathing suit, compression bra, etc.) in which the frame and/or casing will be included and/or the desired look, durability, or flexibility of the material. Materials may also be layered to create a frame and/or casing disclosed herein responsively physical characteristics of a wearer (e.g., body size, body shape, body mass index (BMI) relative positioning of body features, breast size). For example, a frame or casing disclosed herein made for a wearer with a breast weight of 6 pounds per breast may include more layers of material than frame or casing disclosed herein made for a wearer with a breast weight of 1.5 pounds per breast. Additionally, or alternatively, a frame and/or casing may include more layers if it is adapted for inclusion in a garment designed to offer more breast weight support (e.g., a compression bra) than when it is adapted for inclusion a garment designed to offer relatively less support for breast weight (e.g., a camisole). In some instances, more layers may be used in the manufacturing of a frame and/or casing disclosed herein so as to decrease and/or spread out the compression of the wearer's underlying skin or tissue when she is wearing a garment including the frames and/or casings disclosed herein. For instance, when a wearer has a high BMI then, any compression by a bra into her tissue may cause undesired repositioning of the surrounding tissue (e.g., create fat bulges or lines) that be visible (even when wearing a garment on top of the bra). Use of multiple layers in the frame and/or casing, arranged in a manner to gradually increase the compression of the wearer's tissue, and/or an arrangement of layers in the frame and/or casing adapted to spread the footprint of the compressive force on the wearer's tissue caused by the garment including the frame or casing over a greater surface area may serve to reduce and, in some cases, eliminate this effect.

In some embodiments, a size, shape, thickness, and/or width of frames, support structures, and/or casings disclosed herein may be dependent on a positioning of the wearer's breasts and/or an inframammary fold on the wearer's torso. For example, if a wearer's breasts are positioned such than the wearer's inframammary fold sits further above second horizontal reference line 40 than is typical then, a curvature of under-bust band upper edge 1435, volumetric cup portion 1810, arc 1475, and/or wrap around portion 1445 (and/or corresponding portions of a casing or housing) may be adapted to accommodate, for example, the relative distance between the inframammary fold and the wearer's axilla and/or a curvature of the wearer's torso at that point. In this instance, other features of a frame, support structure, and/or casing described herein may also be adjusted to accommodate the relative proximity of the wearer's axilla to her inframammary fold. For example, dimensions of wrap-around portion 1445, a relative angle between wrap-around portion outer edge 1450 and wrap-around portion upper edge 1460 and/or a position of peak 1465 may be adapted so that extension wrap-around portion upper edge 1460 does not coincide with the sensitive under-arm region of the wearer, which is of particular concern because the frame, casing, and/or garment will sit higher on this wearer than on the typical wearer.

In some embodiments, a shape, curvature, and/or width, and/or thickness of the frames, casings, and/or support structures disclosed herein may cooperate with one another to provide a system for redistribution of breast weight to the torso, or rib cage, of a wearer without, in some instances, support from the shoulder by use of a cantilever projection.

In some embodiments, a wearer may be sized for a garment that includes casing 2700 by measuring the dimensions of the wearer's torso at, or near, the wearer's inframammary fold using, for example, processes 200, 300, 400, 500, 600, 700, 800, 900, 1000, and/or 1100 as described above. Measured dimensions may include, for example, direct, manual measurements of the wearer's body (e.g., a manual measurement of a circumference of the wearer's torso) and/or measurements taken from an image of scan of the wearer's body. In some cases, a 3D image or scan (i.e., a series of images of the wearer from different angles, which may include a 360° scan of the wearer's torso) may be taken of the wearer's torso and various measurements of the dimensions of the wearer may be calculated therefrom. For example, a 360° 3D scan of the wearer's torso may be used to generate one or more ellipse-like shapes that may approximate the cross-sectional dimensions of the wearer's torso at various points along sagittal plane center midline 25 along a plane that is perpendicular to sagittal plane center midline 25.

In some embodiments, the frames and/or casings described herein may be self-supporting so that they maintain their respective shapes without application of external force. This may be achieved by, for example, use of materials for the frames, support structures, and/or casings described herein that are of sufficient rigidity to maintain their respective shapes without the application of an external force. In some circumstances, the frames and/or casings described herein may be sufficiently flexible so as to be deformed via the application of force so as to abut the torso/body of a wearer. The external force may be applied by, for example, the wearer when she wraps a garment including a frame, support structure, and/or casing around her torso and activates one or more closure mechanisms (e.g., hooks, straps, etc.) to fasten the garment in place.

Figure 31A:
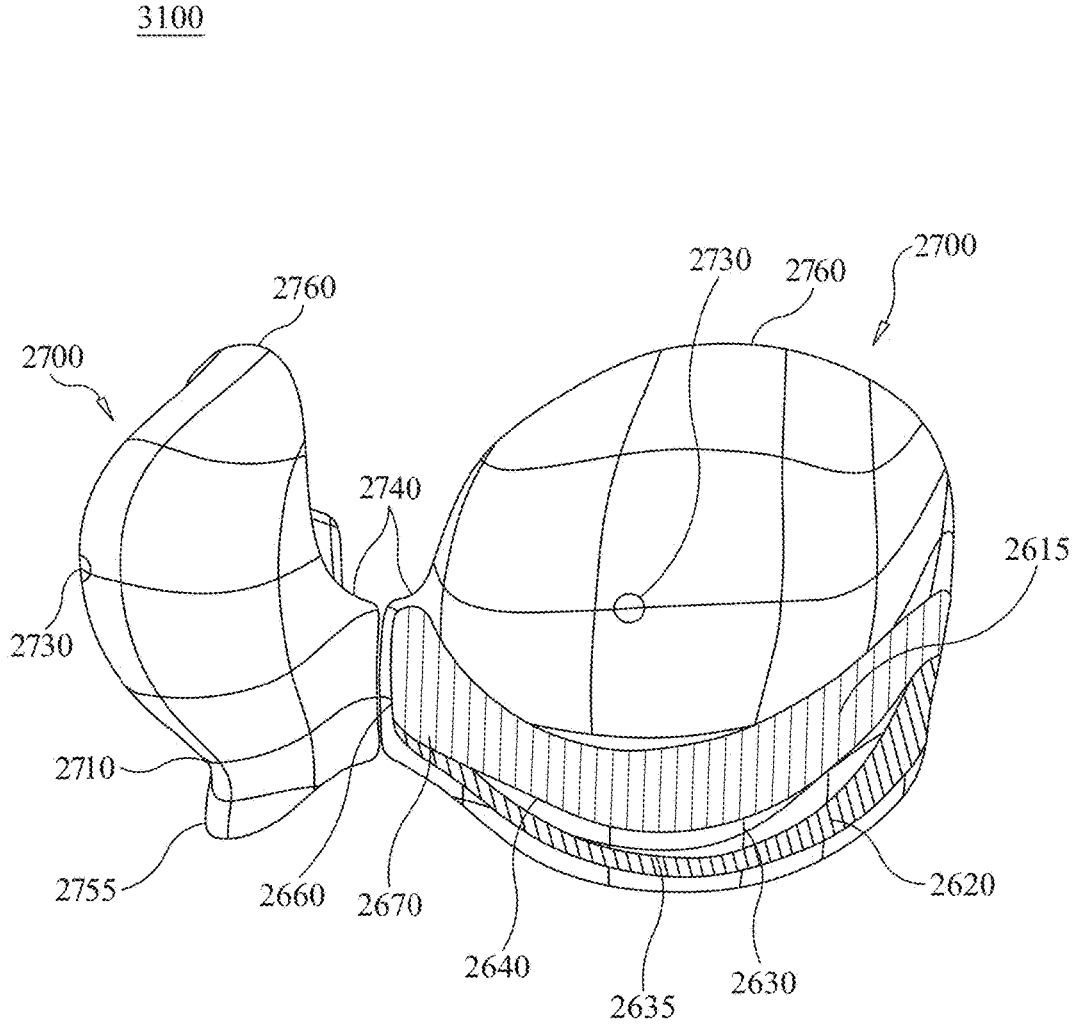
FIGS. 31A and 31B provide illustrations of an exemplary system including a support structure in accordance with embodiments of the present invention.
Figure 31B:
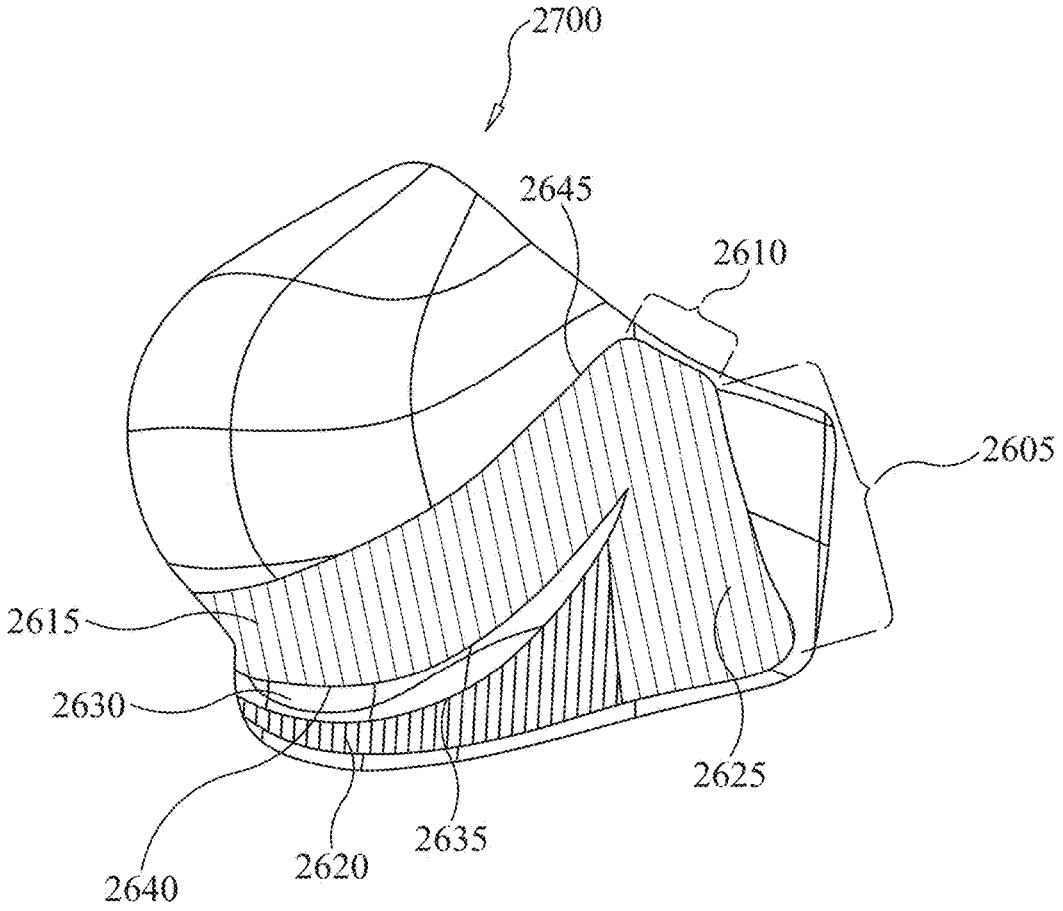

FIGS. 31A and 31B provide an exemplary system 3100 including a support structure 2600 as it may align with an exemplary casing, like casing 2700. While support structure 2600 is shown in FIGS. 31A and 31B as being superimposed on an external surface casing 2700, it will be understood by those of skill of the art that support structure 2600 may also reside within casing 2700 in a manner similar to support structure's 1800 positioning within casing 2700 as discussed above with regard to FIGS. 29A-29F. The support structure 2600 may be affixed to and/or positioned within casing 2700 using any appropriate means including, but not limited to, chemical bonding, mechanical bonding, sewing, vibration bonding, and so on. Casing 2700 may be, for example, a component of a bra that forms some, or all, of a component of a garment adapted to cover a breast and surrounding tissue (e.g., a bra cup). In some instances, casing 2700 may be self-supporting (i.e., retain its shape independently of a housing). Casing 2700 may include a single, or multiple pieces of, material. Although support structure 2600 is shown superimposed on an exterior surface of casing 2700, this need not be the case. For instance, support structure 2600 may be positioned inside casing 2700 (e.g., the material that comprises the casing covers a both front and back surfaces of the support structure 2600).

As noted above, casing 2700 may be adapted to provide a preferred silhouette or shape for breast tissue of the wearer. It may also serve to smooth lines to generate a uniform exterior and/or interior surface. Casing 2700 may also serve as an interface between the skin of a wearer and support structure 2600 and, in this way, may make the wearing of support structure 2600 and/or a brassiere incorporating a support structure 2600 and/or a casing 2700 more comfortable.

Casing's 2700 apex 2730 may correspond to for example, a desired position for an apex of a wearer's breast volume. In most instances, support structure 2600 will be sized, shaped, and positioned so that the upper edge of upper band 2615 sits below apex 2730 and, in some cases, support structure 2600 may be shaped and sized so as to fit onto/into casing 2700 so that a height of second edge 2610 and/or intermammary-cleft portion 2670 is approximately the same as the height of apex 2730 within/on casing 2700.

As may be seen in FIGS. 31A and 31B, lower band 2620 is adapted to correspond to a portion of casing 3115 that has a substantially vertical orientation and is designed to correspond to a region of the wearer's torso 20 positioned underneath the breast but not on the wearer's breast. Lower band 2620 may be adapted to provide structural support/rigidity to the support structure 2600 and/or a garment including support structure 2600. Casing portion 3115 may be adapted to provide a comfortable interface between the wearer and lower band 2620.

As shown in FIGS. 31A and 31B, curved opening 2630 may be shaped, sized, and positioned to correspond with indentation line 2710 so that, for example, the material comprising support structure 2600 does not abut a wearer's inframammary fold when he or she is wearing a garment including system 3100.

Support structure 2600 and/or a portion thereof may have a uniform or non-uniform thickness throughout of, for example, 1 mm-45 mm. In some instances, the relative thicknesses of portions of support structure 2600 (e.g., lower band 2620 and/or upper band 2615) may have different thicknesses (e.g., 1.5 mm, 1.7 mm, 31.7 mm, etc.) and the thickness of portions of support structure 2600 may be proportional to the overall size of support structure 2600 and/or system 3100.

As shown in FIG. 31B, second extension 105 and a corresponding portion of casing 2700 may extend beyond a wearer's breast to wrap around a side portion of the wearer's torso (i.e., under the wearer's arm). Thus, a portion of the weight of a wearer's breast may be repositioned to the side of a wearer.

Figure 32A:
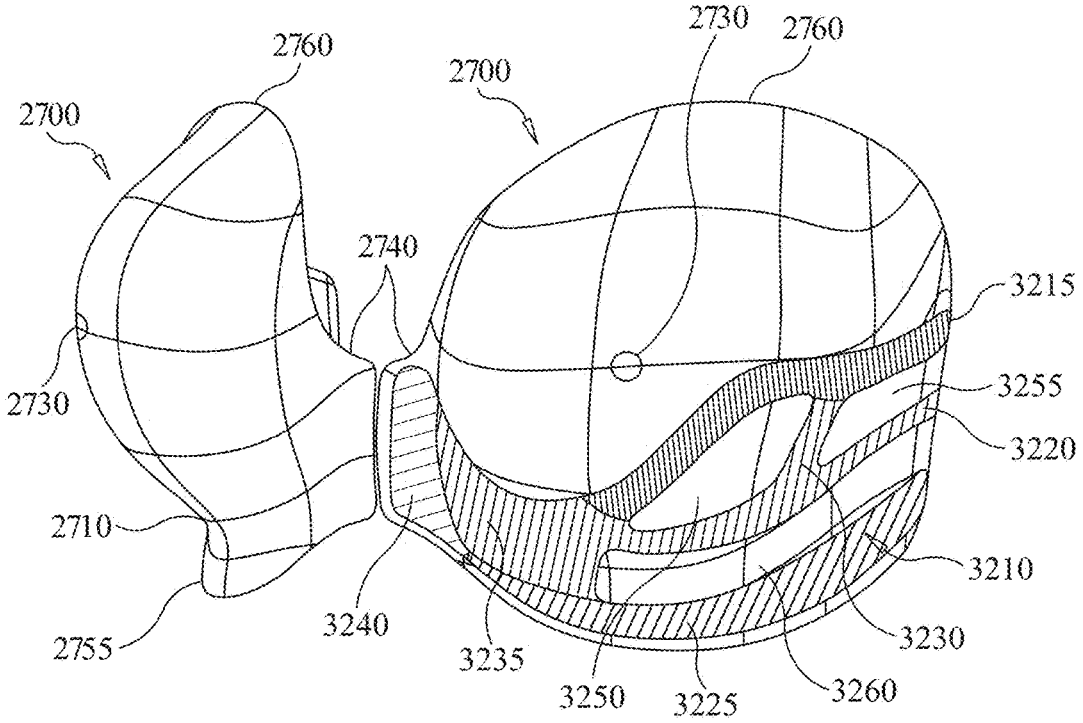
FIGS. 32A-32B, 33A-33B and 32A-32B provide illustrations of a front plan view and a side view, respectively, of an exemplary system in accordance with embodiments of the present invention.
Figure 32B:
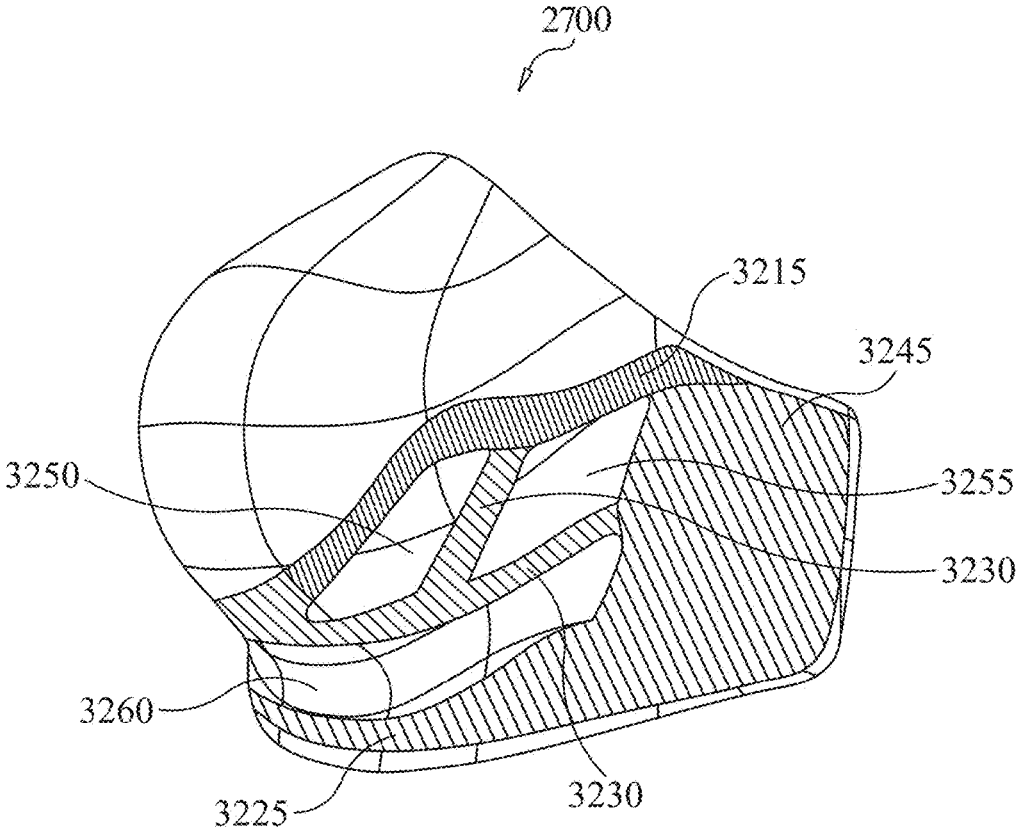

FIGS. 32A and 32B provide a front plan view and a side view, respectively, of an exemplary system 3200. System 3200 includes another exemplary support structure 3210 and a casing like casing 2700. FIGS. 32A and 32B show how support structure 3210 aligns with casing 2700 and various features thereof, such as indentation line 2710, indentation line 2710, end-of-indentation line 2720, upper edge 2725, apex 2730, lower edge 2735, inside edge 2740, volumetric cup 2745, outer edge 2750, under-bust band 2755, and apex of the curvature of the upper edge 2760.

Support structure 3210 includes an intermammary-cleft portion 3240 that may be configured in a manner, and serve a purpose, similar to intermammary-cleft portion 210. An under-bust band 3225 is coupled to, and extends outward from, intermammary-cleft portion 3240 along the lower edge of support structure 3210.

A panel 3235 is adjacent, and coupled to, intermammary-cleft portion 2340 and extends outward therefrom in a direction similar to under-bust band 3225. Panel 3235 also extends upward from under-bust band 3225 and, an upper edge of panel 3235 forms a portion of an upper edge of support structure 2600. Panel 3235 may be adapted to reposition breast volume into a preferred shape. In some embodiments, panel 3235 also provide structural support for breast tissue positioned therein.

Support structure 2600 includes a first band 3215 and a second band 3220 that extend from the side of panel 3235 not coincident with intermammary-cleft portion 3240 to a wrap-around portion 3245. First band 3215 is positioned above second band 3220 and is connected to second band 3220 via a coupler 3230. As first band 3215 extends from panel 3235, it's direction is angled upward at an angle of approximately 30-75° relative to the Y-axis for approximately 1.5 to 5 cm (depending on a size of support structure 3210) after which first band 3215 changes direction and extends approximately parallel to the X-axis for approximately 1.5 cm to 8 cm until it connects with wrap-around portion 3245. The overall curvature of second band 3220 approximates the shape of the fold line 1010 as the second band 3230 extends from intermammary-cleft portion 3240 to wrap around portion 3245. In most instances, second band 3230 is configured to sit at, or near, fold time 1010.

First band 3215 is joined with second band 3220 via a connector 3230 which extends from first band 3215 at an angle of between approximately 20-70° relative to first band 3215. The path of first band 3215, second band 3220, and connector 3230 defines an outline for a first open space 3250 and a second open space 3255. The path between second band 3220 and under-bust band 3225 defines a third open space 3260. More specifically, a first portion of a lower edge of first band 3215, a second portion of an upper edge of second band 3220, and an inside edge of connector 3220 defines a size and shape of first open space 3250; a second portion of the lower edge of first band 3215, a second portion of an upper edge of second band 3220, and an outside edge of connector 3220 defines a size and shape of second open space 3250; and an upper edge of under-bust band 3225 and a lower edge of first band 2315 defines a size and shape of third open space 3220.

First, second, and third open spaces 3250, 3255, and 3260 may, in some instances, be empty (i.e., not include material used to manufacture support structure of 3210 and/or casing 2700). In other instances, first, second, and third open spaces 3250, 3255, and 3260 may define spaces that differ in one or more ways (e.g., type of material, thickness of material, manner of manufacturing material) from first band 3215, second band 3220, and/or under-bust band 3225.

In some instances, a width and/or thickness of one or more of first band 3215, second band 3220, under-bust band 3225, connector 3230, intermammary-cleft portion 3240, panel 3235, and/or wrap-around portion 3245 may be uniform throughout and/or relative to one another. While in other instances, a width and/or thickness of one or more of first band 3215, second band 3220, under-bust band 3225, connector 3230, intermammary-cleft portion 3240, panel 3235, and/or wrap-around portion 3245 may be vary relative to itself and/or each other. For example, when the entirely of support structure 3210 is of uniform thickness, then each first band 3215, second band 3220, under-bust band 3225, connector 3230, intermammary-cleft portion 3240, panel 3235, and/or wrap-around portion 3245 will have uniform thickness of, for example, 0.2-6 mm. In another example, first band 3215 may have a thickness of, for example, 0.2-2.5 mm, second band 3220 may have a thickness of, for example, 0.4-5 mm, under-bust band 3225 may have a thickness of, for example, 0.5-5 mm, connector 3230 may have a thickness of, for example, 0.4-5 mm, intermammary-cleft portion 3240 may have a thickness of, for example, 0.5-10 mm, panel 3235 may have a thickness of, for example, 0.3-7 mm, and/or wrap-around portion 3245 may have a thickness of, for example, 0.5-10 mm. In another embodiment, a width and/or thickness of one or more of first band 3215, second band 3220, under-bust band 3225, connector 3230, intermammary-cleft portion 3240, panel 3235, and/or wrap-around portion 3245 may vary along their respective lengths. For example, a width of first band 3215, second band 3220, and/or under-bust band 3225 may be larger near a junction with panel 3235 and/or wrap-around portion 3245 so as to, for example, facilitate greater rigidity in these area(s) and/or greater flexibility (due to the decreased width) away from these areas.

In some embodiments, support structure 3210 may be made from one or more piece(s) of material (e.g., plastic or foam) and, in some embodiments may include one or more joints, or areas of relatively greater flexibility. At times, these joints may be placed where different components (band 3310, under-bust band 3325, intermammary-cleft portion 3340, and/or wrap-around portion 3330) of support structure 3310 meet one another.

Figure 33A:
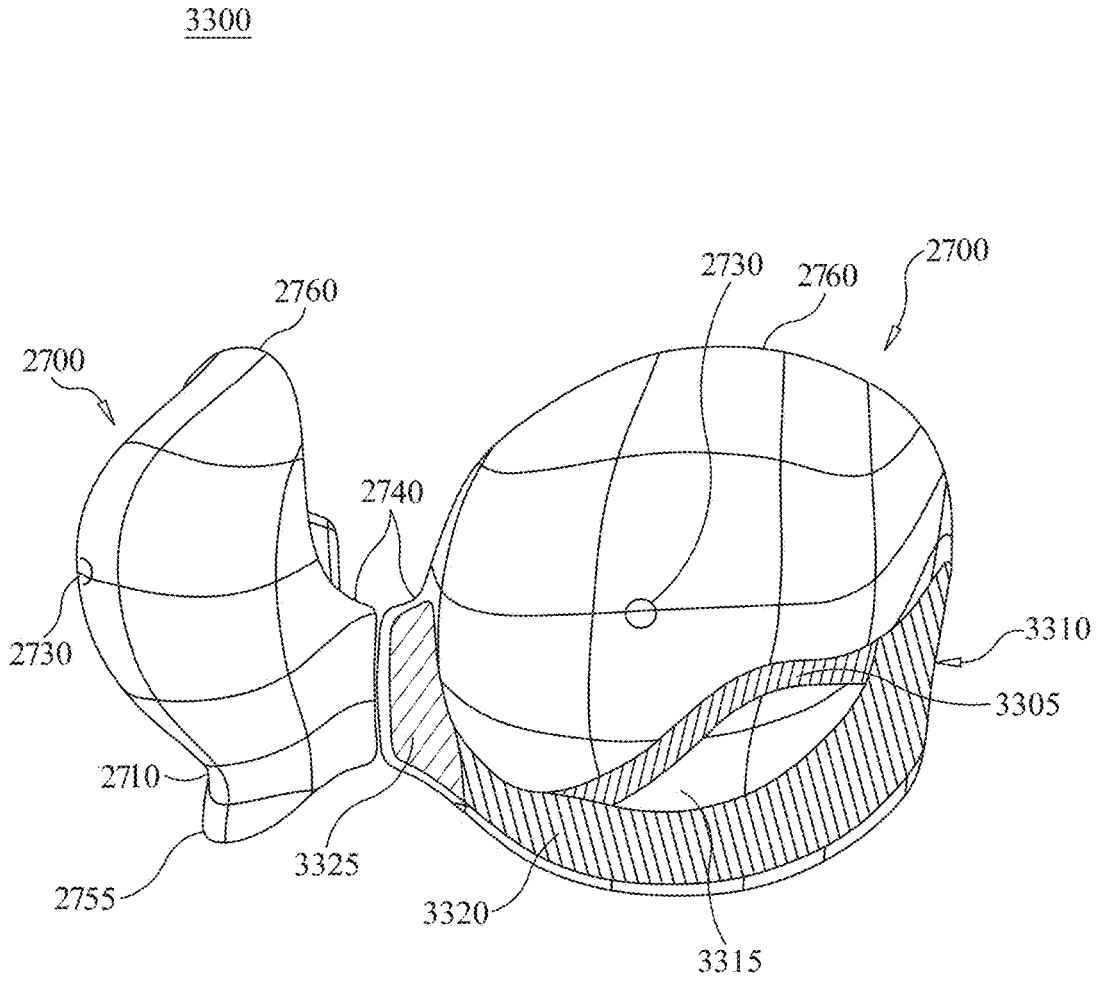
Figure 33B:
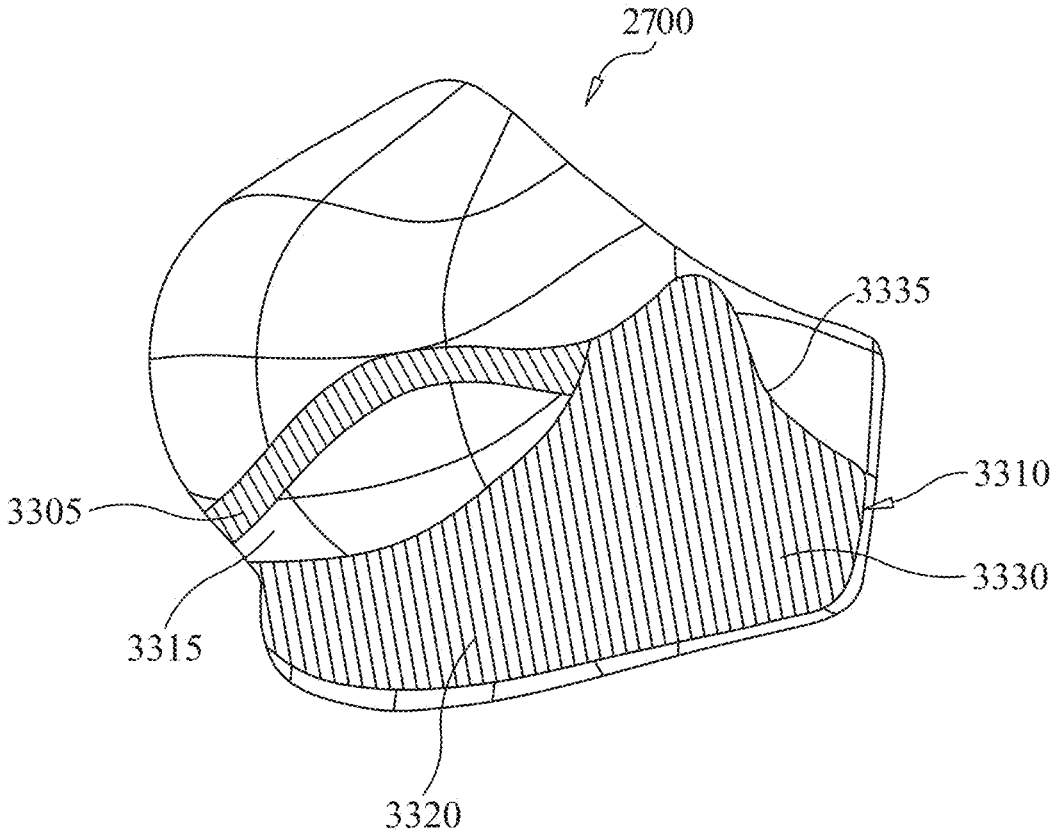

FIGS. 33A and 33B provide a front plan view and a side view, respectively, of an exemplary system 3300. System 3300 includes another exemplary support structure 3310 and a casing like casing 2700. FIGS. 33A and 33B show how support structure 3310 aligns with casing 2700 and various features thereof, such as indentation line 2710, indentation line 2710, end-of-indentation line 2720, upper edge 2725, apex 2730, lower edge 2735, inside edge 2740, volumetric cup 2745, outer edge 2750, under-bust band 2755, and apex of the curvature of the upper edge 2760.

Support structure 3310 includes an intermammary-cleft portion 3323 that may be configured in a manner, and serve a purpose, similar to intermammary-cleft portion 210. An under-bust band 3320 is coupled to, and extends outward from, intermammary-cleft portion 3325 along the lower edge of support structure 3310.

Support structure 3310 includes a band 3305 that extends from an under-bust band 3320 in an upward direction at an angle of approximately 30-75° relative to the Y-axis for approximately 1.5 to 5 cm (depending on a size of support structure 3310) after which band 3310 changes direction and extends in a direction approximately parallel to the X-axis for approximately 1.5 cm to 8 cm until it connects with wrap-around portion 3330. Often, a portion of band 3305 extending at the angel from the under-bust band 3325 adjacent to the under-bust band 3320 may align, or nearly align, with the apex 2730 of casing 2700.

A lower edge of band 3310 and an upper edge of under-bust band 3320 defines a size and shape of an open space 3315, that may, in some instances, be empty (i.e., not include material used to manufacture support structure of 3310 and/or casing 2700). In other instances, open space 3315 may define spaces that differ in one or more ways (e.g., type of material, thickness of material, manner of manufacturing material) from support structure 3300, band 3310, under-bust band 3320, and/or wrap-around portion 3330.

Wrap-around portion 3330 includes an upper edge 3335 that is oriented at an angle of approximately −30° to −80° (or 110° to 170°) relative to the outer edge of wrap-around portion. This orientation may facilitate increased comfort when support structure 3310 is worn by wearer 10 because the wrap-around portion 3330 will not push into her torso at, or near, her under-arm region.

In some instances, a width and/or thickness of one or more of band 3310, under-bust band 3325, intermammary-cleft portion 3340, and/or wrap-around portion 3330 may be uniform throughout and/or relative to one another. While in other instances, a width and/or thickness of one or more of band 3310, under-bust band 3325, intermammary-cleft portion 3340, and/or wrap-around portion 3330 may vary relative to itself and/or each other. For example, when the entirely of support structure 3310 is of uniform thickness, then each of band 3310, under-bust band 3325, intermammary-cleft portion 3340, and/or wrap-around portion 3330 will have uniform thickness of, for example, 0.2-6 mm. In another example, band 3310 may have a thickness of, for example, 0.2-2.5 mm, under-bust band 3325 may have a thickness of, for example, 0.2-10 mm, intermammary-cleft portion 3340 may have a thickness of, for example, 0.5-10 mm, and/or wrap-around portion 3330 may have a thickness of, for example, 0.5-10 mm. In another embodiment, a width and/or thickness of one or more of band 3310, under-bust band 3325, intermammary-cleft portion 3340, and/or wrap-around portion 3330 may vary along their respective lengths. For example, a width of band 3310, under-bust band 3325, and/or wrap-around portion 3330 may be larger near a junction of band 3310 and/or under-bust band 3325 with intermammary-cleft portion 3340 and/or wrap-around portion 3330 so as to, for example, facilitate greater rigidity in these area(s) and/or greater flexibility (due to the decreased width) away from these areas.

In some embodiments, support structure 3310 may be made from one or more piece(s) of material (e.g., plastic or foam) and, in some embodiments may include one or more joints, or areas of relatively greater flexibility. At times, these joints may be placed where different components (band 3310, under-bust band 3325, intermammary-cleft portion 3340, and/or wrap-around portion 3330) of support structure meet one another.

As shown in FIGS. 26A-26C, 32A, 32B, 33A, and 33B each of the support structures 2600, 3210, 3310, respectively, are shaped so as to have an arc-like shape along the lower edge of the respective support structure/under-bust band much like arc 1475. When viewed from above or below an overall shape of support structures 2600, 3210, 3310 demonstrates that they conform to this arc-like shape in a manner similar to support structure 1800 so that they curve around a front and side of wearer's torso when worn in a manner similar to the way support structure curves around wearer 10 as shown in FIGS. 19A-20C.

The frames and/or support structure disclosed herein may be encased, enclosed, and/or covered with one or more casings or portions thereof and, in many embodiments, features of a casing may correspond with and/or align to a frame and/or support structure encased/included therein. In some instances, a casing acts to provide a full volumetric cup for a breast cup of a bra or similar garment. A casing described herein may serve to increase the comfort of wearing a frame, such as frame 1400, a support structure such as support structure(s) 1800, 2100, 2200, 2300, 2400, 2500, 2600, 3200, and/or 3300 by surrounding the frame and/or support structure with softer, more flexible, materials because the material comprising casing will typically be more flexible than the material of a frame or support structure housed therein. The casings disclosed herein may also provide a smooth silhouette when worn under another garment (e.g., shirt or dress). The casing may be included in a garment, such as a dress, blouse, bathing suit, or camisole and, in other instances the casing may be housed in a brassiere or bustier.

The casings disclosed herein may be made from any appropriate material including, but not limited to, plastic, foam, fabric, rubber, and combinations thereof. In some embodiments, a casing may be made from thermoset plastics, thermoplastics, polyurethane foam, viscoelastic foam, latex foam, under-bust bander foam, open cell foam, closed cell foam, Evlon foam, microfiber fabrics, natural fiber fabrics, synthetic fabrics, and/or combinations thereof. In some embodiments, a thickness of a casing may be uniform throughout the casing and, in other embodiments, a thickness of a casing may vary in different parts of the casing. For example, a casing may be thicker in areas where greater rigidity/support is desired and may be thinner in areas where greater flexibility/less support is desired. For instance, a material making up a region of a casing positioned underneath a breast cup may be thicker that the material making up a region of the casing at the top of the breast cup. A typical range of thickness of material for a casing 2700 is 0.5 mm-20 mm.

Although casings disclosed herein comprise a single piece, this need not be the case. For example, a casing may include two or more pieces that are coupled together via, for example, a flexible or rigid bond induced via, for example, a chemical or mechanical bonding process. In some instances, joints between two or more pieces that make up a casing may be flexible and, in the casings disclosed herein may be a solid structure (e.g., no holes, or openings) or may have openings or holes placed throughout. These holes or openings may be made by, for example, punching, cutting, and/or stamping out material and/or may be part of the manufacturing process using, for example, 3D printing or the overlay of materials to create perforations or openings. The openings may serve to increase, for example, the flexibility and/or breathability of the casing and/or decrease its weight. This variation in thickness may be configured to provide flexibility to, for example, support structure 1800, under-bust band 1430, and/or volumetric cup portion 1810 and, in some instances, may be configured accommodate a change in breast size and/or volume by, for example, expanding and/or contracting. Another example may be multiple joints in throughout the frame 1400 or volumetric cup portion 1810 in varying thickness to allow for additional flexibility.

A frame and/or support structure such as frame 1400 and/or support structure(s) 1800 and/or 2600 may be affixed to, encased, or otherwise coupled with a casing via any appropriate means including, but not limited to, a flexible or rigid bond induced via, for example, sewing and/or a chemical or mechanical bonding process and/or inserting the frame or support structure into a pocket or opening in the casing and then closing the pocket (via, e.g., sewing, heat bonding, etc.). In some instances, the frame, support structure, and/or casing may be printed using 3D printing techniques as separate components and then assembled and, in other instances, the frame, support structure, and/or casing 2700 may be simultaneously printed as one piece or interlocking pieces via, for example, a 3D printing process.

In some embodiments, a casing, and/or frame or support structure included therein may be rigid enough to be self-supporting (i.e., maintain its shape without the application of an external force) yet may be flexible enough to bend or flex upon application by an outside force as may be applied when wearer puts on, or takes off, a garment including the respective casing, frame, and/or support structure. In some cases, an outside force may be applied and/or maintained by a housing for the casing, frame, and/or support structure may act to abut, or otherwise conform, the casing, frame, and/or support structure to a wearer's torso 20. In these cases, the overall shape of casing, frame, and/or support structure will remain the same as when the garment is not being worn (i.e., the external force is not applied) with the exception of, for example, the radius of curvature of the lower edge of casing, frame, and/or support structure which may be adjusted by the force so as to facilitate application or removal of casing, frame, and/or support structure from a wearer and/or facilitate maintain a position of casing, frame, and/or support structure when worn. The rigidity of the casing, frame, and/or support structure may assist with distributing weight from the wearer's breasts 15 to the wearer's torso 20 and prevent collapse of the casing, frame, and/or support structure under the weight of the wearer's breasts 15.

It will be recognized by those of skill in the art that some of the frame, support structure, and/or casing features described above with regard to a particular embodiment may be used in other embodiments described herein. For example, bands 2110, 2210, 2310, and/or 2510 may share certain characteristics and, in some instances, may be fully, or partially, interchangeable with one another in different embodiments. Additionally, or alternatively, the patterned mesh used in support structures 2100, 2200, and/or 2300 may share certain characteristics and, in some instances, may be fully, or partially, interchangeable with one another in different embodiments. Moreover, in some embodiments one or more of frame 1400, support structures 1800, 2100, 2200, 2300, and/or 2400 may be solid (e.g., no perforations) in form.

In some instances, support structures 2100, 2200, 2300, 2400, and/or 2500 may share characteristics (e.g., shape, form, material, function, etc.) with features of support structure 1800. For example, structural elements 2120, 2220, 2320, 2340, and/or 2350 may, in some instances, resemble under-bust band(s) 1430 and/or 2755 in form and function and side extensions 2125, 2225, 2325, 2425, and/or 2555 may in some instances, resemble wrap-around portion 1425.

Additionally, or alternatively, support structures 2100, 2200, 2300, 2400, and/or 2500 may share characteristics (e.g., shape, form, material, function, etc.) with features of support structures 2600, 3210 and 3310 as discussed below with regard to FIGS. 26, 32 and 33, respectively. For example, structural elements 2120, 2220, 2320, 2340, and/or 2350 may, in some instances, resemble lower band 2620, under-bust band 3225, and/or under-bust band 3320 and side extensions 2125, 2225, 2325, 2425, and/or 2555 may in some instances, resemble wrap-around extension 2625, wrap-around portion 3245, and/or wrap-around portion 3330 as discussed below with regard to FIGS. 26, 32, and 33, respectively.

Additionally, or alternatively, an overall shape of support structures 2100, 2200, 2300, 2400, and/or 2500 as may be seen in FIGS. 21A-25B and/or when, for example, viewed from above or below is that of an arc like arc 1475. More specifically, a shape of a lower edge of structural element 2120, structural element 2220, structural element 2320, under-bust band 2420, and/or under-bust band 2550 may have a radius of curvature similar to arc 1475.

In some instances, support structure(s) 2100, 2200, 2300, 2400, and/or 2500 may be partially, or wholly, housed within a housing like housing 3400, as discussed below with regard to FIGS. 34A-34H. Exemplary housings may be made from, for example, fabric, foam, leather, plastic, nylon, rayon, LYCRA™, elastic, latex, biocompatible materials and combinations thereof.

Figure 34A:
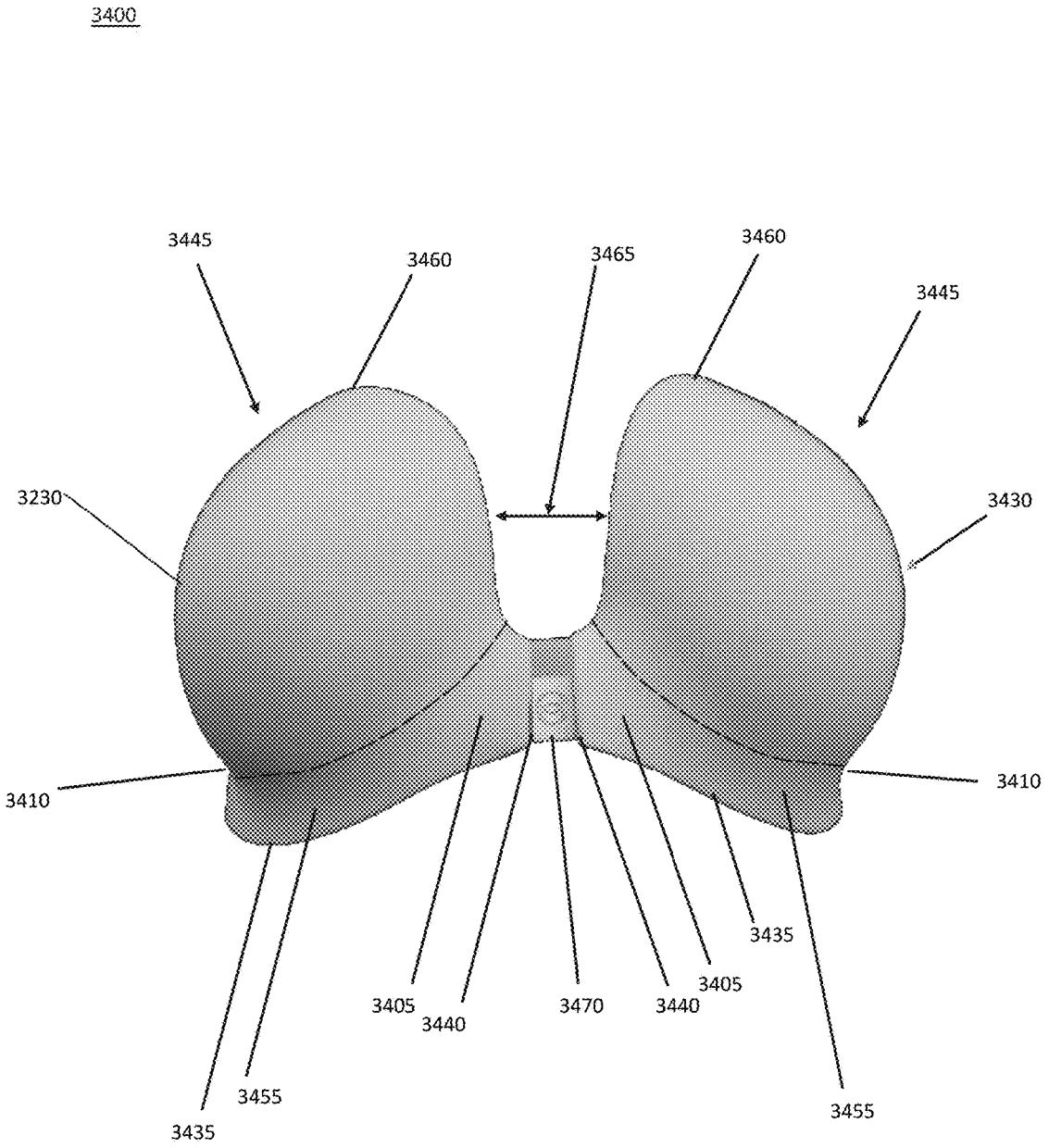
FIGS. 34A-34H provide illustrations of an exemplary housing in accordance with embodiments of the present invention.
Figure 34B:
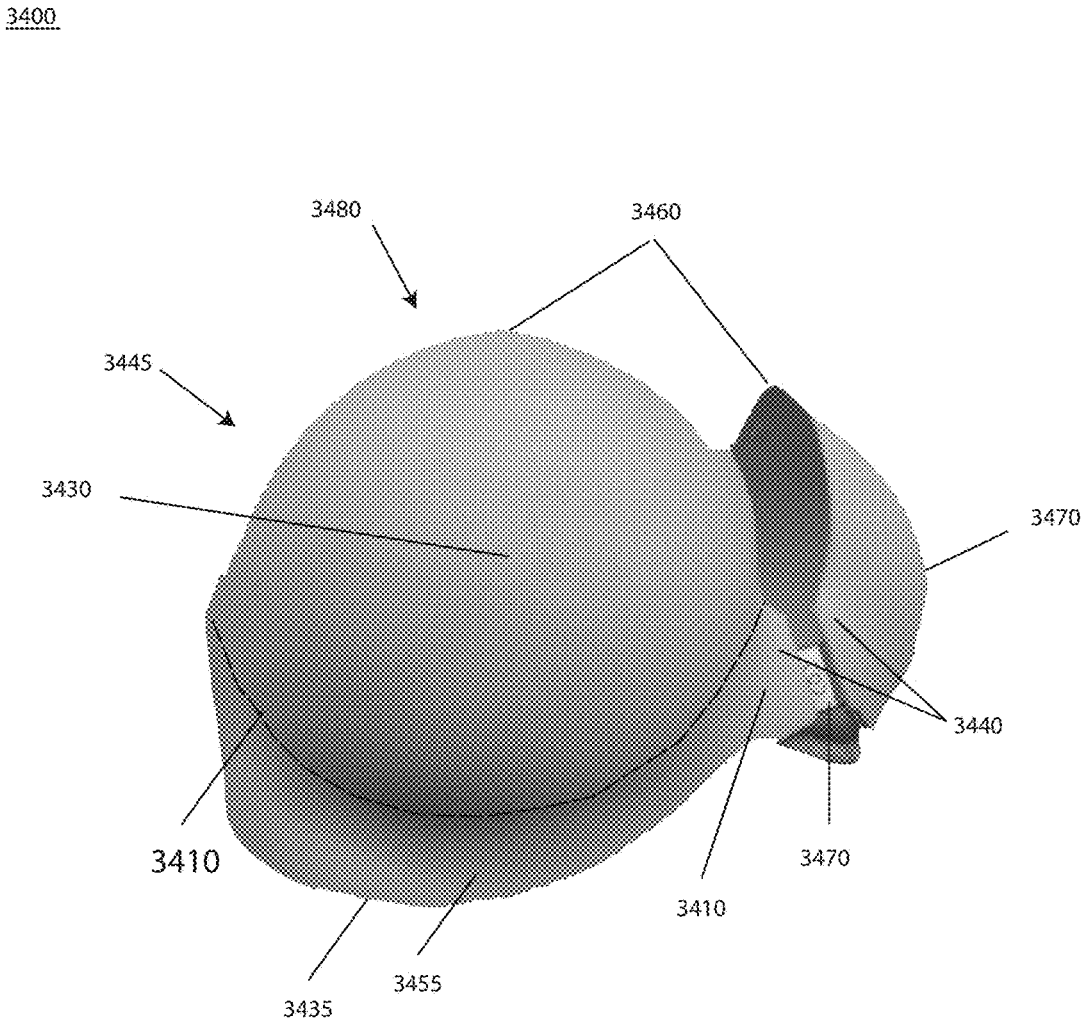
Figure 34C:
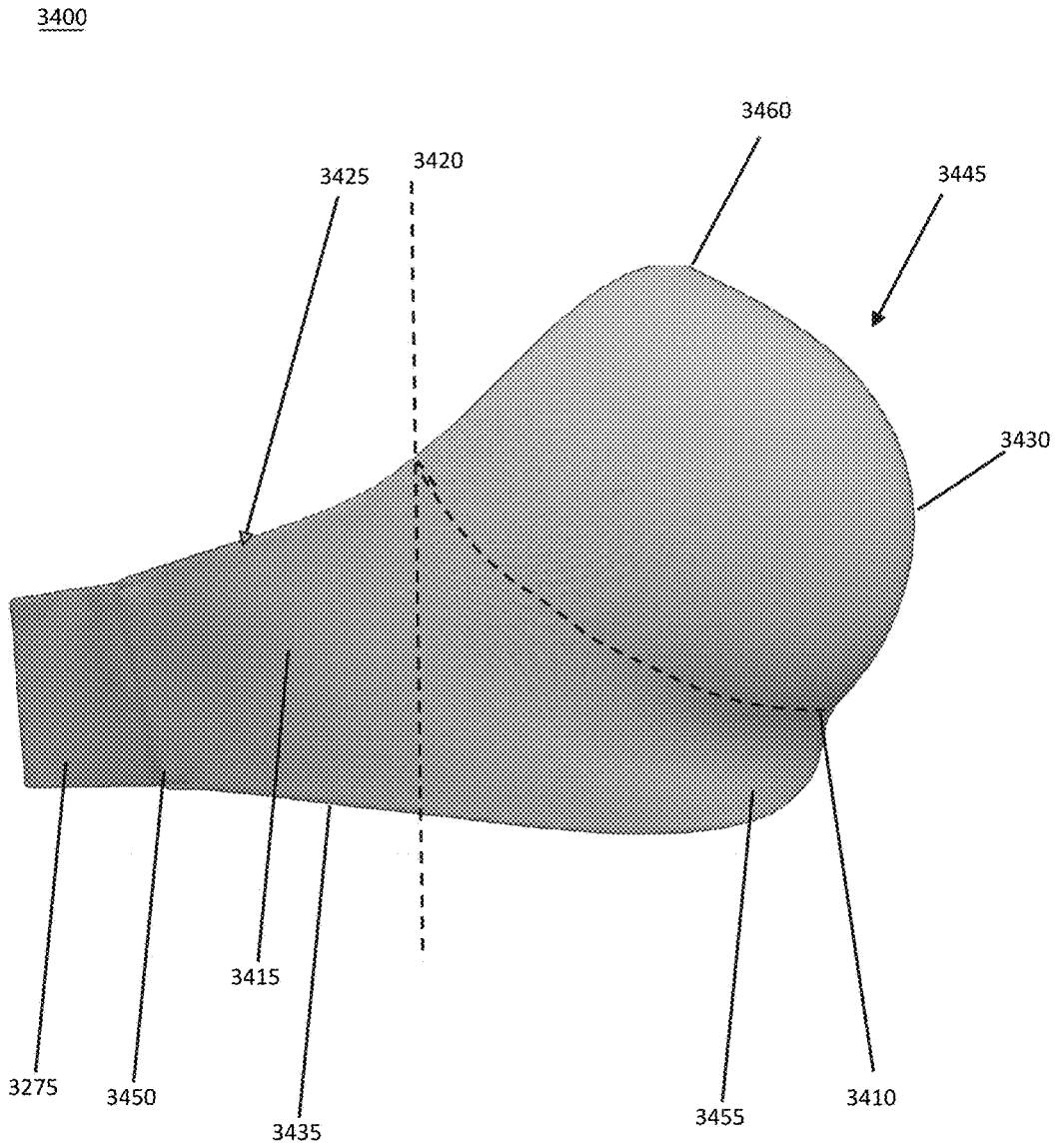
Figure 34D:
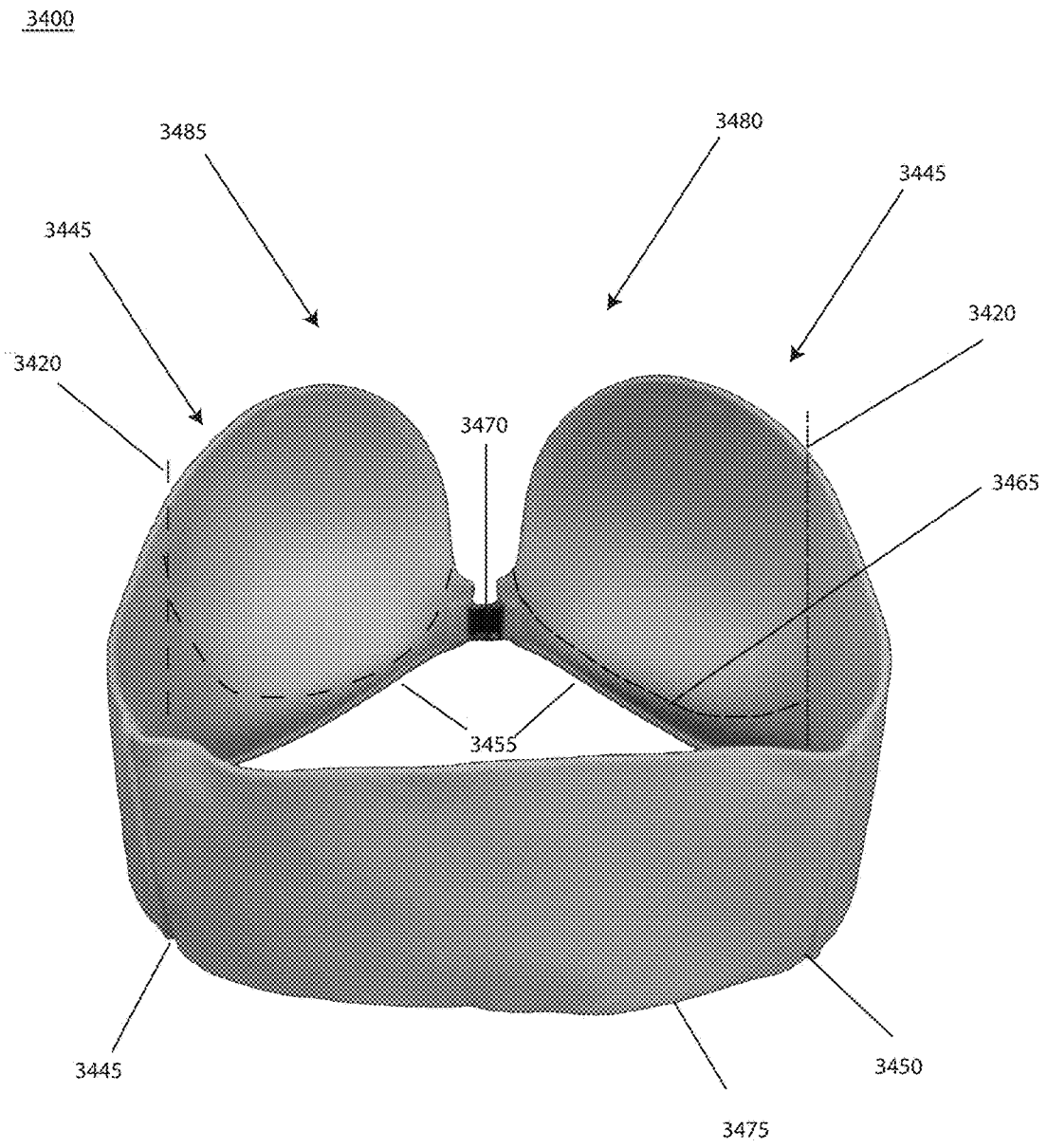
Figure 34E:
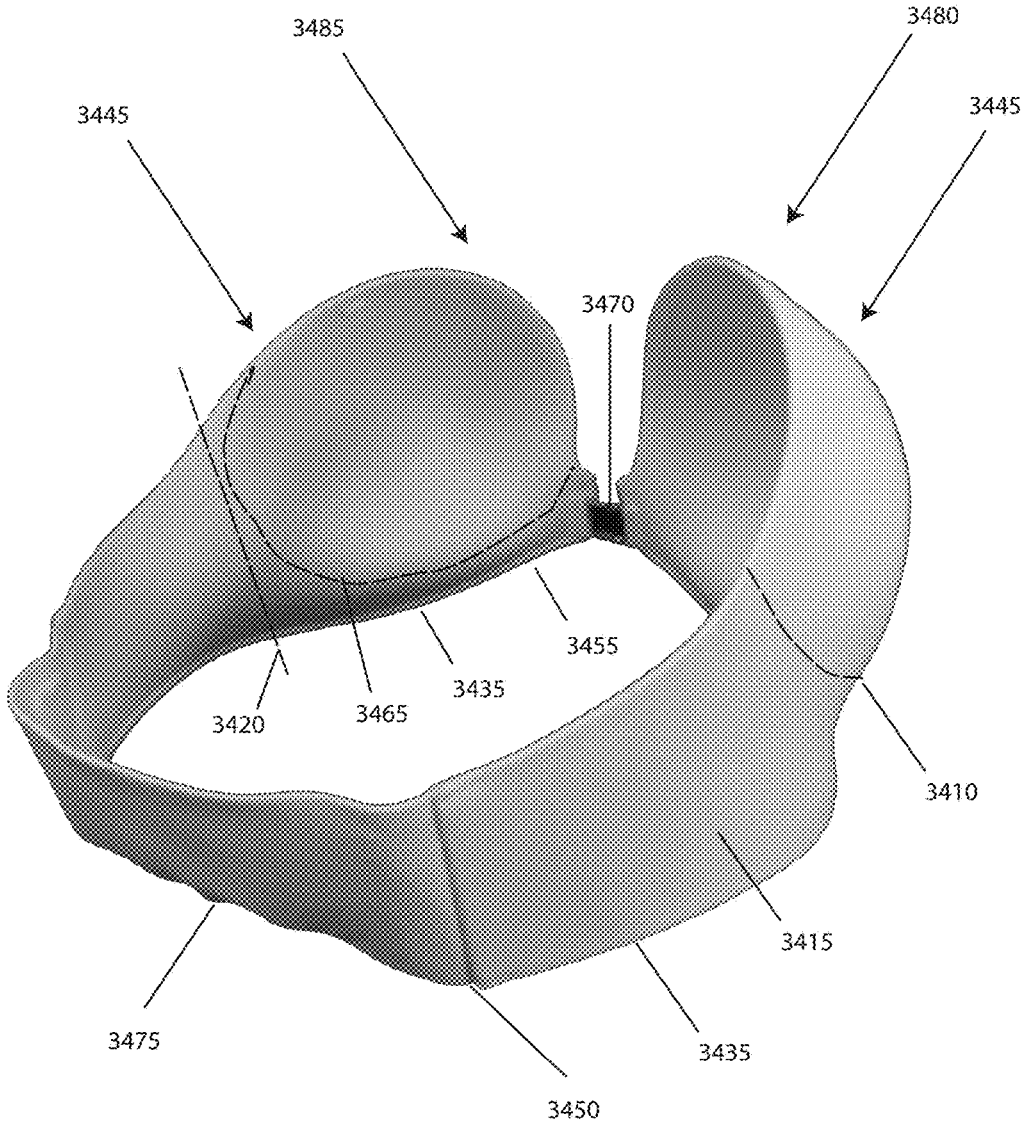
Figure 34F:
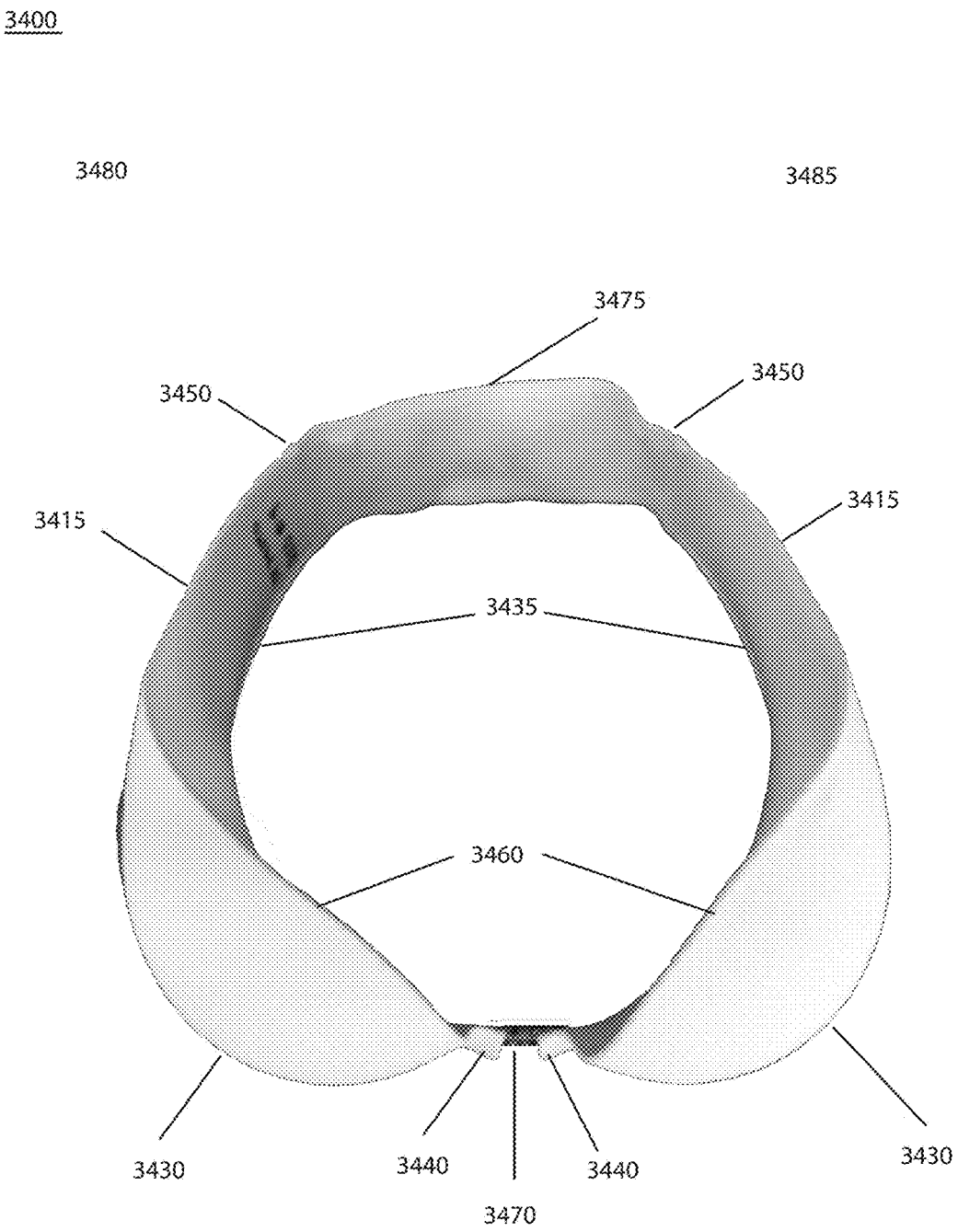

FIGS. 34A-34F provide images of an exemplary housing 3400 for housing a casing, like casing 2700, which may be encasing a support structure, like support structure 1800, 2100, 2200, 2300, 2500, 2600, 3200, and/or 3300 and/or a frame like frame 1400. More particularly, FIG. 34A provides a front plan view of housing 3400, FIG. 34B provides a side perspective view of housing 3400, FIG. 34C provides a side view of an outside of housing 3400, FIG. 34D provides a side plan view of an inside of a housing 3400 when open, FIG. 34E provides a top plan view of portion of housing 3400 when open, FIG. 34F provides a rear perspective view of housing 3400, FIG. 34G provides another rear perspective view of housing 3400, and FIG. 34H provides a top plan view of housing 3400.

In some embodiments, housing 3400 forms the exterior and interior surfaces of a front-closure bra and is configured to be worn by a wearer like wearer 10 over her breasts, such as breasts 15A and 15B. More particularly, housing 3400 has a first side configured to be worn on a wearer's first front side 60 and a second side configured to be worn on the wearer's second front side 65. In other embodiments, housing 3400 includes a first and second casing 2700 joined by a closure mechanism 3470 and a back band 3475. In this embodiment, the first and second casing correspond to/are housed within a first side 3480 and a second side 3485.

In one embodiment, housing 3400 includes a first side 3480 and a second side 3485, each of which include an intermammary-cleft portion 3405, an indentation line 3410, a wrap-around portion 3415, an end-of-indentation line 3420, an upper edge 3425, an apex 3430, a lower edge 3435, an inside edge 3440, a volumetric cup 3445, an outer edge 3450, an under-bust band 3455, and an apex of the curvature of the upper edge 3460. The intermammary-cleft portion 3405, an indentation line 3410, a wrap-around portion 3415, an end-of-indentation line 3420, an upper edge 3425, an apex 3430, a lower edge 3435, an inside edge 3440, a volumetric cup 3445, an outer edge 3450, an under-bust band 3455, and an apex of the curvature of the upper edge 3460 of the first side 3480 are configured to be worn on the wearer's first front side 60 and the intermammary-cleft portion 3405, an indentation line 3410, a wrap-around portion 3415, an end-of-indentation line 3420, an upper edge 3425, an apex 3430, a lower edge 3435, an inside edge 3440, a volumetric cup 3445, an outer edge 3450, an under-bust band 3455, and an apex of the curvature of the upper edge 3460 of the second side 3485 are configured to be worn on the wearer's second front side 65. In most instances, the features of first side 3480 and second side 3485 will be symmetrical mirror images of one another. However, in some instances one or more dimensions of a feature of first side 3480 may be different from one or more dimensions of a corresponding feature of second side 3485 as may be desired when, for example, wearer 10 has asymmetrical breasts.

Figure 34G:
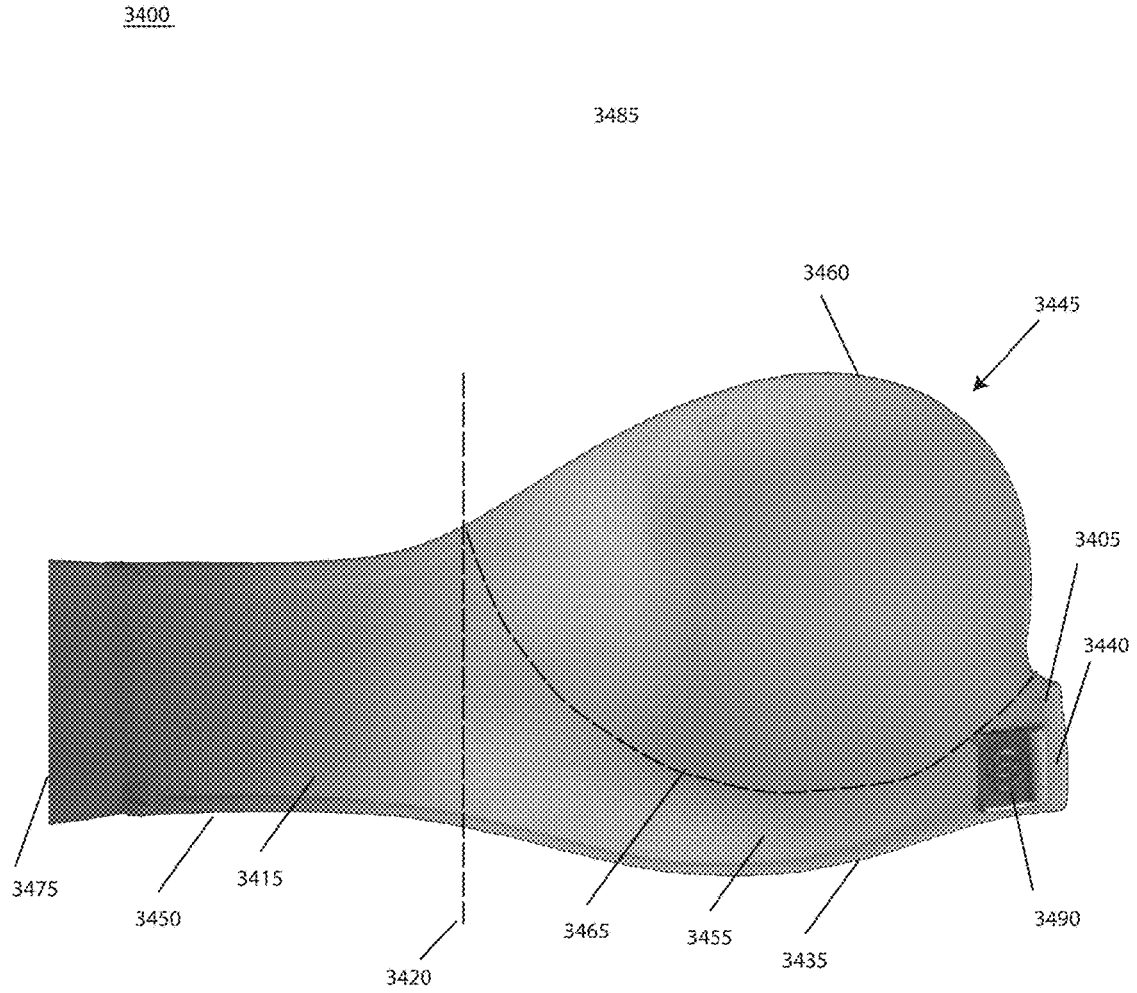
Figure 34H:
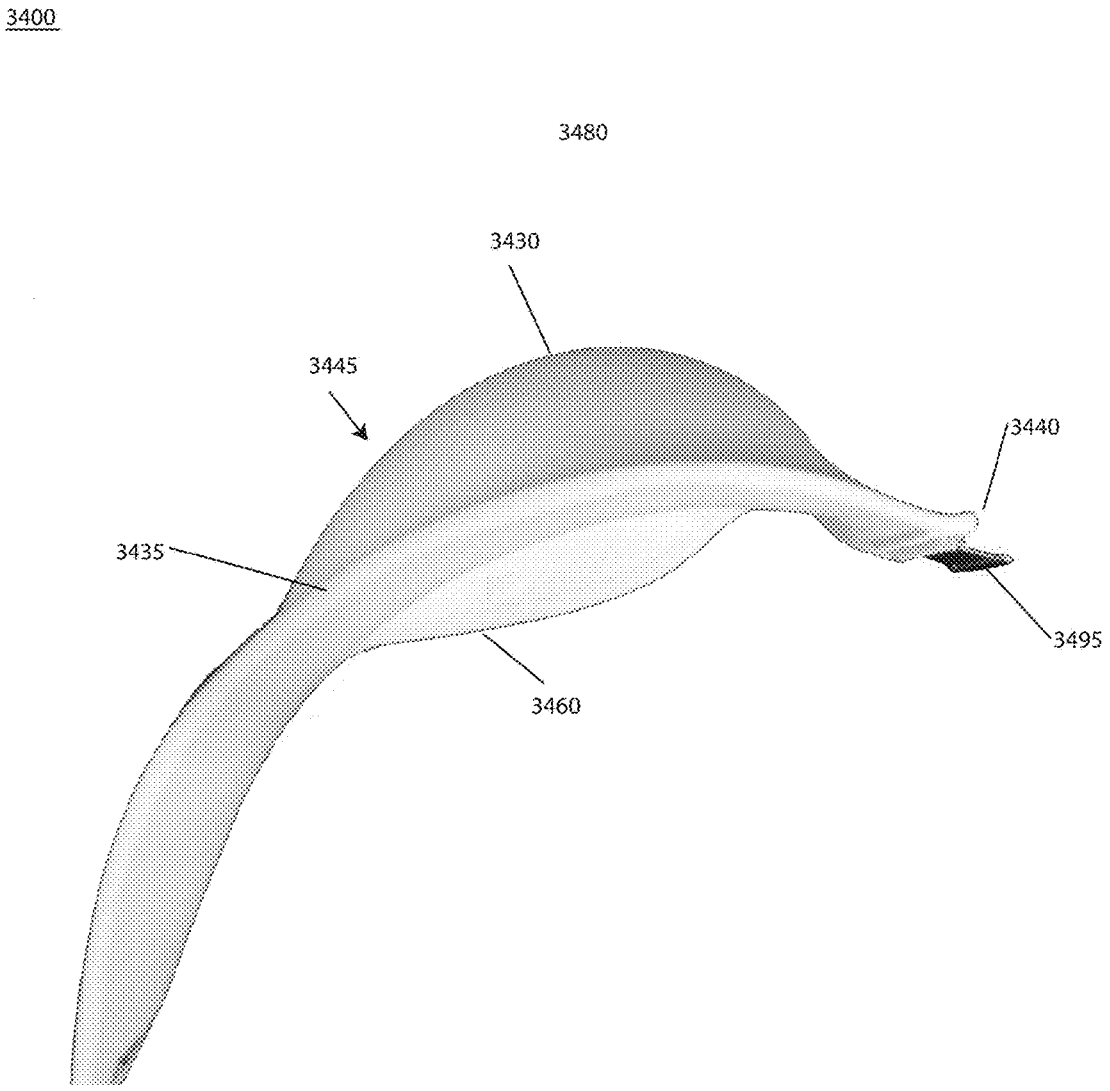

The first and second sides 3480 and 3485 of housing 3400 are joined together in the front of housing 3400 (as shown in FIGS. 34A, 34B, 34F, 34G, and 34F) by a closure mechanism 3470 and are joined together in the back of housing 3400 by a back band 3475 (as shown in FIGS. 34F, 34G, and 34H) to form a garment that encircles a torso, such as torso 20, of the wearer when worn. It is expected that the wearer will wrap an open housing 3400 (i.e., when closure mechanism 3470 is open) around her torso and then close closure mechanism 3470 to close the bra around her torso 20 so that it may be worn. When taking the housing 3400 off, it is expected that the wearer 10 will open, or otherwise, detach attachment mechanism 3470 so that it opens housing 3400. In most embodiments, housing 3400 will be strapless although optional straps may be affixed to housing 4300 via, for example, a tab positioned on the interior of housing 3400. Additionally, or alternatively, housing 3400 may include a permanently attached strap.

Closure mechanism 3470 may be any mechanism configured to close and open housing 3400. In some instances, closure mechanism 3470 may be adjustable so that a size of the closure mechanism may change in the X (width) direction and/or Y– (length) direction. Exemplary closure mechanisms 3470 include, but are not limited to, clasps, hooks, clips, clamps, and pressure-sensitive closures. In many instances, closure mechanism 3470 will have two sides, and a portion of each of the two sides (e.g., a hook, tab, or loop) will be attached to a respective one of first side 3480 and second side 3485 at, or near, for example, inside edge 3440.

In some embodiments, housing 3400 may be completely seamless and, in other embodiments, housing 3400 may have a pair of seems, each of which join a side of back band 3475 to an outer edge 3450 of the first and second cups 3480 and 3485 as shown in FIGS. 34F, 34G, and 34H. In some instances, back band 3475 may be flexible or elastic so that it may stretch, expand, and/or move with the wearer when worn although this need not always be the case. In some embodiments, back band 3475 may be adjustable by, for example, one or more adjustment mechanisms (not shown) such as hooks, VELCRO™, snaps, etc.

Features of housing 3400, and/or dimensions thereof, may correspond with, and/or align to, features of a frame and/or support structure, such as frame 1400 and/or support structure(s) 1800, 2100, 2200, 2300, 2400, 2500, 2600, 3200, and/or 3300 encased/included therein. This correspondence/alignment may include, but is not limited to, alignment of features (e.g., placement of curves, padding, stitches) and how the housing is shaped or affixed to the casing, frame, and/or support structure. For example, inframammary cleft portion 3405 may correspond to/align with inframammary cleft portion 1410; indentation line 3410 may correspond to/align with upper edge of under-bust band 1440 and/or indentation line 2710; wrap-around portion 3415 may correspond to/align with wrap-around portion 1445 and/or 2715; end-of-indentation line 3420 may correspond to/align with wrap-around-portion reference line 1470 and/or end-of-indentation line 1820; upper edge 3425 may correspond to/align with first curved upper edge 1815, second curved upper edge 1820, and/or upper edge 2725; apex 3430 may correspond to/align with apex 2730; lower edge 3435 may correspond to/align with inframammary cleft portion lower edge 1425, under-bust band lower edge 1435, wrap-around portion lower edge 1455, and/or lower edge 2735; inside edge 3440 may correspond to/align with inner edge 1420 and/or inside edge 2740; volumetric cup 3445 may correspond to/align with volumetric cup portion 1810 and/or volumetric cup 2745; outer edge 3450 may correspond to/align with wrap-around portion outside edge 1450 and/or outer edge 2750; under-bust band 3455 may correspond to/align with under-bust band 1430 and/or under-bust band 1855; and/or apex of the curvature of the upper edge 3460 may correspond to/align with apex of the curvature of the upper edge 2760.

When housing 3400 is held in an upright position (as shown in, for example, FIG. 34A), an inter-breast distance 3462 between first side 3480 and second side 3485 may be seen. The inter-breast distance 3465 corresponds to a distance between the breasts of the wearer. In some embodiments, the magnitude of the inter-breast distance 3465 may be adjustable via, for example, adjustability of the closure mechanism 3470 and/or back band 3475.

As illustrated in FIGS. 34A and 34B, under-bust band 3455 is configured/adapted to be oriented in a manner substantially perpendicular to a sagittal plane center midline of a wearer, such as sagittal plane center midline 25 of wearer 10. Under-bust band 3455 extends from the inside edge 3440 along the lower edge of housing 3400 underneath indentation line 3410 until end-of-indentation line 3420.

As illustrated in FIGS. 34C and 34D, wrap-around portion 3415 may begin at, or near, end-of-indentation line 3420 and extend away from volumetric cup 3445 toward outside edge 3450 thereby forming wrap-around portion 3415. The size and shape of wrap-around portion 3415 may mimic the size and shape of an encased frame's and/or support structure's wrap-around portion as noted above. End-of-indentation line 3420 is a vertical reference line superimposed on the depictions of housing 3400 shown in of FIG. 34C to indicate where indentation line 3410 ends but is not present on housing 3400.

Volumetric cup 3425 may have similar characteristics to volumetric cup portion 1810 and may be designed to contain and/or cover, for example, 25%, 50%, 75%, 80%, 90%, 95% and/or 340% of a wearer's breast inserted therein. An amount of breast volume contained by volumetric cup 3425 may be dependent upon the overall size and/or shape of volumetric cup 3425 which, in turn, may be based upon a shape or curvature of upper edge 3425 as well as a distance between an apex 3430 and under-bust band 3490.

Volumetric cup 3425 may have an apex 3430, which corresponds to an outer most point of a volumetric spherical-like shape of volumetric cup 3425 and a positioning of apex 3430 may correspond with a desired apex of the wearer's breast tissue when she is wearing housing 3400, which in some instances, may correspond with a position of a wearer's nipple (when the wearer's breast is repositioned within the volumetric cup 3425). In the embodiment of FIGS. 34A-34H, the upper edge 3425 of housing 3400 is curved so that a position of apex 3430 of the volumetric cup along the Y-axis approximately corresponds with an apex of the curvature of the upper edge 3460 along the Y-axis.

FIG. 34C provides a side view of housing 3400 that illustrates how the upper edge of the volumetric cup 3445 tapers down to form the upper edge of the wrap-around extension 3215. FIG. 34C also illustrates an upward curvature of the lower edge 3435 so that it tapers upward as it approaches outer edge 3450. This shape of the upper edge of the volumetric cup 3445 and/or lower edge of the volumetric cup 3435 may serve to support breast tissue from the side when worn while not aligning with the wearer's sensitive armpit region. In this way, housing 3400 is not expected to press into the wearer's skin under her arm or along the side of her body under her arm.

FIG. 34C also shows a joint between outer edge 3450 of first side 3480 and back band 3475. In some embodiments, this joint may be positioned at an angle relative to the lower edge of wrap-around portion 3415. In some embodiments, an adjustment mechanism (e.g., hook/eye, strap, etc.) for back band 3475 may be positioned at, or near, this joint. In some instances, the joint may be made with flexible material, such as elastic or a mesh. FIG. 34C also illustrates the intersection of end-of-indentation line 3420 and indentation line 3410. It should be noted that any variation in the line for indentation line 3410 drawn on any of FIGS. 34A-34H is not part of the invention as the trajectory of indentation line 3410 is intended to be smooth.

FIGS. 34F and 34G provide two different rear perspective views of housing 3400 and show the outside of back band 3475 and an inside of a portion of first side 3480 and second side 3485. FIGS. 34F and 34G show a smooth transition between volumetric cup 3445 and wrap around extension 3415 on the interior of housing. The interior of housing 3400 may include a layer of foam (e.g., memory foam) or other material that interfaces between the frame or support structure and the outer layer of fabric seen in FIGS. 34F and 34G. The foam or other material may be of uniform or non-uniform thickness throughout and, in some instances may cover the entire inner (or outer) surface of the frame or support structure or only a portion thereof. In some instances, the foam or other material may be concentrated at, or near, an interior of housing 3400 at indentation line 3410. FIG. 34G also shows closure mechanism 3470 in an open state so that only a covering (or male) 3490 of closure mechanism 3470 is shown. A tab 3495, or female portion of closure mechanism 3470, is shown in FIG. 34H. Closure mechanism 3470 may be closed when tab 3495 is inserted into covering 3490. At times, feedback regarding a secure closure of closure mechanism 3470 may be provided to the wearer via an auditory or manual sound or clicking sensation indicating when tab 3495 is properly seated in covering 3490. Likewise, closure mechanism may be opened when tab 3495 is separated from covering 3490.

FIG. 34E provides a top-side view of housing 3400 which shows a curvature of the lower edge of housing 3400, and of housing 3400 in general. The curvature may mimic, or approximate, curvature 1475. As may be seen in FIG. 34E, as well as FIGS. 34F and 34G, a curvature of housing 3400 as a whole as well as casing's 3400 lower edge, under-bust band 3430, and wrap-around portion 3415 may approximate a curvature of a wearer's torso 20 at, or near, her inframammary fold.

Volumetric cup 3445 may be a cantilever projection with a lower edge that may be positioned in a manner that corresponds with indentation line 3410 so that the interior lower edge of volumetric cup 3445 aligns with/corresponds to the exterior lower edge volumetric cup 3445. In other embodiments, the lower interior edge of volumetric cup 3445 may be positioned in a manner that does not correspond to/align with indentation line 3410/the exterior lower edge of volumetric cup 3445. For example, in some instances, the interior lower edge of volumetric cup 3445 may be positioned higher than indentation line 3410 as may be desired when, for example, pushing breast tissue upward. In other instances, the interior lower edge of volumetric cup 3445 may be positioned lower than indentation line 3410 as may be desired when, for example, positioning breast tissue downward.

In many cases, the ridge line, or edge, of the interior lower edge of volumetric cup 3445 may be most pronounced underneath the volumetric cup 3445 at, or near, a portion of volumetric cup that aligns with an intersection of a vertical reference line (not shown) passing through apex 3430 and the interior lower edge of volumetric cup 3445. As the interior lower edge of volumetric cup 3445 progresses away from this intersection (i.e., toward wrap-around portion 3415

One or more characteristics (e.g., size, shape, thickness, material used, perforation pattern, width, etc.) of the features of frame 1400, support structures 1800, 2100, 2200, 2300, 2400, 2500, 2600, 3200, and/or 3300, and/or housing 3400 may be determined via execution of one or more of processes 200, 300, 400, 500, 600, 700, 800, 900, 1000, and/or 1100 as described above with regard to FIGS. 2A-11, respectively. For example, information received from a wearer and/or user via execution of one or more of these processes may be used to determine a dimension of feature of frame 1400, support structures 1800, 2100, 2200, 2300, 2400, 2500, 2600, 3200, and/or 3300, casing 2700 and/or 2800, and/or housing 3400 and/or to match wearer 10 with an appropriately sized (according to, for example, the second sizing convention) frame, support structure, casing and/or housing.

The frames, support structures, casings, and/or housings disclosed herein and/or a portion thereof may, in some instances, provide a cantilever projection that extends outward from a portion of an upper edge of the frame and/or an under-bust portion of an under-bust band. The cantilevered projection may be shaped, sized, and positioned so as to accept a portion of a wearer's breast when worn. In some cases, a width of the cantilever projection may larger on a first side (e.g., near the intermammary cleft portion) of the cantilever projection than a width of the cantilever projection on a second side (e.g., near the wrap-around portion) of the cantilever projection. In some instances, a shape (e.g., a lower edge (e.g., where the cantilever projection meets an under-bust band)) of the cantilever projection may approximate a shape and/or size of the wearer's inframammary fold as may be, for example, determined by the wearer's second sizing convention size.

Dimensions of the frames, support structures, casings, and/or housings disclosed herein may, in some instances, be dictated by and/or associated with one or more sizes of the second sizing convention discussed herein. In some cases, one or more aspects, features, and/or dimensions of frames, support structures, casings, and/or housings disclosed herein may be determined by one or more of the process(es) 200, 300, 400, 500, 600, 700, 800, 900, 1000, and 1100 and/or a portion thereof discussed above.

Hence, garment or bra frames, support structures, casings, and housings have been herein disclosed along with methods for determining a wearer's size for a bra including frames, support structures, casings, and housings disclosed herein and how to produce the frames, support structures, casings, and housings.

We claim:

1. A frame comprising:

an under-bust band shaped so as to approximate a curvature in a horizontal plane of a wearer's torso proximate to an inframammary fold of the wearer, the under-bust band comprising a wrap-around portion configured to extend to a position on a wearer proximate to a vertical midline separating an anterior portion of the wearer from a posterior portion of the wearer.

2. The frame of claim 1, wherein a portion of the under-bust band is adapted for positioning under a wearer's breast proximate to the wearer's inframammary fold.

3. The frame of claim 1, the under-bust band further comprising:

an intermammary-cleft portion, the intermammary-cleft portion being adapted to be proximate to an intermammary cleft of a wearer when worn by the wearer;

an under-bust portion, a first side of the under-bust portion being connected to the intermammary-cleft portion and adapted to be proximate to an under-bust region of the wearer when worn by the wearer; and a wrap-around portion, the wrap-around portion being connected to a second side of the under-bust portion and adapted to be proximate to a lateral side of the wearer's torso.

4. The frame of claim 3, the wrap-around portion having an outer edge adapted to be proximate to a side vertical midline of the wearer when worn by the wearer, the side vertical midline extending through a center of the wearer's torso as viewed from the side and bisecting an anterior and a posterior of the wearer.

5. The frame of claim 1, the under-bust band further comprising:

a wrap-around portion, the wrap-around portion being adapted to correspond to a position on a wearer beyond a vertical midline separating an anterior portion of the wearer from a posterior portion of the wearer.

6. The frame of claim 1, the under-bust band further comprising:

a wrap-around portion, the wrap-around portion being curved so as to approximate a curvature of a wearer's torso along a horizontal plane extending approximately from a sagittal plane center midline of a wearer to a frontal plane reference line of the wearer.

7. The frame of claim 1, the under-bust band further comprising:

a wrap-around portion, the wrap-around portion being curved so as to approximate a curvature of a wearer's torso along a horizontal plane extending approximately from a sagittal plane center midline of the wearer through a frontal plane reference line of the wearer and around a posterior portion of the wearer when the frame is worn.

8. The frame of claim 1, the under-bust band further comprising:

an under-bust portion, an upper edge of the under-bust portion being curved so as to accept a portion of a wearer's breast inserted therein when worn by the wearer.

9. The frame of claim 1, the under-bust band further comprising:

an under-bust portion, an upper edge of the under-bust portion being curved so as to approximate a curvature of a wearer's inframammary fold.

10. The frame of claim 1, wherein the frame is adapted for inclusion in a casing.

11. The frame of claim 1, wherein the frame is adapted for inclusion in a casing and the casing is adapted for inclusion in a housing.

12. The frame of claim 1, the under-bust band further comprising:

an under-bust portion adapted to be proximate to an under-bust region of a wearer when worn by the wearer; and a cantilever projection, the cantilever projection extending outward from a portion of an upper edge of the under-bust portion.

13. The frame of claim 12, wherein a width of the cantilever projection is larger on a first side of the cantilever projection than a width of the cantilever projection on a second side of the cantilever projection.

14. The frame of claim 1, the under-bust band further comprising:

a cantilever projection, the cantilever projection extending outward from a portion of an upper edge of the band.

15. The frame of claim 1, the under-bust band further comprising:

a cantilever projection, the cantilever projection extending outward from a portion of an upper edge of the band and being curved so as to approximate a wearer's inframammary fold.

16. The frame of claim 1, the under-bust band further comprising:

a cantilever projection, the cantilever projection extending from a portion of an upper edge of the band, the cantilever projection being shaped, sized, and positioned so as to accept a portion of a wearer's breast when worn.

17. The frame of claim 1, wherein the shape of the band is self-supporting.

18. A system comprising:

a frame that includes an under-bust band shaped so as to approximate a curvature of a wearer's torso proximate to an inframammary fold of the wearer and adapted for positioning under a wearer's breast at the inframammary fold, the under-bust band comprising a wrap-around portion configured to extend to a position on a wearer proximate to a vertical midline separating an anterior portion of the wearer from a posterior portion of the wearer; and a casing, the casing encasing the frame.

19. The system of claim 18, wherein the frame further comprises:

a cantilever projection, the cantilever projection extending from a portion of an upper edge of the band, the cantilever projection being shaped, sized, and positioned so as to accept a portion of a wearer's breast when worn.

20. The system of claim 18, the casing further comprising:

a volumetric cup shaped, sized, and positioned so as to accept a portion of a wearer's breast when worn.

* * * * *